US012508684B2

(12) United States Patent
Layton, Jr. et al.

(10) Patent No.: US 12,508,684 B2
(45) Date of Patent: Dec. 30, 2025

(54) SKATE BLADE SHARPENING SYSTEM

(71) Applicant: Velasa Sports, Inc., Acton, MA (US)

(72) Inventors: Russell K. Layton, Jr., Acton, MA (US); Daniel A. Beaudet, Lexington, MA (US); Ivan D. Goryachev, Nashua, NH (US); Matt Hanczor, Redding, CT (US); Clive Bolton, Acton, MA (US); Alex Taylor Willisson, Acton, MA (US)

(73) Assignee: Velasa Sports, Inc., Acton, MA (US)

( * ) Notice: Subject to any disclaimer, the term of this patent is extended or adjusted under 35 U.S.C. 154(b) by 153 days.

(21) Appl. No.: 18/595,269

(22) Filed: Mar. 4, 2024

(65) Prior Publication Data

US 2024/0359283 A1 Oct. 31, 2024

Related U.S. Application Data

(63) Continuation of application No. 16/424,294, filed on May 28, 2019, now Pat. No. 11,919,119, which is a (Continued)

(51) Int. Cl.
*B24B 3/00* (2006.01)
*A63C 1/42* (2006.01)

(Continued)

(52) U.S. Cl.
CPC ..... *B24B 3/003* (2013.01); *A63C 1/42* (2013.01); *B24B 41/06* (2013.01); *B24B 55/00* (2013.01);

(Continued)

(58) Field of Classification Search
CPC ..... B24B 3/003; A63C 1/42

(Continued)

(56) References Cited

U.S. PATENT DOCUMENTS 1,219,004 A 3/1917 Kalanquin
1,381,724 A 6/1921 Maloney (Continued)

FOREIGN PATENT DOCUMENTS

CA 1118514 2/1982
CA 1229985 12/1987

(Continued)

OTHER PUBLICATIONS

Invitation to Pay Additional Fees issued in International Application No. PCT/US2015/057078, mailed on Feb. 24, 2016.

(Continued)

*Primary Examiner* — George B Bennett
(74) *Attorney, Agent, or Firm* — Knobbe, Martens, Olson & Bear, LLP

(57) ABSTRACT

A skate blade sharpening system used to sharpen the blades of ice skates. The skate sharpener can include a housing that includes an elongated slot for receiving the blade of an ice skate for sharpening, and clamp jaws for retaining the skate. The housing can include at least one slot cover to engage the skate blade. Engagement of the skate blade can be sensed by a controller to enable sharpening operations to proceed. The skate blade sharpening system can automatically operate a grinding wheel and move the rotating grinding wheel back and forth along the lower face of the skate blade a desired number of times to sharpen the skate blade.

28 Claims, 82 Drawing Sheets

Related U.S. Application Data continuation of application No. 15/494,412, filed on Apr. 21, 2017, now Pat. No. 10,300,574, which is a continuation-in-part of application No. PCT/US2015/057078, filed on Oct. 23, 2015, which is a continuation-in-part of application No. 14/805,772, filed on Jul. 22, 2015, now Pat. No. 9,352,444, and a continuation-in-part of application No. 29/532,597, filed on Jul. 8, 2015, now Pat. No. Des. 793,830, and a continuation-in-part of application No. 14/723,564, filed on May 28, 2015, now Pat. No. 9,573,236, and a continuation-in-part of application No. 14/523,453, filed on Oct. 24, 2014, now Pat. No. 9,902,035, and a continuation-in-part of application No. 14/523,483, filed on Oct. 24, 2014, now Pat. No. 9,475,175, and a continuation-in-part of application No. 14/523,499, filed on Oct. 24, 2014, now Pat. No. 9,352,437, and a continuation-in-part of application No. 14/523,463, filed on Oct. 24, 2014, now Pat. No. 9,242,330, said application No. 14/805,772 is a continuation of application No. 14/523,489, filed on Oct. 24, 2014, now Pat. No. 9,114,498, said application No. PCT/US2015/057078 is a continuation-in-part of application No. 14/523,407, filed on Oct. 24, 2014, now Pat. No. 9,669,508, which is a continuation-in-part of application No. 14/523,476, filed on Oct. 24, 2014, now Pat. No. 9,566,682.

(60) Provisional application No. 62/335,003, filed on May 11, 2016, provisional application No. 62/129,095, filed on Mar. 6, 2015.

(51) Int. Cl.

| | |
|---|---|
| ***B24B 41/06*** | (2012.01) |
| ***B24B 55/00*** | (2006.01) |
| ***B24D 5/02*** | (2006.01) |
| ***B24D 5/16*** | (2006.01) |
| *B24B 37/27* | (2012.01) |

(52) U.S. Cl.
CPC ..... *B24D 5/02* (2013.01); *B24D 5/16* (2013.01); *B24B 37/27* (2013.01)

(58) Field of Classification Search
USPC ..... 451/383
See application file for complete search history.

(56) References Cited

U.S. PATENT DOCUMENTS

| | | | | |
|---|---|---|---|---|
| 2,114,967 | A | 4/1938 | Myers | |
| 2,438,543 | A | 3/1948 | Custin et al. | |
| 2,563,018 | A | 8/1951 | Fello | |
| 2,599,952 | A | 6/1952 | Strayer | |
| 2,722,792 | A | 11/1955 | Harrington | |
| 2,775,075 | A | 12/1956 | McMaster et al. | |
| 2,819,568 | A | 1/1958 | Kasick | |
| 2,990,661 | A | 7/1961 | Hackett | |
| 3,118,256 | A | 1/1964 | De Witt | |
| 3,259,959 | A | 7/1966 | Tobey | |
| 3,524,285 | A | 8/1970 | Rutt | |
| 3,574,975 | A | 4/1971 | Liss | |
| 3,650,073 | A | 3/1972 | Weisman | |
| 3,735,533 | A | 5/1973 | Salberg | |
| 3,742,655 | A | 7/1973 | Oliver | |
| 3,756,796 | A | 9/1973 | Miller | |
| 3,789,551 | A | 2/1974 | Norris et al. | |
| 3,800,632 | A | 4/1974 | Juranitch | |
| 3,827,185 | A | 8/1974 | Smith | |
| 3,839,828 | A | 10/1974 | Arnold | |
| 3,881,280 | A | 5/1975 | Thompson | |
| 3,948,001 | A | 4/1976 | Miyazawa et al. | |
| 3,988,124 | A | 10/1976 | Babcock | |
| 3,988,865 | A | 11/1976 | Weisman | |
| 4,055,026 | A | 10/1977 | Zwicker | |
| 4,078,337 | A | 3/1978 | Chiasson et al. | |
| 4,094,101 | A | 6/1978 | Robinson | |
| 4,172,343 | A | 10/1979 | Sakcriska | |
| 4,235,050 | A | 11/1980 | Hannaford et al. | |
| 4,235,052 | A | 11/1980 | Guidry | |
| 4,271,635 | A | 6/1981 | Szalay | |
| 4,294,043 | A | 10/1981 | Sakcriska | |
| 4,516,357 | A | 5/1985 | Gach | |
| 4,534,134 | A | 8/1985 | Consay et al. | |
| 4,549,372 | A | 10/1985 | Sexton et al. | |
| 4,558,541 | A | 12/1985 | Consay | |
| 4,570,387 | A | 2/1986 | Unno et al. | |
| 4,615,144 | A | 10/1986 | Peacock et al. | |
| 4,615,149 | A | 10/1986 | Yoneda et al. | |
| 4,722,152 | A | 2/1988 | Ek et al. | |
| 4,756,125 | A | 7/1988 | Kadnar | |
| 4,967,515 | A | 11/1990 | Tsujiuchi et al. | |
| 5,009,039 | A | 4/1991 | Lager et al. | |
| D328,305 | S | 7/1992 | Wong | |
| 5,127,194 | A | 7/1992 | Jobin | |
| 5,129,190 | A | 7/1992 | Kovach et al. | |
| 5,139,138 | A | 8/1992 | Isaksen | |
| 5,172,680 | A | 12/1992 | Swan | |
| 5,177,901 | A | 1/1993 | Smith | |
| 5,259,148 | A | 11/1993 | Wiand | |
| 5,547,416 | A | 8/1996 | Timms | |
| 5,562,526 | A | 10/1996 | Yoneda et al. | |
| 5,591,069 | A | 1/1997 | Wurthman | |
| 5,601,473 | A | 2/1997 | Strain et al. | |
| 5,823,854 | A | 10/1998 | Chen | |
| 5,897,428 | A | 4/1999 | Sakcriska | |
| 5,989,114 | A | 11/1999 | Donahue et al. | |
| 6,116,989 | A | 9/2000 | Balastik | |
| 6,422,934 | B1 | 7/2002 | Blach et al. | |
| D478,905 | S | 8/2003 | Byrne et al. | |
| 6,602,109 | B1 | 8/2003 | Malkin et al. | |
| 6,626,745 | B1 | 9/2003 | Bernard | |
| 7,018,280 | B2 | 3/2006 | Walker | |
| D525,936 | S | 8/2006 | Tanabe et al. | |
| D527,225 | S | 8/2006 | Krieger et al. | |
| 7,104,876 | B1 | 9/2006 | Lin | |
| 7,118,466 | B2 | 10/2006 | Laney | |
| 7,121,932 | B2 | 10/2006 | Liao | |
| 7,220,161 | B2 | 5/2007 | Eriksson | |
| 7,387,562 | B1 | 6/2008 | Blum | |
| 7,473,164 | B2 | 1/2009 | Sunnen | |
| D594,952 | S | 6/2009 | Orihara et al. | |
| D595,318 | S | 6/2009 | Cigarini | |
| D603,432 | S | 11/2009 | Wilson et al. | |
| 7,934,978 | B2 | 5/2011 | Wilson et al. | |
| 8,197,304 | B2 | 6/2012 | Hummel | |
| D665,830 | S | 8/2012 | Wilson et al. | |
| 8,246,425 | B2 | 8/2012 | Schudel | |
| 8,277,284 | B2 | 10/2012 | Wilson et al. | |
| 8,316,742 | B2 | 11/2012 | Craig et al. | |
| D681,077 | S | 4/2013 | Wilson et al. | |
| 8,430,723 | B2 | 4/2013 | Moon | |
| D682,646 | S | 5/2013 | Knopp et al. | |
| 8,696,407 | B2 | 4/2014 | Dovel | |
| D708,922 | S | 7/2014 | Evans | |
| 8,801,501 | B2 | 8/2014 | Worthington | |
| 8,827,768 | B2 | 9/2014 | Allen | |
| 8,888,567 | B2 | 11/2014 | Allen et al. | |
| D725,453 | S | 3/2015 | Lodato et al. | |
| 9,114,498 | B1 | 8/2015 | Layton, Jr. et al. | |
| 9,242,330 | B1 * | 1/2016 | Layton, Jr. | B24B 3/003 |
| D757,514 | S | 5/2016 | Cigarini | |
| 9,339,911 | B2 | 5/2016 | Eriksson | |
| 9,352,437 | B2 * | 5/2016 | Layton, Jr. | B24B 3/003 |
| 9,352,444 | B2 * | 5/2016 | Layton, Jr. | B24B 55/04 |
| 9,475,175 | B2 * | 10/2016 | Layton, Jr. | B24B 3/003 |
| D772,670 | S | 11/2016 | Barezzani et al. | |
| 9,566,682 | B2 * | 2/2017 | Layton, Jr. | B24B 3/003 |
| 9,573,236 | B2 * | 2/2017 | Layton, Jr. | G01B 5/255 |

(56) References Cited

U.S. PATENT DOCUMENTS

| | | | | |
|---|---|---|---|---|
| 9,669,508 | B2 * | 6/2017 | Layton, Jr. | B24B 17/10 |
| D793,830 | S | 8/2017 | Layton, Jr. et al. | |
| 9,902,035 | B2 * | 2/2018 | Layton, Jr. | B24D 5/16 |
| 10,065,282 | B2 | 9/2018 | Layton, Jr. et al. | |
| 10,300,574 | B2 * | 5/2019 | Layton, Jr. | B24D 5/02 |
| 11,919,119 | B2 * | 3/2024 | Layton, Jr. | B24B 3/003 |
| 2002/0009964 | A1 | 1/2002 | Wolf et al. | |
| 2003/0156401 | A1 | 8/2003 | Komine et al. | |
| 2004/0209547 | A1 | 10/2004 | Hatano et al. | |
| 2005/0130571 | A1 | 6/2005 | Sunnen | |
| 2006/0040587 | A1 | 2/2006 | Eriksson | |
| 2006/0159533 | A1 | 7/2006 | Zeiler et al. | |
| 2006/0183411 | A1 | 8/2006 | Moon | |
| 2006/0223419 | A1 | 10/2006 | Moon | |
| 2007/0054598 | A1 | 3/2007 | Uchida et al. | |
| 2007/0184756 | A1 | 8/2007 | Dieck et al. | |
| 2008/0004743 | A1 | 1/2008 | Goers et al. | |
| 2008/0176496 | A1 | 7/2008 | Tasi | |
| 2008/0280548 | A1 | 11/2008 | Wilson et al. | |
| 2010/0068975 | A1 | 3/2010 | Yadid et al. | |
| 2010/0125362 | A1 | 5/2010 | Canora et al. | |
| 2011/0169233 | A1 | 7/2011 | Wilson et al. | |
| 2011/0201257 | A1 | 8/2011 | Walker | |
| 2012/0108151 | A1 | 5/2012 | Swist | |
| 2012/0190279 | A1 | 7/2012 | Ficai | |
| 2012/0302147 | A1 | 11/2012 | Trautner et al. | |
| 2013/0344774 | A1 | 12/2013 | Allen | |
| 2014/0087639 | A1 | 3/2014 | Worthington | |
| 2014/0179201 | A1 | 6/2014 | Proulx | |
| 2014/0213160 | A1 | 7/2014 | Page | |
| 2015/0140901 | A1 | 5/2015 | Eriksson | |
| 2015/0367224 | A1 | 12/2015 | Schatz | |
| 2017/0165808 | A1 | 6/2017 | Buser | |
| 2018/0126250 | A1 | 5/2018 | Proulx | |
| 2019/0091550 | A1 * | 3/2019 | Shaffer | A63C 1/32 |
| 2020/0376621 | A1 | 12/2020 | Dovel | |
| 2022/0032419 | A1 | 2/2022 | Beaudet et al. | |

FOREIGN PATENT DOCUMENTS

| | | | |
|---|---|---|---|
| CA | 2260531 | | 8/1999 |
| CA | 2309222 | | 11/2000 |
| CA | 2323321 | | 4/2002 |
| EP | 0175168 | A2 | 3/1986 |
| EP | 1604782 | A1 | 12/2005 |
| WO | WO 2009/076496 | A2 | 6/2009 |
| WO | WO 2016/065237 | A2 | 4/2016 |
| WO | WO 2016/183663 | A1 | 11/2016 |

OTHER PUBLICATIONS

International Search Report & Written Opinion of the International Searching Authority issued in International Application No. PCT/US2015/057078, mailed on May 2, 2016.

International Preliminary Report on Patentability and Written Opinion of the International Searching Authority issued in International Application No. PCT/US2015/057078, mailed on May 4, 2017.

International Search Report & Written Opinion of the International Searching Authority issued in International Application No. PCT/US2021/070805, mailed on Jul. 31, 2020.

Extended European Search Report issued in European Patent Appication No., 21170266.7, on Oct. 22, 2021, in 10 pages.

Brinksmeier et al., "Sensible Schleifwerkzeuge, Wie werkzeugseitige Piezosensorik bei der Werkzeug- und Prozessueberwachung hilft," Werkstatt Uno Betrieb, Hanser, Munchen, vol. 133(4), Apr. 1, 2000, XP000954470, ISSN: 0043-2792.

"Cag One Service AB", downloaded from www.cagone.pl/dokumenty/cag-one-users-manual.pdf, 32 pages, Sep. 2009.

"Cag Profiler Manual", downloaded from www.cagone.com/img/profiler.pdf, 23 pages, Sep. 2010.

"Dupliskate Users Manual", downloaded from www.dupliskate.com/pdf/Dupliskate-User-Manual. pdf, 11 pages, Aug. 2013.

"Prosharp AS2001 Allpro, AS1001 Portable, Skatepal Pro3 Instructions", downloaded from www.prosharp.net/file/broschyroriginalinstructions-eng.pdf, 40 pages, Apr. 2013.

"Skatepal Pro Instructions", downloaded from www.prosharp.net/file/instruction-skatepal-pro2-eng.pdf, 12 pages, Oct. 2010.

"Spareparts Skatepal Pro 3", downloaded from www.prosharp.net/file/schematicssp13a1.pdf, 6 pages, Mar. 2013.

"SSM Catalog", downloaded from www.skyice.org/ssm_catalogue_2011.pdf, 12 pages.

Cag One Skate Sharpeners, "Cag One New Evolution Sharpening Machine", URL: http://cagone.com/evolution/, pp. 1-4.

Craig Forsythe, "Cag Speed III Sharpener Manual", Teflone Publications MMV, downloaded from www.cagone.com/img/speed.pdf, 14 pages, Aug. 2009.

Prosharp, "Grinding Wheels—SkatePals", 2015 ProSharp AB, URL: http://prosharp.com/products/grinding-wheels/grinding-wheels, pp. 1-9.

* cited by examiner

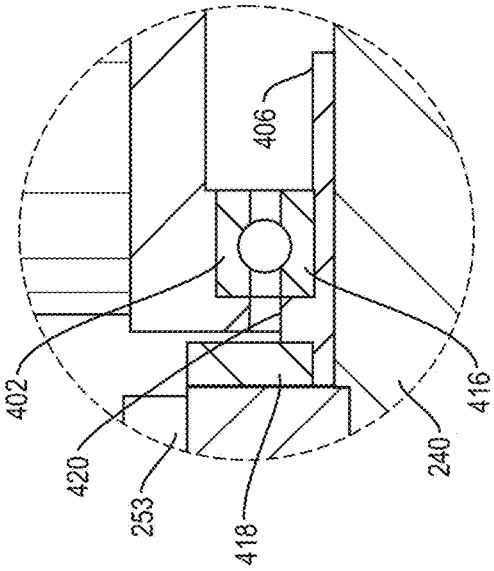
FIG. 24
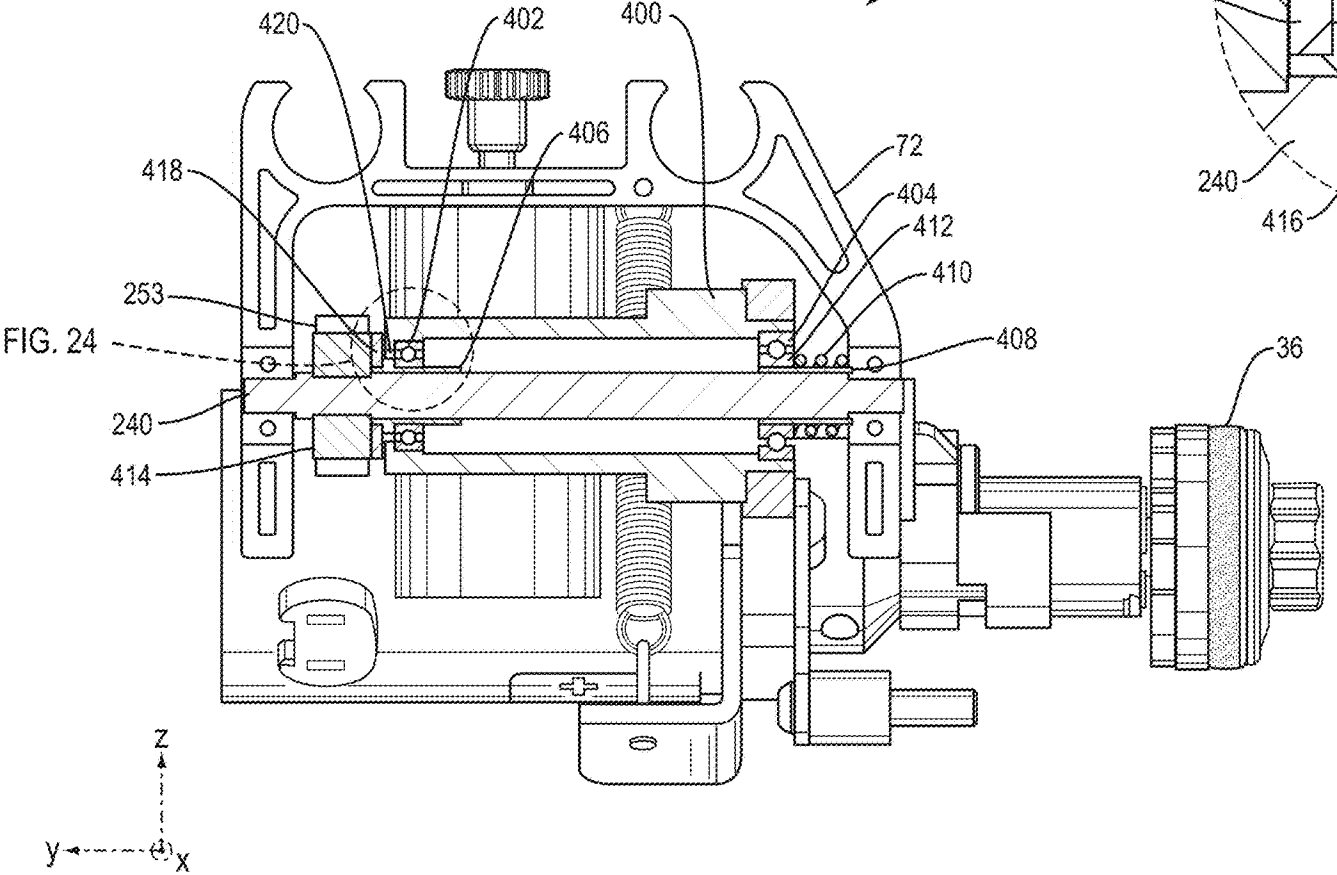
FIG. 23
FIG. 24

SKATE BLADE SHARPENING SYSTEM

INCORPORATIONS BY REFERENCE

Any and all applications for which a foreign or domestic priority claim is identified in the Application Data Sheet as filed with the present application are hereby incorporated by reference under 37 C.F.R. § 1.57 and are identified in the Application Data Sheet as filed with the present application. The applications include at least:

- U.S. patent application Ser. No. 14/523,407, filed 24 Oct. 2014;
- U.S. patent application Ser. No. 14/523,453, filed 24 Oct. 2014;
- U.S. patent application Ser. No. 14/523,463, filed 24 Oct. 2014;
- U.S. patent application Ser. No. 14/523,476, filed 24 Oct. 2014;
- U.S. patent application Ser. No. 14/523,483, filed 24 Oct. 2014;
- U.S. patent application Ser. No. 14/805,772, filed 22 Jul. 2015, which is a continuation of U.S. patent application Ser. No. 14/523,489, filed 24 Oct. 2014 and issued as U.S. Pat. No. 9,114,498 on 25 Aug. 2015;
- U.S. patent application Ser. No. 14/523,499, filed 24 Oct. 2014;
- U.S. Design patent application Ser. No. 29/532,597, filed 8 Jul. 2015;
- U.S. Provisional Patent Application No. 62/129,095, filed 6 Mar. 2015;
- U.S. patent application Ser. No. 14/723,564, filed 28 May 2015;
- International Application No. PCT/US2015/057078, filed 23 Oct. 2015;
- U.S. Provisional Patent Application No. 62/335,003, filed 11 May 2016; and
- U.S. patent application Ser. No. 15/494,412, filed 21 Apr. 2017.

BACKGROUND

Field of the Invention

The present invention generally relates to machines configured to sharpen blades for ice skates. More particularly, the present invention relates to such machines configured for automated sharpening of blades for ice skates.

Description of the Related Art

Ice skates engage the surface of the ice on a pair of edges. Over time, the edges can become dull or nicked and, in such conditions, the performance of the ice skates is less than optimal. To restore the performance of the ice skates, the skate blades can be sharpened.

While the frequency of ice skate blade sharpening differs depending upon the individual, the recommended frequency for most serious skaters is one sharpening for every three to five hours of ice time. When it is time for the sharpening, few people have the equipment necessary to sharpen the skates and, for that reason, the skates need to be dropped off at a local skate shop or ice rink for sharpening. The frequent trips for sharpening can become an annoyance and many skaters will skate on less than optimal skate blades simply to avoid the extra trips or time in line at the skate shop or rink.

Even if people had access to the equipment, few people have the training or skills necessary to sharpen their own skates.

SUMMARY OF EMBODIMENTS

A need exists for skate sharpening machines that are simple to use and cost effective enough for home use. Certain features, aspects and advantages of the present invention address a myriad of challenges encountered when designing a portable skate sharpening machine that is cost effective and easy to use.

Certain aspects of the disclosure provide a method of aligning a grinding component in a skate blade sharpening system. The method can include positioning a first visual reference feature at a first predetermined location relative to at least one jaw configured to secure a skate blade within the skate blade sharpening system; providing a second visual reference feature at a second predetermined location on a motor-driven component, wherein the motor-driven component is movable within a housing of the skate blade sharpening system by an adjustment mechanism; and operating the adjustment mechanism to position the motor-driven component such that the second visual reference feature is brought into alignment with the first visual reference feature thereby bringing into alignment the skate blade with the grinding component.

In some configurations, the first visual reference feature is positioned at a defined distance from a centerline of the at least one jaw when a skate blade is secured within the at least one jaw. In some configurations, the second visual reference feature is positioned at a defined distance from a centerline of a grinding portion of a grinding component when the grinding component is mounted on a mounting location of the motor-driven component. In some configurations, the centerline of the grinding component is at a maximum outer diameter of the grinding portion. In some configurations, the alignment of the second visual reference feature with the first visual reference feature aligns the centerline of the grinding component with a centerline of the skate blade. In some configurations, positioning the first visual reference feature at the first predetermined location includes temporarily securing the first visual reference feature within the housing of the skate blade sharpening system. In some configurations the method includes positioning a magnifying lens configured to magnify a view area of the first visual reference feature and the second visual reference feature. In some configurations, a grinding component is configured to be removably mounted on a mounting location of the motor-driven component without adjusting the alignment of the motor-driven component. In some configurations, the first visual reference feature is a flag-like structure. In some configurations, the second visual reference feature is incorporated into the motor-driven component. In some configurations, the second visual reference feature is positioned on an arbor coupled to the motor-driven component. In some configurations, the second visual reference feature is a notch recessed in an alignment component coupled to the motor-driven component. In some configurations, the alignment component has a noncircular shape. In some configurations, the second visual reference feature is on a grinding component coupled to the motor-driven component, wherein the grinding component comprises an alignment portion and a grinding portion, wherein the grinding portion comprises an abrasive outer layer. In some configurations, the second visual reference feature is a notch recessed in the alignment portion. In some configurations, operating the adjustment mechanism to position the motor-driven component such that the second visual reference feature is brought into alignment with the first visual reference feature is performed by a controller configured to control the operation of the adjustment mechanism. In some configurations, the method includes comprising positioning the motor-driven component in an alignment position within the housing of the skate blade sharpening system prior to alignment.

In another embodiment, a skate blade sharpening system includes a housing comprising at least one jaw configured to secure a skate blade; a motor-driven component configured to be movable within the housing of the skate blade sharpening system relative to the at least one jaw; a first visual reference feature positioned within the housing at a first predetermined location relative to the at least one jaw; a second visual reference feature positioned on the motor-driven component at a second predetermined location; and an adjustment mechanism configured to position the motor-driven component such that the second visual reference feature is brought into alignment with the first visual reference feature.

In some configurations, the second visual reference feature is positioned at a defined distance from a centerline of a grinding portion of a grinding component when the grinding component is mounted on a mounting location on the motor-driven component. In some configurations, the alignment of the second visual reference feature with the first visual reference feature aligns a centerline of the at least one jaw with the centerline of the grinding component when the grinding component is mounted to the mounting location. In some configurations, the second visual reference feature is positioned on an alignment component mounted on a mounting location on the motor-driven component. In some configurations, the second visual reference feature is incorporated into the motor-driven component. In some configurations, a grinding component is configured to be removably mounted on a mounting location of the motor-driven component without adjusting the alignment of the motor-driven component. In some configurations, the second visual reference feature is on a grinding component coupled to the motor-driven component, wherein the grinding component comprises an alignment portion and a grinding portion, wherein the grinding portion comprises an abrasive outer layer. In some configurations, the system includes a controller configured to control operation of the adjustment mechanism and automatically position the motor-driven component such that the second visual reference is brought into alignment with the first visual reference feature.

In another embodiment, a skate blade sharpening system includes a grinding component coupled to a motor for rotation, the grinding component configured to translate longitudinally relative to a bottom edge of a skate blade retained by the skate blade holder, the grinding component having an outer surface dimensioned and configured to sharpen the bottom edge of the skate blade during a sharpening operation, and the grinding component including an identification tag having interface circuitry configured to communicate with electronic circuitry of the skate blade sharpening system and memory including a usage location configured to store a usage tracking value. The skate sharpening can also include electronic circuitry that can include a transceiver configured to communicate with the interface circuitry of the identification tag and to read from and write to the usage location; sharpening control circuitry configured to control operation of the grinding component and perform sharpening operations; and usage control circuitry configured to write, using the transceiver, an update to the usage tracking value based, at least in part, on usage of the grinding component during sharpening operations; read, using the transceiver, a current usage tracking value from the usage location; and control operation of the sharpening control circuitry for sharpening operations based, at least in part, on the current usage tracking value.

In some configurations, the usage control circuitry is further configured to selectively enable or disable operation of the sharpening control circuitry for sharpening operations. In some configurations, the usage tracking value indicates usage of the grinding component as a number of passes performed by the grinding component during sharpening operations, wherein the electronic circuitry is configured to update the usage tracking value based, at least in part, on the number of passes performed by the grinding component. In some configurations, the usage location is further configured to store a usage limit value, the usage limit value indicates a maximum number of passes a grinding component can complete, wherein the grinding component includes a metal grinding ring having an outer surface with an abrasive layer thereon, the abrasive layer having a defined lifetime, and wherein the usage limit value corresponds to a period of use of the abrasive layer that is less than the defined lifetime of the abrasive layer. In some configurations, the usage control circuitry is further configured to determine whether a usage threshold of the grinding component has been satisfied based, at least in part, on a relationship between the current usage tracking value and the usage limit value. In some configurations, the memory of the identification tag is further configured to include one or more system setup parameter locations for storing system setup parameters, and wherein the interface circuitry is further configured to provide the system setup parameters from the system setup parameter locations to the electronic circuitry of the sharpening system to be applied to setup parameters of the sharpening system. In some configurations, the system setup parameters comprise operating parameters having determined values for the specific grinding component, wherein the operating parameters include one or more of a grinding motor rotation speed, a translation speed, or a normal grinding force. In some configurations, the memory of the identification tag is further configured to include one or more user setting locations for storing user-specific default settings for parameters of a sharpening operation, and wherein the interface circuitry is configured to provide the user-specific default settings to the electronic circuitry to be applied to control a sharpening operation. In some configurations, the memory of the identification tag is further configured to include one or more fault information locations for storing fault data describing one or more fault conditions occurring during a sharpening operation using the grinding component, the fault information locations being readable by a separate reader used in a fault diagnosis, and wherein the interface circuitry is configured to (i) receive from the electronic circuitry particular fault data identifying an occurrence of a particular fault during a sharpening operation, and (ii) write the particular fault data to the fault information locations. In some configurations, the interface circuitry provides a wireless interface for wireless communication between the transceiver and the identification tag. In some configurations, the identification tag is located within the grinding component such that the identification tag rotates with the grinding component during the sharpening operation, and wherein the interface circuitry is configured to engage in the wireless communication with the transceiver during the sharpening operation as the grinding component rotates. In some configurations, the grinding component includes a metallic ring having an abrasive-coated outer surface for contacting a blade to be sharpened during sharpening operations; and a generally disk-shaped hub carrying the identification tag and to which the metallic ring is fixedly mounted, the hub and ring being configured for mating with an arbor on a rotating shaft of the sharpening system. In some configurations, the metallic ring circumscribes a cylindrical region in which at least part of the hub is located, the cylindrical area extending between first and second axial ends of the metallic ring; the interface circuitry of the identification tag provides a wireless interface for wireless communication between the transceiver and the identification tag; and the identification tag is mounted to the hub in a manner to reduce an effect of the metallic ring on the wireless communication between the transceiver and the identification tag. In some configurations, the grinding component is a grinding wheel. In some configurations, the grinding component includes a hub of a non-metallic material, the hub carrying the identification tag. In some configurations, an axial end of the hub includes a user-inaccessible covered cavity in which the identification tag is located.

In another embodiment, a method of operating a skate blade sharpening system can include performing at least one sharpening operation with a grinding component using the skate blade sharpening system, wherein a motor-driven component housed within the skate blade sharpening system translates the grinding component longitudinally along a bottom edge of a skate blade retained by a skate blade holder, the grinding component having an outer surface dimensioned and configured to sharpen the bottom edge of the skate blade, and the grinding component including an identification tag having interface circuitry configured to communicate wirelessly and memory including a usage location configured to store a usage tracking value; communicating, using a transceiver of the skate blade sharpening system, with the interface circuitry of the identification tag to write an updated usage tracking value to the usage location based, at least in part, on usage of the grinding component during the at least one sharpening operation, communicating, using the transceiver, with the interface circuitry of the identification tag to read the updated usage tracking value from the usage location, and controlling operation of the sharpening control circuitry for sharpening operations based, at least in part, on the updated usage tracking value.

In some configurations, controlling operation of the sharpening control circuitry comprises enabling or disabling operation of the sharpening control circuitry. In some configurations, usage of the grinding component during the at least one sharpening operation comprises a number of passes performed by the grinding component during the sharpening operation, and the updated usage tracking value is based, at least in part, on the number of passes performed by the grinding component during the at least one sharpening operation. In some configurations, controlling operation of the sharpening control circuitry for sharpening operations is based, at least in part, on the updated usage tracking value further includes comparing the updated usage tracking value to a usage limit value stored in the usage location of the identification tag, wherein the usage limit value indicates a maximum number of passes a grinding component can complete; and determining whether a usage threshold of the grinding component has been exceeded based, at least in part, on a relationship between the updated usage tracking value and the usage limit value. In some configurations, the can include, prior to performing the at least one sharpening operation, communicating with the identification tag to access at least one system setup parameter; and configuring the skate blade sharpening system in accordance with the at least one setup parameter. In some configurations, the method can include, prior to performing the at least one sharpening operation, communicating with the identification tag to access at least one operating parameter associated with the operation of the grinding component; and performing the at least one sharpening operation with the grinding component in accordance with the at least one operating parameter. In some configurations, the method can include, prior to performing the at least one sharpening operation, communicating with the identification tag to access at least one user-specific default setting for parameters of the sharpening operation; and performing the at least one sharpening operation with the grinding component in accordance with the at least one user-specific default setting for parameters of the sharpening operation.

In another embodiment, a skate blade sharpening system can include a housing having a slot configured to receive a skate blade in a sharpening position; a grinding component configured for movement along the slot at a lower edge of the skate blade during a sharpening operation; at least one slot cover movable between an occluding position and a non-occluding position along the slot; at least one sensing component configured to determine engagement of the at least one slot cover with the skate blade; wherein in the non-occluding position the at least one slot cover permits insertion and removal of the skate blade, wherein in the occluding position the at least one slot cover engages at least one end of the skate blade and limits access through at least a portion of the slot; and a controller of the skate blade sharpening system configured to control operation of the grinding component based, at least in part, on at least one indication received from the at least one sensing component.

In some configurations, the controller is further configured to prevent a sharpening operation based, at least in part, on an indication received from the at least one sensing component that the at least one slot cover is positioned in the non-occluding position. In some configurations, the skate blade sharpening system can include a dust pan switch configured to determine whether a dust pan is positioned within the chassis of the skate blade sharpening system, wherein the controller is further configured to prevent operation of the skate blade sharpening system when the dust pan is not positioned within the chassis. In some configurations, the skate blade sharpening system can include a door configured to provide access to an interior of the chassis and a door switch configured to determine whether the door is in an open position or a closed position, wherein the controller is further configured to prevent operation of the skate blade sharpening system when the door is in the open position. In some configurations, the skate blade sharpening system can include a lighting component configured to provide a visual indication indicative of an operational state of the skate blade sharpening system. In some configurations, the lighting component is configured to provide different visual indications for different operational states. In some configurations, the lighting component is a light-emitting diode. In some configurations, the at least one sensing component is included in the at least one slot cover. In some configurations, the at least one sensing component includes a mechanical member moving between a first position and a second position, the mechanical member configured to be in the first position when the at least one slot cover is not engaged by the skate blade, the mechanical member configured to be in the second position when the at least one slot cover is engaged by the skate blade. In some configurations, the mechanical member includes a switch-engaging portion, wherein the at least one sensing component further includes an electrical switch engaged by the switch-engaging portion when the mechanical member is in the first position, and the indication provided by the at least one sensing component indicates an electrical state of the electrical switch. In some configurations, in the first position, the indication provided by the at least one sensing component is an open electrical state, and in the second position, the indication provided by the at least one sensing component is a closed electrical state. In some configurations, the mechanical member is a bumper having a face portion configured to be pushed by the skate blade to move the bumper from the first position to the second position. In some configurations, the at least one slot is positioned on top of the housing. In some configurations, the grinding component is a grinding wheel.

In another embodiment, a method of operating a skate blade sharpening system can include receiving, by a controller, an indication from a sensing component of a position of at least one slot cover, wherein the at least one slot cover is mounted relative to a slot of a housing, the slot configured to receive a skate blade in a sharpening position, the at least one slot cover movable between an occluding position and a non-occluding position along the slot, wherein a grinding component is positioned within the housing and configured for movement along the slot at a lower edge of the skate blade during a sharpening operation; determining, by the controller, whether the at least one slot cover is positioned in the occluding position based, at least in part, on the indication from the sensing component, wherein in the non-occluding position the at least one slot cover permits insertion and removal of the skate blade, wherein in the occluding position the at least one slot cover is engaged with at least one end of the skate blade and limits access through at least a portion of the slot during the sharpening operation; and based on a determination that the at least one slot cover is positioned in the non-occluding position, preventing initiation of the sharpening operation.

In some configurations, based on a determination that the at least one slot cover is positioned in the occluding position, initiating a sharpening operation; receiving an indication during the sharpening operation that the at least one slot cover is positioned in the non-occluding position; and stopping operation of the sharpening operation based, at least in part, on the indication. In some configurations, the method can include determining whether a dust pan is positioned within the chassis of the skate blade sharpening system based, at least in part, on an indication received from a dust pan switch; and preventing operation of the sharpening operation when the dust pan is not positioned within the chassis. In some configurations, the method can include determining whether a door is in an open position or a closed position based, at least in part, on an indication received from a door switch, wherein the door provides access to an interior of the chassis; and preventing operation of the sharpening operation when the door is in the open position. In some configurations, the method can include determining whether a filter element is positioned within the chassis of the skate blade sharpening system based, at least in part, on an indication received from a filter switch; and preventing operation of the sharpening operation when the filter is not positioned within the chassis. In some configurations, the method can include outputting a visual indication from at least one light component indicating that the skate blade sharpening system will not operate based, at least in part, on at least one of an indication that the at least on slot cover is not engaged with the skate blade, an indication that the dust pan is not positioned within the chassis, an indication that the door is in an open position, or an indication that the filter element is not positioned within the chassis. In some configurations, the method can include the visual indication is configured to direct a user to a component of the skate sharpening system that requires attention.

BRIEF DESCRIPTION OF THE DRAWINGS

These and other features, aspects, and advantages will be apparent from the following description of particular embodiments, as illustrated in the accompanying drawings in which like reference characters refer to the same parts throughout the different views.

FIG. 23 is a section view of one end of a carriage assembly;

FIG. 24 is a close-up view of a portion of FIG. 23;

DETAILED DESCRIPTION OF EMBODIMENTS

Figure 1:
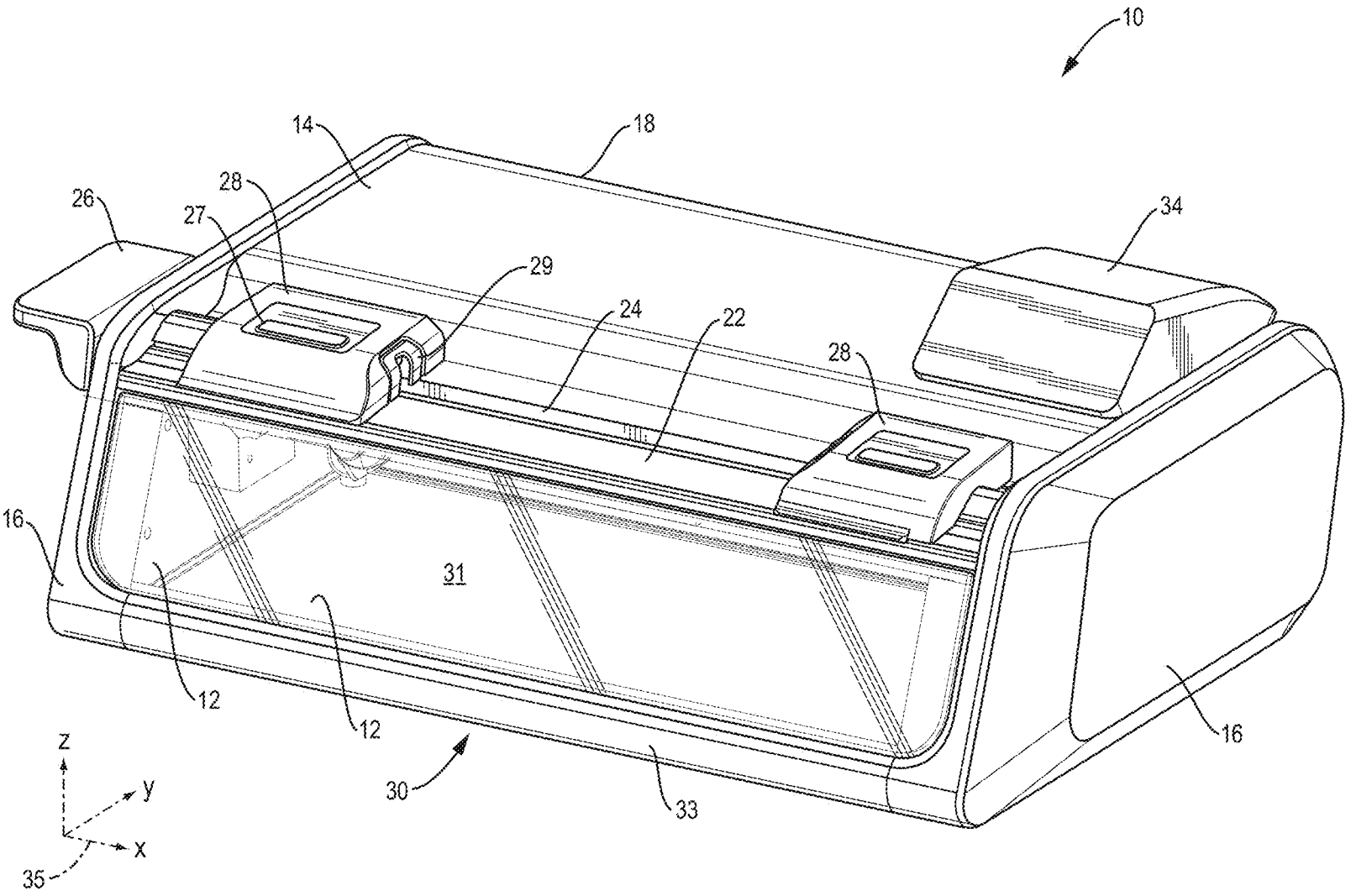
FIG. 1 is a perspective view of a skate sharpening system.
Figure 36:
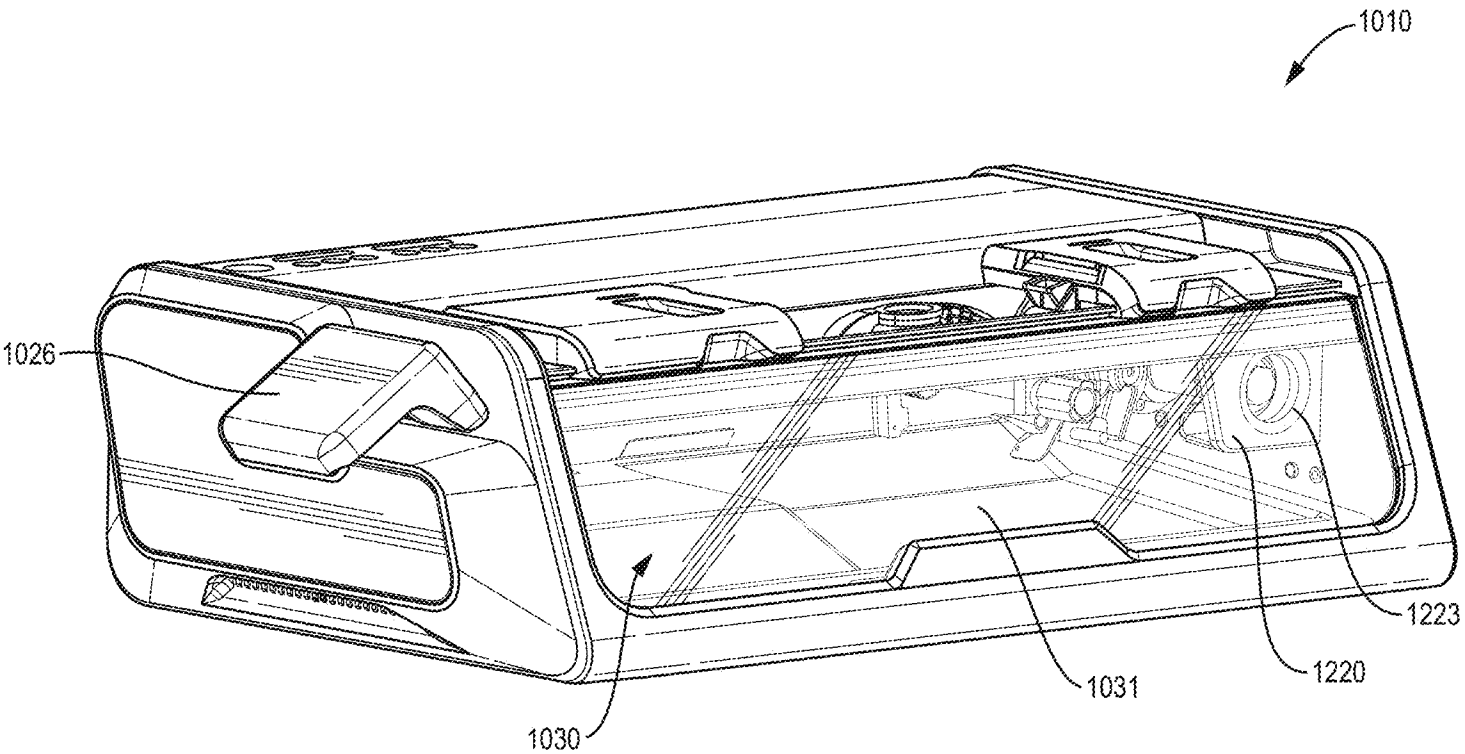
FIG. 36 is a perspective view of a skate sharpening system.

FIG. 1 is a perspective view of a skate sharpener 10 used to sharpen the blades of ice skates. As illustrated, the skate sharpener 10 is designed and configured to provide a safe, clean and automated skate sharpening system that allows anyone to sharpen skates at home, on their own schedule, and with professional quality results. A second skate sharpener 1010 is shown in FIG. 36. The second skate sharpener 1010, which being largely the same configuration as the skate sharpener 10 in FIG. 1, has some differences that will be discussed throughout this application. The similarities, however, will not be described in detail. Many of the structures of one skate sharpener 10, 1010 can be used with the other interchangeably and, thus, it is possible to construct a skate sharpener using certain features of one embodiment with certain features of another embodiment and such combinations are expressly contemplated to be within the scope of this disclosure.

Skate Sharpener Overview

The illustrated skate sharpener 10 has a box-like housing with structural elements including a rigid frame 12 (bottom visible in FIG. 1) and a rigid chassis 14. Attached components include end caps 16 and a rear cover 18. The chassis 14 includes a front platform portion 22, also referred to as "platform" 22 herein. The platform 22 includes an elongated slot 24 for receiving the blade of an ice skate for sharpening, and the blade is retained by clamp jaws (not shown) on the underside of the platform 22 which are actuated by a mechanism including a clamp paddle 26. Disposed on the platform 22 are slot covers or "scoops" 28 at respective ends of the slot 24, each including a respective bumper 29 serving to sense contact with a skate blade holder. An outward-opening door 30 having a glass panel 31 and lower hinge portion 33 extends across a front opening. A user interface display panel 34 is disposed at top right on the chassis 14. The skate sharpener 10 also includes a control module or controller, which is not visible in FIG. 1 and may be located, for example, inside of the rear cover 18. Further mechanical and electrical details are provided below.

FIG. 1 also shows a coordinate system 35 for references to spatial directions herein. The X direction is left-to-right, the Y direction front-to-back, and the Z direction bottom-to-top with respect to the skate sharpener 10 in the upright, front-facing orientation of FIG. 1. This coordinate system also defines an X-Y plane (horizontal), X-Z plane (vertical and left-to-right), and Y-Z plane (vertical and front-to-back). Using this coordinate system 35, the slot 24 extends in the X direction and the skate blade is clamped in an X-Z plane during sharpening as described more below.

Figure 2:
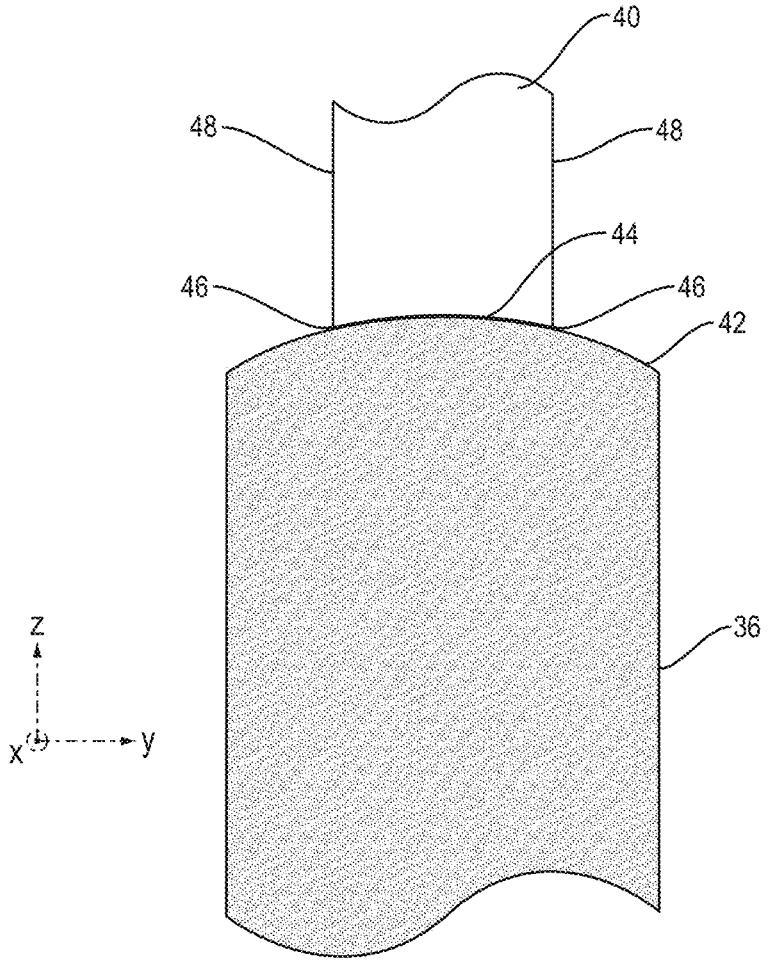
FIG. 2 is a schematic depiction of a grinding wheel contacting a skate blade during sharpening.

FIG. 2 depicts how a skate blade is sharpened. This is a schematic edge-on view of a lower portion of a skate blade 40 in contact with an outer edge of a grinding wheel 36. With reference to the coordinate system 35, this is a view in the X direction. As shown, the grinding wheel 36 has a convex rounded grinding edge 42. In practice the grinding edge 42 may be generally hemispherical. The grinding wheel 36 rotates in the plane of the blade 40 (X-Z plane, into the paper in FIG. 2), thereby imparting a corresponding concave rounded shape to a lower face 44 of the skate blade 40. Two acute edges 46 are formed at the intersection of the curved lower face 44 and the respective sides 48 of the blade 40. As material is removed, a clean and precise arcuate shape is restored to the lower face 44, including sharper edges 46. In practice, the radius of curvature of the lower face 44 is in the general range of ⅜" to 1", with one generally preferred radius being ½". It will be appreciated that the disclosed methods and apparatus may be used with other blade profiles, including flat and V-shaped, for example.

Method of Using the Skate Sharpener

Returning to FIG. 1, basic operation with a complete skate is as follows. First a user may need to install a grinding wheel onto an internal carriage (not shown) accessible via the front opening. For this the user opens the door 30, rotating it forward and downward about the horizontal hinge 33, and then closes the door after successfully installing the grinding wheel. The nature of the installation will be apparent from the more detailed description below. The user then clamps the blade of the skate in the slot 24 and slides the scoops 28 inwardly until the bumpers 29 are engaged by the blade holder part of the skate. Each bumper 29 actuates a limit switch within the respective scoop 28, so that the engagement is sensed by the controller to enable sharpening to proceed. The user then interacts with a user interface presented on the display panel 34 to initiate a sharpening operation. Subject to certain conditions as described more below, control circuitry of the control unit automatically operates both a grinding motor to spin a grinding wheel and a separate carriage motor (both described below) to move the rotating grinding wheel back and forth along the lower face of the skate blade a desired number of times. Each traversal of the grinding wheel across the length of the blade is referred to as a "pass". In each cycle of two passes (one to the left and the other to the right), the grinding wheel is moved to a far-right position at one end of the skate blade to permit a communications exchange between circuitry on the wheel and the control unit. This communication and related control are described below. Upon completion of a desired number of passes, the control unit stops both the rotation and back-and-forth motion of the wheel 36, and the user unclamps and removes the skate blade from the sharpener 10. It is noted that controls and locations could be reversed in alternative embodiments, so that the communications position would be a far-left position rather than a far-right position.

The above operation may also be used with bare removable skate blades of the type known in the art. In this case a blade holder or other mechanical aid of some type may be used to enable a user to position the bare blade in the slot 24 for clamping and to engage the bumpers 29 of the scoops 28 to permit operation. For example, the blade may be secured in a blade holder such as that described in co-pending U.S. patent application Ser. No. 14/632,862, filed Feb. 26, 2015, and U.S. patent application Ser. No. 14/632,868, filed Feb. 26, 2015, both of which are hereby incorporated by reference in their entirety. Alternatively, a bare blade could also be positioned without a blade holder. As described more below, a blade holder may engage limit switches on the slot covers 28 to enable sharpening operation, and enables a user to insert a loose skate blade in clamping jaws.

Grinding Wheel Translation and Vertical Movement

Figure 3:
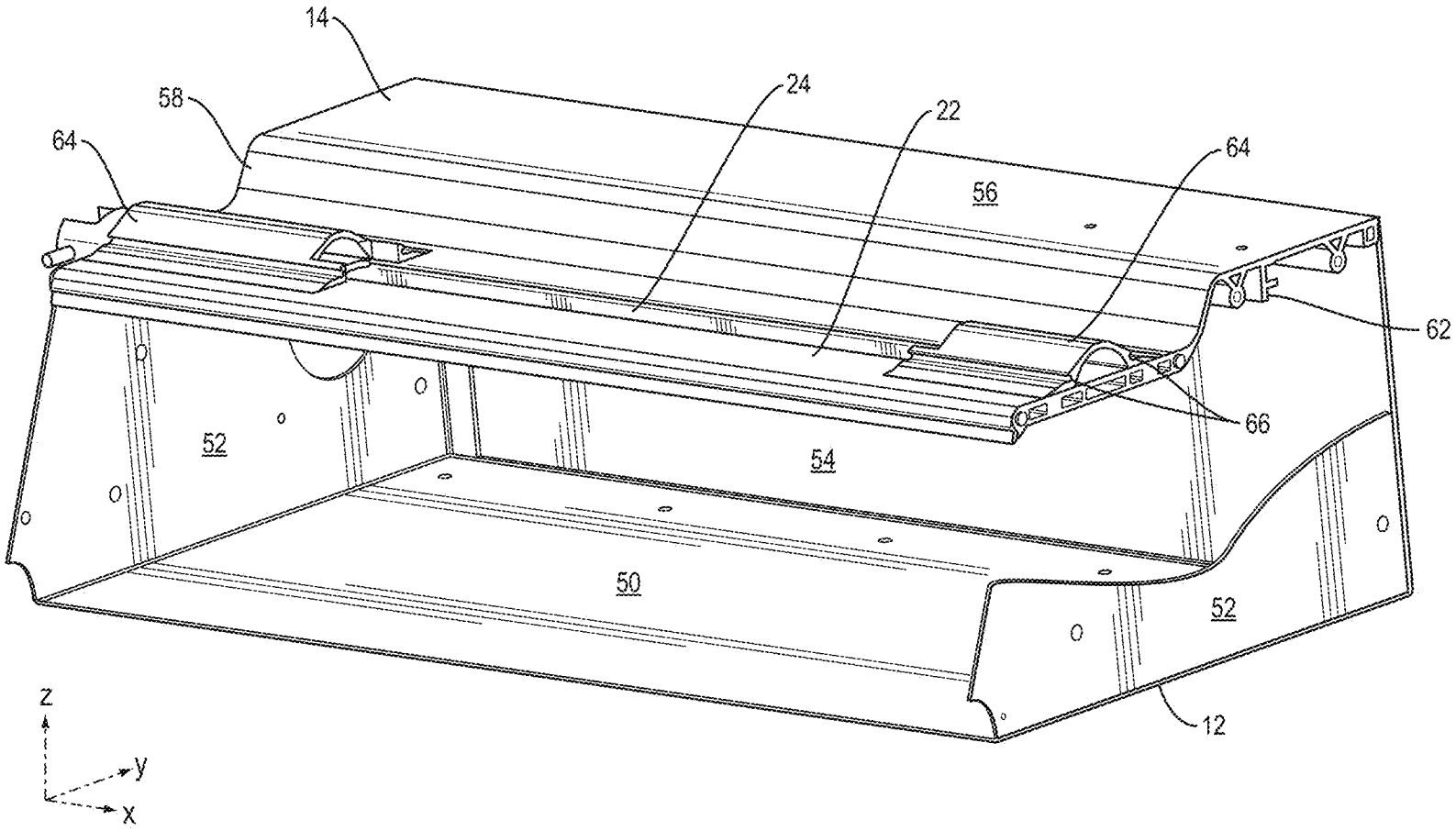
FIG. 3 is a perspective view of a metal frame and chassis of a sharpening system.

FIG. 3 is a view of the frame 12 and chassis 14. In one embodiment, the frame 12 is made of a single piece of sheet metal, folded to form a bottom 50, sides 52 and back 54. The chassis 14 serves as a top for the sharpener 10 and provides support for key components including a skate clamp and a carriage assembly, both described below. The chassis 14 is a rigid component made of metal or other suitably strong material. In one embodiment, the chassis 14 is made of aluminum and formed by extrusion, which can provide very accurate dimensions and geometry in a highly repeatable manner. The chassis 14 may be made of other materials and by other methods, including machining for example, in alternative embodiments.

As shown, the chassis 14 has an S-like cross section defining the frontward platform 22 and a rearward shelf portion ("shelf") 56 separated by a sloping wall 58. The underside of the shelf 56 includes two rails 60 on which a carriage (not shown) moves, as well as a downward-projecting flange 62. As described more below, a toothed "gear rack" that forms part of a rack-and-pinion mechanism for moving the carriage is attached to the flange 62. On the platform 22 at each end of the slot 24 are rounded projections 64 on which the scoops 28 are slidably mounted. The projections 64, also referred to as "arches" 64 below, have retention grooves 66 that engage with corresponding features in the scoops 28 to retain the scoops 28 on the projections 64 while permitting them to slide left and right.

Figure 4:
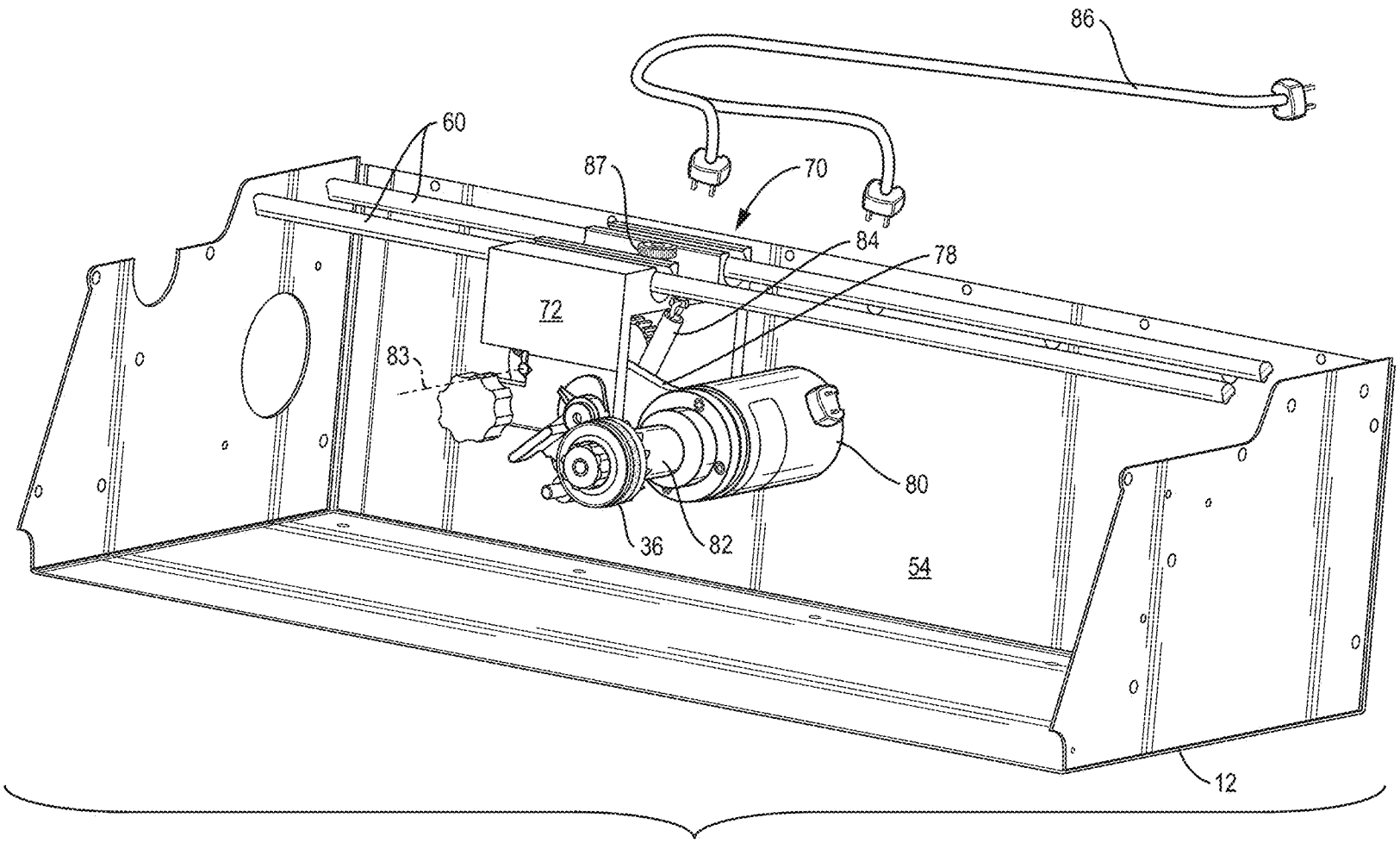
FIG. 4 is a perspective view of an interior of a sharpening system including a carriage assembly.

FIG. 4 shows the sharpener 10 with several external components removed. The 4-sided sheet metal frame 12 is fully visible. A carriage assembly 70 includes a carriage 72 mounted on the two rails 60, which are shown as separated from the rest of the chassis 14 in this view. The carriage assembly 70 includes a pivoting motor arm 78 to which a grinding wheel motor 80 is mounted. The grinding wheel 36 is mechanically coupled to the rotating shaft of the motor 80 by an elongated spindle 82. The motor arm 78 has limited rotational travel about a horizontal pivot axis 83, so that the grinding wheel 36 can move in a vertical direction to follow the profile of a skate blade when the sharpener 10 is in operation. In the illustrated embodiment, the motor arm 78 is biased toward an upper vertical limit by a spring 84 connected between the motor arm 78 and an upper portion of the carriage 72.

One important feature of the presently disclosed skate sharpener 10 is use of a compact (small-diameter) grinding wheel 36. Specifically, its diameter is less than the diameter of the grinding wheel motor 80 by which it is rotated. Use of a compact grinding wheel 36 can provide certain advantages including greater precision in operation and lower cost.

Also shown in schematic fashion in FIG. 4 is a wire harness 86 providing electrical connections between the grinding wheel motor 80 and the above-mentioned controller as well as between the controller and a carriage motor mounted within the carriage 72 (not visible in FIG. 4). In FIG. 4 the wire harness 86 is shown separate from the rest of the unit for ease of illustration, but it is actually located inside the unit along the rear wall 54. It preferably is self-supporting along its length in a manner that maintains its vertical position while permitting back-and-forth movement of the connectors attached to the carriage assembly 70. An example of a suitable support element is a ribbon-like material of the type used in printers and other machines with translating components. This material can flex about a transverse axis while being stiff about a longitudinal axis, and thus can maintain horizontal straightness while also flexing in a desired curling manner about a vertical axis that follows movement of the carriage assembly 70.

In operation, the grinding wheel 36 is rotated by the grinding wheel motor 80 via the spindle 82, and the carriage assembly 70 is moved back and forth along the rails 60 by action of a rack-and-pinion mechanism that includes a motor-drive pinion gear 87 engaging a toothed rack on the underside of the chassis 14 (described more below). The pinion gear 87 is driven by a carriage motor mounted within the carriage 72, not visible in FIG. 4. Each unidirectional pass of the grinding wheel 36 begins with the grinding wheel 36 located off one end of the skate blade and at the upper vertical limit position by action of the spring 84. As the carriage assembly 70 is moved toward the opposite end of the sharpener 10, the grinding wheel 36 encounters an end of the skate blade and is deflected downward to follow the profile of the skate blade across its length. At the end of the pass, the wheel 36 rides off the other end of the skate blade and returns to the vertical limit position by action of the spring 84.

Clamping Mechanism

Figure 5:
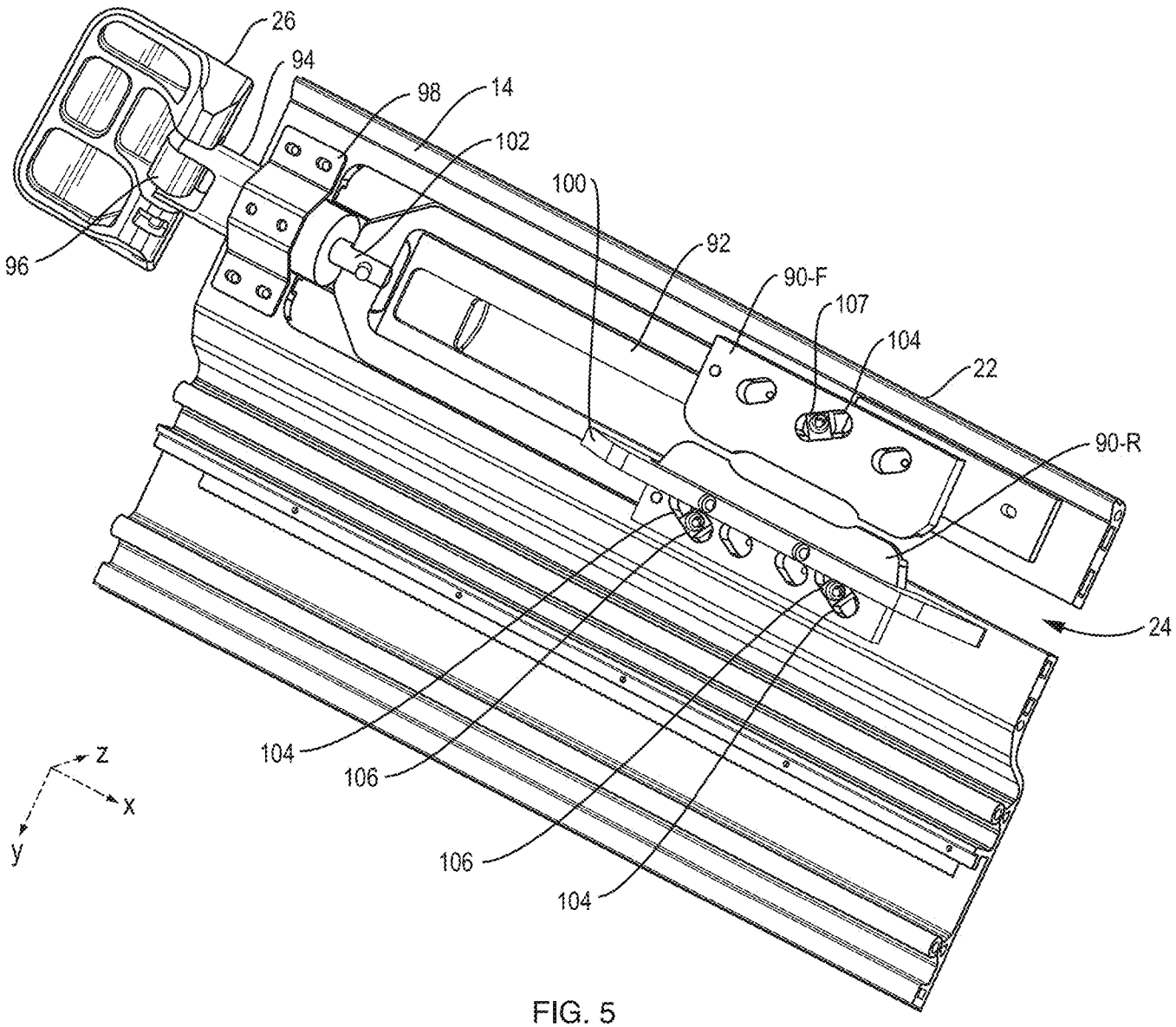
FIG. 5 is a perspective view of a skate blade clamp.

FIG. 5 shows the underside of the chassis 14. It includes a skate blade clamping mechanism whose major components are a pair of clamp jaws 90, specifically a front jaw 90-F and a rear jaw 90-R; a pull rod fork 92; a clamp cylinder 94; and a cam 96 at the underside of the clamp paddle 26 that rotates therewith. The clamp cylinder 94 is retained by a bracket 98. Also shown is a jaw guard 100. The clamp cylinder 94 has a pull rod 102 connected to the pull rod fork 92 and an internal spring-piston arrangement that actuates the pull rod 102 and thus the jaws 90 via the pull rod fork 92.

As shown, the jaws 90 each include angled slots 104, and in the slots 104 are arranged rectangular guide blocks 106 that retain the jaws 90 at the underside of the platform 22 with spacing to permit the jaws 90 to slide in the long direction of the slots 104. The front jaw 90-F is retained by one guide block 107 in a center slot 104, while the rear jaw 90-R is retained by respective guide blocks 106 in outer two slots 104. This arrangement permits the front jaw 90-F to rotate very slightly about a Z-direction axis extending through the single guide block 106, while the rear jaw 90-F is rotationally fixed. Additional details are provided below.

When the clamp paddle 26 is in the position shown in both FIG. 5 and FIG. 1, i.e., extending horizontally away from the platform 22, the cam 96 does not engage the internal piston of the clamp cylinder 94, and the action of the internal spring is to retract the pull rod 102 (toward the left in FIG. 5) so that the jaws 90 are brought toward each other by action of the angled slots 104 and guide blocks 106, 107. This is a referred to as a "closed" position, in which the jaws 90 are either just touching each other or are only slightly spaced apart, less than the width of the thinnest skate blade to be sharpened. Because this position is created by the spring alone, it is referred to as a "biased closed" position.

When a skate blade is to be clamped for sharpening, a user rotates the clamp paddle 26 to open the jaws 90. Referring to FIG. 1, the user pushes downward on the outer part of the clamp paddle 26. In FIG. 5, the clamp handle 26 rotates out of the page, rotating the cam 96 accordingly and causing it to push against the piston within the clamp cylinder 94. This force works against the spring bias to extend the pull rod 102 and push on the jaws 90, causing them to move away from each other by action of the angled slots 104 and guide blocks 106, 107. The space between the jaws in the open position is wider than the widest skate blade to be sharpened. The cam 96 and head of the piston may be co-configured to establish a detent with the jaws in the fully open position. The skate blade is then inserted through the slot 24 between the jaws 90, and the user then rotates the clamp paddle 26 upwardly (FIG. 1) to close the jaws 90 on the skate blade. It will be appreciated that the front jaw 90-F automatically rotates as necessary to close snugly against the skate blade with balanced force across the length of the jaws 90. In the absence of this rotating feature, any imperfection in alignment of the jaws 90 could create undesirable binding and/or rotational skewing of the skate blade, adversely affecting sharpening operation.

The jaw guard 100 protects against the possibility of contact between the grinding wheel 36 and the jaws 90. If the sharpener 10 were to somehow be operated without a skate blade present, then without the jaw guard 100 the wheel 36 would move across the jaws 90 at its upper vertical limit position, potentially damaging the grinding wheel 36 and/or the jaws 90. The likelihood of this occurring can be reduced or eliminated by the jaw guard 100, which would be encountered by the spindle 82 (FIG. 4) and keep the grinding wheel 36 in a more downward position safely away from the jaws 90.

Also shown in FIG. 5 is the above-mentioned rack 120 that is part of the rack-and-pinion mechanism for moving the carriage 70, as mentioned above. In the illustrated embodiment it is an elongated member, of a material such as metal or plastic, attached to the flange 62. In an alternative embodiment, the rack 120 could be formed by machining or otherwise forming a toothed pattern in the flange 62 or similar feature of the chassis 14. In yet other alternative embodiments, a different type of mechanism such as a belt drive might be used to move the carriage 70.

Electronics and Electrical

Figure 6:
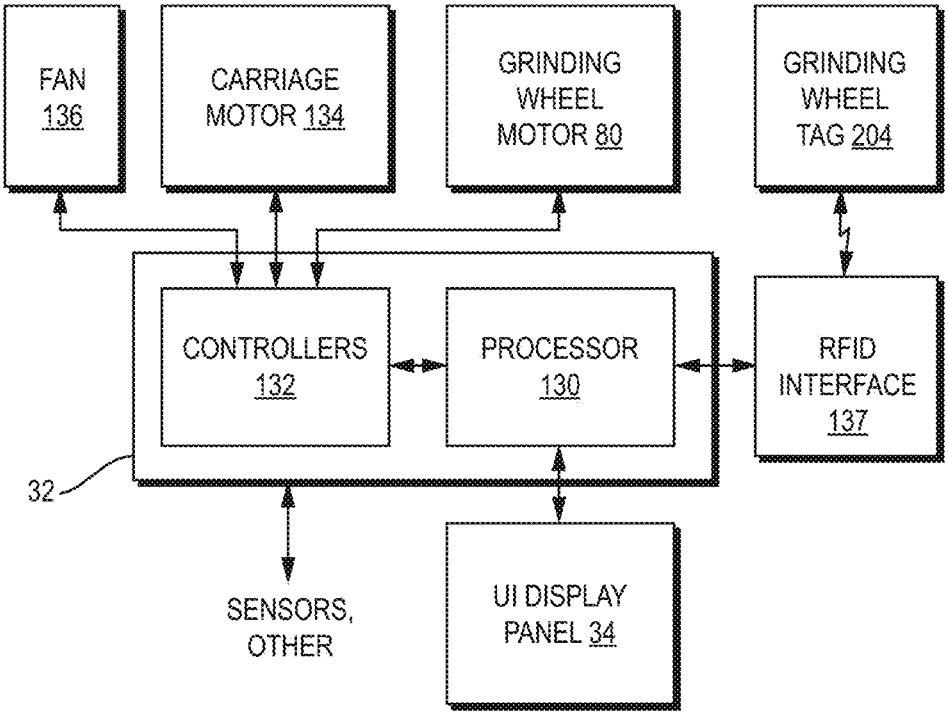
FIG. 6 is a block diagram of an electrical subsystem of a skate sharpening system.

FIG. 6 is an electrical block diagram of the skate sharpener 10. A control unit 32 includes a processor 130 and one or more controllers 132. The controllers 132 provide lower-level control of corresponding elements, such as the grinding wheel motor 80, a carriage motor 134, and a fan 136. Also shown are the user interface (UI) display panel 34 and RFID interface circuitry 137 in radio communications with an identification tag 204 of the grinding wheel 36 (described more below). In addition, sensors and other components (e.g., switches) can also be connected to the control 32. For example, sensors or switches, as will be discussed below, can be used to detect whether a skate is properly positioned for sharpening, whether the door 30 has been opened or is closed, whether a dust tray or filter member is properly positioned or the like. The information from these sensors and other components can be used to better control operations of the skate sharpener to provide improved performance or safer operation.

Both the controllers 132 and processor 130 are computerized devices including memory, I/O interface circuitry and instruction processing circuitry for executing computer program instructions stored in the memory. The controllers 132 may be specialized for low-level real-time control tasks such as achieving and maintaining a commanded rotational speed for a motor. The processor 130 may have a more generalized architecture and potentially richer set of programming resources to perform a variety of higher-level tasks, including interfacing to a user via the UI display panel 34. The processor 130 executing instructions of a particular computer program may be viewed as circuitry for performing functions defined by the program. For example, the processor executing instructions of a sharpening operation controller may be referred to as sharpening control circuitry, and the processor executing instructions related to usage control may be referred to as usage control circuitry. As mentioned above with reference to FIG. 1, the controller 32 may be located within the rear cover 18.

Figure 7:
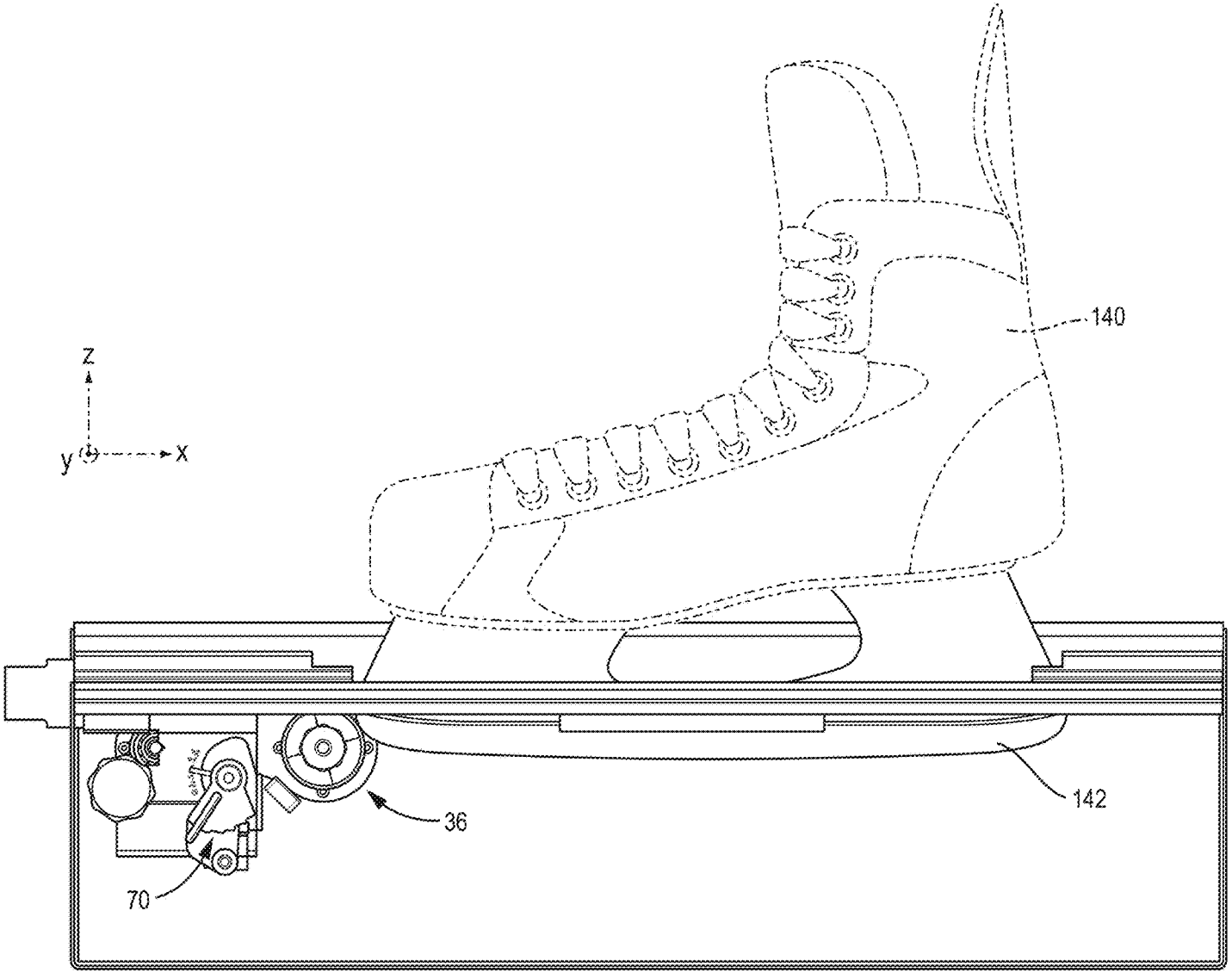
FIGS. 7 and 8 are front elevation views of a sharpening system.
Figure 8:
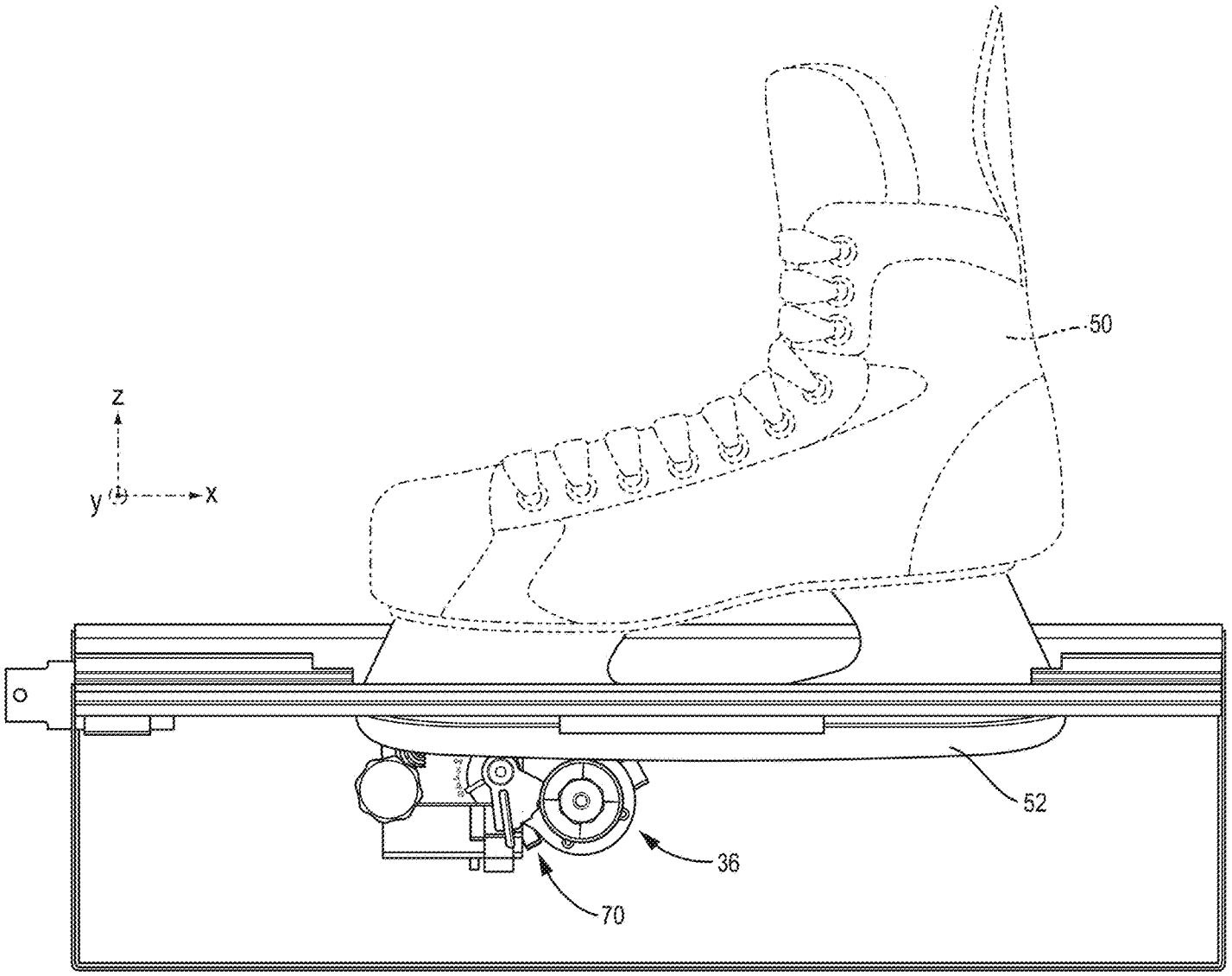

FIGS. 7 and 8 are front views illustrating the above operation. A skate 140 is present and its blade 142 is clamped into a sharpening position in which the lower portion of the blade 142 extends downward through the slot 24 (FIG. 1) into the interior of the sharpener 10. In FIG. 7 the carriage assembly 70 is located at far left, and the grinding wheel 36 is at an upper vertical limit position just off the left (leading) edge of the skate blade 142. FIG. 8 shows the carriage assembly 70 and grinding wheel 36 in the middle of a pass. It can be seen that the grinding wheel 36 has moved downward as it has followed the profile of the blade 142. As mentioned, this left-to-right pass ends with the grinding wheel 36 at the far right, off the right (trailing) edge of the blade 142. Generally multiple passes are used in a sharpening operation for a given blade 142, with the number of passes being determined by the amount of material removal that is necessary to achieve desired sharpness. The sharpener may use both left-to-right and right-to-left passes in sequence, i.e., the grinding wheel 36 travels back and forth in contact with the blade 142 in both directions. Assuming a single home position at one end, in practice each sharpening operation may have a number of two-pass cycles, each including a pass in one direction and a pass in the opposite direction. In alternative embodiments sharpening may occur in only one direction, i.e., the grinding wheel 36 is in contact with the skate blade 142 only for passes in one direction, which alternate with non-sharpening return passes in the other direction.

Grinding Wheel

Figure 9:
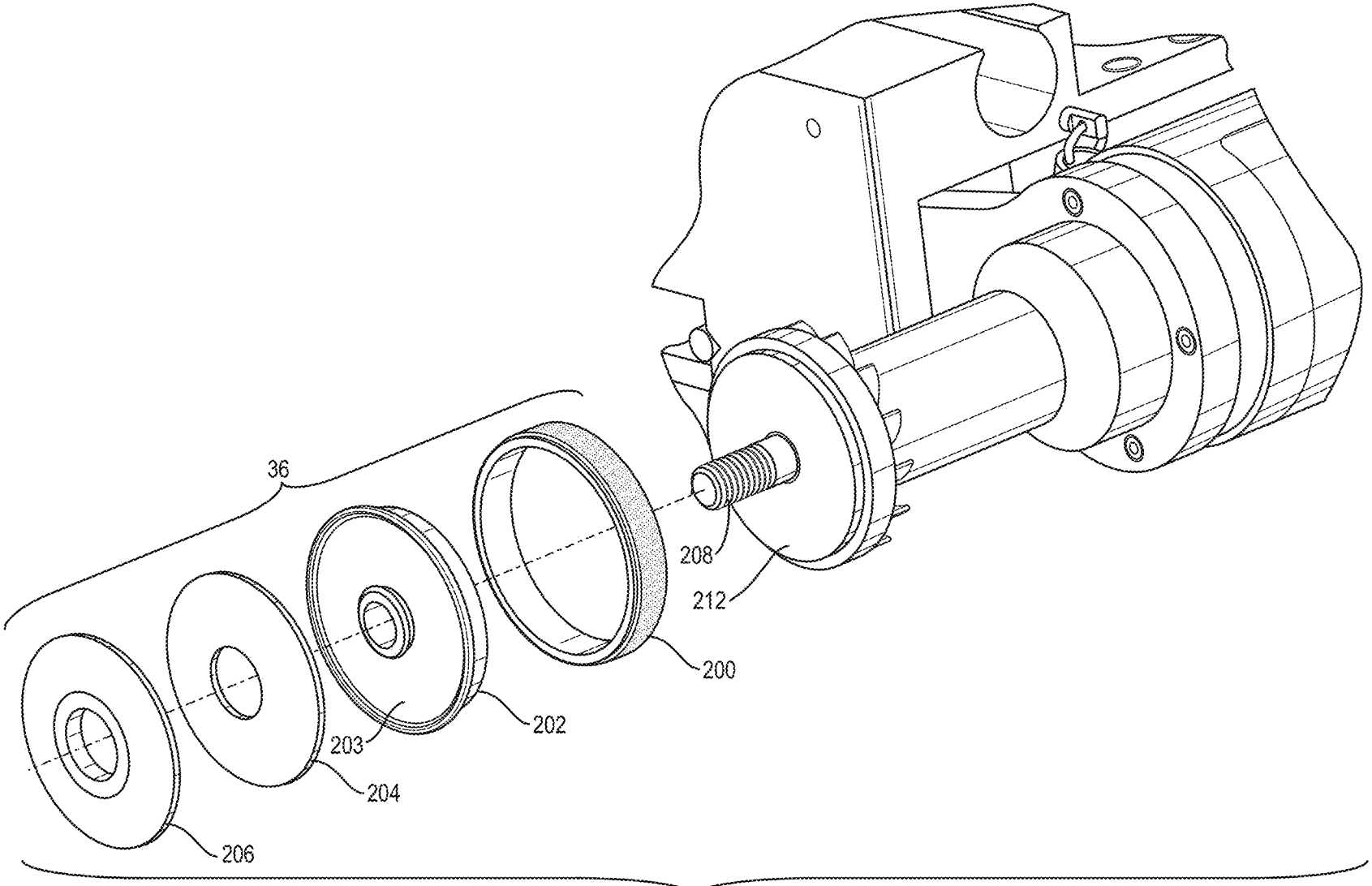
FIG. 9 is an exploded perspective view of a grinding wheel.

FIG. 9 shows details of the grinding wheel 36 in one embodiment. It is a multi-piece removable assembly that includes a metal grinding ring 200 disposed on a rigid hub 202, such as by a press fit. The hub 202 has a shallow front-facing cavity 203 which receives an identification tag 204 and a tag capture disk 206. The identification tag 204 (and an optional graphic label not shown in FIG. 9) is covered by the capture disk 206, which has a snap-fit to the hub 202. The identification tag 204 may be adhered to the hub 202. Once the capture disk 206 is snapped onto the hub 202, disassembly is very difficult. In one embodiment the hub 202 and disk 206 are formed of thermoplastic or similar hard non-metallic material, and may be substantially transparent. The grinding wheel 36 is mounted to an axle 208 of the spindle 82 by a retention nut (not shown) that urges the grinding wheel 36 against a metal arbor 212 that forms part of the spindle 82.

The grinding ring 200 has an abrasive outer surface for removing material from a skate blade during operation. In one embodiment the abrasive surface may include a diamond or cubic boron nitride (CBN) coating, deposited by electroplating for example. The grinding ring 200 is preferably of steel or similar rigid, strong metal, and it may be fabricated from steel tubing or bar stock. Although in general the grinding ring 200 may be of any size, it is preferably less than about 100 mm in diameter and even more preferably less than about 50 mm in diameter. Its thickness (radially) is substantially less than its radius, e.g., by a ratio of 1:4 or smaller. The ring shape, as opposed to a disk shape as used in more conventional grinding wheel designs, produces a much lighter grinding wheel 36 which can reduce the effects of wheel imbalance, eccentricity, and non-planarity. Reducing such effects can contribute to a smoother finish on a skate blade and a higher performance skate sharpening.

As shown, both the arbor 212 and hub 202 have shaped outer edges which mate with respective edges of the grinding ring 200. The mating between the arbor 212 and ring 200 is a sliding contact mating that permits mounting and dismounting of the grinding wheel 36 while also providing for heat transfer between the grinding ring 200 and the arbor 212. This relatively tight fit is also responsible for the centering of the grinding wheel. The heat transfer helps dissipate frictional heat generated in the grinding ring 200 as it rotates against a skate blade in operation. Specifically this mating is between a portion of an inner annular surface of the grinding ring 200 and an annular outer rim of the arbor 212. Both the hub 202 and arbor 212 have notches or shoulders on which respective portions of the grinding ring 200 rest. Thus the shoulder portion of the hub 202 extends only partway into the grinding ring 200, so that a remaining part of the grinding ring 200 extends beyond the arbor-facing end of the hub 202 and mates with the shoulder portion of the arbor 212.

The arbor 212 may include vanes or other features to increase its surface area and/or enhance air flow for a desired cooling effect, further promoting heat dissipation and helping to maintain a desired operating temperature of the grinding ring 200 in operation.

One important feature of the grinding ring 200 is its relatively small size, as compared to conventional grinding wheels which may be several inches in diameter for example. Both the small size of the ring (outer diameter) as well as its ring geometry (in contrast to disk geometry of conventional grinding wheels) contribute to advantages as well as challenges. Advantages include low cost and ease of manufacture, so that it can be easily and inexpensively replaced to maintain high-quality sharpening operation. The size and geometry also reduce any contribution of the grinding ring 200 to imbalance and related mechanical imperfections of operation. Balance and related operational characteristics are more heavily influenced by the arbor 212, which is preferably precision-formed and precision-mounted. One challenge of the geometry and size of the grinding ring 200 is heat removal, and this is addressed in part by the heat-conducting mating with the arbor 212 and heat-dissipating features of the arbor 212.

The identification tag 204 has a unique identifier such as a manufacturer's serial number, and when packaged with a grinding wheel 36 into an assembly serves to uniquely identify that assembly including the constituent grinding wheel 36. The identification tag 204 also includes memory capable of persistently storing data items, used for any of a variety of functions such as described further below. The identification tag preferably employs a security mechanism to protect itself against tampering and improper use, including improper manipulation of the contents of the memory. Memory protected in such a manner may be referred to as "secure memory". The serial number should be a read-only value, while the memory is preferably both readable and writeable. As described below, a separate transceiver in the system 10 is capable of exchanging communication signals with the tag 204 for reading and writing data. In one embodiment, so-called "RFID" or radio frequency identification techniques may be employed. Using RFID, the identification tag 204 is read from and written to using radio-frequency electromagnetic waves by an RFID transceiver contained in the sharpening system 10 (described more below). Other types of implementations are possible, including optically interrogated tags and contact-based tags such as an iButton® device.

For security, the identification tag 204 may use an access code that is read by the control unit 32 and validated. The access code can be generated by a cryptographic hash function or other encryption algorithm that takes as input the serial number of the identification tag 204 and a confidential hash key. Using the serial number ensures that the access code created is uniquely paired with a specific identification tag 204. This uniqueness can help reduce or eliminate the likelihood of misuse that is attempted by copying an access code from one identification tag 204 to another. When the serial number of the other identification tag 204 is encrypted, the result will not match the copied access code, and appropriate action can be taken such as reducing or eliminating the likelihood of use of the grinding wheel 36 that contains the apparently fraudulent identification tag 204.

Figure 10:
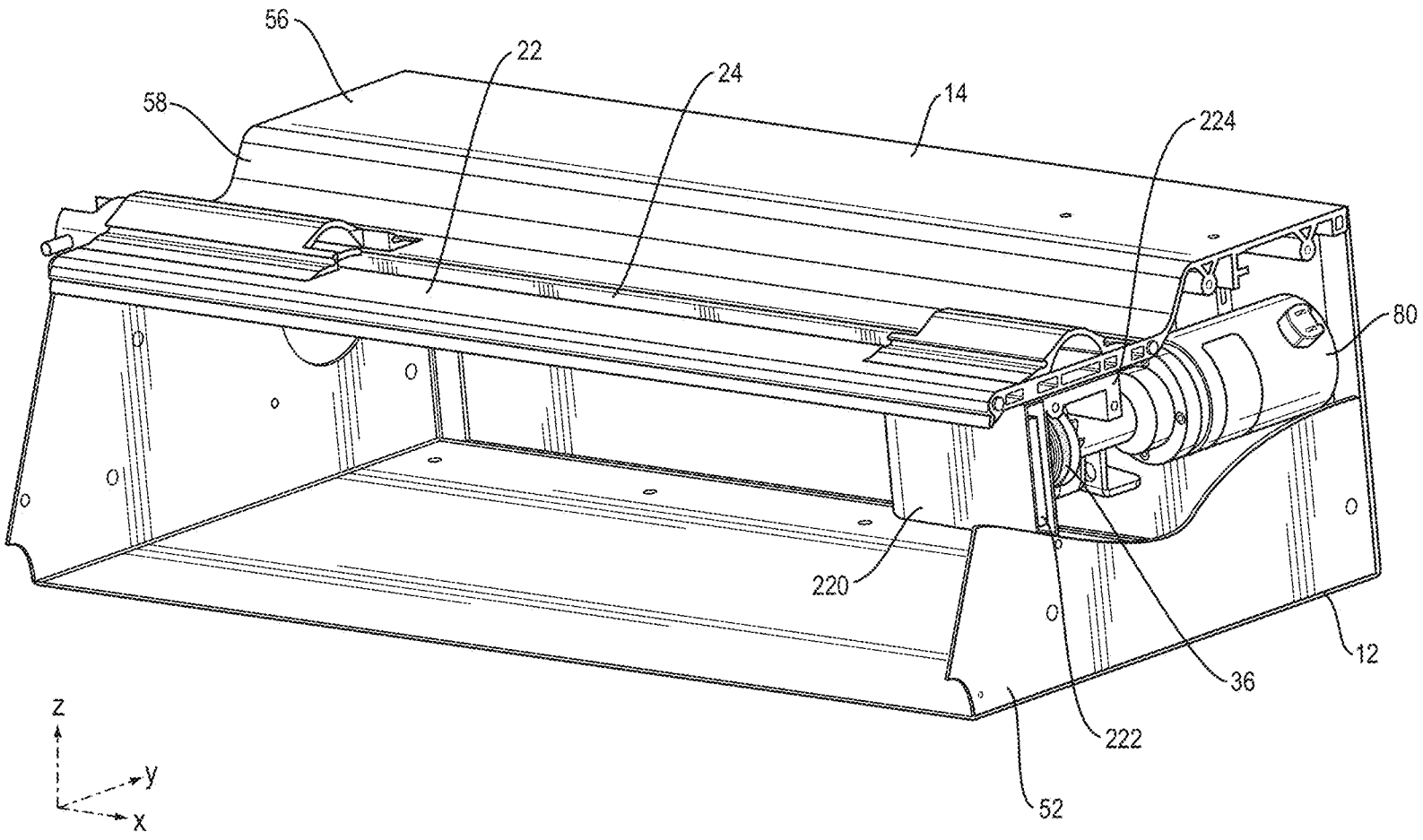
FIG. 10 is a perspective view of an interior of a sharpening system including a carriage assembly.

FIG. 10 shows the sharpener 10 having the carriage 70 located in a "home" position at the far right of the sharpener 10. The right end wall 52 is cut away in this view in order to show pertinent detail. Attached to the right wall 52 is a housing 220 in which an electronic sensor module 222 is mounted. The sensor module 222 is connected by cabling (not shown) to the controller 32 (FIG. 6). In this position the grinding wheel 36 is adjacent to an inner side of the housing 220 and vertically centered on the housing 220 by action of a shoulder member 224 of the housing 220. Additional details of this arrangement are described below.

Figure 37:
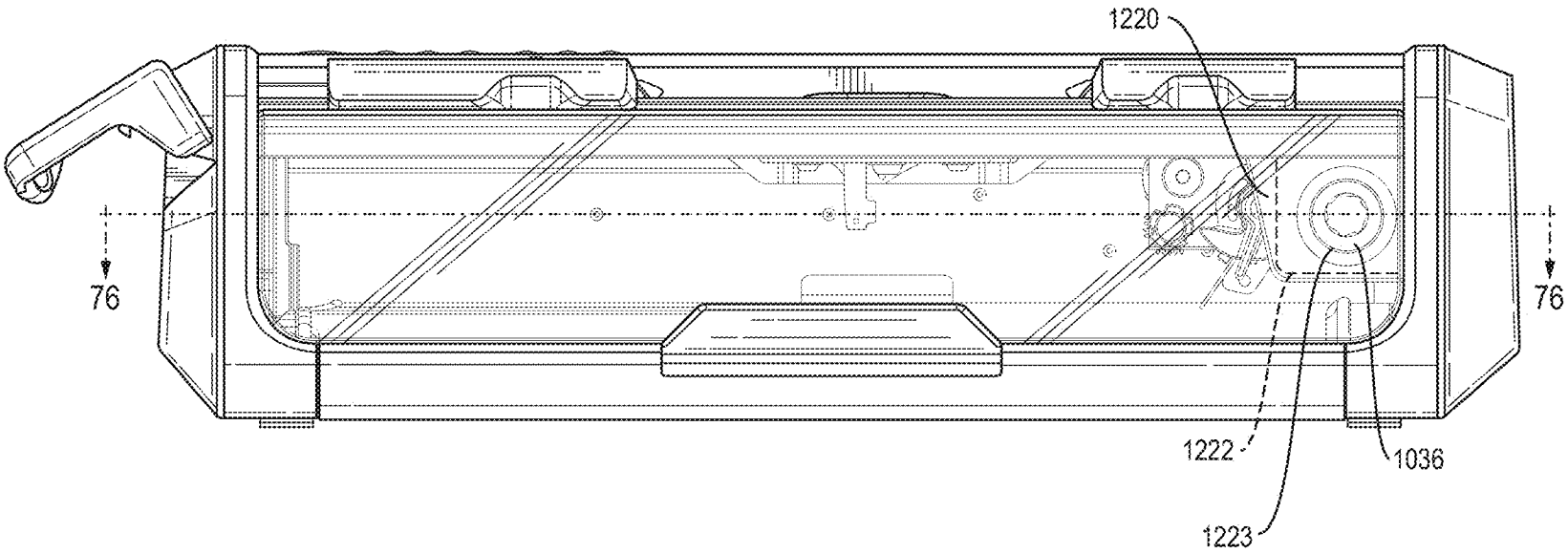
FIG. 37 is a front view of the skate sharpening system of FIG. 36.

With reference now to FIG. 37, another configuration of a housing 1220 and sensor module 1222 is illustrated. As illustrated, the sensor module 1222 is contained within a portion of the housing 1220. In one configuration, the sensor module 1222 includes an RFID antenna or the like. Any type of communications antenna may be used that will facilitate communication between the skate sharpener 1010 and the grinding wheel 1036. In some configurations, the antenna is circular in shape and mounted to a circuit board. The circular shape for the RFID antenna has been found to increase the likelihood of consistent communication between the skate sharpener 1010 and the grinding wheel 1036.

Other shapes for the antenna and other locations are possible. For example, the antenna could be located behind the grinding wheel 1036 when the grinding wheel 1036 is in the home position such that a user would see the grinding wheel 1036 and the grinding wheel would obscure at least a portion of the antenna or the housing 1220 containing the antenna or the like. In some configurations, the sensor module 1222 could be positioned in a different location within the skate sharpener 1010. For example, the sensor module 1222 could be positioned at the opposite end of the sharpening pass or at another location along the sharpening pass. In some configurations, the sensor module 1222 could be positioned between the two ends of the sharpening pass. In some configurations, the sensor module 1222 could be positioned within a region bounded by the ends of the jaws of the clamps such that any time the grinding wheel 1036 made a full sharpening pass, the grinding wheel 1036 would pass through a region containing the sensor module 1222 (even if the grinding wheel 1036 did not move all the way to the home position).

In the illustrated configuration, the circular shape of the antenna provides a central area of the circuit board that can be removed without adversely impacting communication performance. The housing 1220 that encloses the sensor module 1222 also can include an opening 1223. Because the home position for a grinding wheel 1036 in the currently configuration is within a region including the housing 1220 (e.g., the read/write region), the grinding wheel 1036, when in the home position, would generally be obscured by the housing 1220. As shown in FIG. 37, the opening 1223 advantageously enables a user to view the grinding wheel 1036 without turning on the sharpening system 1010. As such, the user is able to visually inspect the grinding wheel and, based upon the appearance of the installed grinding wheel 1036, determine the type/style/hollow of the grinding wheel 1036 presently installed. In some configurations, rather than having an opening, the portion of the housing 1220 containing the sensor module 1222 could be small enough in proportion that at least an identification portion of the grinding wheel 1036 would be exposed beyond the housing 1220.

While the illustrated opening 1223 of the housing 1220 is concentric with the grinding wheel 1036 in the home position, the opening 1223 could have other configurations keeping in mind a desire to view at least a portion of the grinding wheel 1023 through the opening 1223. For example, the opening 1223 could be smaller but overlap a portion of the grinding wheel 1036 such that the opening 1223 provides a user the ability to determine the variety of grinding wheel 1036 installed. In some configurations, the opening 1223 is a window and has a covering such as a light transmissive or light transparent covering. In the illustrated configuration, however, the opening 1223 is not covered and allows physical access to the grinding wheel 1036.

As mentioned above, the wheel 36 includes an identification tag 204 on which various data may be stored for a variety of purposes. In the illustrated embodiment this tag employs a wireless communication technique such as Radio Frequency Identification (RFID) communications. The sensor module 222 includes an RFID antenna (not shown) which becomes registered or aligned with the identification tag 204 when the grinding wheel 36 is in the illustrated home position, so that the tag 204 may be read from and written to using RFID communications. Generally the RFID antenna has one or more loops of conductive material such as wire or metal etch, with the loops having a circular or other shape (e.g., rectangular). The RFID communications may operate on any of a number of frequencies. Frequencies in common use include 133 kHz (Low Frequency or LF), 13.56 MHZ (High Frequency or HF), and 900 MHz (Ultra High Frequency or UHF).

In the illustrated embodiment the identification tag 204 is within the circumference of the circular RFID antenna of the sensor module 222, e.g., concentric with the antenna, during the reading and writing of data from/to the tag 204 as part of operation. By this arrangement the identification tag 204 can be read from and written to even when the grinding wheel 36 is rotating at full speed, which may be between 1000 and 25000 RPM. In some configurations, the tag 204 can be read from and written to when rotating at speeds between 700 RPM and 5000 RPM. In some configurations, the tag 204 can be read from and written to when rotating at speeds between 1000 RPM and 4000 RPM. Reading and writing at full rotational speed has a distinct advantage of allowing the sharpener 10 to sharpen more quickly, because it is not necessary to slow/stop wheel rotation and then bring rotation back up to speed for each read/write operation. As described more below, in one embodiment reading and writing occurs once during each 2-pass cycle, so the time savings is proportional to the number of cycles in a sharpening operation. Additionally, reading and writing at full rotational speed can discourage any tampering with the grinding wheel 36, because it is always moving during any attempted authentication or reading/writing process. In some embodiments it may be advantageous to maintain rotation but at a reduced rotational speed to improve the read/write communications with the tag 204.

Figure 11:
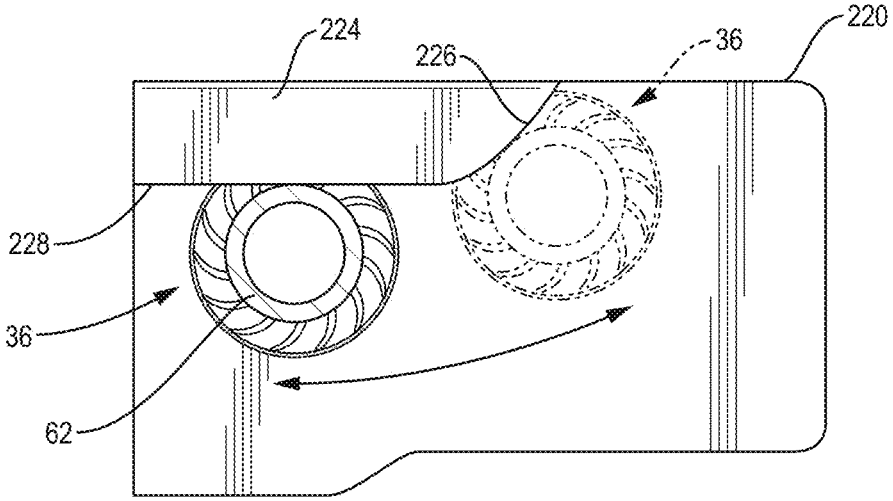
FIG. 11 is a rear view of a rear part of a radio frequency identification (RFID) antenna housing in a sharpening system.

FIG. 11 is a view from inside the sharpener 10 toward the front, showing the inside-facing part of the housing 220 and other details. As shown, the shoulder member 224 has a sloped edge 226 and horizontal edge 228. When the grinding wheel 36 is returning to the home position, moving right-to-left in FIG. 11, it initially is at its vertical limit position as indicated in phantom. The spindle 62 encounters the sloped edge 226 and follows it downward, then rides along the horizontal edge 228. This motion of the spindle 62 brings the wheel 36 into a desired vertical position with respect to the antenna within the housing 220, e.g., aligning the center of the wheel 36 with the center of the antenna. This alignment generally maximizes the RF coupling between the antenna and the tag 204, resulting in robust and accurate transfer of RF signals there between.

Figure 12:
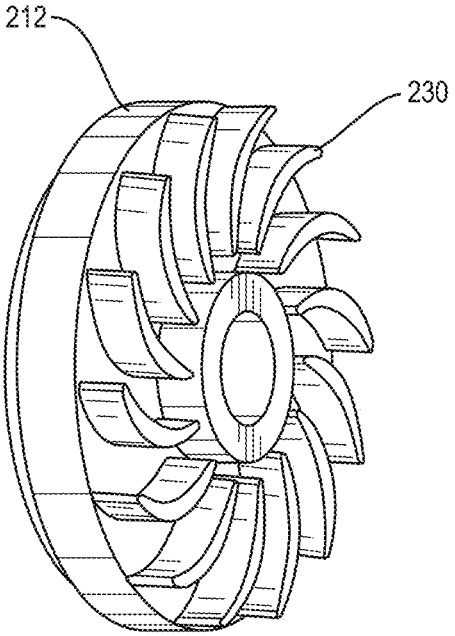
FIG. 12 is a perspective view of an arbor.

FIG. 12 shows the rear face of the arbor 212. It is a unitary component including a set of rearward-facing projections or "vanes" 230, each extending generally radially with slight curvature as shown. With this configuration the arbor 212 creates airflow in the vicinity of the arbor 212 and grinding ring 200, increasing convective heat dissipation from these components over an alternative lacking this feature. It will be appreciated that any of a variety of specific vane configurations may be employed, including non-curved vanes.

Grinding Wheel Vertical Travel Stop Adjustment

Figure 13:
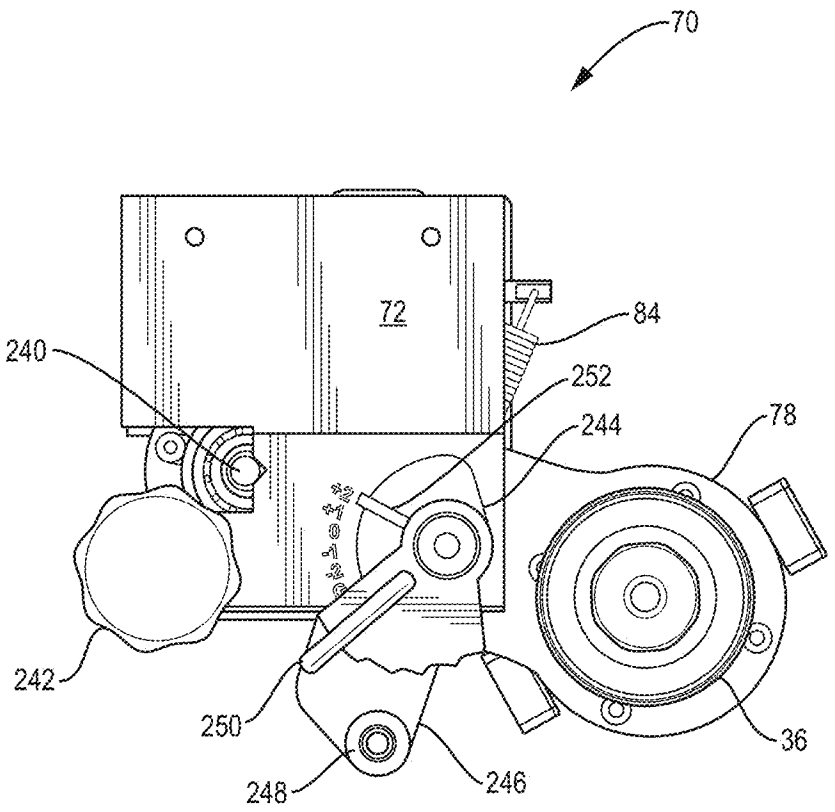
FIG. 13 is a front elevation view of a carriage assembly.

FIG. 13 shows the front of the carriage assembly 70. The motor arm 78 is an oblong member mounted for rotation on a spindle axle 240 at the left side of the carriage 70. A Y-adjustment knob 242 is mounted on a separate Y-adjustment axle below the spindle axle 240. A height adjustment mechanism includes a rotating adjustment member 244 and a bracket 246 extending downward from the motor arm 78 and having a limit peg 248. The adjustment member 244 includes a user handle 250 and a pointer feature 252 having a terminus at an array of numbers arranged on the carriage 70. Its lower edge is scalloped by a series of faces having successively increasing distances from the center of rotation (proceeding clockwise along the edge).

As the adjustment member 244 is turned, it presents different faces of the scalloped lower edge at a rest position of the limit peg 248. When the grinding wheel 36 is clear of the skate blade and the motor arm 78 rotates upward under the action of the spring 84, the upward travel is limited by the limit peg 248 encountering a face of the lower edge of the adjustment member 244. The different faces of the adjustment member 244 are at different radii from the center of rotation of the adjustment member 244, thereby establishing different vertical locations for this rest position of the limit peg 248.

In operation, a user rotates the adjustment member 244 to set a maximum vertical position of the grinding wheel 36. The purpose of this adjustment is to set a vertical travel limit of the grinding wheel 36 when it comes off the edge of the skate blade. This feature helps tailor operation depending on the type of skate being sharpened. Regular ice hockey skates have rounded upturns at each end of the skate blade (e.g. toe or heel), and it is desired that the grinding wheel 36 move upward to follow the upturns. This can be accomplished by having a high maximum vertical position. The blades on so-called "goalie skates" are flatter and it is typically desired that the grinding wheel 36 not move as far upward as it leaves the end of the blade, but rather come off relatively straight. This can be accomplished by adjusting the height limit using the adjustment member 244 to set a lower maximum vertical position.

In FIG. 13, the grinding wheel 36 is shown in a downward position such as it occupies when riding along a skate blade, so the limit peg 248 is well away from the adjustment member 244. It will be appreciated that upward rotation of the motor arm 78, such as occurs when the grinding wheel 36 moves away from the skate blade, rotates the bracket 246 upward so that the limit peg 248 encounters the lower edge of the adjustment member 244.

Figure 14:
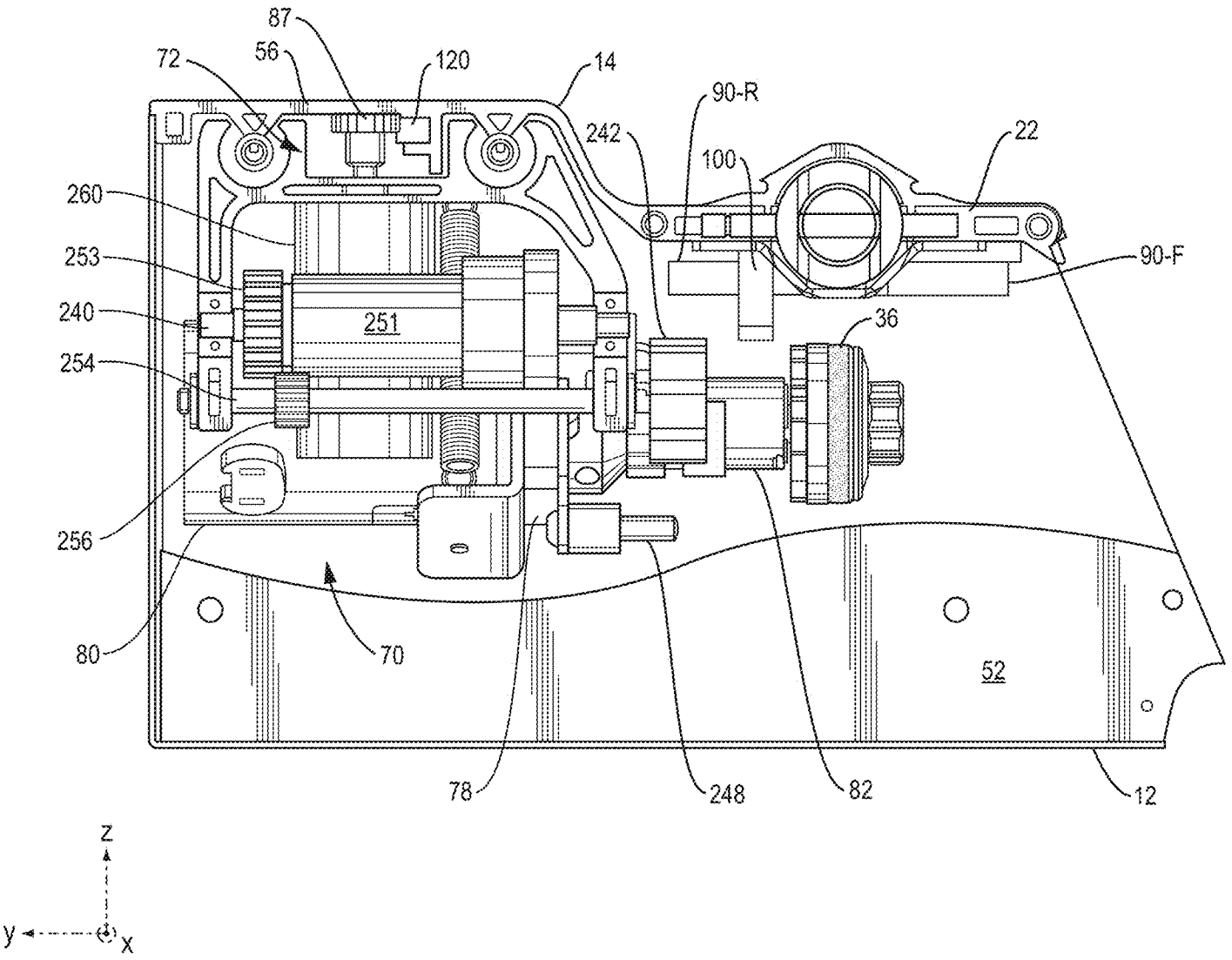
FIG. 14 is a side elevation view of a carriage assembly.

FIG. 14 is a view from the left side of the sharpener 10, with the near end wall 52 partially cut away. This view illustrates several features related in some manner to the compactness of the grinding wheel 36, i.e., its smaller diameter relative to that of the grinding wheel motor 80 (FIG. 4). When conventional larger grinding wheels are used, there is inherently greater vertical space within which other mechanical components may be mounted, such as the grinding wheel motor, clamping jaws for the skate blade, etc. Using the compact grinding wheel 36 enables a corresponding compactness in the overall skate sharpener 10, which is generally advantageous but also requires that more attention be paid to the design and organization of other mechanical features.

One feature visible in FIG. 14 is the height difference between the rear shelf 56 and the lower front platform 22 of the chassis 14. The relative height of the shelf 56 provides clearance for the carriage assembly 72 and the components it carries, including the grinding wheel motor 80 with its vertical movement on the motor arm 78 (see FIG. 4). The lower platform 22 is closer to the grinding wheel 36. The jaws 90 are located below the platform portion 22, even closer to the grinding wheel 36 to permit the skate blade to be retained at a sufficiently low position that it can be contacted by the grinding wheel 36 in operation. The above-described protective function of the jaw guard 100 can also be appreciated in this view—the spacing between this component and the spindle 82 is smaller than the spacing between the grinding wheel 36 and the jaws 90.

Another pertinent feature relates to a Y-adjustment mechanism permitting fine adjustment of the position of the grinding wheel 36 to align it with a retained skate blade in the X-Z plane (which is perpendicular to the page of FIG. 14). The grinding wheel 36 is mechanically coupled to the carriage 70 by a series of components including the spindle 82, the grinding wheel motor 80, and the motor arm 78, which is mounted to a spindle 251 having a spindle axle 240 mechanically fixed to the carriage 70. The spindle 251 includes an interior mechanism causing fine translational movement (horizontally in FIG. 14) in response to rotation of a spindle gear 253. In some embodiments, the spindle 251 is located above a nominal position of the grinding wheel 36, creating a desired arc of movement of the motor arm 78 and direction of force between the grinding wheel 36 and the skate blade. In order to actuate the Y-adjust mechanism of the spindle 251, an adjustment axle 254 on which the adjustment knob 242 is mounted is located below the spindle 251 and has a gear 256 engaging the spindle gear 253. This lower position enables a user to reach into the unit (from the front opening which is to the right in FIG. 14) and rotate the adjustment knob 242 with their fingers, clearing the underside of the front platform portion 22 of the chassis 14.

FIG. 14 also shows the above-mentioned carriage motor 260 that drives the pinion gear 87 in engagement with the rack 120.

Use of Identification Tag 204

The grinding wheel 36 utilizes the identification tag 204 to carry important information and provide it to the control unit 32 of the sharpener 10. The information carried by the tag 204 can be used to improve sharpening operation and reduce costs associated with the skate sharpener 10.

Accurate and repeatable skate sharpening is obtained when the grinding wheel 36 is in good condition (e.g. running true, not excessively worn, not damaged). One of the limitations of existing sharpeners is that there is no indicator for the user that alerts them when the grinding wheel is not in good condition. Generally the user must make a judgment call on when to retire a grinding wheel. This may occur, for example, in response to a bad skating experience with skates that were sharpened with a grinding wheel that is no longer in good condition.

The disclosed sharpener 10 can use the data-carrying ability of the grinding wheel 36 to track usage, and employ the usage information in some way to promote delivery of consistent high quality sharpening. Generally this will involve comparing actual usage to a usage limit that has been predetermined as a dividing point between high quality sharpening and unacceptably low quality sharpening. When the usage limit is reached, some action is taken. For example, the control unit 32 may provide an indication to a user via the user interface display panel 34. It may also reduce or eliminate the likelihood of further use of the grinding wheel 36, i.e., refrain from performing any passes with a wheel whose usage has reached the limit, even if such continued use has been requested by a user.

In one embodiment, the above usage tracking may be realized by initially loading the usage limit value onto the tag 204 and then subtracting or "debiting" the stored value as the grinding wheel 36 is used. The usage limit may be deemed to have been reached when the stored value reaches a predefined number such as zero. Generally the usage tracking and usage limit may be specified in any of a variety of ways, including a count of passes or cycles as has been mentioned, or alternatively by counting operating time (tracking the operating time for each sharpening and accumulating the time values over a period of successive sharpenings). If the usage limit value is specified as a maximum number of passes, then the value is decremented by two for each 2-pass cycle of the grinding wheel 36 over a skate blade during sharpening. In one embodiment, this decrementing can take place once each cycle, with the grinding wheel 36 passing through the home position (FIG. 8) to enable the required RFID communications. In another embodiment, the updating may occur only once for a multi-pass sharpening operation. For example, once a number of passes has been specified (either by default or by actual user selection), the number of passes may be updated by the system immediately after the machine reads the tag 204 and just before the carriage motor 260 begins rotating. If the stored value were updated less frequently or at a different time, there may be more opportunity for a user to somehow "trick" the sharpener 10 into using a grinding wheel 36 longer than its useful life, which would jeopardize the quality of the skate sharpening.

A specific example is now provided for illustration. It is assumed that the useful lifetime of a grinding wheel 36 is on the order of 160 passes. This translates to approximately 10 sessions of sharpening a pair of skates if an average of 4 cycles (8 passes) is used per skate (8*2*10=160).

In a given embodiment, usage may be tracked in units of passes, cycles, blades sharpened (assuming some fixed or limited number of passes per blade), time, or some other scheme. The UI display 34 may be used to display remaining usable life for a grinding wheel 36 to the user.

For example, it may be displayed as a fraction or percentage, or as more general ranges which could be indicated by colored indicators, for example—e.g., green for high remaining lifetime, white or other neutral color for intermediate, and red for low remaining lifetime. In one embodiment a linear array of indicators may be used, and indicators successively extinguished from one end as usage increases, and the end-of-life indicated by no indicators being lit.

Since there will be user-to-user variability in how many passes are done for a skate sharpening, the system may alert a user when the number of cycles needed to complete a sharpening exceed the number of cycles of remaining life of the grinding wheel 36. The alert may be provided, for example, by dimming or flashing a set of indicators, and/or by stopping a sharpening that is in progress or reducing or eliminating the likelihood of a new sharpening from beginning. Generally, it is desired that the display technique enable a user to accurately plan for use and avoid running out of usable grinding wheel lifetime in the middle of a sharpening Beyond the usage tracking information, the tag 204 may also be used to carry system setup parameters that the control unit 32 can read and then apply to operation. This programming-type approach can enable a single sharpener 10 having a generalized design to be used in a wide variety of ways. For example, the tag 204 may contain parameters for the rotational speed of the grinding wheel motor 80; the speed of translation of the carriage assembly 70 across the skate blade; and the magnitude of a normal grinding force (i.e., the force applied by the grinding wheel 36 in a direction normal to the bottom face of the skate blade 40). Employing customizable settings in this manner can support variability in the materials, diameters, and grits used for different grinding wheels 36. Larger wheel diameters for different skates, or different grits for different skate steels or surface finishes, will generally require different system settings (grinding wheel RPM and translation speed) for optimized use. In operation, the control unit 32 can read the parameters from the tag 204 and then apply the parameters prior to beginning a sharpening operation, such as by programming the appropriate controllers 132 (FIG. 6). This programmability may also promote compatibility as designs of the grinding wheels 36 evolve over time. For example, if an innovation in grinding wheel abrasives happens in 5 years and this requires different system settings, the wheels produced in 5 years will store corresponding values of operating parameters to enable existing sharpener systems 10 to properly adjust themselves to produce an optimal sharpening. Not only can these parameters be used to program the machine, the parameters can define an evolution of parameters over the life of the wheel. For example, a grinding wheel may exhibit a change in abrasiveness, which would result in a change in material removal rate over time, which can be compensated for by altering the rotation speed of the wheel motor, the translation speed, and/or the force applied, for example but without limitation. Any and all of these parameters, among others, could be defined and could vary over the recorded usage life of the grinding wheel. In one embodiment, the rotation speed dictated by the grinding wheel is defined by parameters stored on the wheel that define a polynomial curve for rotation speed as a function of the number of cycles that the grinding wheel has been used.

The identification tag 204 may also store user-specific settings to be used for sharpening operations, such as a default number of passes for a skate sharpening. The control unit 32 can read such values and then use them unless they are overridden by a specific current selection by the user. One user may sharpen relatively frequently and typically use a small number of passes, such as two, while another user may sharpen less frequently and typically use a larger number of passes, such as eight. The user interface preferably would enable a user to modify or update any such persistently stored values. Saving user-specific values on the grinding wheel 36 also enhances "portability" of the customization. A user can carry their own grinding wheel 36 and mount it for use in different sharpener systems 10 at different locations while still obtaining the same user-specific operation. For example, an organization such as a hockey club or rink operator can provide access to a sharpener system 10 and allow users to swap grinding wheels 36, so that each user receives a desired user-specific experience.

The sharpener system 10 may also have features for defeating counterfeiting or certain tampering with tags 204. For example, it might record the unique tag identifiers (e.g., tag serial numbers) for every tag 204 that has been used over some interval on that sharpener, as well as recording the number of passes that were last seen on the tag 204. If there is ever a time when a sharpener 10 sees a grinding wheel 36 that it has seen before but having remaining pass count greater than the number of remaining passes last seen on that wheel, the sharpener 10 could deem the grinding wheel 36 to be a counterfeit or tampered with and prevent its use. This might be done to insure that only grinding wheels 36 of sufficient quality are used, to obtain good sharpening results and avoid any unsafe conditions that could occur by using a defective or inferior grinding wheel 36. The system 10 may store the most recent passes remaining count as individual numbers or as percentages similar to the way the system displays the grinding wheel remaining life to the user.

Yet another possibility is for the tag 204 to store system fault data, i.e., data describing fault conditions that have occurred during a sharpening operation. This can help users interact with technical service to diagnose problems they may be having with their machine. A manufacturer or service organization might request that the user send a grinding wheel 36 to that organization for review. The grinding wheel is smaller and thus far cheaper and convenient to send than is the entire system 10. At the manufacturer or service organization, technicians can read fault data such as fault codes from the wheel 36. In another embodiment, the identification tag 204 may be compatible with readers such as near-field communications (NFC) readers such as used on smart phones and similar small computing devices. When the user experiences a system fault, the user can remove the grinding wheel 36 and place it near the computing device. The device might immediately launch an application or navigate to a particular web site to provide information to the user about the particular fault that is identified by the fault data stored on the tag 204. Another use for this type of interface is for repurchasing grinding wheels 36. The application or website launched by the device may provide product ordering functionality, enabling a user to easily obtain replacement grinding wheels 36 as existing grinding wheels are used up. In some configurations, the application or website, for example, may provide a tool for reading a grinding wheel life indicator and, in some configurations, for providing the ability to reorder grinding wheels. Such configurations can simplify the ordering process for operations or individuals with a large number of rings to track, monitor and replace, for example but without limitation.

Figure 15:
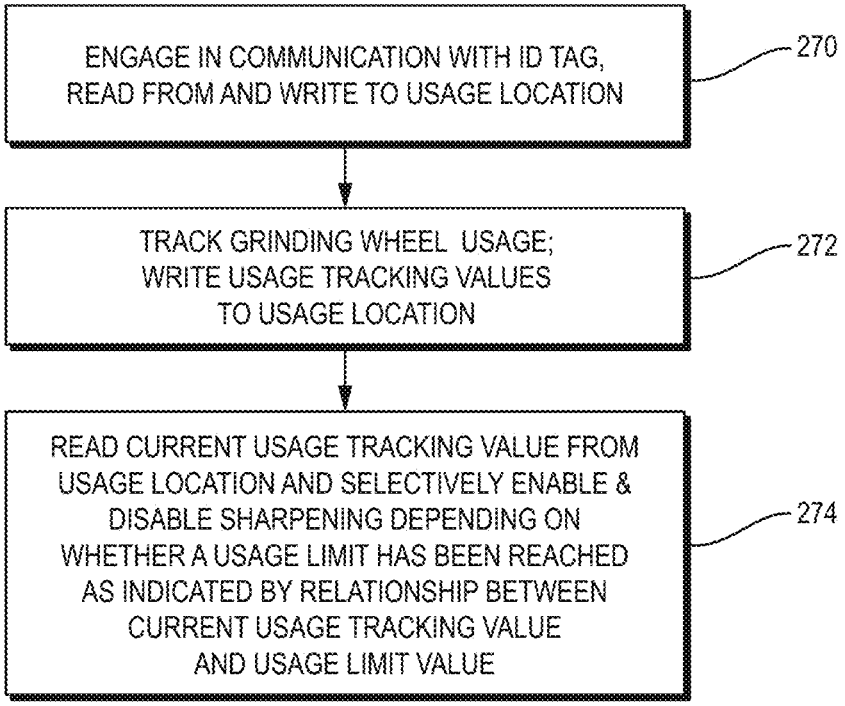
FIG. 15 is a flow diagram of operation of a sharpening system.

FIG. 15 provides a high-level description of system operation with respect to the identification tag 204. At 270, the system 10 engages in communication with the identification tag 204 which is attached to a grinding wheel 36 mounted in the sharpening system 10. As described above, the identification tag 204 has secure memory including a usage location for persistently and securely storing a usage tracking value. The communication both reads from and writes to the usage location.

At 272, the system 10 tracks usage of the grinding wheel 36 for sharpening operations and writes updated usage tracking values to the usage location as the grinding wheel 36 is used for the sharpening operations. Usage may be tracked by counting passes, for example, in which case it may be convenient for the usage tracking value to be expressed as a pass count. The usage value may directly indicate an amount of usage that has occurred, e.g., as an increasing count of passes, or it may be directly indicate an amount of usage remaining, e.g., as a decreasing count of passes.

At 274, the system 10 reads a current usage tracking value from the usage location and selectively enables and disables sharpening depending on whether a usage limit has been reached, as indicated by a relationship between the current usage tracking value and a predetermined usage limit value. When a decreasing or decremented usage value is used to indicate an amount of usage remaining, then the predetermined usage limit value can be used as the starting usage value, and the usage limit is reached when the usage value is decremented to zero. As indicated above, the system 10 also can read usage parameters (e.g., rotational speed, translation speed, etc.) for use during operation. Furthermore, one or more of those usage parameters may vary over the life of the grinding wheel such that, as the grinding wheel experiences wear over time, the operation of the system may be adjusted accordingly.

Figure 16:
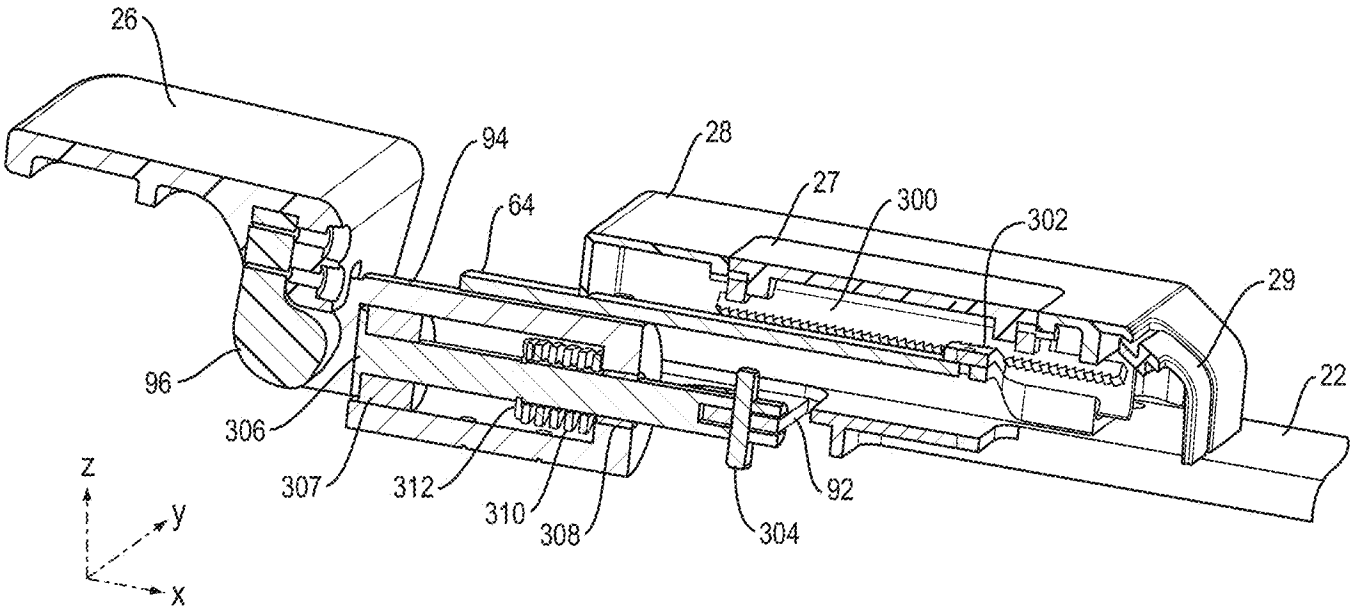
FIG. 16 is a section view of the platform area of the chassis.

FIG. 16 is a section view of the platform area 22 of chassis 14. The clamp paddle 26 and left slot cover 28 (FIG. 1) are shown, as well as various components of the blade clamping mechanism described above with reference to FIG. 5.

Slot Covers

Referring first to the slot cover 28, a button 27 is mounted for rocking on a horizontal axis and has a downward-extending rack 300 at the rear. The rack 300 engages a pawl 302 attached to the arch (rounded projections) 64. A spring (not shown) biases the button 27 so that its top is co-planar with the top of the slot cover 28 and the rack 300 engages the pawl 302, locking the slot cover 28 in place. In use, a user depresses a front part of the button 27 (see FIG. 1), lifting the rack 300 and enabling the slot cover 28 to slide left and right along the arch 64. The left slot cover 28 travels between a far left position and a more rightward position in which it covers the left end of the slot 24. A limit for the far left position is established by the rightmost wall of the slot cover 28 hitting a rightward wall or face of the arch 64 adjacent the platform 22. A limit for the rightward position is established by the left wall of the slot cover 28 hitting the pawl 302. There is a similar but mirrored arrangement for the right slot cover 28. While the slot covers 28 are designed for manual operation to move to a closed position, it also is possible to configure the skate sharpener such that the slot covers are biased to a close position and are moved apart for insertion of a skate blade. In some such configurations, a mechanical member, such as a lever or the like, can be used to hold the slot covers in the open position until a skate or skate blade is properly positioned. The slot covers are considered to be in an open position when positioned away from the skate blade or skate blade holder. The open position of the slot covers can also be referred to as a non-occluding position, and the closed position of the slot covers can be referred to as an occluding position. Additional details of the slot cover 28 are given below.

Skate Blade Clamping Details

Referring next to the blade clamping mechanism, as shown in FIG. 16, a pin 304 secures a vertex portion of the U-shaped pull rod fork 92 to the pull rod 102. The pull rod 102 extends through the clamp cylinder 94, terminating at a piston head 306. The pull rod 102 is disposed within bushings 307, 308. A spring 310 is disposed between one end of the body of the clamp cylinder 94 and an external retaining ring 312 on the pull rod 102. The spring 310 biases the pull rod 102 to the left in FIG. 16 such that, unless urged away from the end of the body of the clamp cylinder 94 closest to the handle 26, the piston head 306 is seated against that end of the body of the clamp cylinder 94.

When the clamp paddle 26 is in the position shown, the cam 96 presents a lower-radius face to the piston 306, and the spring 310 urges the pull rod 102 to a maximum retracted position, to the left in FIG. 16. The pull rod fork 92 is under tension and pulls the clamp jaws 90 (FIG. 5) in a closed position. The illustrated closed position, without a skate blade present, is not fully closed (i.e., clamp jaws 90 in contact with each other) yet the closed position, without a skate blade present, is not a position in which the clamp jaws 90 are spaced apart enough to receive a skate blade. If a skate blade is present then the clamp jaws 90 clamp the skate blade into place with a force geometrically related to the force created by the spring 310. This arrangement is referred to as a biasing mechanism and the force as a bias force.

A user opens the clamp jaws 90 by pushing downward on an outer part of the paddle 26, rotating it counterclockwise in the view of FIG. 16. The cam 96 has increasing radius in this direction and pushes the piston head 306 rightward against the force of the spring 310. This action releases the clamping force between the jaws 90 and skate blade if present, and pushes the pull rod fork 92 rightward pushing the jaws 90 apart. The jaws are fully open when a maximum-radius part of the cam 96 is contacting the piston head 306. This maximum-radius location can generally be anywhere in a range of about 10 degrees to 90 degrees from the closed position of FIG. 16. For smooth operation and good mechanical advantage it may preferably be somewhere in the smaller range of 40 degrees to 75 degrees. In one embodiment it is located at 60 degrees. As mentioned above, a configuration providing a detent action may be used. For example, the cam 96 may have a slightly flattened area at maximum-radius location for a slight detent action.

Figure 17:
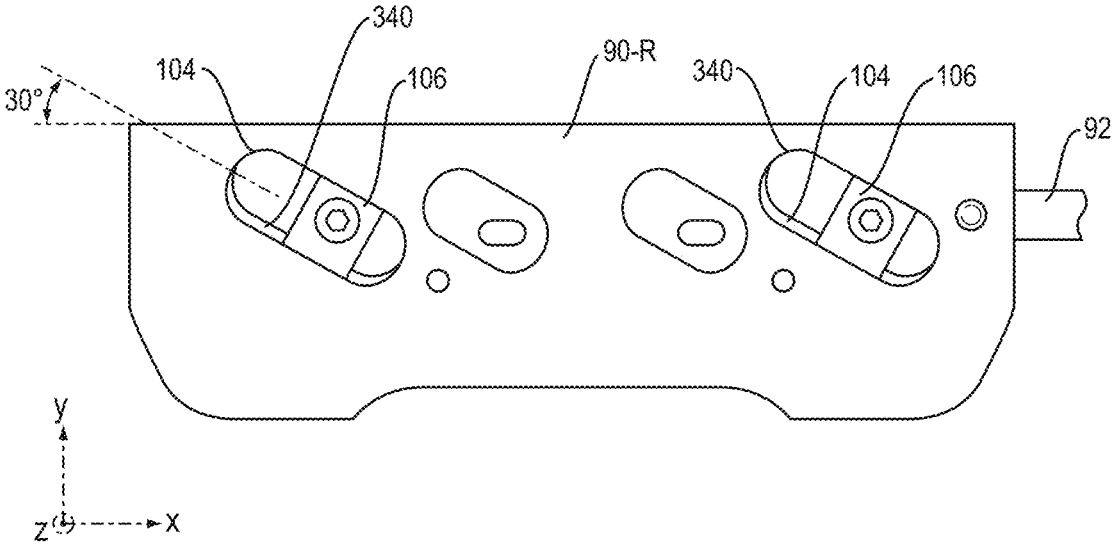
FIGS. 17 and 18 are plan views of clamping jaws.
Figure 18:
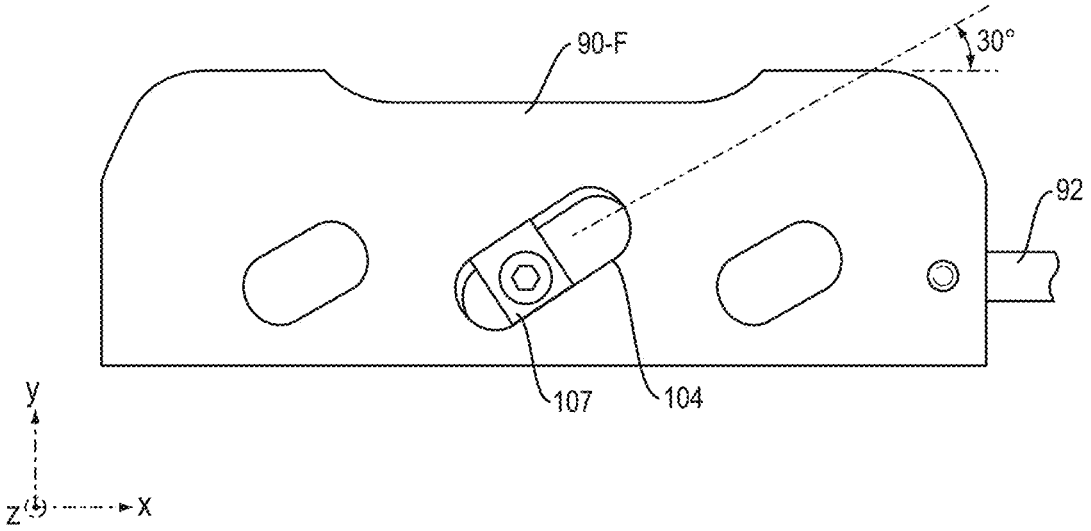
Figure 19:
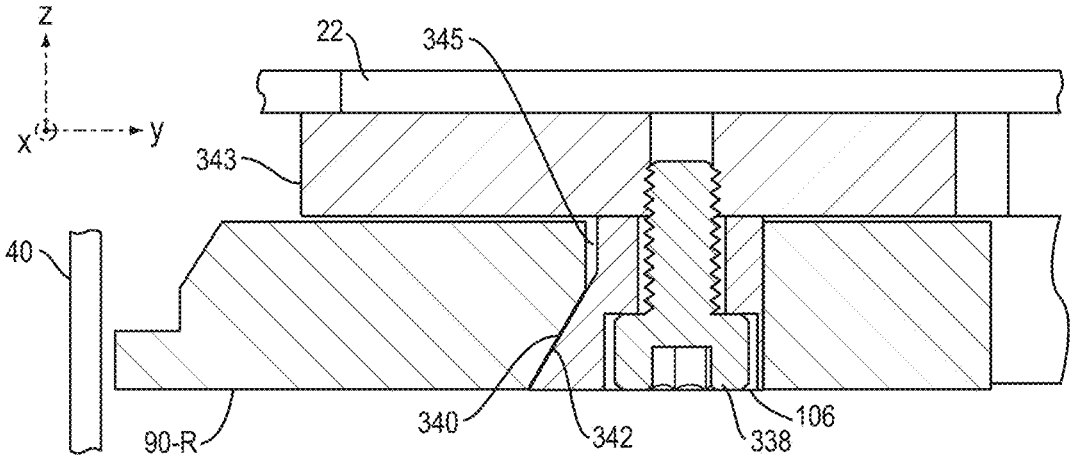
FIGS. 19, 20 and 21 are section views of clamping jaws and guide blocks.
Figure 20:
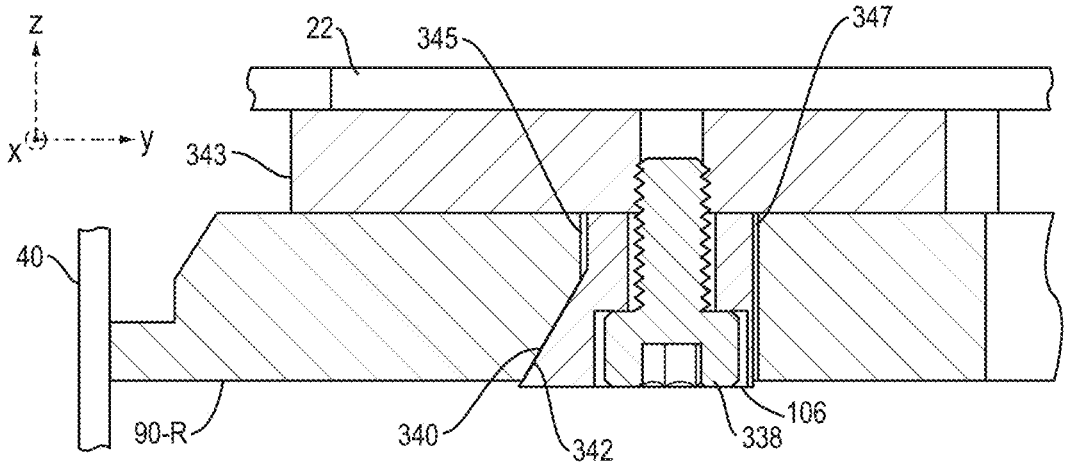
Figure 21:
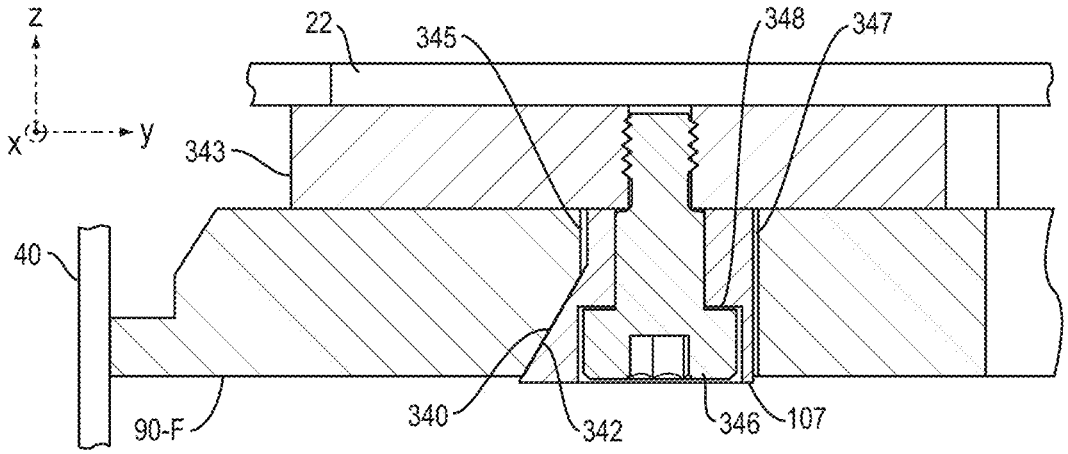

FIGS. 17 through 21 show details of the jaws 90 including connections to respective ends of the pull rod fork 92. FIGS. 17 and 18 show plan views of the bottoms of the rear and front jaws 90-R, 90-F respectively. FIGS. 19 and 20 show sections through a guide slot 104 and guide block 106 of the rear jaw 90-R, and FIG. 21 shows a section through a guide slot 104 and guide block 107 of the front jaw 90-F.

FIG. 17 shows the use of two guide blocks 106 at respective endmost slots 104 for the rear jaw 90-R. The slots 104 are oriented at approximately 30 degrees with respect to the long axis of the jaws 90 (X direction). In response to force exerted by the pull rod fork 92, the jaw 90-R slides along the guide blocks 106. When opening, the rear jaw 90-R moves upward and to the left in the view of FIG. 17, and when closing it moves in the opposite direction. The rear jaw 90-R maintains a fixed orientation substantially along the X axis. It establishes the orientation of the clamped skate blade, which should be highly co-planar with the X-Z plane of movement of the grinding wheel 36.

As shown in FIG. 18, the front jaw 90-F has a generally symmetrical configuration with respect to the rear jaw 90-R, and it moves symmetrically as well, i.e., downward and to the left when opening in the view of FIG. 18. However, the front jaw 90-F is secured with only one guide block 107, located in the center guide slot 104. As described more below, the guide block 107 is mounted in a manner permitting slight pivoting, while the guide blocks 106 for rear jaw 90-R are not. Thus, the front jaw 90-F also rotates slightly about the Z-direction axis of the single central guide block 107. This enables the front jaw 90-F to conform its orientation to that of the rear jaw 90-R when a skate blade is clamped between them. It will be appreciated that this configuration avoids issues that could occur if the front jaw 90-F had an orientation that was fixed but slightly different from that of the rear jaw 90-R due to normal mechanical tolerances. These issues include mechanical binding, uneven force across faces of the jaws (higher at one end than at the other), as well as inaccuracy in the orientation of the skate blade, adversely affecting sharpening quality. The illustrated configuration avoids these issues by allowing the rear jaw 90-R to serve as a mechanical reference and the front jaw 90-F to conform itself to that reference.

FIGS. 19 through 21 illustrate certain functionality provided by the configuration of a guide slot 104 (i.e., of its surrounding walls) and the guide blocks 106, 107. As shown, the jaws 90 are spaced from the platform 22 by respective spacer blocks 343 which are rigidly secured to the underside of the platform 22. The jaws 90 and guide blocks 106, 107 have a configuration that provides for spacing the jaws 90 slightly from the respective spacer blocks 343, enabling the jaws 90 to slide easily between open and closed positions. The configuration also provides for closing this spacing when the jaws 90 are brought into the closed position, so that they rest flush against the spacer blocks 343. This action makes the jaw positioning precise and accurate. It also reduces or eliminates the likelihood of the jaws 90 tilting about their longitudinal axes, which would tend to occur if the space were not closed up as the jaws 90 are tightened against the skate blade 40. Maintaining a predictable flat orientation of the jaws 90 provides for greater accuracy in the positioning of the clamped skate blade 40.

FIGS. 19 and 20 show details for the rear jaw 90-R. The guide blocks 106 for the rear jaw 90-R are fastened to the spacer block 343 by bolts 338. The jaw 90-R and guide block 106 have respective sloped or angled surfaces 340, 342 contacting each other. The jaw surface 340 is one side wall of the guide slot 104 (FIG. 17) in which the guide block 106 is located. FIG. 19 is a section view showing these surfaces 340, 342 as lines at the intersection with the Y-Z plane of the paper. Referring back to FIG. 17, the surfaces 340, 342 are also angled in the direction of the guide slot 104, which corresponds to a plane through the paper of FIG. 19, tilted about 30 degrees to the left of X-direction normal. In the view of FIG. 19, the front of the jaw 90-R and skate blade 40 are at the left. The jaw 90-R is pulled in the X direction out of the paper to be closed, and pushed in the opposite direction to be opened. The pulling and pushing cause corresponding leftward (closing) and rightward (opening) motion by action of the angled guide slots 104.

FIG. 19 shows that the combination of the thickness of the rear jaw 90-R, the width of the guide slot 104, and the height and width of the guide block 106 is such that the top of the jaw 90-R is slightly spaced from the bottom of the spacer block 343 in the illustrated position. This is a first condition in which the jaw 90-R is slack, i.e., not exerting a clamping force. This could be either a fully or partially open position. The jaw 90-R rests relatively loosely on the guide block 106 and is able to slide thereon without interfering contact with the spacer block 343. There is a slight space 345 between the jaw 90-R and guide block 106 as shown.

FIG. 20 is a similar view as FIG. 19 but in a second condition in which the rear jaw 90-R is pulled tightly by the pull rod fork 92 (FIG. 5) and exerting a clamping force on the skate blade 40. As the jaw 90-R encounters the skate blade 40 it experiences a rightward force causing it to ride up the surface 342 of the guide block 106 until the top of the jaw 90-R hits the bottom of the spacer block 343. This movement closes the space 345 and opens a separate space 347 on the other side of the guide block 106. Because the surfaces 340, 342 have precisely the same slope, the jaw 90-R automatically assumes a position in which its upper surface is flush against the bottom surface of the spacer block 343. As the motion ceases, the combined forces of the pull rod fork 92 and the skate blade 40 press and hold the jaw 90-R at this upward position, tight against the guide block 106. This action occurs consistently whenever the jaw 90-R is closed, and thus the rear jaw 90-R and skate blade 40 are consistently positioned.

The above motion reverses when the jaws 90 are opened. As the rear jaw 90-R is pushed in the X direction, clamping tension is released and it slides downward in the Z direction, closing the space 347 and returning to the position of FIG. 19 The configuration providing the space 347 in the closed position of FIG. 20 also provides for the slight looseness of the jaw 90-R that permits it to slide easily when slack.

FIG. 21 is an analogous view to that of FIG. 20 but for the front jaw 90-F, which is secured via only one guide block 107 as described above. The configuration and operation are essentially the same as for the rear jaw 90-R—the front jaw 90-F is pushed against the spacer block 343 and guide block 107 in the same manner, and has the same configuration providing for spaces 345 and 347. However, the guide block 107 is secured to the spacer block using a shoulder screw 346 in a tightly toleranced counter-bored hole of the guide block 107. The shoulder screw 346 and counter-bored hole of the guide block 107 are sized to create a slight gap 348, so that the guide block 107 is not secured tightly to the spacer block 343. Thus, the guide block 107 is free to rotate slightly about the Z-direction axis of the shoulder screw 346 to provide the above-described rotational compliance of the front jaw 90-F.

In the illustrated embodiment as described above with reference to FIGS. 19 through 21, the jaw closing direction (left or right) is perpendicular to the direction of the actuating force (out of the paper), and the slots 104 are angled accordingly to translate the actuating force to the clamping force. Also, the actuating force is a pulling force, essentially pulling each jaw 90 up the surface 342 of the guide blocks 106, 107. It will be appreciated that in alternative embodiments other configurations may be used, depending in part on the relative locations of the jaws and the force-generating actuator as well as the nature of the force as either compressing or tensioning the jaws. In particular, the slots 104 may be oriented at angles other than 30 degrees. Also, in the illustrated embodiment the jaw 90 is slightly thinner than the height of the guide block 106, but this is not essential.

In the illustrated embodiment the jaws 90 are urged against a lower or bottom surface of the spacer blocks 343, which are fixedly secured to the underside of the platform 22 of the chassis 14. More generally the jaws 90 are urged against a surface that is in some manner referenced to the chassis 14, i.e., having a fixed position with respect to the chassis 14. In an alternative embodiment, the jaws 90 might be secured directly to a surface of the chassis 14 itself, such as the bottom surface.

Figure 42:
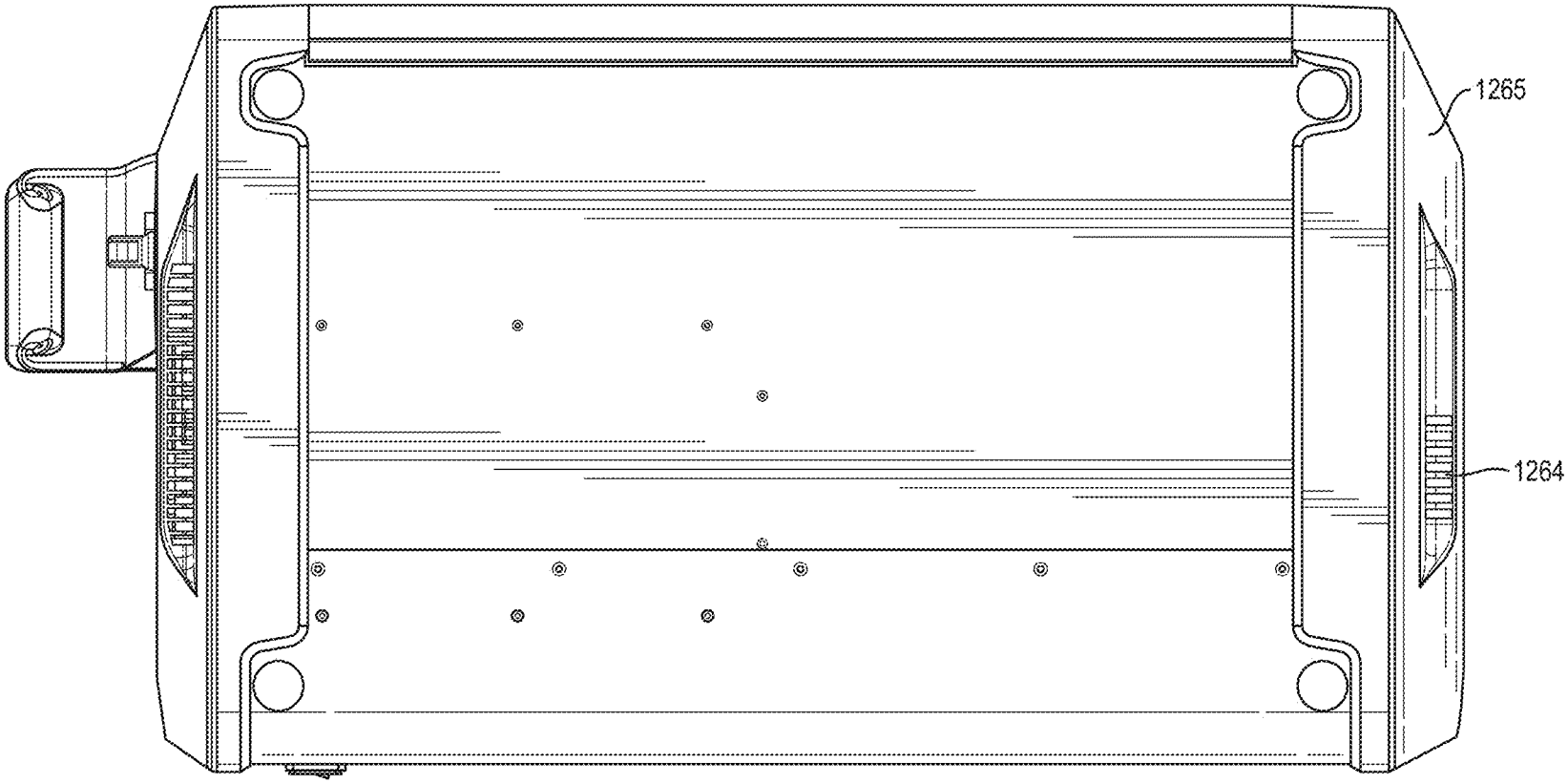
FIG. 42 is a bottom view of the skate sharpening system of FIG. 36.

With reference now to FIG. 42, a bottom view of another clamping mechanism 1088 is shown. The illustrated clamping mechanism 1088 broadly includes a paddle 1026 that is removably connected to a cam member 1096. The cam member 1096 is mounted to a shaft 1097 (see FIG. 44) to rotate relative to a horizontal axis such that a portion of the cam member 1096 can bear against a piston head 1306 (see FIG. 44) of a clamp piston that is contained within a clamp cylinder 1094. In some configurations, the cam member 1096 is pivotally or rotationally mounted to the clamp cylinder 1094 itself. A pull rod 1102 of the clamp piston extends beyond the clamp cylinder 1094 and couples to a pull rod yoke 1103. The pull rod yoke 1103 is connected to a pair of pull rod legs 1092. The pull rod legs 1092 are connected to the jaws 1090.

Figure 43:
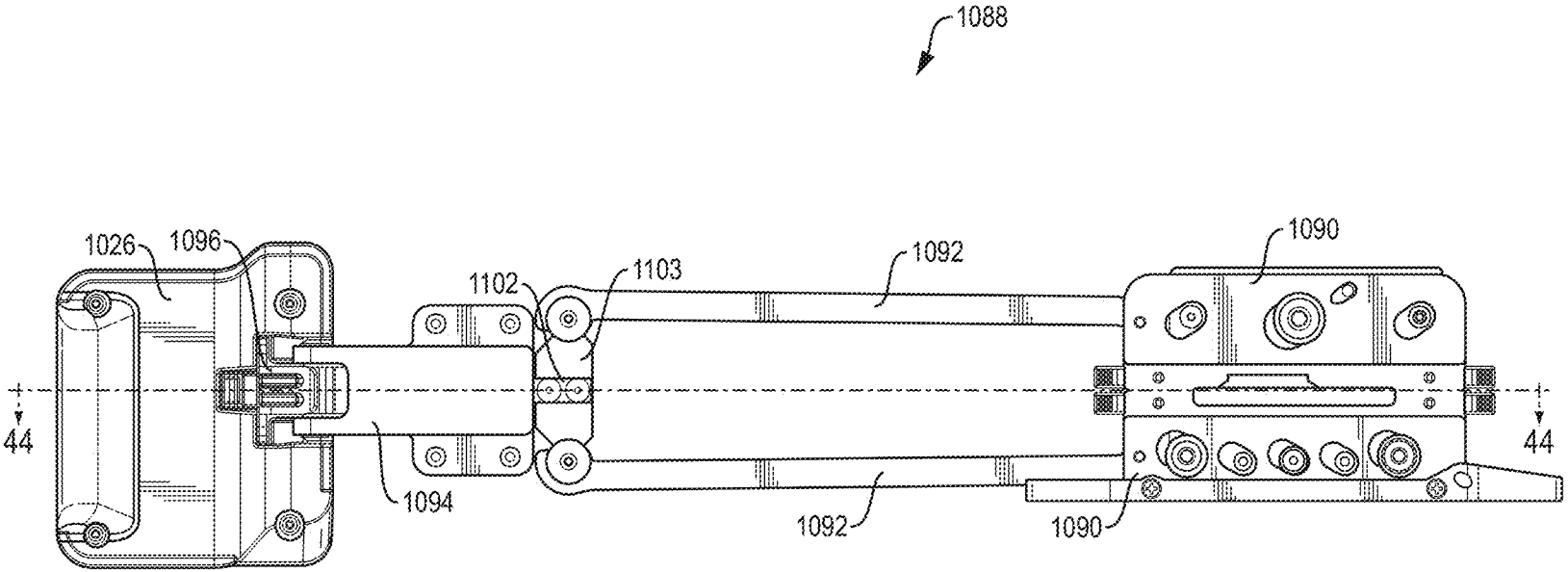
FIG. 43 is a bottom view of a skate clamping mechanism.

With the illustrated clamping mechanism 1088, the pull rod 1102 is urged to the left in FIG. 43 under the force of a biasing member that can be positioned within the clamp cylinder 1094. Any suitable biasing member can be used, such as a coiled compression spring, for example but without limitation. The pull rod 1102 forms a portion of a piston that is predominantly positioned within the clamp cylinder 1094. The cam member 1096, when rotated by pivoting the paddle 1026, bears against a head of the piston and forces the pull rod 1102 to the right against the biasing force of the biasing member. Rightward movement in FIG. 43 of the pull rod 1102 is translated through the yoke 1103 and the pair of pull rod legs 1092 to the jaws 1090.

Figure 44:
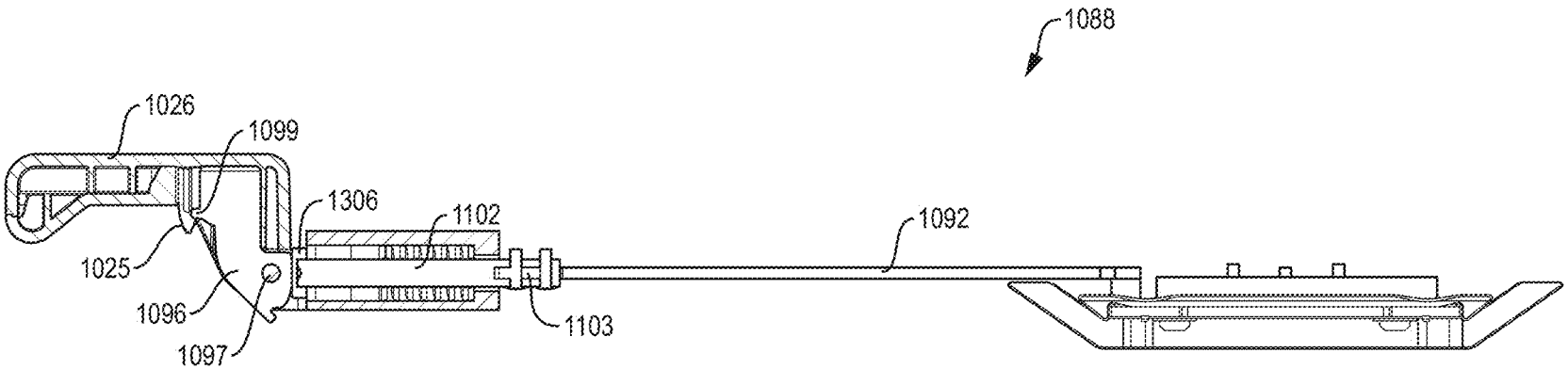
FIG. 44 is a front sectioned view of a skate clamping mechanism taken along the line 44-44 in FIG. 43.

In the illustrated configuration, the paddle 1026 is removable from the cam member 1096. In some configurations, the paddle 1026 is designed to slide off of the cam member 1096 in a vertical direction. Thus, in such advantageous configurations, the paddle 1026 would be prone to separate from the cam member 1096 if a user were to attempt to lift the skate sharpener 1010 using the paddle 1026. By allowing the paddle 1026 to separate in this manner, a risk of damage to the clamping mechanism 1088 caused by lifting from the paddle 1026 can be reduced or eliminated. In the illustrated configuration, as shown in FIG. 44, the paddle 1026 can include a recess or pocket that receives the cam member 1096 and the paddle 1026 and the cam member 1096 can have interlocking features. Any suitable interlocking construction can be used. In the illustrated configuration, the paddle 1026 has a flexible finger 1025 while the cam member 1096 has an embossment 1099. The finger 1025 and the embossment 1099 can be designed to snap-fit together such that an audible clip, snap or pop can be head to verify for the user that the paddle 1026 has been fully installed on the cam member 1096. In some configurations, the cam member 1096 can include a pocket that receives at least a portion of the paddle 1026. Other configurations also are possible keeping in mind a desire to couple together the paddle 1026 and the cam member 1096 in a manner that allows the two components to be used together to operate the clamping mechanism 1088. For example, the paddle 1026 and the cam member 1096 can slide apart in a horizontal direction or other direction other than vertical. Such configurations will not, however, result in the added advantage of reducing or eliminating the likelihood of the skate sharpener 1010 being lifted by the paddle 1026. Furthermore, providing an easily removed and easily reconnectable paddle improves the portability, transportability and packing of the sharpener. In some configurations, the size of a box or carrying case can be reduced simply because the paddle is easily removed and reinstalled.

Figure 45:
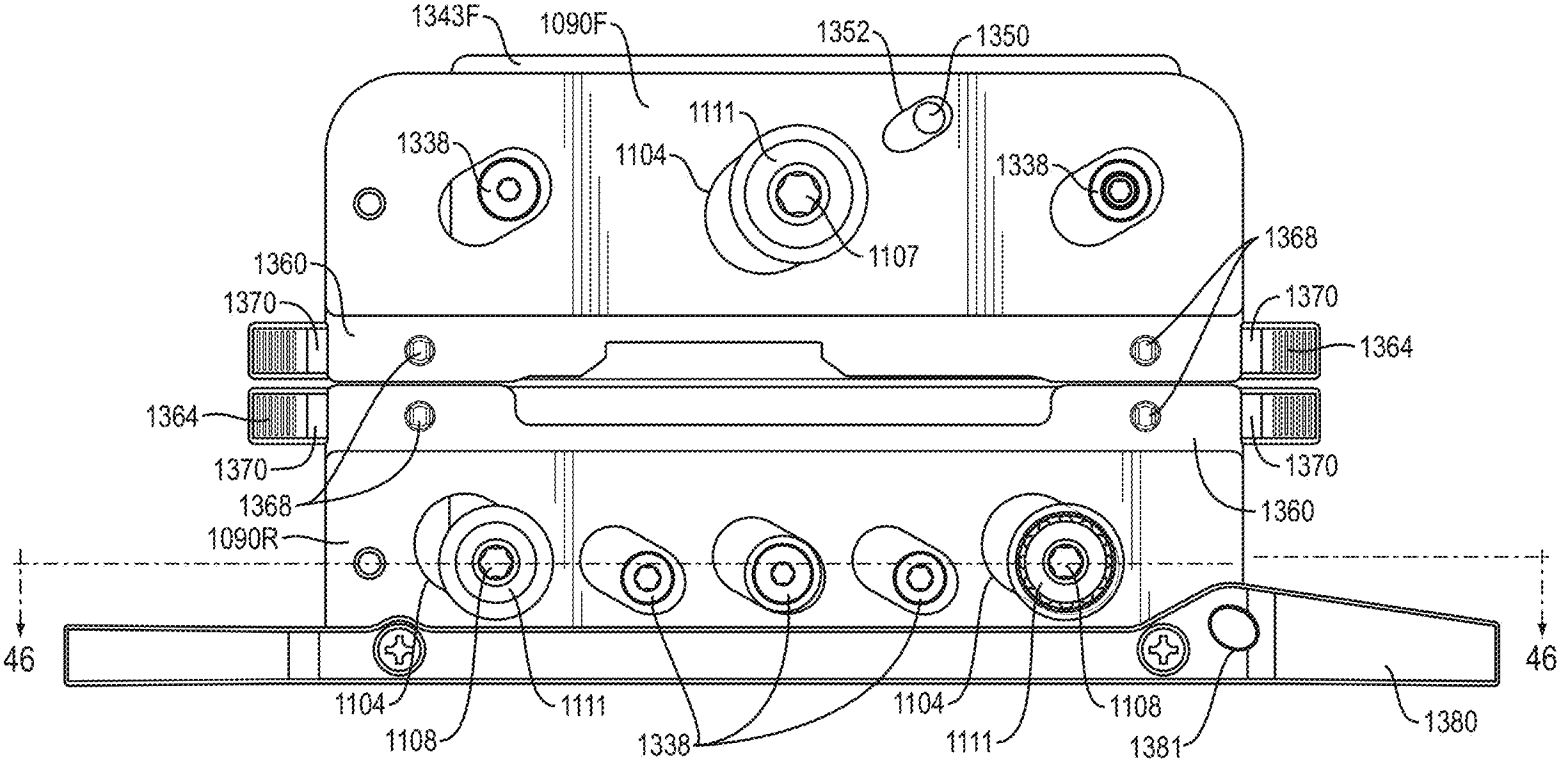
FIG. 45 is a bottom view of a skate clamp.

With reference now to FIG. 45, an enlarged bottom view of the jaws 1090F, 1090R is presented. The jaws 1090F, 1090R differ from the jaws 90F, 90R shown in FIGS. 17 and 18 mainly in the manner in which the jaws 1090F, 1090R are secured for movement. As with the configuration of FIGS. 17 and 18, the jaws 1090F, 1090R maintain a structure by which one of the jaws 1090F is secured to pivot about a single location 1107 while the other of the jaws 1090R is secured in two spaced apart locations 1108. In the illustrated configuration, one of the locations 1107 is disposed between the other two locations 1108. In the illustrated configuration, the locations 1107, 1108 form a triangle. In the illustrated configuration, the locations 1107, 1108 form a triangle with the largest distance between the centers of the locations 1107, 1108 being the distance between the centers of the locations 1108 on the same jaw 1090R. In the illustrated configuration, the location 1107 is offset toward the location 1108 on the right in FIG. 45 (i.e., the location 1107 is not equidistant from both of the locations 1108). Other configurations are possible.

Figure 46:
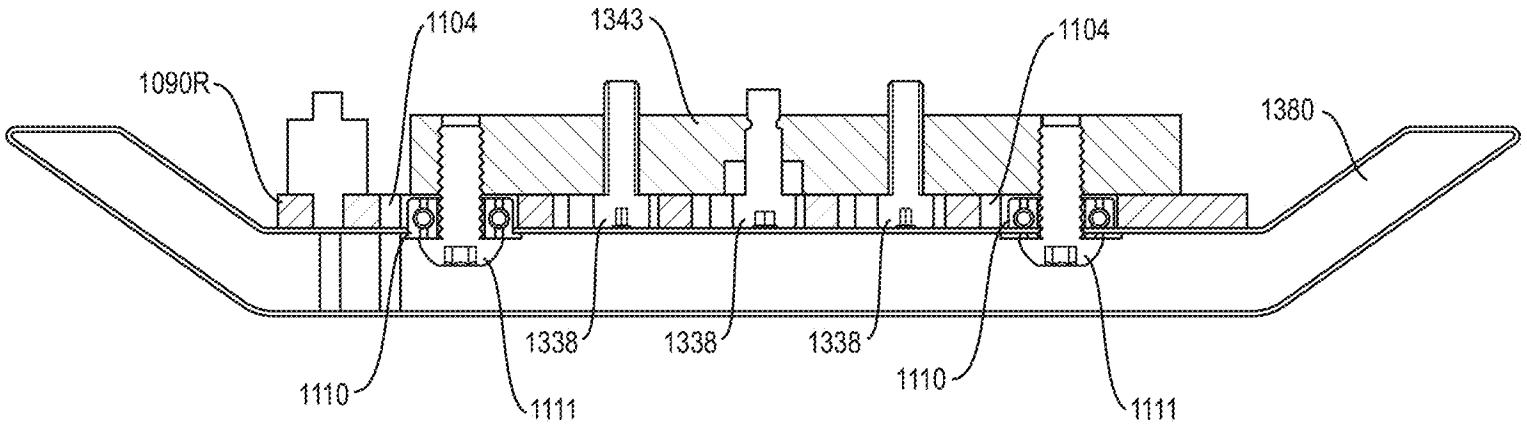
FIG. 46 is a front sectioned view of the skate clamp of FIG. 45 taken along the line 46-46 in FIG. 45.

As shown in FIG. 46, the locations 1108 can include a flanged bearing 1110 or the like secured in position within a recess 1104. In some configurations, a shim can be positioned between the bearing 1110 and the spacer block 1343F, 1343R. The bearing 1110 can be secured in positon using a button head socket cap screw 1111, or another other type of threaded fastener or the like. Similarly, at the pivot location 1107 of the front jaw 1090F, the location 1107 can include a bearing secured in position with a button head socket cap screw 1111, or another other type of threaded fastener or the like. The use of bearings 1110 in place of the blocks used in FIGS. 17 and 18 improves the life and performance of the jaws 1090F, 1090R. The bearings 1110 reduce sliding friction compared to the blocks used in FIGS. 17 and 18. The blocks, when operating as desired, would pull the jaws 90F, 90R tight against the spacer blocks 343. The bearings 1111 do not cause the jaws 1090F, 1090R to be drawn up tight against the spacer blocks 1343F, 1343R but the bearings 1111 provide consistent flush engagement between the jaws 1090F, 1090R and the skate blade, when present.

Figure 48:
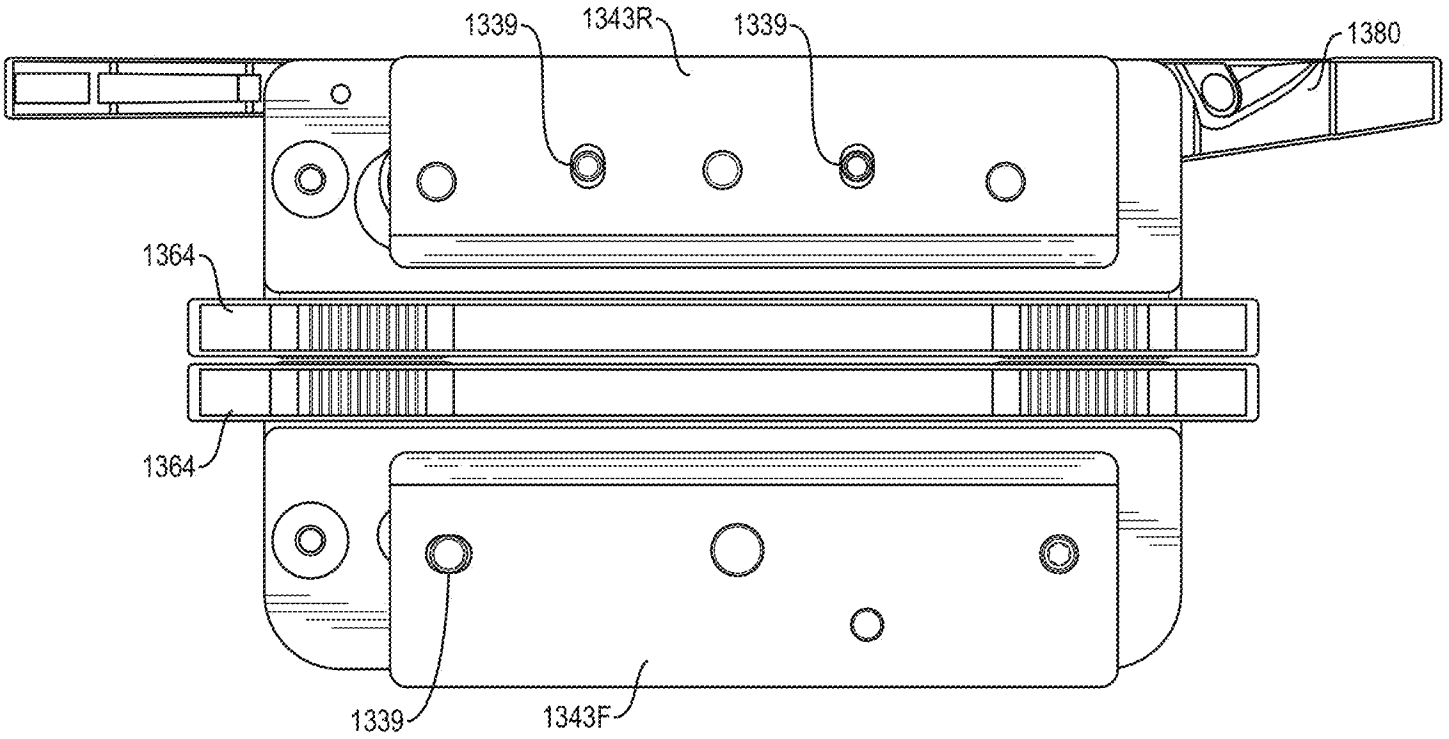
FIG. 48 is a top view of the skate clamp of FIG. 45.

In addition, to provide fine adjustment of the jaws 1090F, 1090R during manufacture, the jaws 1090R, 1090R are secured in position relative to the spacer blocks 1343F, 1343R using fasteners 1338. These fasteners 1338 can be secured to the spacer blocks 1343F, 1343R. In some configurations, as shown in FIG. 48, to provide adjustment to the orientations of the jaws 1090F, 1090R relative to each other, one or more of the fasteners 1338 can be secured in oblong openings formed within the spacer blocks. For example, the left opening in the forward spacer block 1343F, 1343R in FIG. 45 can be elongated in the left to right direction while the two openings adjacent to the bearing locations 1108 in the rearward spacer block 1343F, 1343R in FIG. 45 can be elongated in the up to down direction. Through the use of the elongated openings in the spacer blocks 1343F, 1343R, the angular orientation of each of the jaws can be corrected or finely adjusted during manufacture or repair.

In some configurations, one or both of the jaws 1090F, 1090R can be provided with one or more additional motion confining element. In the configuration illustrated in FIG. 45, a dowel 1350 can project from the spacer block 1343F, 1343R into a slotted opening 1352 formed in the forward jaw 1090F. Other configurations are possible keeping in mind a desire to control relative pivoting of the two jaws 1090F. 1090R to enable the jaws 1090F, 1090R the ability to abut an interposed skate blade with generally equal force being contributed by each end of the jaws 1090F, 1090R.

Figure 47:
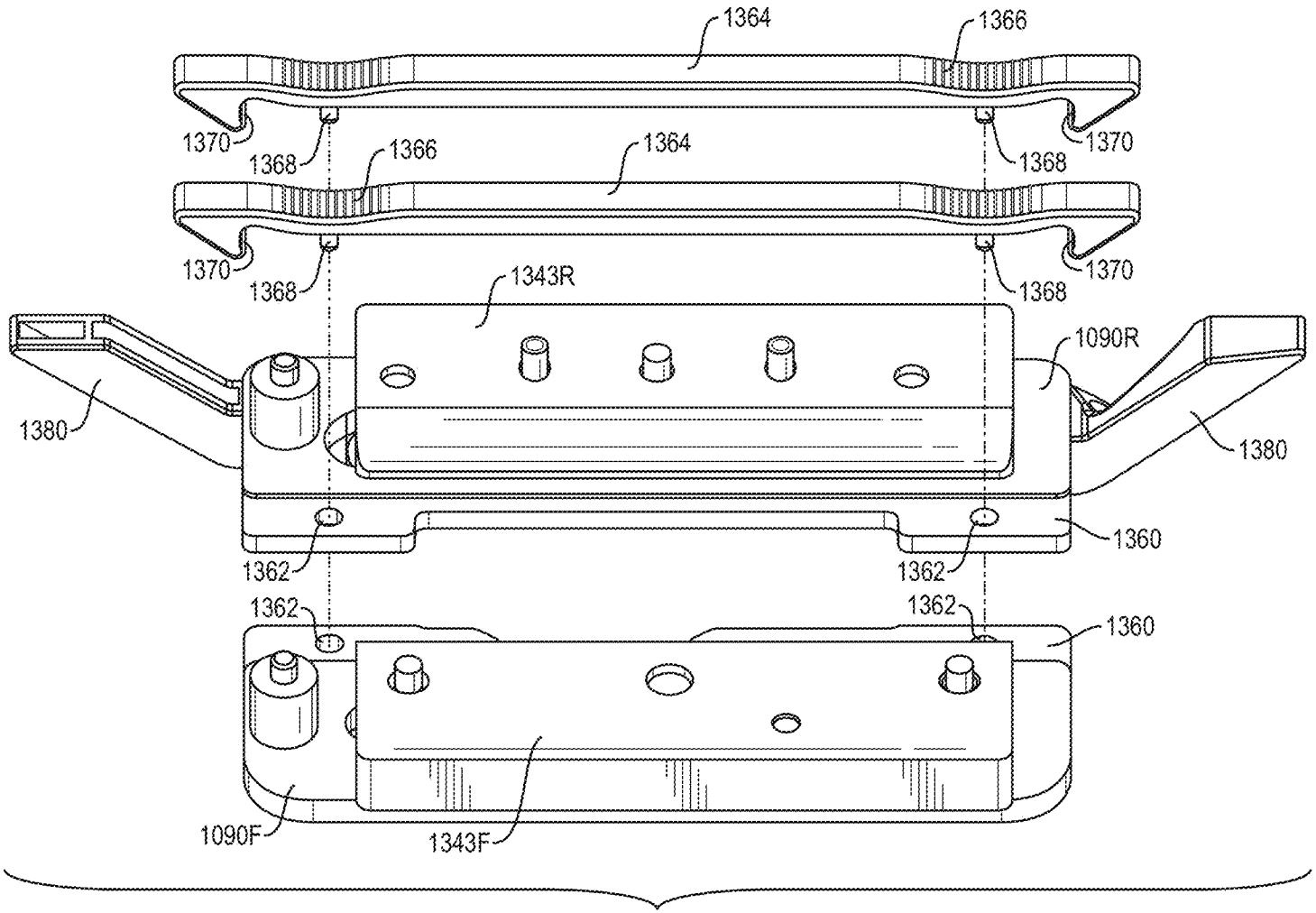
FIG. 47 is an exploded perspective view of the skate clamp of FIG. 45.

With reference to FIGS. 45 and 47, the jaws 1090F, 1090R have a stepped jaw configuration. In other words, a land portion 1360 is defined on each of the jaws 1090F, 1090R. The land portion 1360 results from the presence of a small step from a main body of the respective jaw 1090F, 1090R. The land portions 1360 can include one or more aperture or opening 1362. The openings 1362 can be symmetrically disposed along the land portion 1360 in some configurations.

As shown in FIGS. 45 and 47, the jaws 1090F, 1090R can be provided with a removable jaw riser 1364. The jaw risers 1364 can be installed on the jaws 1090F, 1090R to elevate an abutment surface that will support a goalie skate or another skate (e.g., a smaller skate, such as a small child's skate) during a sharpening operation. By lifting the skate with the risers 1364, it is possible to take into account differences among varying skate types (e.g., skater v. goalie) while maintaining the use of a smaller diameter grinding wheel, the scoop bumper switches and the like. For example, in the case of a small skate, the boot/skate holder design may result in a construction that may not consistently register against the scoop bumper and use of the jaw risers can improve the consistency of registration against the scoop bumper.

The illustrated jaw risers 1364 have a contoured upper surface 1366. The contoured upper surface 1366 can include one or more indicators to help guide a user for placement of a finger or thumb during installation and/or removal. Moreover, the contoured surface provides a region of reduced cross-section that allows increased flexure in the region of the indicators.

In the illustrated configuration, pins 1368 are disposed directly below one or more of the contoured regions 1366. The pins 1368 are received within the openings 1362 formed on the land portions 1360 of the jaws 1090F, 1090R. The pins 1368 can help guide the user to correct installation. The pins 1368 also can reduce or eliminate the likelihood of the jaw risers 1364 sliding laterally off of the land portions 1360 when installed correctly.

The jaw risers 1364 also include hooked ends 1370. The hooked ends 1370 enable the jaw risers 1364 to be secured to the jaws 1090F, 1090R. In some configurations, the hooked ends 1370 can be designed and configured to snap-fit to the land portions 1360 of the jaws 1090F, 1090R. Other configurations also are possible.

Figure 49:
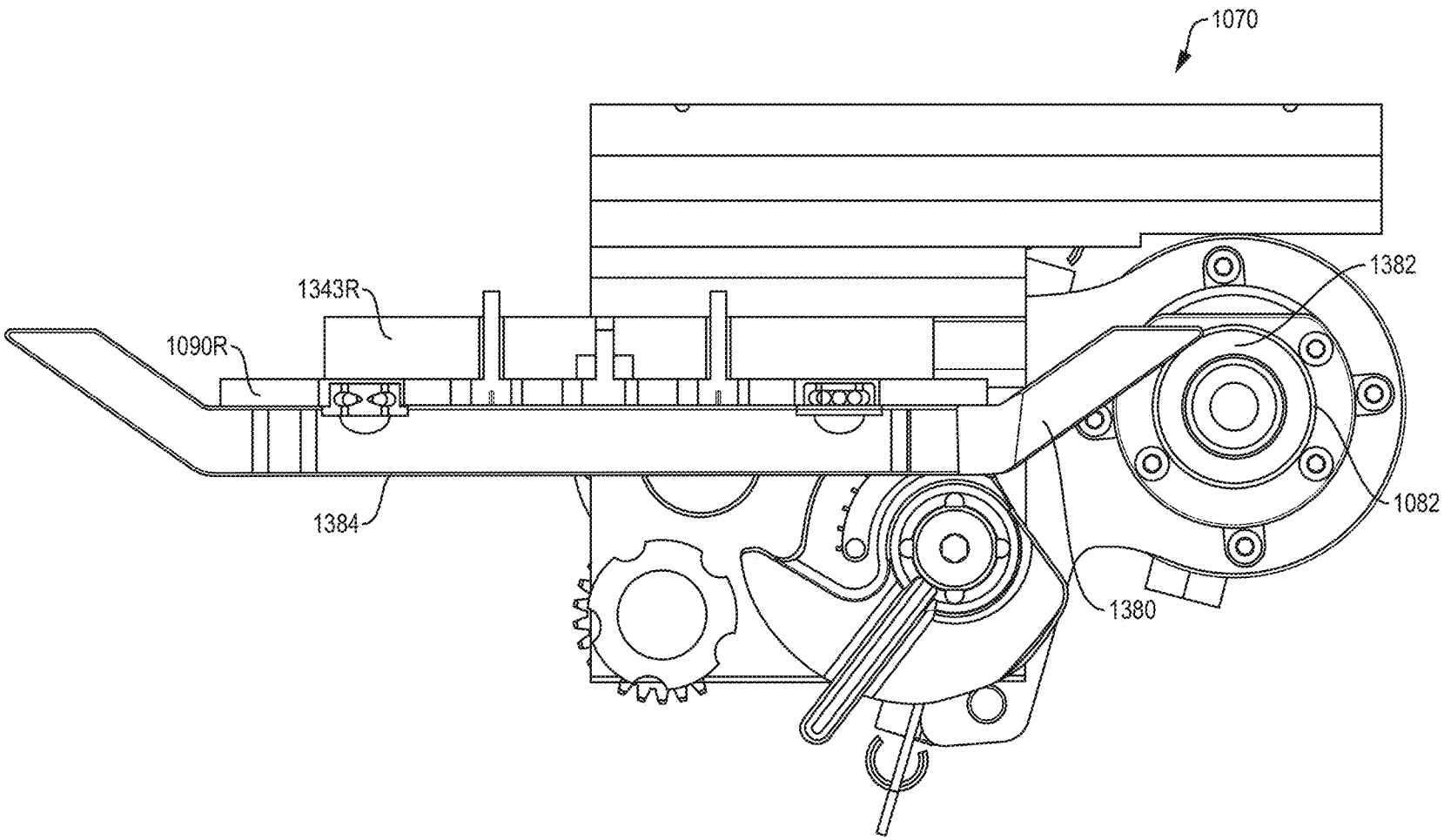
FIG. 49 is a front view of the skate clamp of FIG. 45 together with a carriage and grinding wheel.

With reference to FIGS. 45 and 46, the illustrated configuration also comprises a jaw guard 1380. The jaw guard 1380 can be sized and positioned to reduce or eliminate the likelihood of contact between the grinding wheel 1036 and the jaws 1090F, 1090R. In the event that the skate sharpener 1010 is operated without a skate being positioned within the jaws 1090F, 1090R, it would be possible for the grinding wheel 1036 to grind the bottom surface of the jaws 1090F, 1090R without the presence of the jaw guard 1380. The jaw guard 1380 contacts a portion of the skate sharpener 1010 that moves along with the grinding wheel 1036. For example, in the configuration illustrated in FIG. 49, the jaw guard 1380 is sized and positioned to contact the spindle 1082 that connects to and rotates the grinding wheel 1036. As such, upon translation of the carriage assembly 1070 in the region of the jaws 1090F, 1090R without a skate present, the spindle 1082 will ride along the jaw guard 1380, which will urge the spindle 1082 downward and maintain a clearance between any grinding wheel secured to the spindle 1082 and the bottom surface of the jaws 1090F, 1090R.

The illustrated jaw guard 1380 is secured to the rear jaw 1090R. In some configurations, the jaw guard 1380, when positioned within the skate sharpener 1010, has an uppermost contact portion 1382 that is vertically higher than a rotational axis of the grinding wheel (i.e., which is coaxial with the spindle 1082 in the illustrated configuration) in its uppermost position and a lowermost contact portion 1384 that is vertically lower than a lowermost portion of the jaws 1090F, 1090R. Preferably, the lowermost contact portion 1384 is a distance below the jaws 1090F, 1090R that is sufficient to ensure that the grinding wheel 1036 does not contact the bottom of the jaws 1090F, 1090R. In this manner, the grinding wheel will be forced downward a sufficient distance to clear the bottom of the jaws 1090F, 1090R.

Slot Cover Details

Figure 22A:
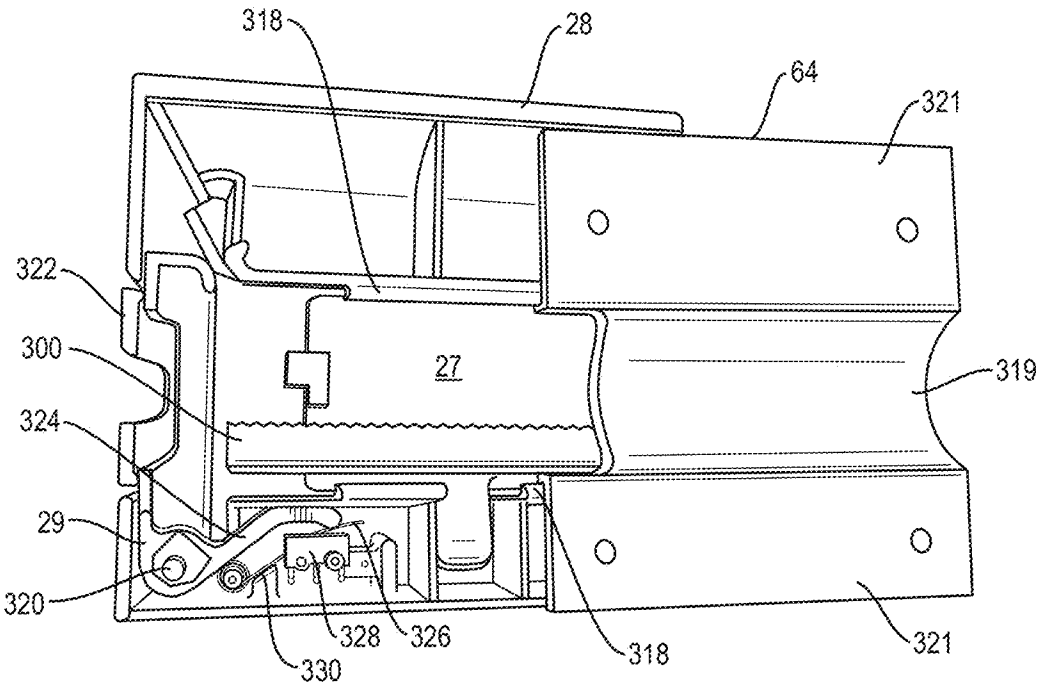
FIG. 22A is a bottom view of a slot cover.
Figure 22B:
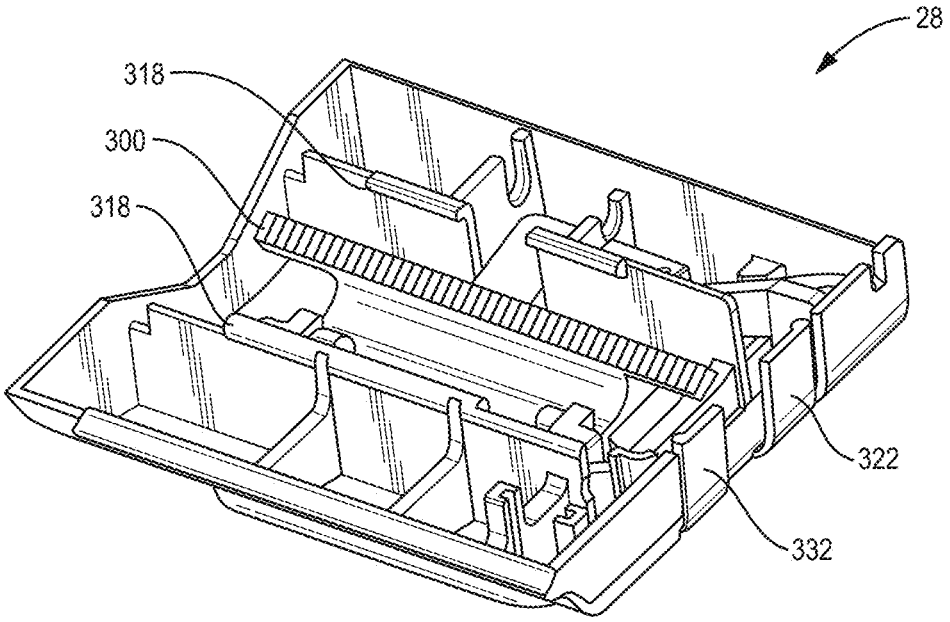
FIG. 22B is another bottom view of the slot cover.
Figure 22C:
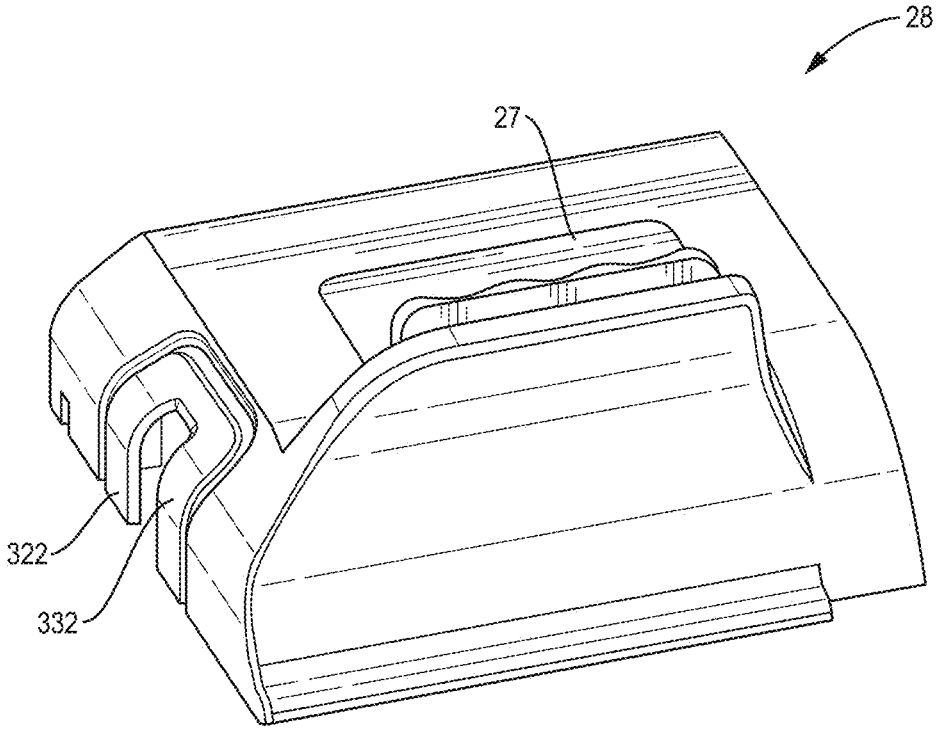
FIG. 22C is a perspective view of the slot cover.
Figure 22D:
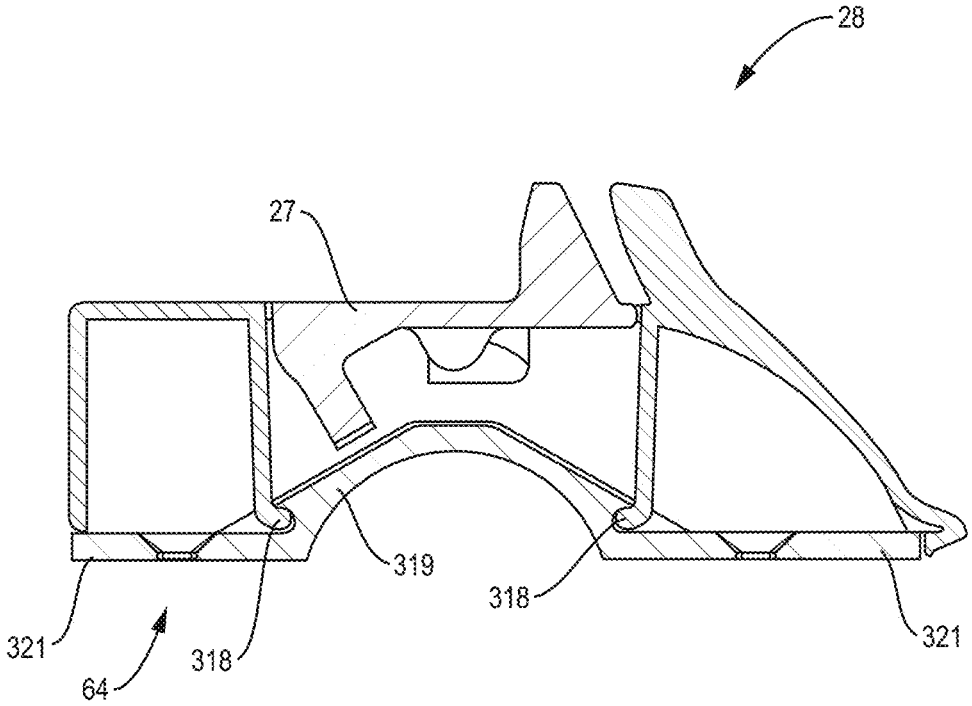
FIG. 22D is an end view of the slot cover and a portion of the platform area.

FIG. 22A is a bottom view of a slot cover 28 and an arch 64 on which it is captured. FIGS. 22B and 22C are additional views of the slot cover 28 while FIG. 22D is a simplified view showing the slot cover 28 engaged with the arch 64.

With reference now to FIG. 22A, the bottom of the button 27 is visible, including the rack 300 that moves in and out of the page in this view when the button 27 is operated as described above. The slot cover 28 is retained on the arch 64 by a latch-like rail mechanism including inner edges 318 of the slot cover 18 that fit within corresponding elongated grooves on the upper surface of the arch 64 where the central rounded portion 319 meets the lateral flat portions 321. The inner edges 318 act as fingers that slide within the generally U-shaped channels defined by the elongated grooves on the upper surface of the arch 64. The connection between the slot cover 28 and the arch 64 is best shown in FIG. 22D.

In the illustrated embodiment, the bumper 29 is attached to the body of the slot cover 28 (at lower left corner in FIG. 22A). The attachment is with a pin or similar fastener 320 that permits the bumper 29 to rotate about a generally vertical rotational axis. A face portion 322 contacts a skate blade holder in operation as described above (FIG. 1 and related description). Another portion 324 extends to an actuation lever 326 of a limit switch 328. The bumper 29 is biased (counterclockwise in this view) by a spring 330. The limit switch 328 is wired to the controller 32 (FIG. 6) to enable the controller 32 to sense its electrical state (open or closed). The wires are omitted in FIG. 22 for ease of illustration. In some configurations, however, the limit switch 328 is connected to the controller 32 using thin flexible silicone wires (e.g., 26 AWG). Other configurations also can be used.

In operation, the limit switch 328 is electrically open by default. In addition, the actuation lever 326 is held away from actuating the limit switch 328 by the mechanical biasing action of the spring 330. When the face portion 322 of the bumper 29 is depressed (e.g., brought into contact with a skate blade or skate blade holder), the bumper 29 rotates (clockwise in this view) and the arm 324 depresses the limit switch lever 326, causing the limit switch 328 to change from electrically open to electrically closed. If the cover moves even further into engagement with the skate or skate blade holder, the over-travel would be taken up by bending of the leg 324 that engages the switch 328.

When the face portion 322 of the bumper 29 is no longer depressed (e.g., the skate blade or skate blade holder is removed or the cover 28 is moved away from the skate blade or skate blade holder), the spring 330 acts to return the bumper 29 to the original position and the arm 324 stops depressing the limit switch lever 326, which returns the limit switch 328 to the normally electrically open state.

The state of the limit switch 328 as open or closed is sensed by the controller 32. In one embodiment, sharpening operation is permitted only when the limit switch 328 is sensed as electrically closed, which normally occurs when a skate blade is clamped in position and the slot covers 28 have been moved inward to contact the skate blade holder. In these operating positions the slot covers 28 cover the outer ends of the slot 24 that would otherwise be open. The operating position of the slot cover 28 can also be referred to as an occluding position. In the operating position, the position of the slot covers 28 can reduce, limit, or eliminates the likelihood of the introduction of any objects through the outer ends of the slot 24, where such objects might harmfully contact the rotating grinding wheel 36 as it moves along the slot 24, during a sharpening operation. If the limit switch 328 of either slot cover 28 is sensed as open, which normally occurs when either a skate or skate blade holder is not present or both slot covers 28 have not been moved inward to their operating positions, the controller 32 prevents sharpening operations, i.e., provides no electrical drive to the grinding wheel motor 80 and the carriage motor 260. With these motors not rotating, it is safer to introduce objects (such as a skate blade during mounting, for example) into the slot 24. By using the configuration described, a failure of the switch or of the switch actuating mechanism would result in the controller 32 detecting that the skate sharpener 10 is not reading to sharpen.

With reference to FIG. 22C, the face portion 322 of the bumper 29 incorporates a lighting feature 332. The lighting feature 332 can comprise a light pipe that is in optical communication with an LED or other light source. In some configurations, the lighting feature 332 comprises an LED or other light source that is positioned adjacent to the bumper 29 and the bumper or at least a portion of the bumper 29 can be formed of a translucent material with a painted mask on the front. Any other suitable lighting feature can be used. The lighting feature 332 is disposed on or around the face portion 322. In some configurations, the lighting feature 332 is positioned such that the lighting feature 332 illuminates an outline of the face portion 322 of the bumper 29.

The lighting feature 332 can be always on when the slot cover 28 is not in contact with a skate blade or a skate blade holder. In other words, the lighting feature 332 can direct the user's attention to the need to close the slot cover 28 prior to initiating operation of the skate sharpener 10. When the slot cover 28 has been moved into engagement with the skate blade or skate blade holder, the lighting feature 332 is turned off. If a user attempts to start a skate sharpening operation without closing the slot covers 28, the lighting feature 332 will flash to direct the user's attention to the need to close the slot covers 28 and, as discussed directly above, the controller will not initiate the skate sharpening operation until the slot covers are moved into position in engagement with the skate blade or skate blade holder. In some configurations, the lighting feature 332 is turned off, or an intermittent flashing is started or stopped, when the slot cover 28 has been moved into engagement with the skate blade or skate blade holder. Any other suitable attention directing configurations can be used.

There are various alternatives to the configuration described above. An alternative to the bumper 29 may be a piston-like mechanism that moves linearly to actuate a switch, instead of rotating about a fixed pivot point as in the above. It is not necessary to use a limit switch with an actuation lever; in an alternative arrangement, the bumper 29 (or analogous member) may directly push on the button of a limit switch. Also, in some embodiments, a separate spring 330 may not be required. It may be possible to rely on the spring of a limit switch to provide a bias or return force. However, it may be desirable to use a separate spring to provide for adjustment of either/both the range of motion and actuation force of the bumper. In yet another alternative, a contactless switch such as an optical emitter-detector pair could be used, with the skate or skate blade holder breaking the optical path to trigger the switch.

In the illustrated embodiment the slot covers 28 are affixed and always present, but in an alternative embodiment they could be separate components that are placed and locked onto the ends of the skate or skate blade holder by the user prior to sharpening. Also, while in the illustrated embodiment the slot covers 28 move by sliding, they could alternatively move by rotating on a hinge, telescoping, or rolling out (like a breadbox or garage door).

As mentioned above, slot cover designs that differ from those shown in FIGS. 1 and 22A-22D also can be used. For example, with reference to FIGS. 50-53, another slot cover configuration 1028 will be described. The second slot cover configuration is shown and described in U.S. Provisional Patent Application No. 62/129,095, filed on Mar. 6, 2015 and entitled SKATE BLADE SHARPENING SYSTEM WITH PROTECTIVE COVERS, which is hereby incorporated by reference in its entirety.

The slot cover 1028 has a body 1313 that can be connected to the front platform portion 22 of the skate sharpener. Disposed along one side of the body 1313 is an opening 1314 sized and configured to receive at least a portion of a skate blade or a skate blade holder (not shown). The opening 1314 preferably extend to the lowermost portion of the body 1313 such that a full doorway is defined by the opening 1314.

The opening 314 is generally closed by a door or bumper 1322. The bumper 1322 is sized and configured to contact the skate blade or skate blade holder. The bumper 1322 in this configuration is designed to pivot about a generally horizontal axis (i.e., different from the generally vertical axis of the bumper 322 shown in FIG. 22A). Thus, the bumper 1322 is designed to pivot about a top portion of the bumper 1322 (i.e., parallel to the Y-axis of the machine). In some configurations, the bumper 1322 pivots on a steel dowel.

The bumper 1322 has a leg 1324 that is connected to the bumper 1322 such that rotation of the bumper 1322 causes rotation of the leg 1324. Rotation of the leg 1324 brings the leg 1324 into and out of engagement with a switch 1328. In some configurations, the switch is configured to an electrically open state when the bumper 1322 is not depressed. For example, the switch 1328 can be mechanically pushed shut without a skate present but the switch 1328 is electrically open in this state. When brought into contact with a skate blade or skate blade holder, for example, the switch 1328 can be relieved or mechanically released and the switch 1328 can transition to an electrically closed state, thereby indicating the presence of the skate. In some configurations, the leg 1324 is in engagement with a lever or contact location 1326 of the switch 1328 until the bumper 1322 contacts a skate blade, skate holder or the like, which causes the leg 1324 to rotate away from the switch 1328. The rotation of the leg 1324 away from the switch 1328 causes the switch 1328 to go to an electrically closed state. This configuration enables the switch 1328 to close the circuit when the bumper 1322 is depressed or otherwise in contact with a skate blade, skate blade holder or the like. The switch can be configured such that a very short travel distance of the leg 1324 is all that is needed to open or close the electrical circuit.

The leg 1324, the bumper 1322 or both can be biased into the closed position. In some configurations, a biasing member biases the bumper 1322 into a closed position, which results in the leg 1324 being also biased into the closed position. In the some configurations, the biasing member 1330 is a torsion spring. In the illustrated configuration, two torsion springs are provided such that the bumper 1322 can be loaded on each lateral side equally. The force provided by the biasing member(s) 1330 can be selected to provide sufficient force on the switch 1328 to maintain the switch in the closed position unless the bumper 1322 is brought into contact with a skate blade, a skate blade holder or the like. Other biasing members or mechanisms also can be used.

Figure 51:
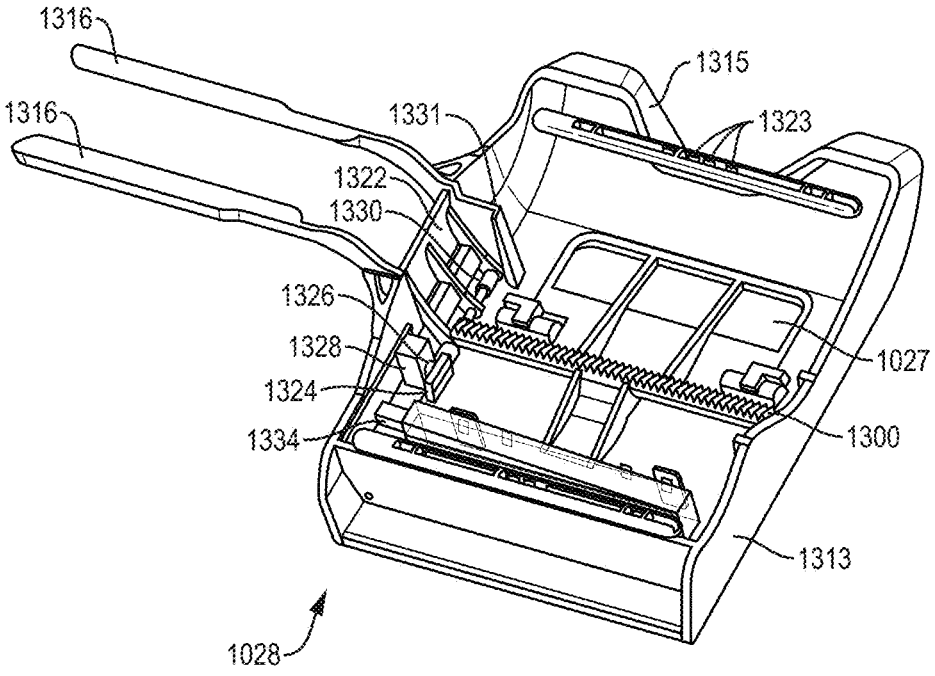
FIG. 51 is a perspective bottom view of the slot cover of FIG. 50.

As shown in FIG. 51, a stop 1331 can be positioned to limit the rotational movement of the bumper 1322. The stop 1331 can limit overstressing of the mechanism during engagement with a skate blade, a skate blade holder or the like. In the illustrated configuration, the stop 1331 can be defined as in internal lip that extends into the path of travel of the bumper 1322. Any other suitable configuration also can be used.

With reference again to FIG. 50, the illustrated body 1313 also includes a lighting feature 1332. The lighting feature 1332 in the illustrated configuration is on an upper or top surface of the cover 1028. As shown in FIG. 51, a light pipe 1333 can extend under the lighting feature 1332 or an opening that defines the lighting feature 1332. The light pipe 1333 can extend from an LED 1334. The LED 1334 can be mounted to the same printed circuit board as the switch 1328. Other configurations also are possible. The lighting feature 1332 can function similarly to the lighting feature 332 described above (i.e., always on when the cover 1028 is not engaged with a skate blade, skate blade holder or the like, flashing when a sharpening is attempted without the cover 1028 is a closed position, off when engaged with a skate blade, skate blade holder, or the like).

Figure 52:
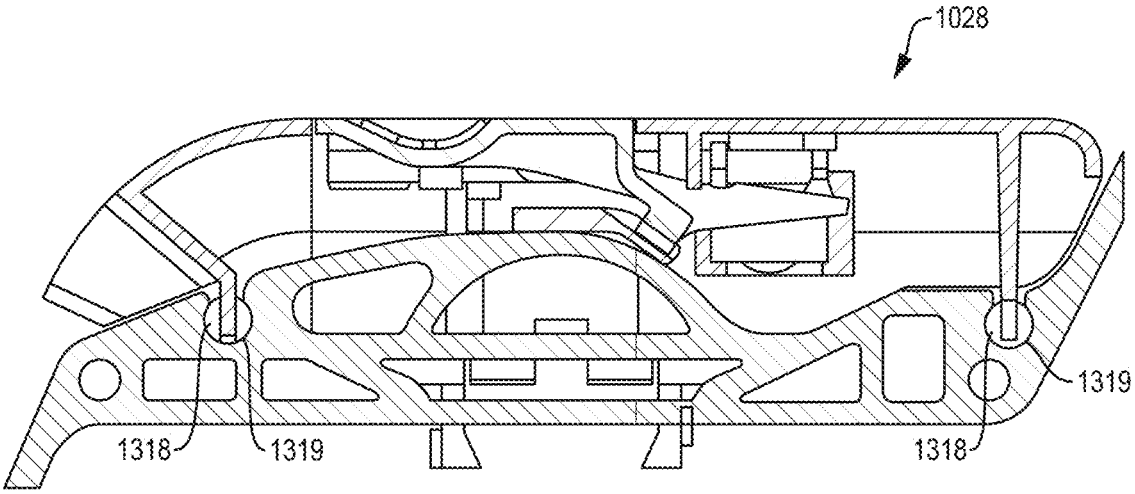
FIG. 52 is a sectioned end view of the slot cover of FIG. 50 together with a front platform portion of the chassis of the skate sharpening system.

With continued reference to FIG. 51, the body 1313 can be provided with skis or slides 1318. The skis 1318, as shown in FIG. 52, are sized and configured to move within generally circular channels 1319. In the illustrated configuration, the skis 1318 snap fit to the body 1313. In some configurations, the body 1313 includes fingers 1323 that secure the skis 1318 to the body 1313. During assembly, a ski guide could be used to position the skis 1318 within the channels 1319 and the fingers 1323 of the body then can be snapped into the skis 1318. Other configurations also are possible.

Figure 50:
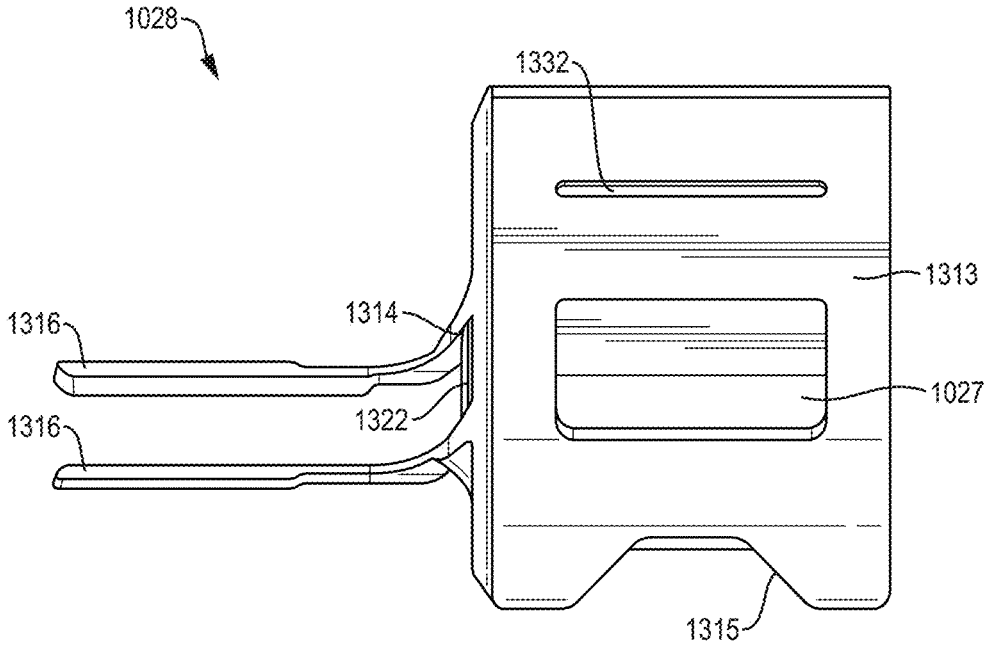
FIG. 50 is a top view of a slot cover.

As shown in FIG. 50, the body 1313 also comprises a button 1027. As described above, depression of the button 1027 raised a rack 1300 and allowed the cover 1028 to be moved along the skate sharpener 10. To assist with the movement, the body 1313 was provided with a recess 1315. The recess 1315 could receive a thumb or the like to assist with movement of the cover 1028. Other configurations also are possible.

Figure 53:
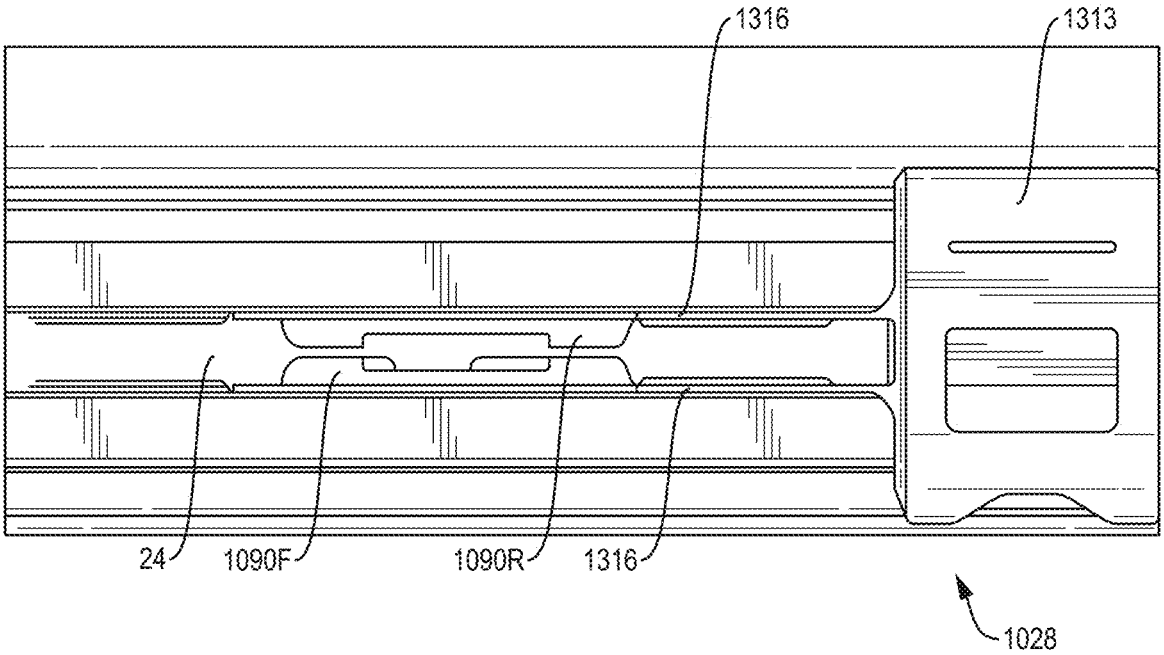
FIG. 53 is a top view of the slot cover of FIG. 50 together with the front platform portion of the chassis and skate clamp of the skate sharpening system.

The body 1313 also was provided with guards 1316. The guards 1316 extend laterally outward from the body 1313. In the illustrated configuration, the guards 1316 extend laterally outward in regions generally adjacent to the opening that receives the door 1322. In the illustrated configuration, the guards 1316 are positioned vertically lower than the bottom surface of the body 1313. The guards 1316 extend vertically downward below the bottom surface of the body 1313 but not so far as to contact the jaws or another component that may be positioned within the slot of the skate sharpener 10. As shown in FIG. 53, the guards 1316 are designed to fill a portion of the slot 24 while leaving a gap between the guards 1316 sufficient to receive the blade of the skate during sharpening operations. As such the outer surfaces of the guards 1316 are spaced apart a distance less than the width of the slot 24 while the inner surfaces of the guards 1316 are spaced apart a distance greater than a skate blade.

Figure 41:
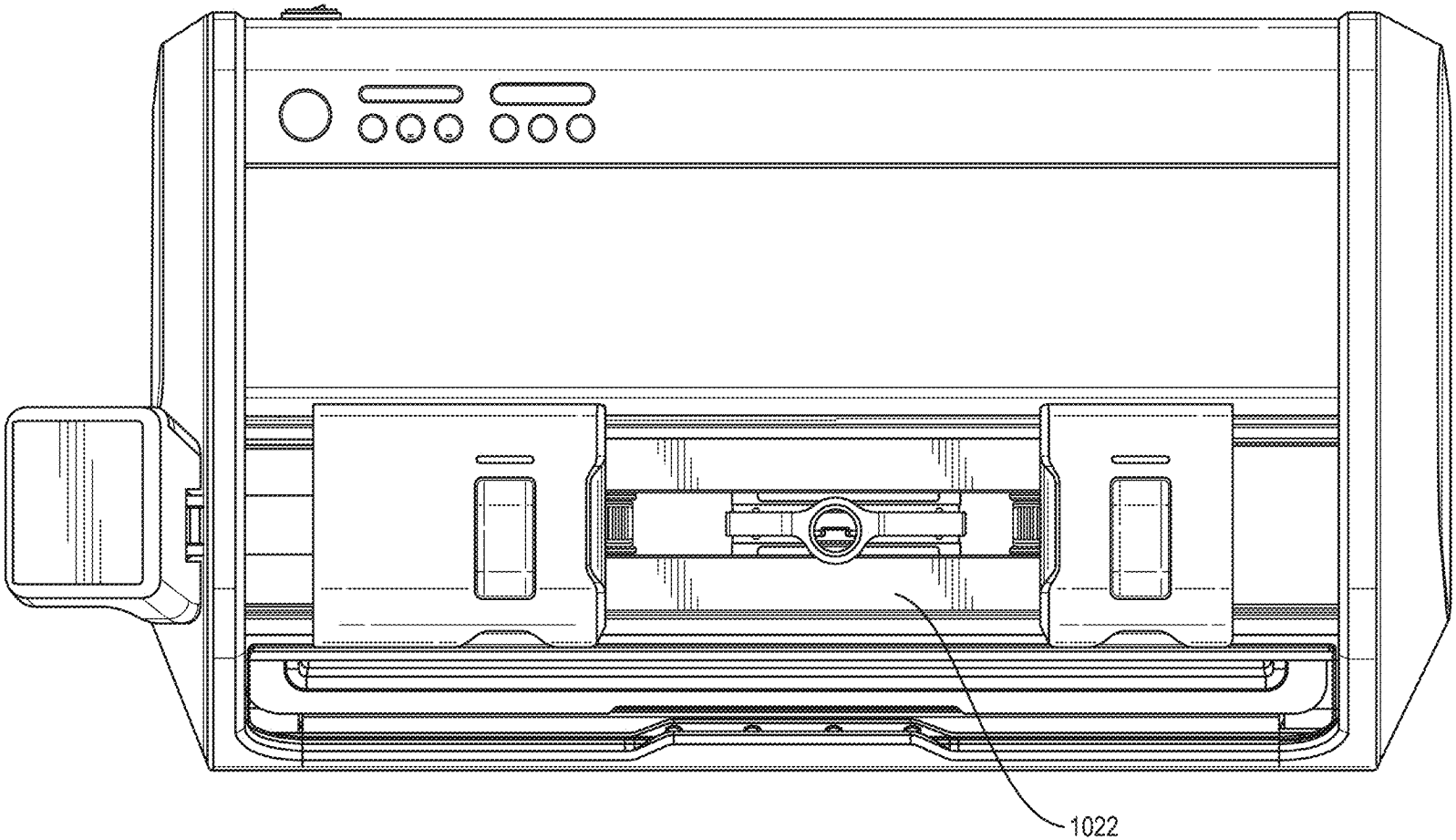
FIG. 41 is a top view of the skate sharpening system of FIG. 36.

With reference now to FIGS. 54-59, a further slot cover 2028 will be discussed. The slot cover 2028 is designed and configured to be received by the front platform portion 1022 shown in FIG. 41. The slot cover 2028 has many aspects in common with the two slot covers described directly above yet offers many improvements to those slot covers.

The slot cover 2028 has a body 2313 formed of two main parts, a base 2309 and a cover 2311. In the illustrated configuration, the base 2309 houses and comprises most of the operational features of the slot cover 2028 while the cover 2311 provides more of a cosmetic skin for the slot cover 2028. The cover 2311 protects the internal components contained within the base 2309. In some configurations, the cover 2311 can be snap-fit or press-fit with the base 2309. In some configurations, the cover 2311 and the base 2309 can be secured with mechanical fasteners. In some configurations, the cover 2311 and the base 2309 can be snap-fit together and secured with a threaded fastener 2303 (see FIG. 55).

Figure 54:
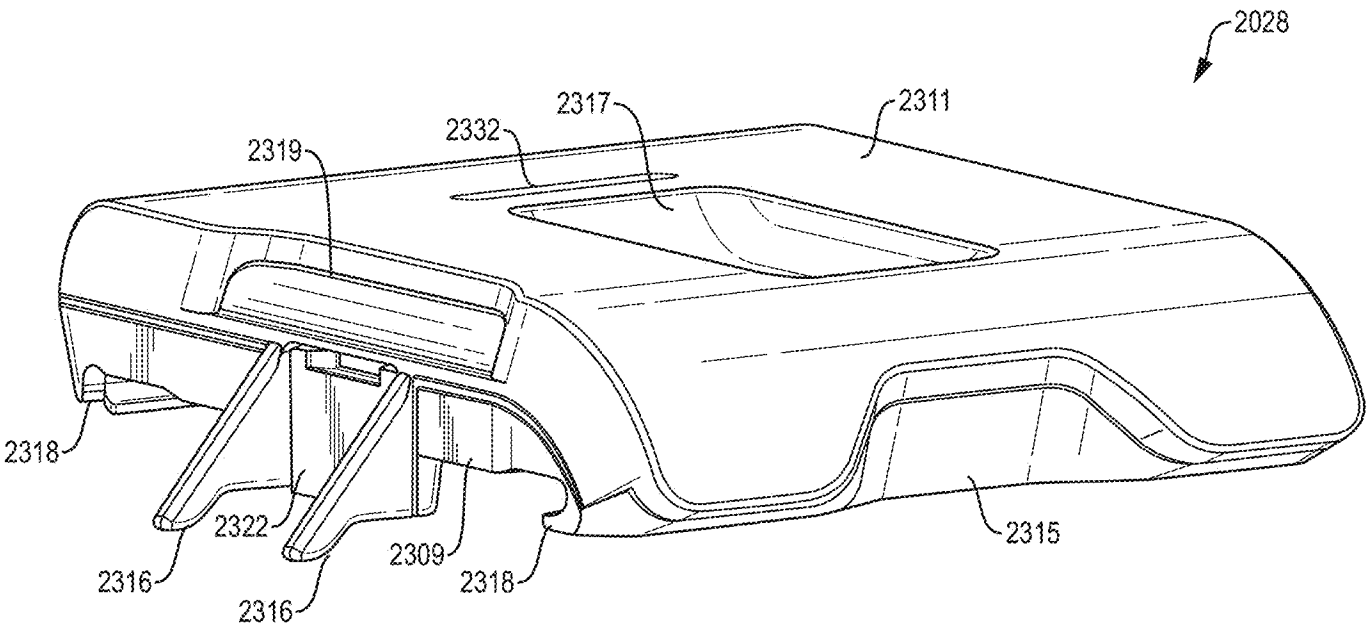
FIG. 54 is a perspective view of a slot cover.

With reference to FIG. 54, the body 2313 comprises a recess 2315. The recess can be formed in the base 2309, the cover 2311 or, as shown, both the base 2309 and the cover 2311. A further recess 2317 can be formed in a top surface of the cover 2311. Together, the recess 2315, which is formed in the front surfaces of the base 2309 and the cover 2311, and the recess 2317 that is formed in the top surface of the cover 2311 can be used to move the cover 2028 along the front platform portion 1022.

The body 2313 also comprises an edge recess 2319. The edge recess 2319 is positioned along the side of the body 2313 that will face the skate during use. The edge recess 2319 lowers the height of the body 2313 in a region that will be adjacent to the skate during a sharpening operation. By reducing the height of the body 2313 in this region, a greater variety of skate designs can be accommodated. In some configurations, the edge recess 2319 and the recess 2317 can be connected to define a single recess. In some configurations, the recess 2319 and the recess 2317 can be eliminated by lowering the upper surface and replacing the recess 2317 with a protrusion or the like to guide a user to move the cover 2028.

Figure 55:
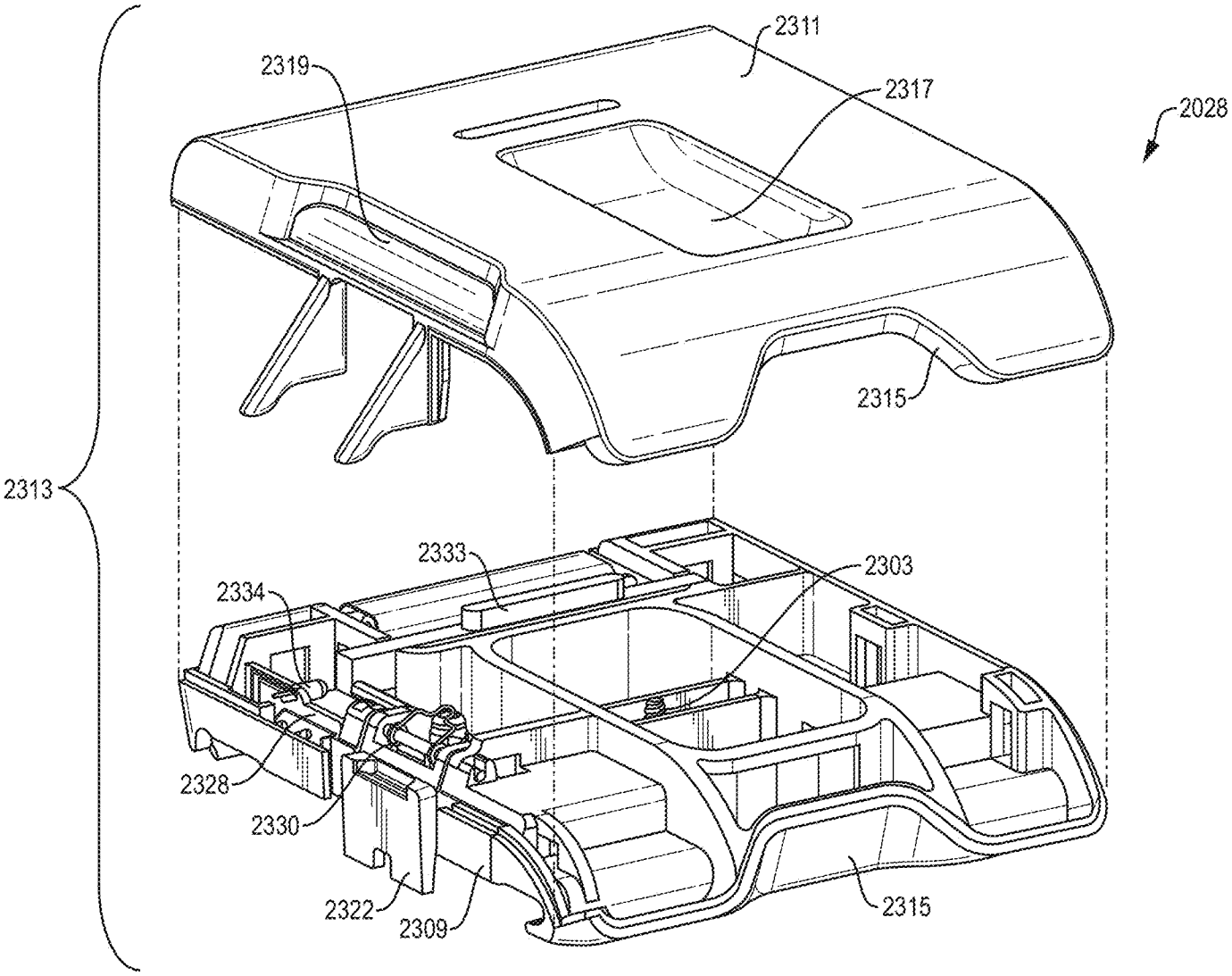
FIG. 55 is an exploded perspective view of the slot cover of FIG. 54.
Figure 56:
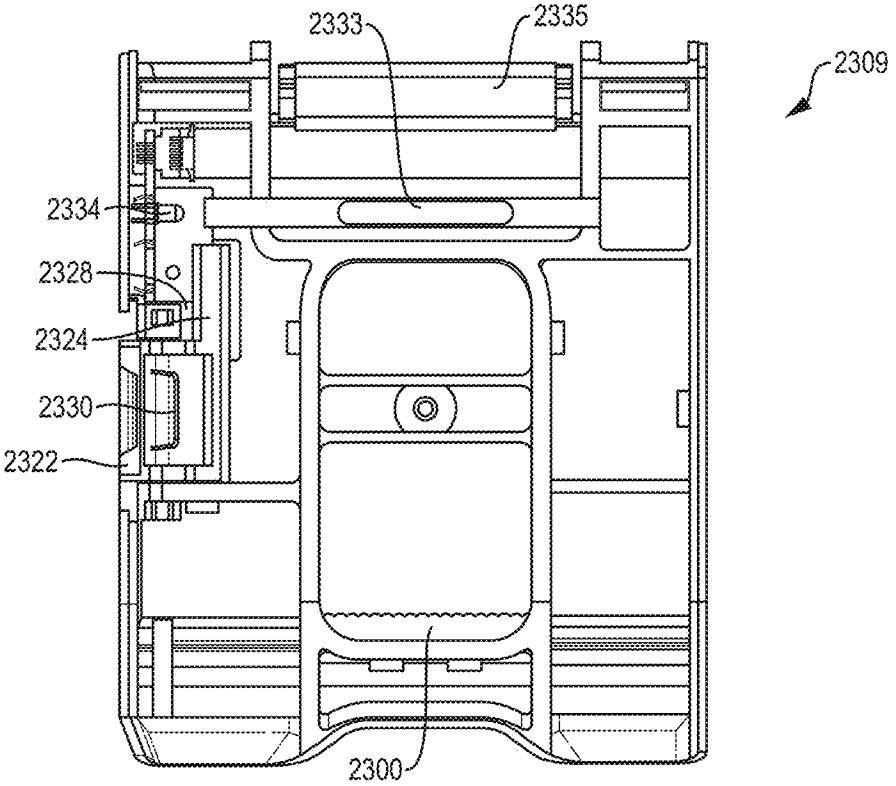
FIG. 56 is a top view of a bottom portion of the slot cover of FIG. 54.

With reference now to FIGS. 55 and 56, the base 2309 includes a door 2322. As described directly above, the door 2322 pivots about its upper end. Thus, the door 2322 is configured to pivot or rotate about a generally horizontal axis. In some configurations, the door 2322 pivots on a steel dowel.

The door 2322 has a leg 2324 that is connected to the door 2322 such that rotation of the door 2322 causes rotation of the leg 2324. Rotation of the leg 2324 brings the leg 2324 into and out of engagement with a switch 2328. In some configurations, the switch is configured to be normally closed and in an electrically open state. In such configurations, the leg 2324 is in engagement with a lever or contact location (not shown) of the switch 2328 until the door 2322 contacts a skate blade, skate holder or the like, which causes the leg 2324 to rotate away from the switch 2328. Because the switch 2328 is normally closed, the rotation of the leg 2324 away from the switch 2328 causes the switch 2328 to go to an electrically closed state. This configuration enables the switch 2328 to open the circuit when the bumper 2322 is no longer in contact with a skate blade, skate blade holder or the like. The switch can be configured such that a very short travel distance of the leg 2324 is all that is needed to close the electrical circuit.

The leg 2324, the door 2322 or both can be biased into the closed position. In some configurations, a biasing member biases the door 2322 into a closed position, which results in the leg 2324 being also biased into the closed position. In the some configurations, the biasing member 2330 is a torsion spring. The force provided by the biasing member 2330 can be selected to provide sufficient force on the switch 2328 to maintain the switch in the closed position unless the door 2322 is brought into contact with a skate blade, a skate blade holder or the like. Other biasing members or mechanisms also can be used.

Figure 57:
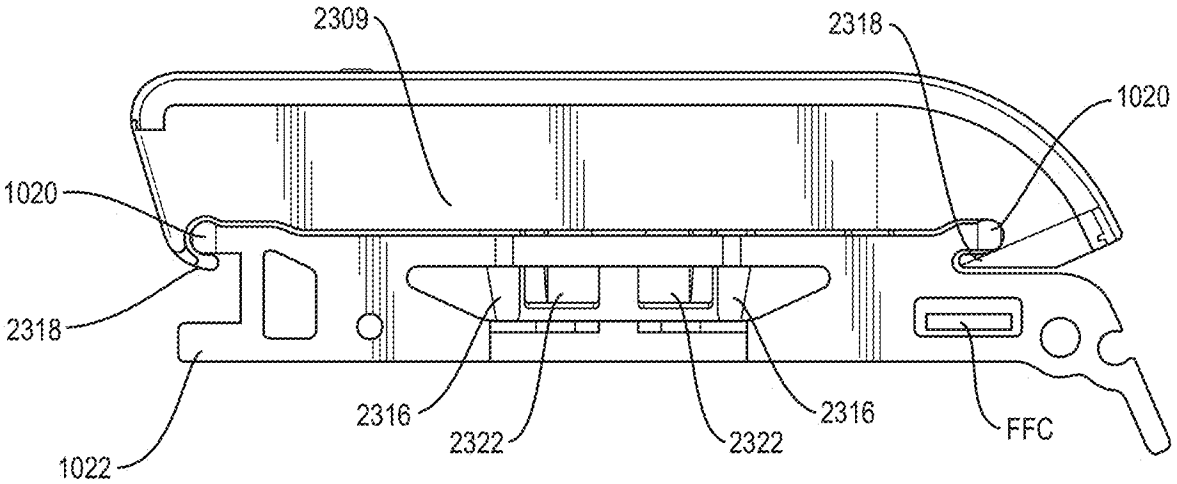
FIG. 57 is a left end view of another slot cover together with the front platform portion of the chassis.

In the configuration shown in FIG. 54, the door 2322 extends well beyond a lower surface of the base 2309. The degree to which the door 2322 extends below the lower surface of the base is shown in FIG. 57, for example. With the door 2322 extending below the lower surface of the base 2309, the door 2322 can pivot toward the base 2309 until the door 2322 makes contact with the base 2309. As such, the base 2309 can limit the rotational travel of the door 2322. Other configurations also can be used to limit the rotational travel of the door 2322.

As with the cover 1028 described directly above, the cover 2028 includes a lighting feature 2332. The lighting feature 2332 in the illustrated in the illustrated configuration is on an upper or top surface of the cover 2311. As shown in FIG. 56, a light pipe 2333 can extend under the lighting feature 2332 or an opening that defines the lighting feature 2332. The light pipe 2333 can extend from an LED 2334. The LED 2334 can be mounted to the same printed circuit board as the switch 2328. Other configurations also are possible. The lighting feature 2332 can function similarly to the lighting feature 332 described above (i.e., always on when the cover 2028 is not engaged with a skate blade, skate blade holder or the like, flashing when a sharpening is attempted without the cover 2028 is a closed position, off when engaged with a skate blade, skate blade holder, or the like).

With reference to FIG. 57, the base 2309 can be formed to include fingers 2318. The fingers define generally cylindrical recesses that are sized and configured to grasp around the outer profile of the front platform portion 1022. The front platform portion can include rails 1020 that the fingers 2318 grasp. To correct for variations incurred during molding and to provide a desired level of friction, a spring 2335 can be provided along with a segment of the fingers 2318. The spring 2335 acts to pull the associated segment of the fingers 2318 inward toward the associated rail 1020. The spring can have any suitable configuration. In one configuration, the spring is a metal u-shaped member. Other configurations also are possible.

Figure 58:
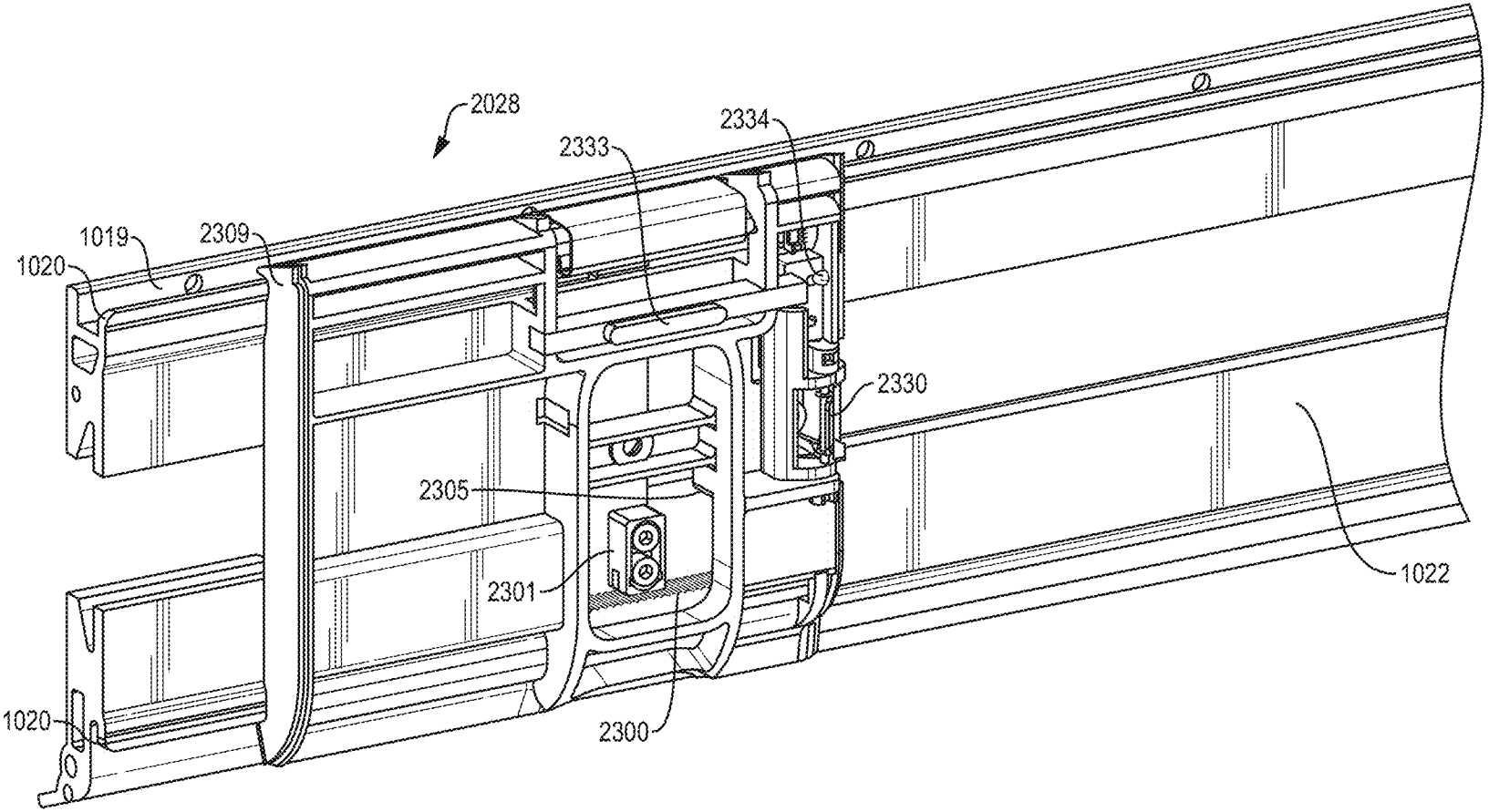
FIG. 58 is a top left perspective view of the slot cover of FIG. 57 with the top portion of the slot cover removed and positioned on the front platform portion of the chassis.
Figure 59:
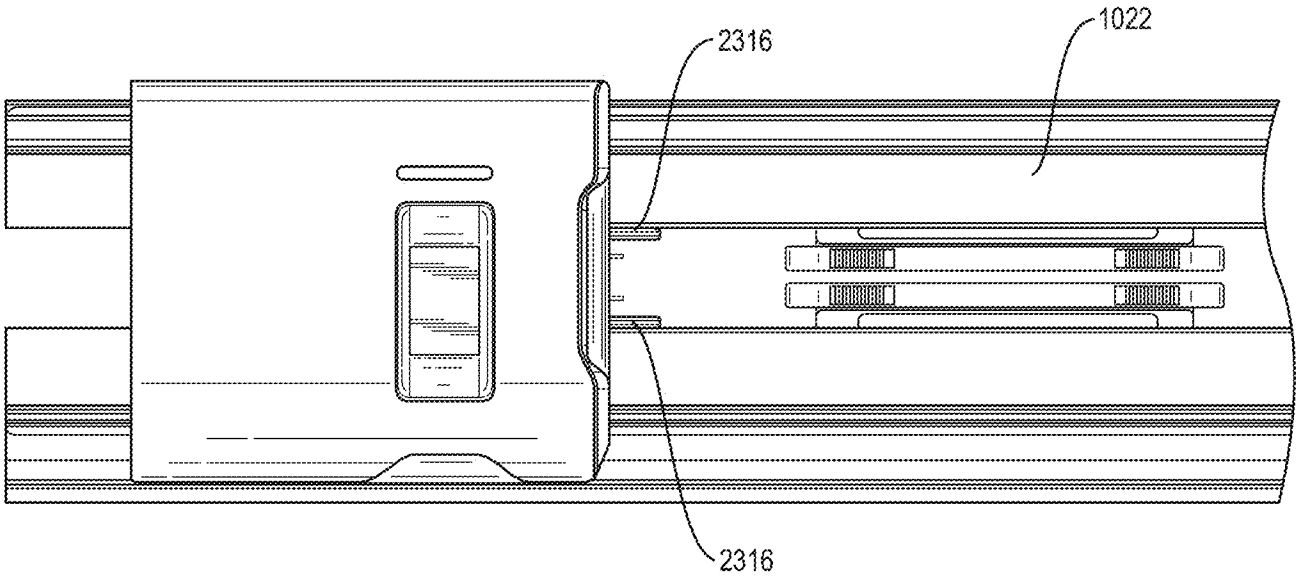
FIG. 59 is a top view of the slot cover of FIG. 57 and front platform portion of the chassis.

In addition, as shown in FIG. 56 and in FIG. 58, the cover 2028 can include a short rack segment 2300. In the illustrated configuration, the rack segment 2300 is positioned toward a front portion of the cover 2028. Other configurations are possible. The rack segment is engaged by a pawl component 2301. The pawl component 2301 can be secured to a portion of the front platform portion 1022. In the illustrated configuration, a pair of mechanical fasteners, such as threaded fasteners, are used to secure the pawl component 2301 in position. The pawl component 2301 can include a metal leaf spring secured to a plastic block. The plastic block accurately locates the leaf spring. A tunnel 2305 formed within the base 2309 allows the base 2309 to slide relative to the pawl component 2301. However, because the pawl component 2301 is captured within the base 2309, the pawl component 2301 in combination with the end walls of the base 2309 limits the range of motion of the base 2309 along the front platform portion 1022. Accordingly, the cover 2028 should be positioned and sized with the distance along the slot 1024 that the slot cover 2028 is desired to travel in mind. The combination of the rack segment 2300 and the pawl component 2301 (i.e., a passive bidirectional ratchet system) work to provide sufficient resistance to movement such that the cover 2028 will remain in position during sharpening operations.

The body 2313 also was provided with guards 2316. The guards 2316 extend laterally outward from the body 2313. In the illustrated configuration, the guards 2316 extend laterally outward in regions generally adjacent to the opening that receives the door 2322. In the illustrated configuration, the guards 2316 are extend to a location vertically lower than the bottom surface of the body 2313. The guards 2316 extend vertically downward below the bottom surface of the body 2313 but not so far as to contact the jaws or another component that may be positioned within the slot of the skate sharpener 10. As shown in FIG. 53, the guards 2316 are designed to fill a portion of the slot 24 while leaving a gap between the guards 2316 sufficient to receive the blade of the skate during sharpening operations. As such the outer surfaces of the guards 2316 are spaced apart a distance less than the width of the slot 24 while the inner surfaces of the guards 2316 are spaced apart a distance greater than a skate blade.

The printed circuit board of the cover 2028 can be connected to the controller of the skate sharpener in any suitable manner. In one configuration, an FFC cable can be used to connect the printed circuit board and the controller of the skate sharpener. Advantageously, the FFC cable can be concealed within the front platform portion 1022 (see FFC in FIG. 57, for example) and can fold and unfold on itself during movement of the cover 2028 relative to the front platform portion 1022. The wires of the FFC can be installed by being snapped into place and the secured with a sealant such as hot-melt adhesive or the like. Other configurations also are possible.

Figure 81:
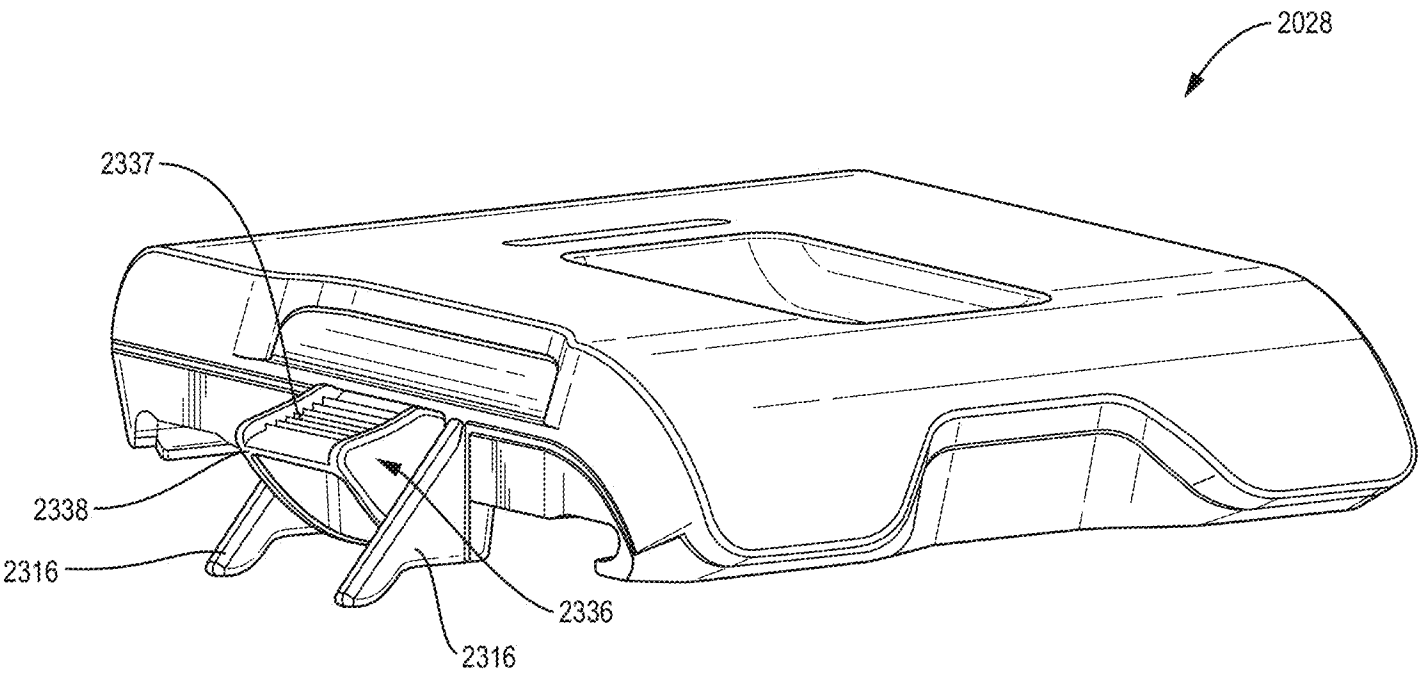
FIG. 81 is another view of the slot cover of FIG. 50 with a youth skate adaptor installed.
Figure 82:
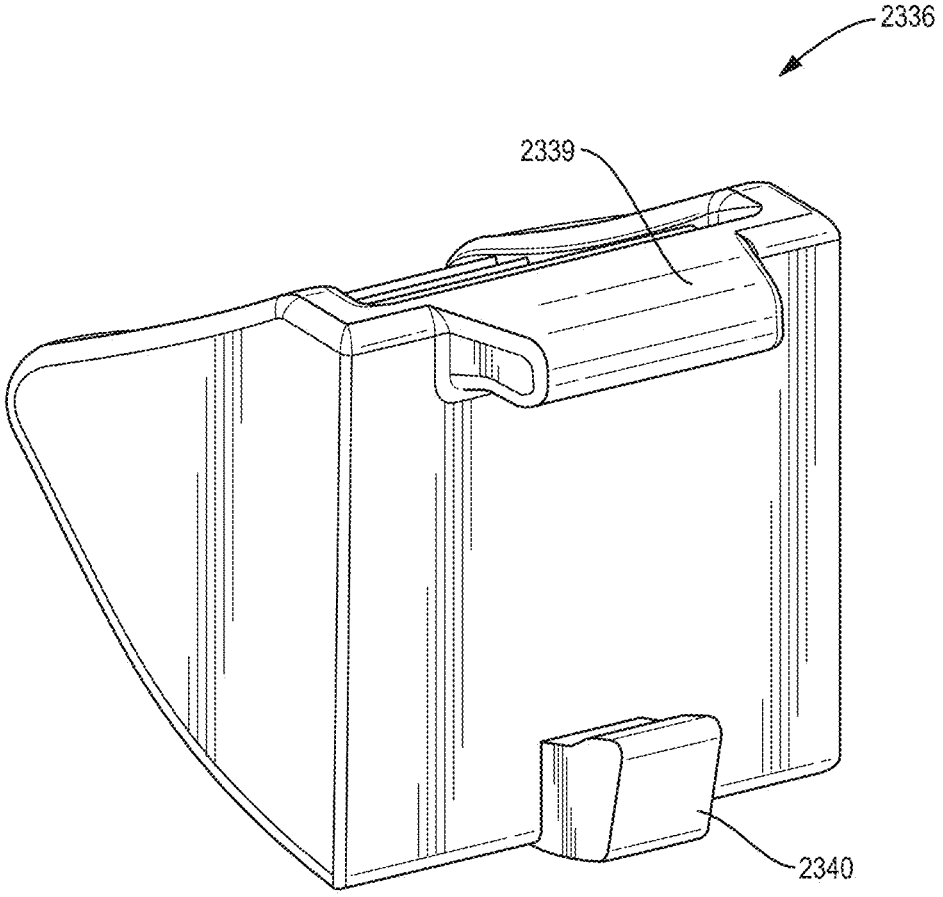
FIG. 82 is a rear perspective view of the youth skate adaptor showing the snap fit features used to secure the youth skate adaptor to the slot cover of FIG. 50.

With reference now to FIGS. 81 and 82, the slot cover 2028 is shown with a youth skate adaptor 2336 installed. In some configurations, due to the configuration of the skates, such as very small youth sizes, the door 2322 and the skate may not make adequate contact. For example, with very small youth sizes, the location of the boot of the skate relative to the skate's blade holder, the boot bumps into the slot cover 2028 and does not allow the door 2322 to make contact with the skate blade or skate blade holder. In such scenarios, the youth skate adaptor 2336 can be installed on the slot cover 2028.

The youth skate adaptor 2336 effectively extends the reach of the door 2322 toward the skate blade or skate blade holder. In some configurations, the adaptor 2336 can be positioned between the guards 2316. In the illustrated configuration, the adaptor 2336 can snap fit to the door 2322. The adaptor 2336 can have a ribbed, stepped or textured surface 2337 on a projecting portion 2338. In some configurations, both the top and the bottom of the projecting portion 2338 can include the textured surfaces 2337.

As shown in FIG. 82, a rear of the adaptor 2336 can have a first member 2339 and a second member 2340. The first and second members 2339, 2340 are spaced apart from each other. In the illustrated configuration, the first member 2339 is vertically above the second member 2340. The first and second member 2339, 2340 each can define a small recess that receives the door 2322. In the illustrated configuration, the first member 2339 is wider than the second member 2340. Together, the first member 2339 and the second member 2340 enable the adaptor 2336 to snap fit onto the door 2322. Other configurations of attaching the adaptor 2336 to the door 2322 and/or other configurations for extending the reach of the door or the skate blade/skate blade holder can be used. In addition, while the adaptor 2336 is configured to extend the reach of the door 2322 for accommodating youth skates, it is possible that other adaptors 2336 could be used to address changes in skate design and/or changes in skate blade holder technology in the future.

Two Piece Carriage and Two Piece Platform

Figure 60:
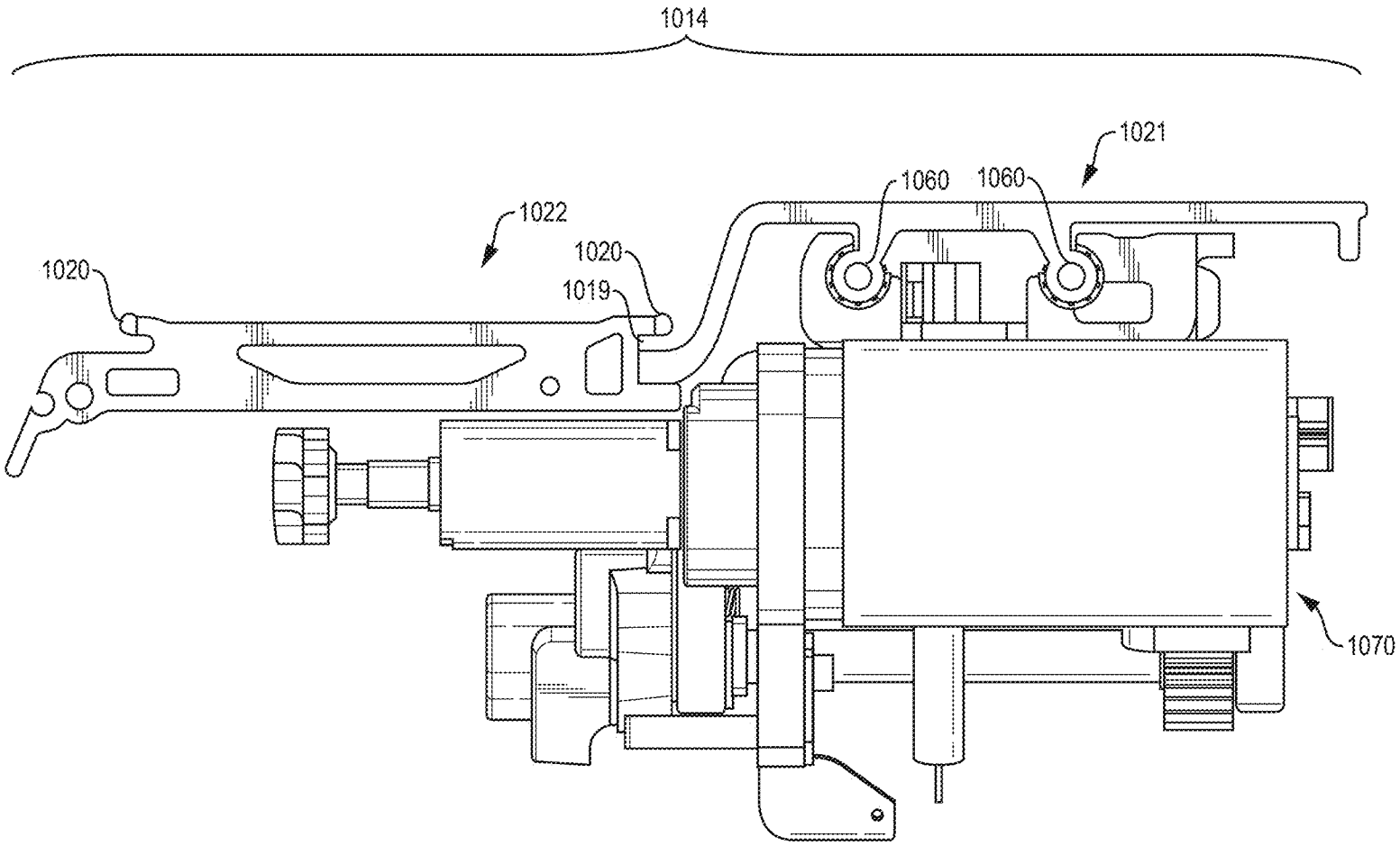
FIG. 60 is a right end view of a portion of the chassis and the carriage assembly.

With reference now to FIG. 60, another platform and another carriage option are shown. In the illustrated configuration, the chassis 1014 includes the front platform portion 1022 and a rear portion 1021. While the configuration shown in FIG. 5 featured a single piece chassis 1014 that included the front and rear portions as a single, monolithic structure (e.g., extrusion), the configuration shown in FIG. 60 has a two piece chassis 1014 that includes a separate front platform portion 1022 and rear portion 1021.

The front portion 1022 and the rear portion 1021 can be formed in any suitable manner. In one configuration, each of the front portion 1022 and the rear portion 1021 can be separately extruded. In one configuration, the front portion 1022 includes a recess 1019. The rear portion 1021 includes a portion that is received within the recess 1019 of the front portion 1022. The rear portion 1021 can be secured to the front portion 1022 using any suitable technique. In some configurations, mechanical fasteners can be used to secure the rear portion 1021 to the front portion 1022. In some configurations, one or more threaded fasteners can be used to secure the front portion 1022 and the rear portion 1021 together (e.g., see the holes shown in the recess 1019 in FIG. 58)

The rear portion 1021 includes the rails 1060. In the illustrated configuration, the rails 1060 are supported by a web that connects the rails 1060 to the main body of the rear portion 1021. In such a manner, the rails 1060 and the main body of the rear portion 1021 can be formed as a single extrusion, which improves manufacturability and decreases assembly time. In some configurations, however, the rails 1060 can be formed separate of the main body and secured thereto using any suitable technique. For example, the rails 1060 can be secured to the main body using mechanical fasteners, such as threaded fasteners, or the like.

The rails 1060 support the carriage assembly 1070. As described above, the rails 1060 generally extend in the X direction and the carriage assembly 1070 is configured to translate along the rails 1060. While the configuration of the carriage assembly 70 shown in FIG. 4, for example, is a single, unitary, monolithic configuration that includes both the carriage 72 and the support framework that carries the related components, the carriage assembly 1070 shown in FIGS. 60 and 61, for example, has been separated out into two or more components.

Figure 61:
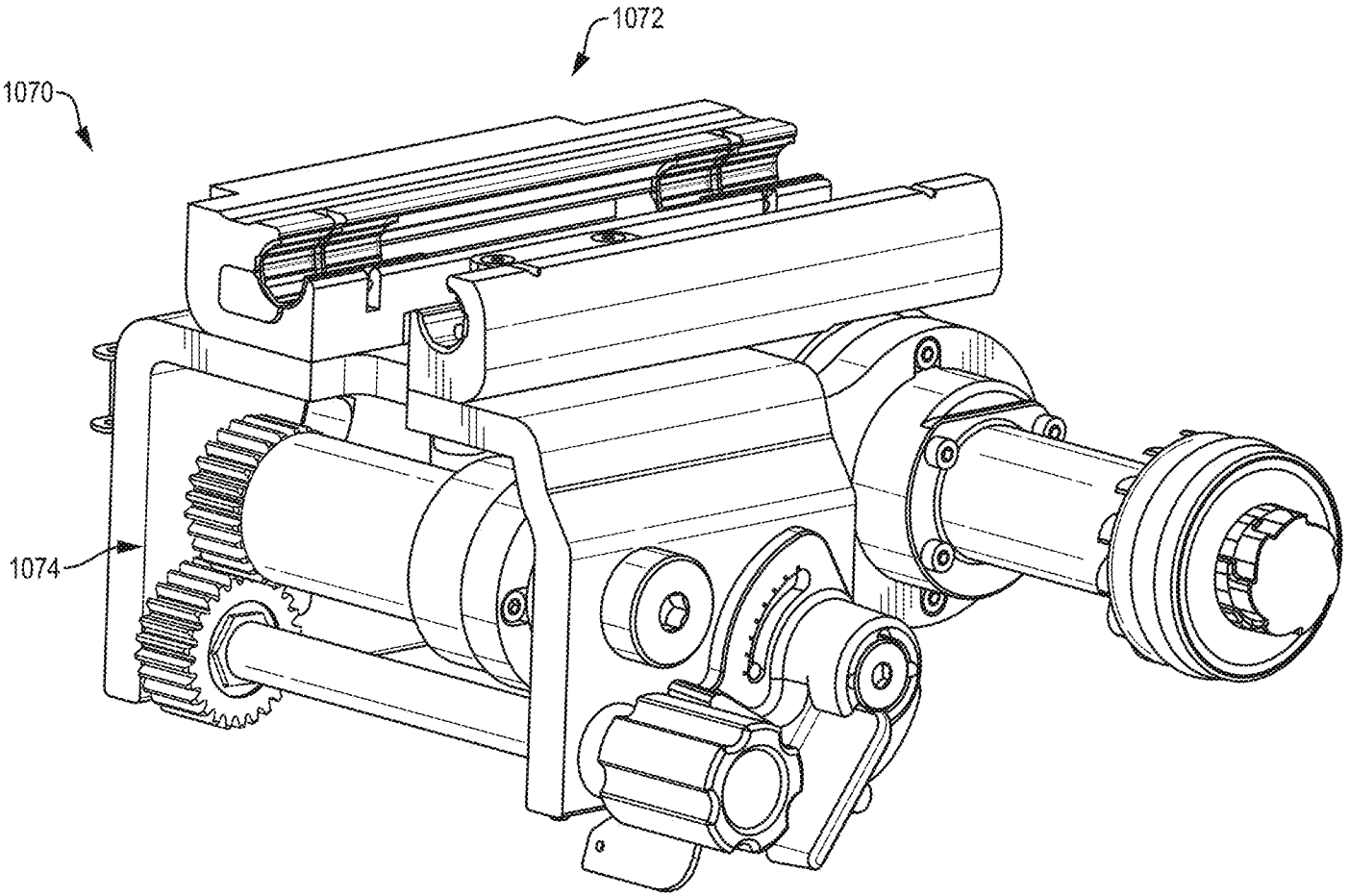
FIG. 61 is a front left perspective view of the carriage assembly of FIG. 60.
Figure 62:
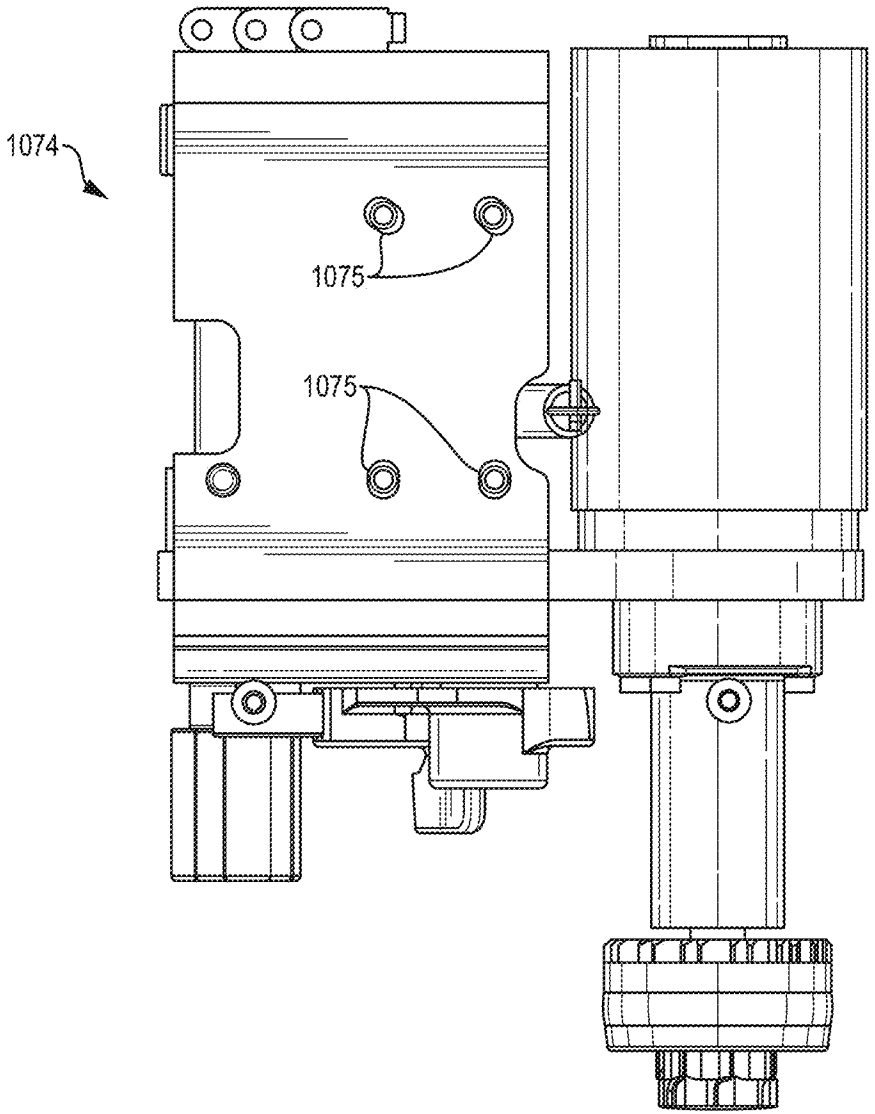
FIG. 62 is a top view of a portion of the carriage assembly of FIG. 60.
Figure 63:
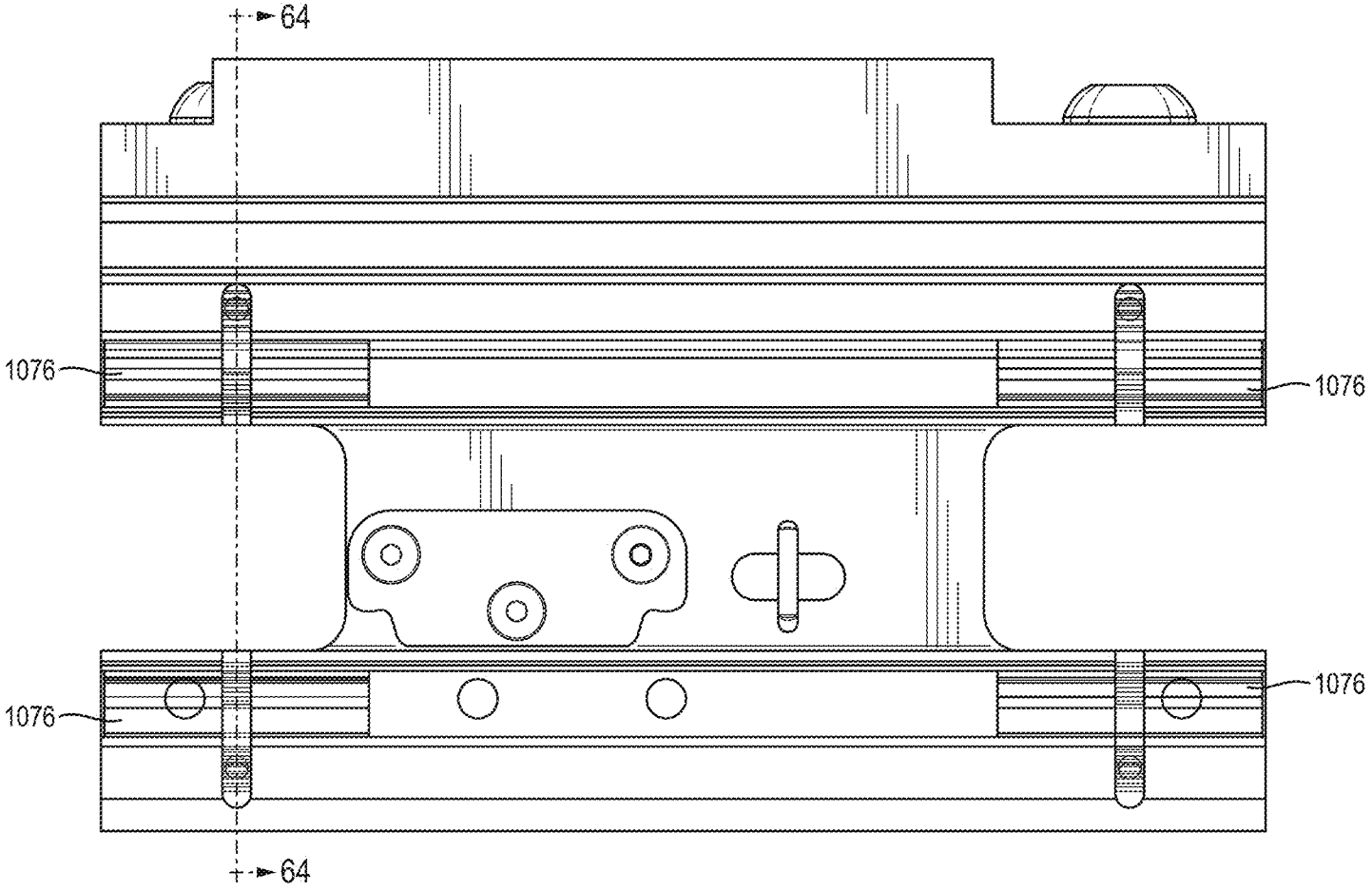
FIG. 63 is a top view of a portion of the carriage assembly of FIG. 60.

As illustrated best in FIG. 61, the illustrated carriage assembly 1070 comprises the carriage 1072 and the support framework 1074. By separating the carriage 1072 from the support framework 1074, it is possible to make alignment changes between the carriage 1072 and the support framework 1074 such that manufacturing tolerances do not result in any significant misalignments. In some configurations, rather than making the carriage 1072 and the support framework 1074 as fully separable components, the carriage 1072 and the support framework 1074 can be formed as a single user yet having the carriage 1072 and the support framework 1074 flexibly interconnected such that alignment adjustments between the two components 1072, 1074 can be made and then the two can be locked together in the desired orientation. For example, a mechanical fastener, such as a threaded fastener, for example, can be used to secure the two components in a desired orientation. In some configurations, as shown in FIG. 62, the framework 1074 includes four slots 1075, two sets of two aligned slots 1075 with the two sets extending in different directions. For example, two slots 1075 can be at an angle to the direction of travel while two slots 1075 can be normal to the direction of travel. Such a configuration facilitates alignment through the use of the slots and the desired alignment can be secured by tightening the threaded fasteners into the upper carriage 1072. Any other suitable configuration can be used keeping in mind a desire to facilitate alignment between the interface with the rails 1060 (i.e., which interaction guides the direction of travel of the carriage) and the axis of rotation of the grinding wheel (i.e., which dictates the sharpening action).

Over time, wear can occur between the carriage assembly 1070 and the rails 1060. Accordingly, a method and/or assembly to accommodate the wear and increase the life of the assembly would be desirable. One such method and/or assembly can include providing the interface between the carriage assembly 1070 and the rails 1060 with wear members. In the illustrated configuration, the carriage assembly 1070 comprises guide channels 1075. The guide channels 1075 extend along at least a portion of the length of the carriage 1072. In the illustrated configuration, the guide channels 1075 extend along the full length of the carriage 1072. The guide channels receive the rails 1060. To reduce wear of the guide channels 1076, one or more bushing liner 1076 can be provided. In the illustrated configuration, two bushing liners 1076 are positioned along each of the guide channels 1075. The bushing liners 1076 can be spaced apart along the length of the guide channel 1075. Other configurations are possible.

Figure 64:
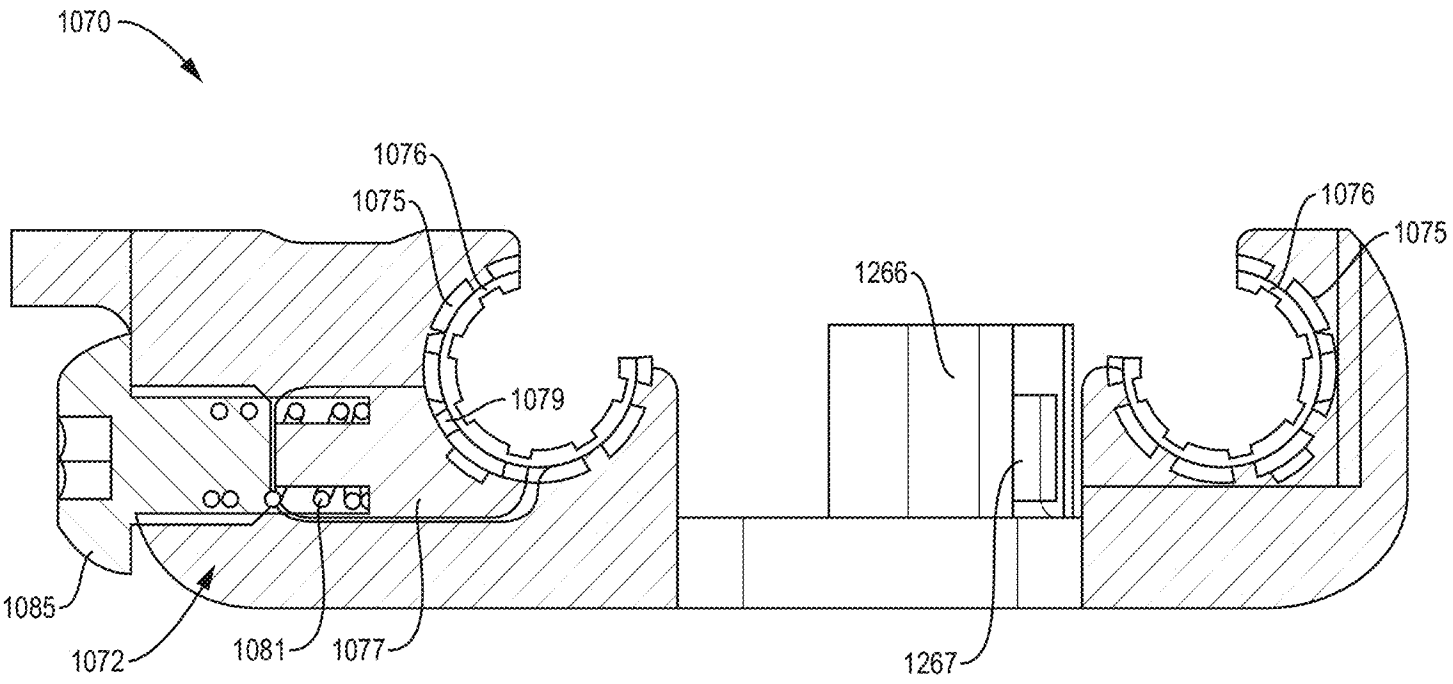
FIG. 64 is a sectioned view of the portion of the carriage assembly of FIG. 63 taken along the line 64-64 in FIG. 63.

With reference to FIG. 64, the bushing liners 1076 do not define a full circle such that the bushing liners 1076 do not fully surround the rails 1060 (see FIG. 60). The bushing liners 1076 can extend only a portion of a full circle. In some configurations, the bushing liners 1076 extend more than 180 degrees and less than 360 degrees. In some configurations, the liners 1076 extend between about 220 degrees and 320 degrees.

While bushing liners 1076 can help improve the movement of the carriage 1072 along the rails 1060, wear over time can affect the consistency of movement. Thus, one or more of the illustrated bushing liners 1076 are biased into abutment with the rails 1060. In the illustrated configuration, two bushing liners 1076 that engage a single rail 1060 are biased into abutment with that rail 1060. With reference to FIG. 64, the bushing liner 1076 is engaged by a floating bushing 1077. The floating bushing 1077 is positioned within a recess of the carriage 1072. The floating bushing 1077 can extend the full length of the bushing liner 1076 or some portion of the bushing liner length. In the illustrated configuration, the floating bushing 1077 extends the full length of the bushing liner 1076. The floating bushing 1077 can include an engagement face 1079 that is in contact with at least a portion of the bushing liner 1076. In some configurations, the engagement face 1079 is arcuate or curved. In some configurations, the engagement face 1079 contacts a portion of the bushing liner 1076 that is generally centrally located between the two edges that define the open portion of the circle. In some configurations, the engagement face 1079 is positioned to contact a portion of the bushing liner 1076 that is diametrically opposed to the opening defined along the bushing liner 1076. Other placements also are possible.

A biasing member 1081 can be captured between the floating bushing 1077 and a threaded member 1085. The threaded member and/or the floating bushing 1077 can include a recess that receives the biasing member 1081. In the illustrated configuration, the floating bushing 1077 includes a recess that surrounds a post member and at least a portion of the biasing member 1081 is received within the recess and supported by the post member. The biasing member 1081 urges the floating bushing 1077 into engagement with the bushing liner 1076. Other configurations are possible. Advantageously, by incorporating a pre-loaded bushing and/or pre-loaded bushing liner, it is possible to maintain a relatively consistent low-level friction component between the carriage assembly 1070 and the rails 1060 for a relatively long period of time during which wear will be occurring. As such, improved performance results from the use of the pre-loaded bushing and/or bushing liner.

Grinding Wheel to Blade Alignment Details

FIG. 23 is an end view of the carriage assembly 70, similar to FIG. 14 but showing a section view at the location of the pivot spindle 240. Certain details are shown more clearly in the close-up view of FIG. 24.

The pivot spindle 240 is secured at each end to the carriage 72. A pivot section 400 of the motor arm 78 is mounted on the pivot spindle 240 by a combination of bearings 402, 404 and bushings 406, 408. Shown on the right in this view is a spring 410 disposed in compression between the front wall of the carriage 72 and an inner race 412 of the bearing 404. Shown on the left is the spindle gear 253 which is disposed on a hub or nut 414 having screw threading engaging corresponding screw threading on the pivot spindle 240. It will be appreciated that the gear and threading features may be integrated into a single component as an alternative. Arranged between the nut 414 and an inner race 416 of the bearing 402 is a washer 418 and a collar portion 420 of the bushing 406, including a detent mechanism as described below.

The mounting of the motor arm 78 on the bearings 402, 404 permits the motor arm 78 to pivot about the pivot spindle 240 so that the grinding wheel 36 can follow the profile of the bottom face of the skate blade during sharpening (as described above with reference to FIGS. 7 and 8). The bushings 406, 408 provide for low-friction transverse (Y-axis) movement of the motor arm 78 (left to right in FIG. 23). The spring 410 provides a biasing force against a side face of the inner race 412 of the bearing 404, urging the motor arm 78 rearward (leftward in FIG. 23). The combination of the threaded nut 414, washer 418 and collar portion 420 of the bushing 406 acts as a stop member against which the motor arm 78 is urged. Specifically the force from spring 410 is transmitted to the nut 414 via a set of mechanical components including the bearing 404, pivot section 400, bearing 402, collar portion 420 of the bushing 406, and washer 418 and detent mechanism described below.

The transverse or Y-direction (left to right in FIG. 23) position of the motor arm 78 is varied by rotation of the nut 414, which occurs by user rotation of the adjustment knob 242 (FIGS. 13, 14) and resultant rotation of the adjustment axle 254 and gears 256, 252 as described above with reference to FIG. 14. As the nut 414 rotates, the screw action causes it to also move transversely in the Y direction along the pivot spindle 240, and due to the pressing force from the spring 410 the motor arm 78 moves transversely along with it. The bushing 406 slides along an outer surface of the pivot spindle 240, and the inner race 412 of bearing 404 is pressed onto bushing 408, which slides along an outer surface of pivot spindle 240. The bushing 408 may alternatively include a flange or collar portion similar to collar portion 420 of the bushing 406.

The nut 414 and washer 418 are co-configured to form a detent mechanism providing several detent locations for a rotation of the nut 414, helping reduce or eliminate the likelihood of undesired transverse movement of the motor arm 78 after an alignment operation has been performed and a sharpening operation has begun. Specifically, the front face (rightward in FIG. 23) of the nut 414 has a shallow depression in which is disposed a ball, and the washer 418 has an array of corresponding holes or depressions arranged in a circle. As the nut 414 is rotated the ball moves from one hole or depression of the washer 418 to the next, requiring a small force to push the ball sufficiently out of the first hole/depression to enable it to travel to the next. This force is easily generated by the user's rotation of the adjustment knob 242 but not by vibration or other mechanical forces occurring during sharpening operation.

Figure 25:
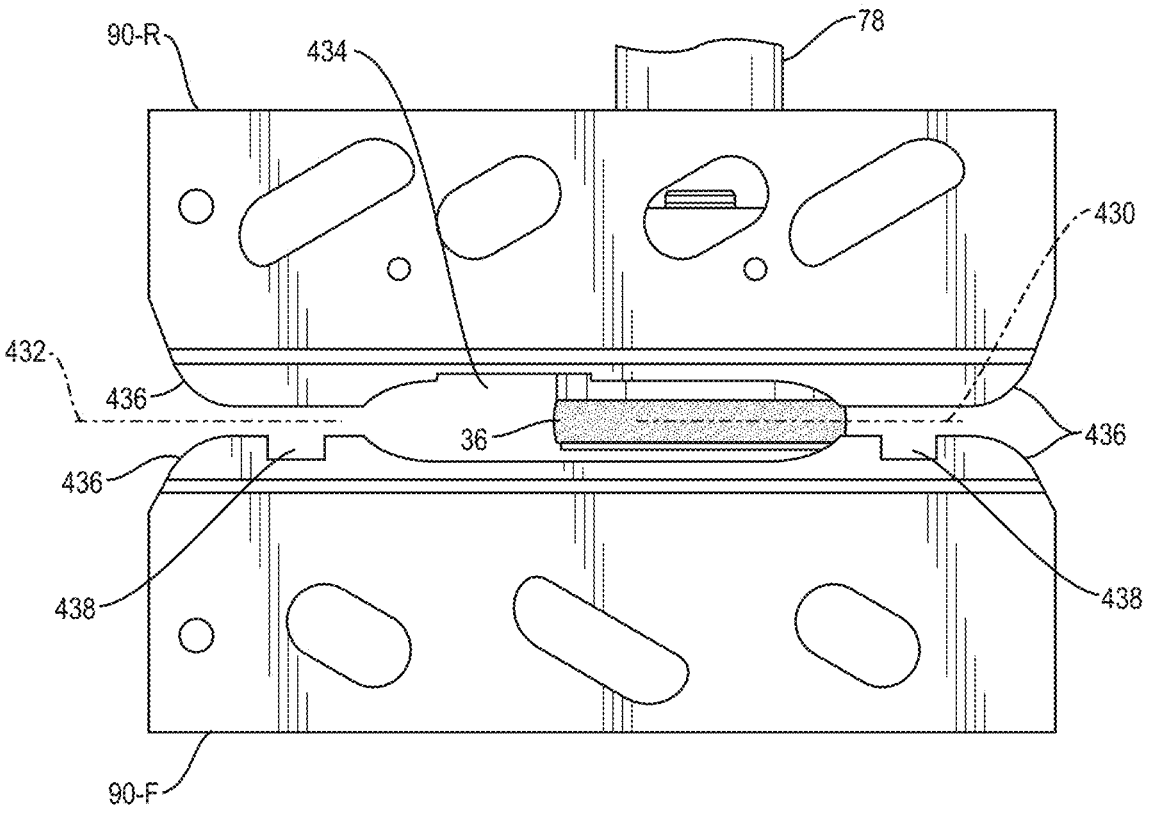
FIG. 25 is a schematic depiction of alignment between clamping jaws and a grinding wheel.

FIG. 25 is a downward view encompassing the jaws 90 and the grinding wheel 36 and motor arm 78 underneath. The jaws 90 are shown in the closed position, slightly spaced apart as they are when retaining a skate blade (not shown). This view is of an aligned position in which a centerline 430 of the grinding wheel 36 is aligned with a centerline 432 of a sharpening position of the skate blade (midway between the clamping surfaces of the jaws 90). In configurations including a jaw guard 1380, the jaw guard 1380 can be used to provide a desired vertical position for alignment and calibration. As discussed above, the jaw guard 1380, by making contact with the spindle 1082, guides the grinding wheel 1036 downward away from the jaws 1090F, 1090R. In the same manner, the jaw guard 1380 can ensure that alignment occurs at a desired vertical position each time calibration or alignment is undertaken.

In some configurations, one or more lighting feature can be incorporated into the jaw guard 1380. In some configurations, the lighting feature can be positioned adjacent to the jaw guard 1380. In some configurations, an LED or the like can be mounted in the jaw guard 1380. For example, one or more holes 1381 (see FIG. 45) can be provided in the jaw guard 1380 in which the LED can be mounted. In other configurations, the LED can be mounted anywhere on the chassis or within the compartment defined within the skate sharpener.

The LED can be illuminated when the grinding wheel is being aligned. For example, in configurations having an alignment mode, the lighting feature in, on or around the jaw guard can be activated when the skate sharpening device enters into the alignment mode or at some time period during the alignment mode. The lighting feature thereby can illuminate the area surrounding the alignment features.

It will be appreciated that the grinding wheel 36 can be moved transversely (up and down in the view of FIG. 25) by the above-described Y-adjustment mechanism, changing the position of the grinding wheel centerline 430 with respect to the centerline 432 of the skate blade. In general there is a small range of uncertainty in the position of the grinding wheel 36 relative to the centerline 432 based on mechanical tolerances as well as planned variability, such as varying sizes of grinding wheels 36 that the system supports, etc. The adjustment mechanism enables a user to obtain accurate alignment to achieve as closely as possible the idealized arrangement of FIG. 2, i.e., perfectly symmetrical curvature of the bottom surface 42 of the skate blade 40 about its centerline 432, so that the edges 44 lie in the same plane perpendicular to the X-Z plane of the skate blade 40. In the present context, the required accuracy of alignment is to within approximately +/−0.001". It will be appreciated that this level of accuracy is generally not possible using simple naked-eye observation of the degree of alignment between the grinding wheel 36 and skate blade 40. Thus features that aid alignment to this degree are disclosed.

FIG. 25 also shows certain features of the jaws 90 pertaining to alignment. First is a central open area 434 through which the grinding wheel 36 can be viewed and a separate alignment tool (described below) is received. Thus the jaws 90 are left with endward clamping portions 436. Second are notches 438 formed in the front jaw 90-F which receive corresponding protrusions from the alignment tool so that the alignment tool is properly oriented and located precisely in the left-to-right direction of FIG. 25. This precise locating in turn provides for close spacing of an alignment feature of the alignment tool with a corresponding feature of the grinding wheel 36, as described more below.

Figure 26:
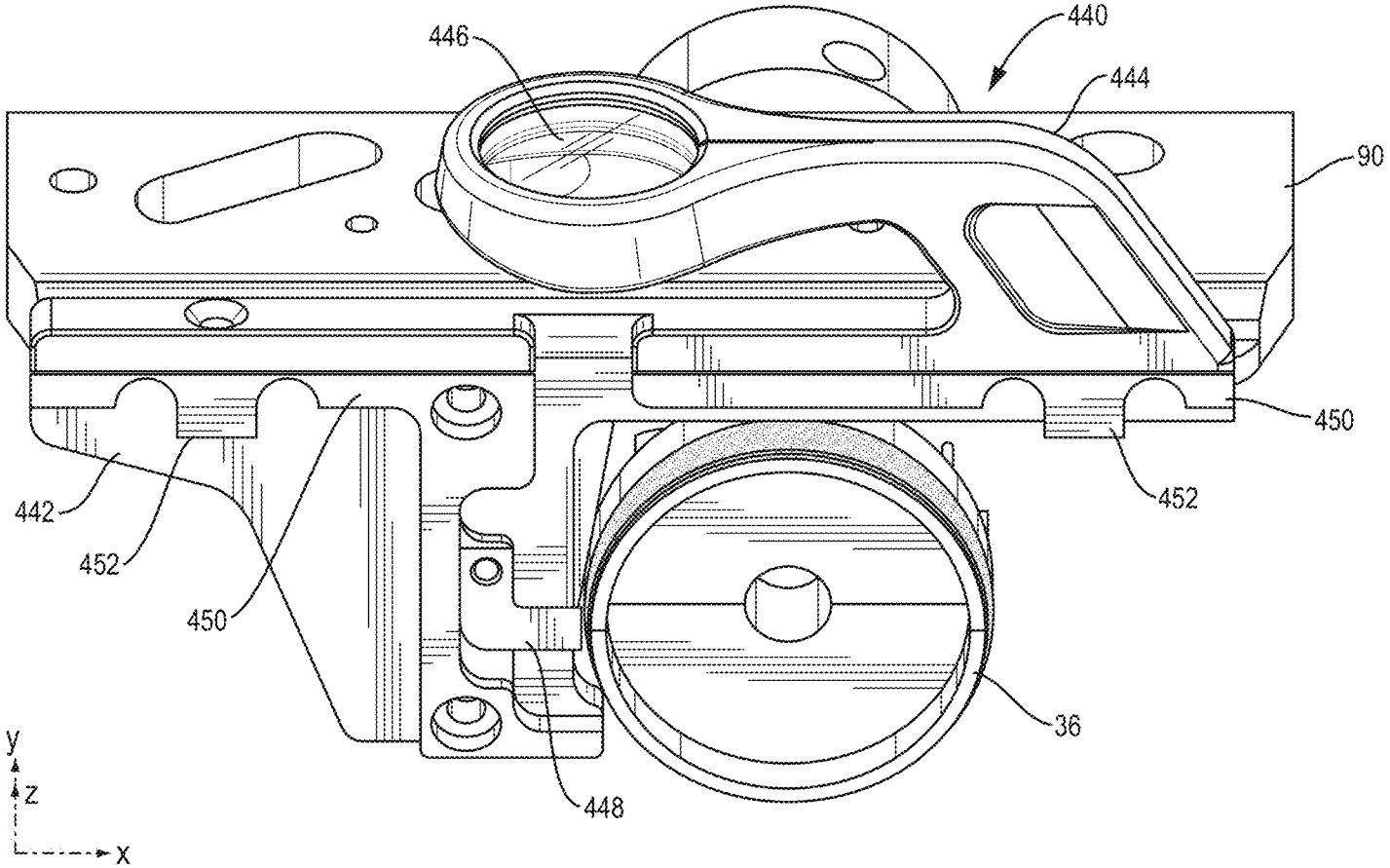
FIG. 26 is a side elevation view of an alignment tool in use.

FIG. 26 illustrates the alignment tool 440 as it is located during use. It has a lower blade-like portion 442 and an upper portion 444 holding a magnifying lens 446. The blade-like portion 442 is clamped between the jaws 90 in the same sharpening position that the skate blade 40 occupies when being sharpened. In this view the front jaw 90-F is omitted for ease of description. The blade-like portion 442 extends downward to support a flag 448 that functions as a first visual reference feature as explained below. In one embodiment the flag 448 is a thin member secured flat against a surface of the lower portion 442. It is thus precisely spaced from the centerline 432 of the jaws 90 (FIG. 25) when the alignment tool 440 is clamped in the illustrated position. In the illustrated embodiment this spacing is on the order of one-half the width of the grinding wheel 36. Also shown in FIG. 26 are machined shoulder portions 450 extending out of the page in this view. Bottom edges of the shoulder portions 450 sit on top of the endward clamping portions 436 of the jaws 90 (FIG. 25), except for the slightly longer protrusions 452 that are received by the notches 438 (FIG. 25). It will be noted that the flag 448 is opposite the grinding wheel 36 along a horizontal diameter. In other embodiments the flag 448 may be formed integrally with the lower portion 442.

In use, a user opens the jaws 90 and inserts the alignment tool 440, locating it so that the shoulder portions 450 sit on top of the endward clamping portions 436 of the jaws 90 and the protrusions 452 are received by the notches 438. The user then closes the jaws 90 so that the alignment tool 440 is retained with the blade-like portion 442 in the same position as a skate blade 40 is retained during sharpening. The carriage 70 is then moved to bring the grinding wheel 36 to the position shown in FIG. 26, i.e., with its outer surface just slightly spaced from the flag 448. This movement may be automatic or manual, and if automatic it may be user-initiated (such as via the user interface 34 of FIG. 1) or in some manner auto-initiated by detection of the presence of the alignment tool 440.

In one embodiment the movement of the grinding wheel 36 into the alignment position of FIG. 26 may employ the same components used for moving the carriage 70 during sharpening, i.e., the carriage motor 260 and rack-and-pinion mechanism. The grinding wheel 36 may be moved until it encounters the alignment tool 440, which can be sensed as an increase in the drive current through the carriage motor 260. Upon sensing this encounter, the controller 32 provides one or more brief pulses of reverse drive current to move the grinding wheel 36 slightly away from the alignment tool 440 to allow for the Y-direction adjustment of the motor arm and grinding wheel 36 as described further below. The movement away from the encounter position could alternatively be guided by use of a position encoder on the motor, for example if greater positional accuracy is needed.

In some configurations, the motor 260 can be a stepper motor 1260. In such configurations, it is possible to specifically define a calibration position. The stepper motor can cause movement of the grinding wheel to the location desired for the alignment operation. For example, the number of steps can be counted and the calibration positon can be determined based upon the number of steps. Moreover, the number of steps to a grinding wheel change location can be counted. As such, movement of the carriage to a location that allows for interchanging of grinding wheels can be provided with consistency and repeatability.

Figure 38:
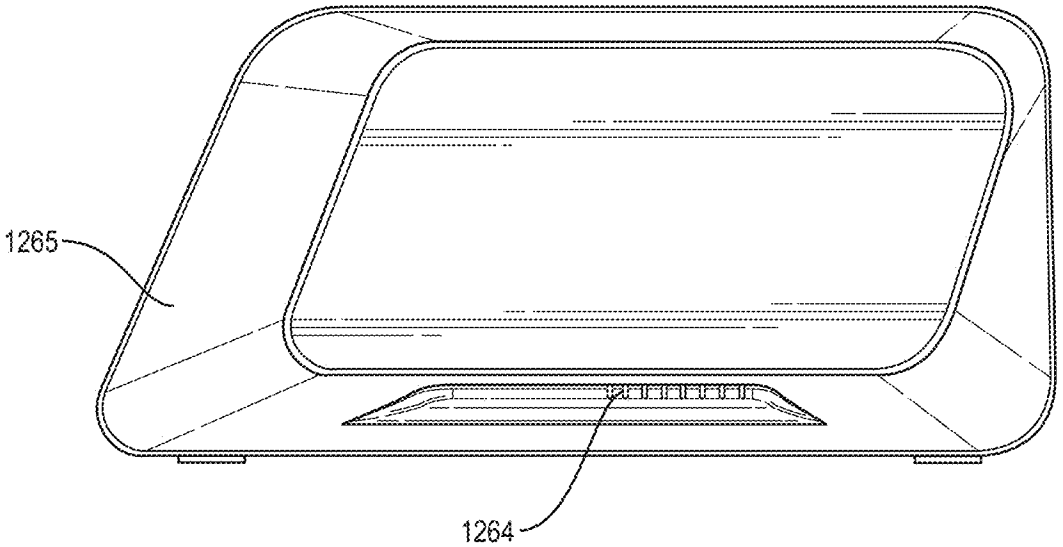
FIG. 38 is a right end view of the skate sharpening system of FIG. 36.
Figure 39:
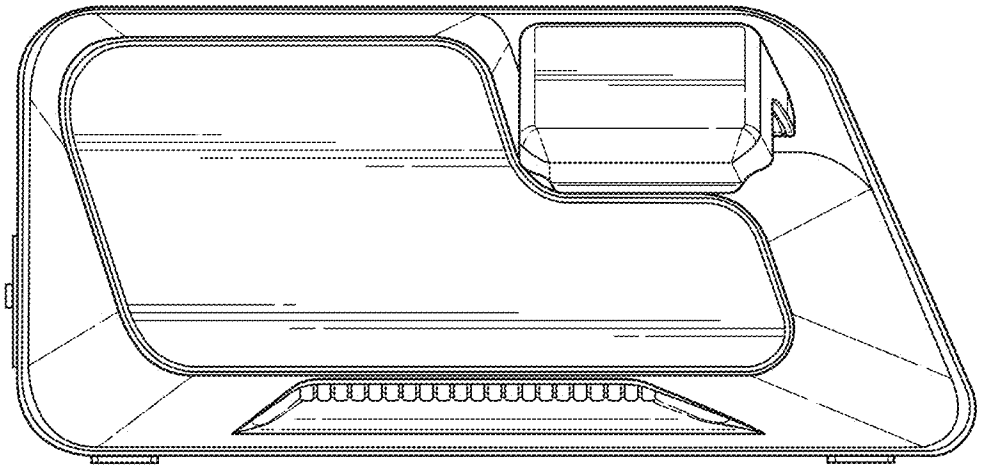
FIG. 39 is a left end view of the skate sharpening system of FIG. 36.
Figure 40:
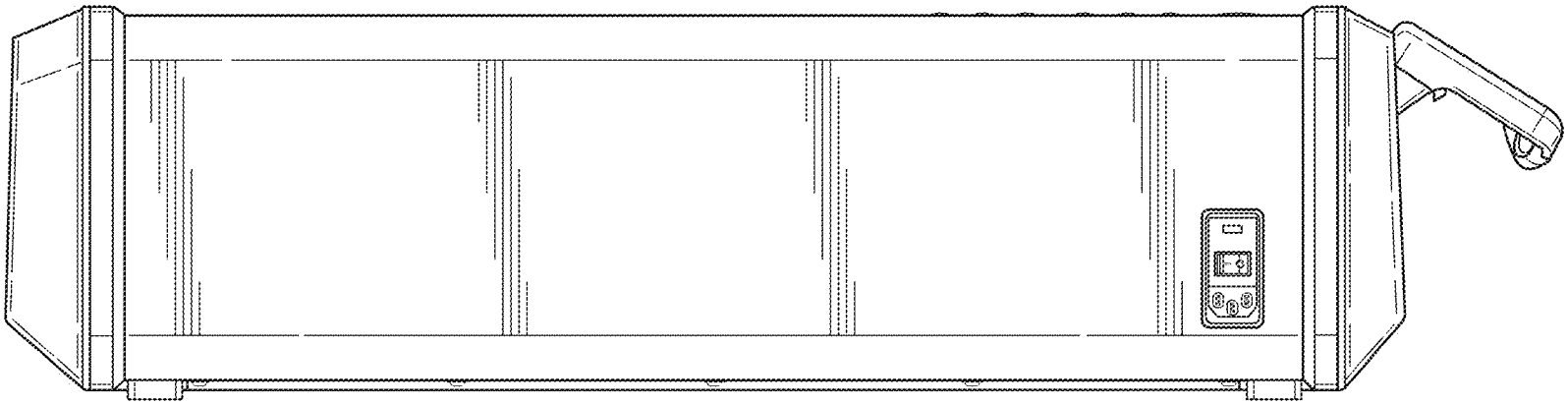
FIG. 40 is a rear view of the skate sharpening system of FIG. 36.
Figure 65:
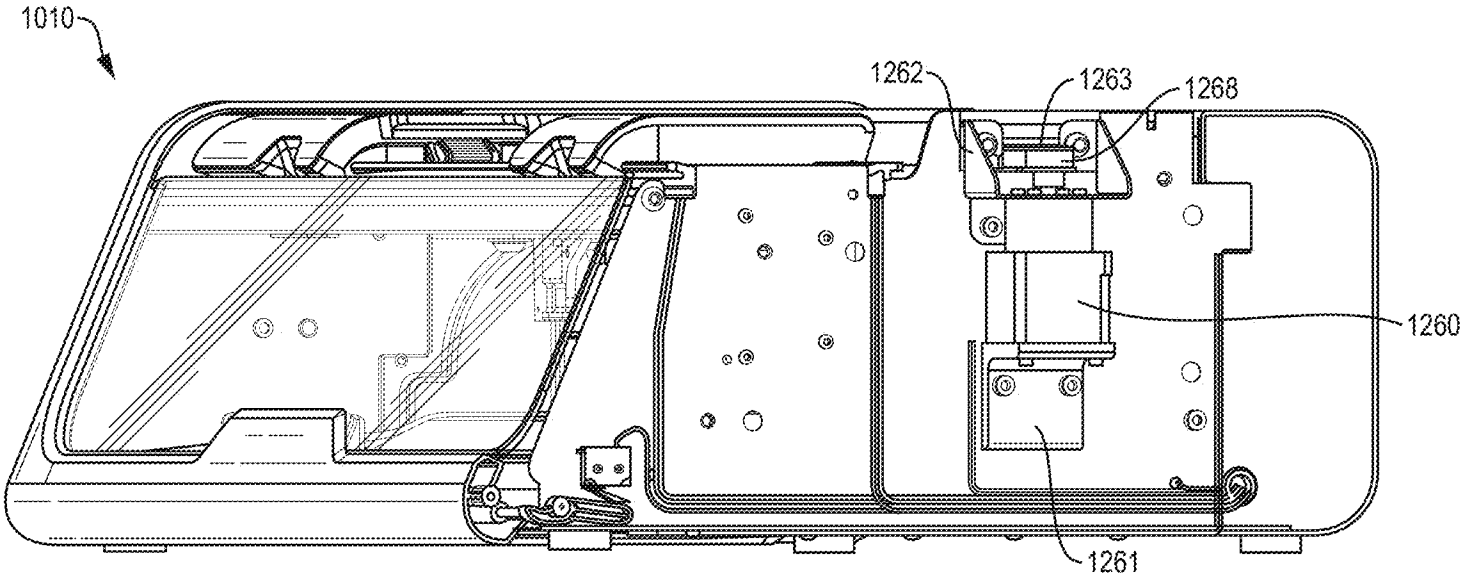
FIG. 65 is a front right perspective view with the right end cap removed to illustrate a stepper motor configuration.
Figure 66:
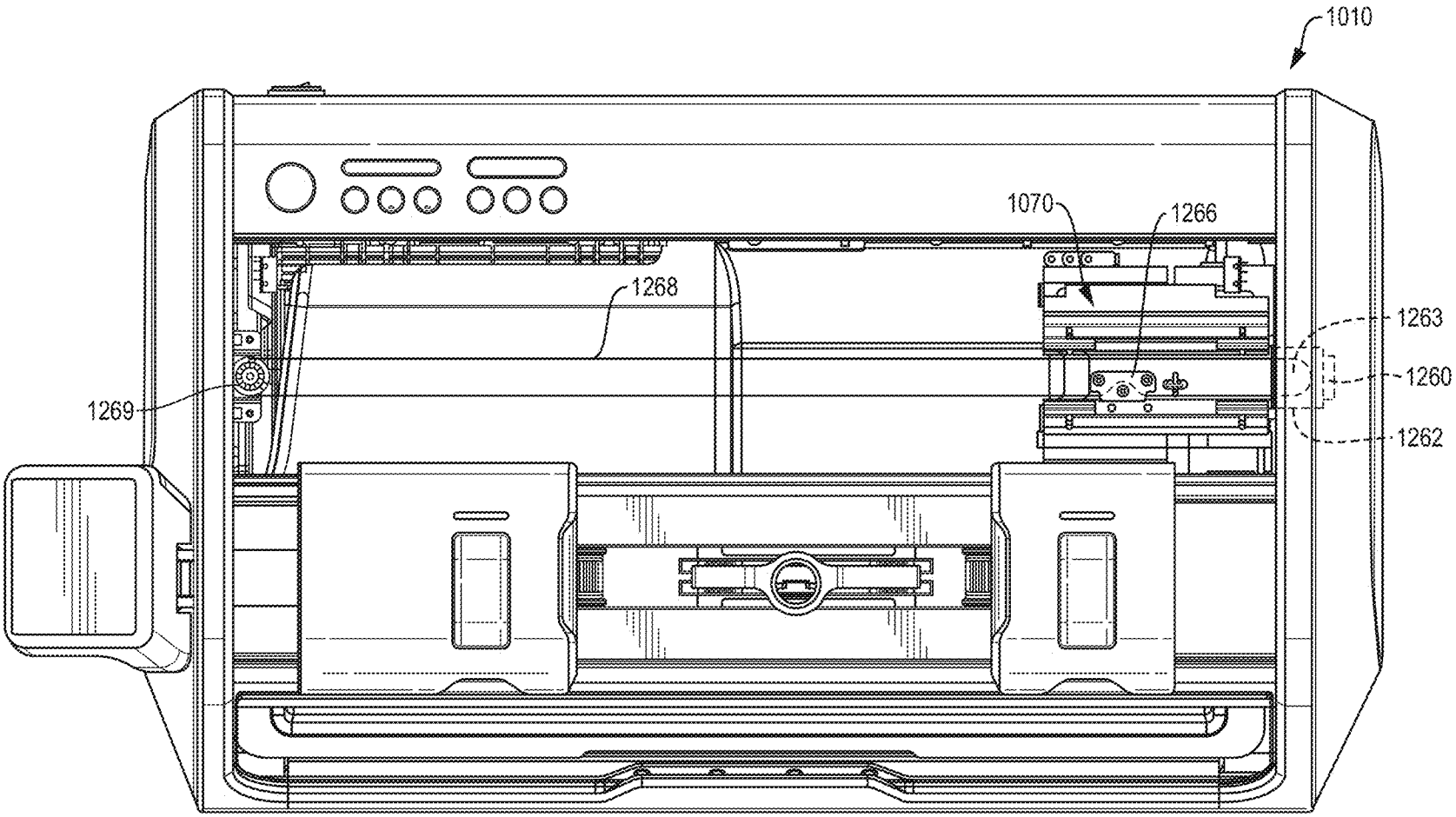
FIG. 66 is a top view of the skate sharpening system of FIG. 36 with a portion of the platform removed to expose the carriage assembly and drive belt assembly.
Figure 67:
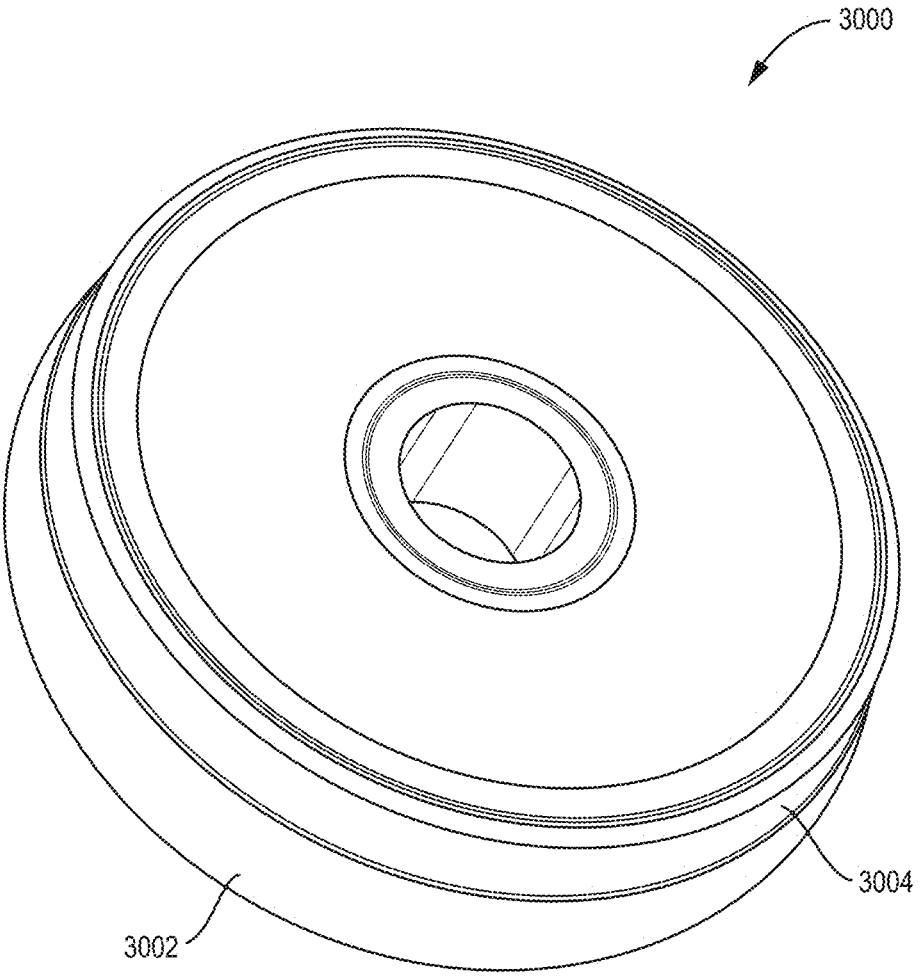
FIG. 67 is a perspective view of a grinding wheel construction.
Figure 68:
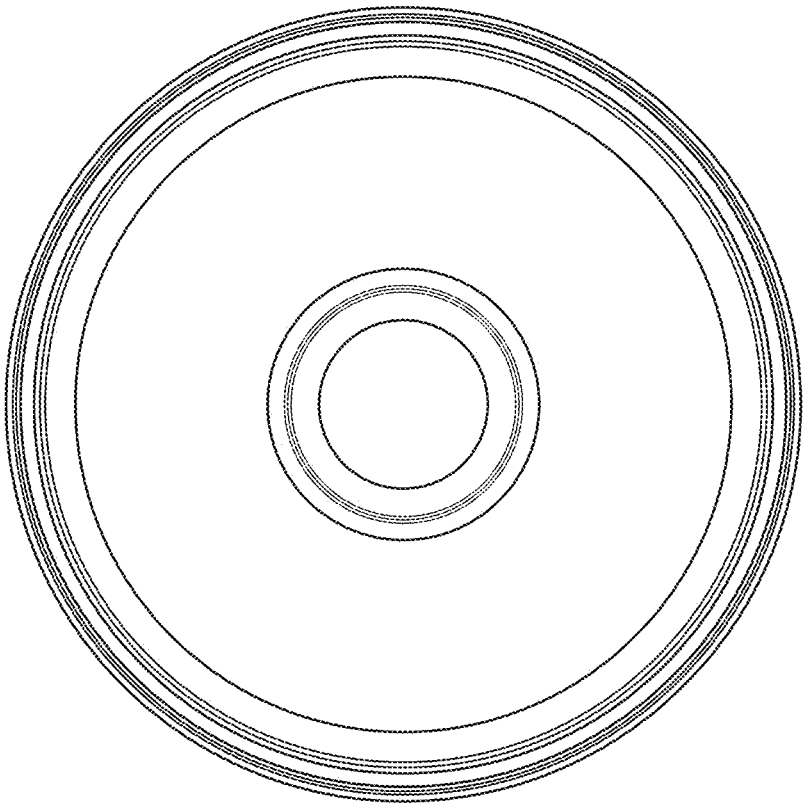
FIG. 68 is a front view of the grinding wheel construction.
Figure 69:
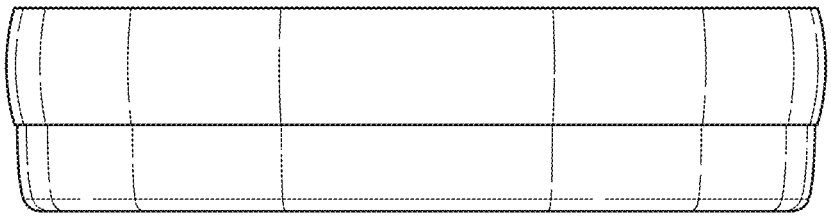
FIG. 69 is a top view of the grinding wheel construction (the bottom view, left view and right view will be identical)
Figure 70:
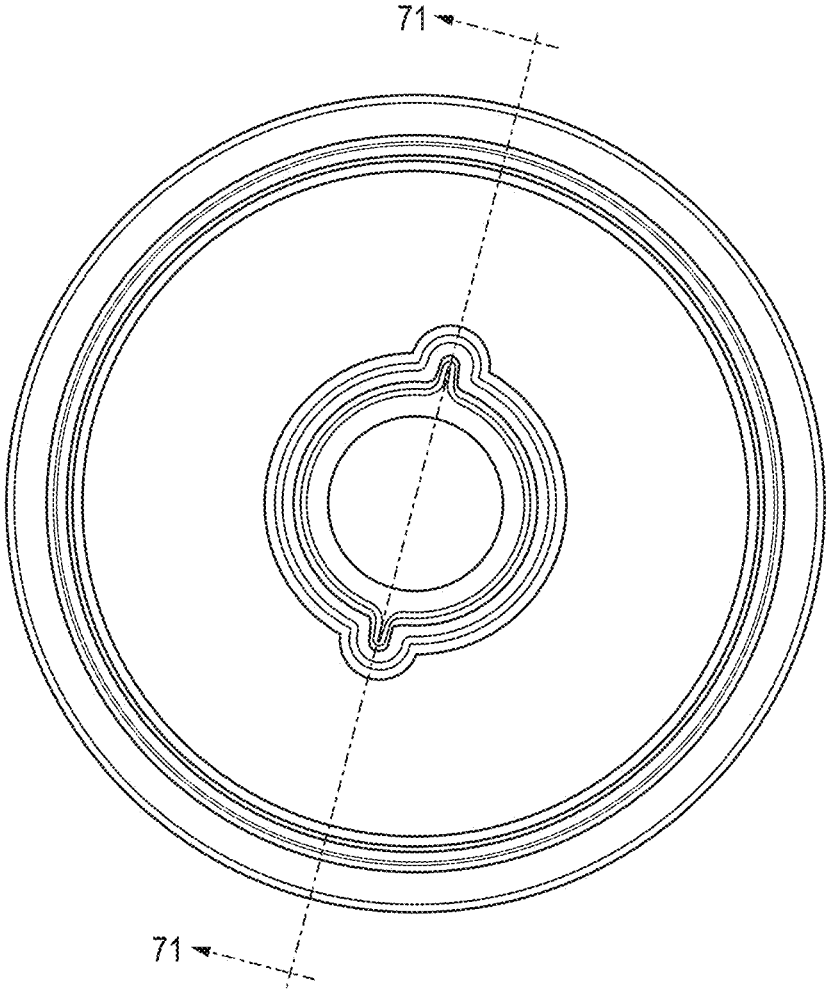
FIG. 70 is a rear view of the grinding wheel construction.

With reference to FIG. 65, the skate sharpener 1010 is illustrated with an end cover removed. The end cover defines a motor compartment that contains the motor 1260. The motor 1260 can be mounted to one or more heat sinks 1261. The heat sinks 1261 help to reduce the operating temperature of the motor 1260. A bracket 1262 also mounts the motor 1260 in position within the motor compartment. A drive pulley 1263 can be mounted to the shaft of the motor 1260. The pulley, bracket, motor and heat sink can be positioned within the motor compartment. As shown in FIG. 38 and FIG. 42, a vent 1264 can be provided in the end cover 1265. The vent 1264 facilitates air exchange during operation to also help lower the operating temperature of the motor 1260. Other configurations are possible. With reference to FIG. 64, the carriage assembly 1070 includes a belt grabber 1266. The belt grabber 1266 can be secured to the carriage assembly 1070 in any suitable manner. In one configuration, mechanical fasteners, such as threaded fasteners, can be used to secure the belt grabber 1266 to the carriage 1072. As shown in FIG. 66, an idler pulley 1269 can be positioned at an opposite end of the skate sharpener 1010 from the motor 1260. Thus, the belt 1268 can wrap around the two pulleys 1263, 1269 and be secured to the carriage assembly 1070.

The belt grabber 1066 can include a channel 1267 that receives a belt 1268 and secures the belt grabber 1066 in position along the belt 1268. In some configurations, a bend or the like is disposed along the channel 1267. In some configurations, the channel 1267 is generally V-shaped. In some configurations, the channel 1267 includes one or more teeth along the length of the channel. In some configurations, one wall that defines the channel 1267 includes a plurality of teeth. In some configurations, the belt 1268 includes teeth and the channel 1267 includes teeth that mesh with the teeth of the belt 1268. Other interlocking or coupling structures also can be used to join the belt 1268 to the carriage assembly 1070.

Figure 27:
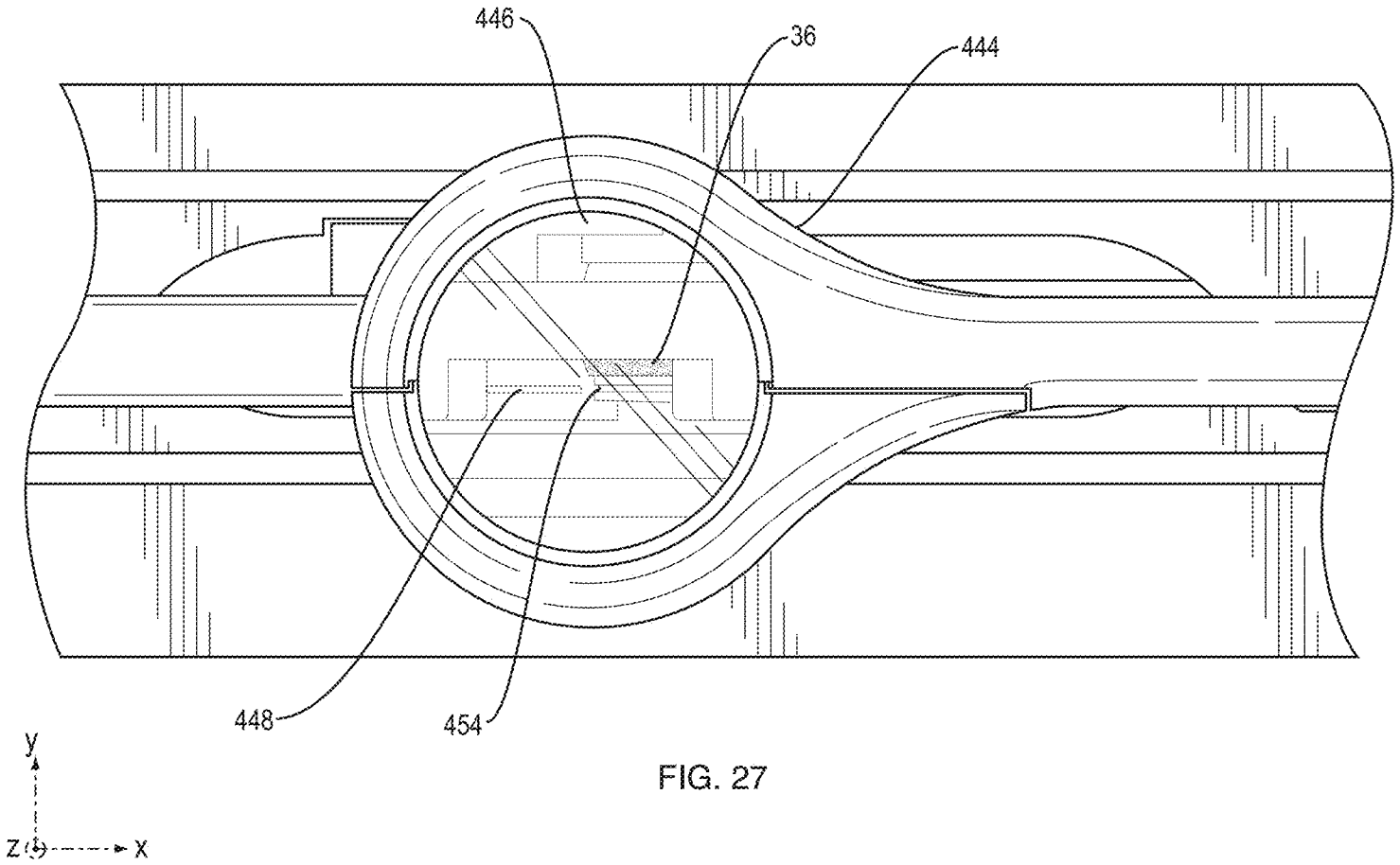
FIG. 27 is a plan view of an alignment tool in use.

FIG. 27 is a view downward through the magnifying lens 446. An area around the flag 448 is visible, with the grinding wheel 36 slightly spaced apart from it. The grinding wheel 36 has an annular notch 454 formed near its front face, which functions as a second visual reference feature as explained below. The notch 454 is precisely spaced from the centerline 430 of the grinding wheel 36 (FIG. 25) by the same amount as the spacing between the flag 448 and the centerline 432 between the jaws 90. Thus, when the flag 448 is aligned with the notch 454, as is shown in FIG. 27, the centerline 430 of the grinding wheel 36 is precisely aligned with the centerline 432 between the jaws 90, and hence with the centerline of the skate blade 40.

As indicated, FIG. 27 shows the aligned position. It will be appreciated that when the centerline 430 of the grinding wheel 36 is not aligned with the centerline 432 between the jaws 90, then the notch 454 is correspondingly offset from the flag 448 (in the up and down direction in FIG. 27) as an indication of such misalignment. A user can look through the magnifying lens 446 to view the area of the flag 448 and simultaneously turn the adjustment knob 242 (FIG. 14) to move the motor arm 78 and grinding wheel 36 in the transverse (Y) direction (up and down in FIG. 27) to bring these centerlines into alignment, thereby accurately aligning the grinding wheel 36 with the bottom of the skate blade 40 for a sharpening operation.

Figure 28:
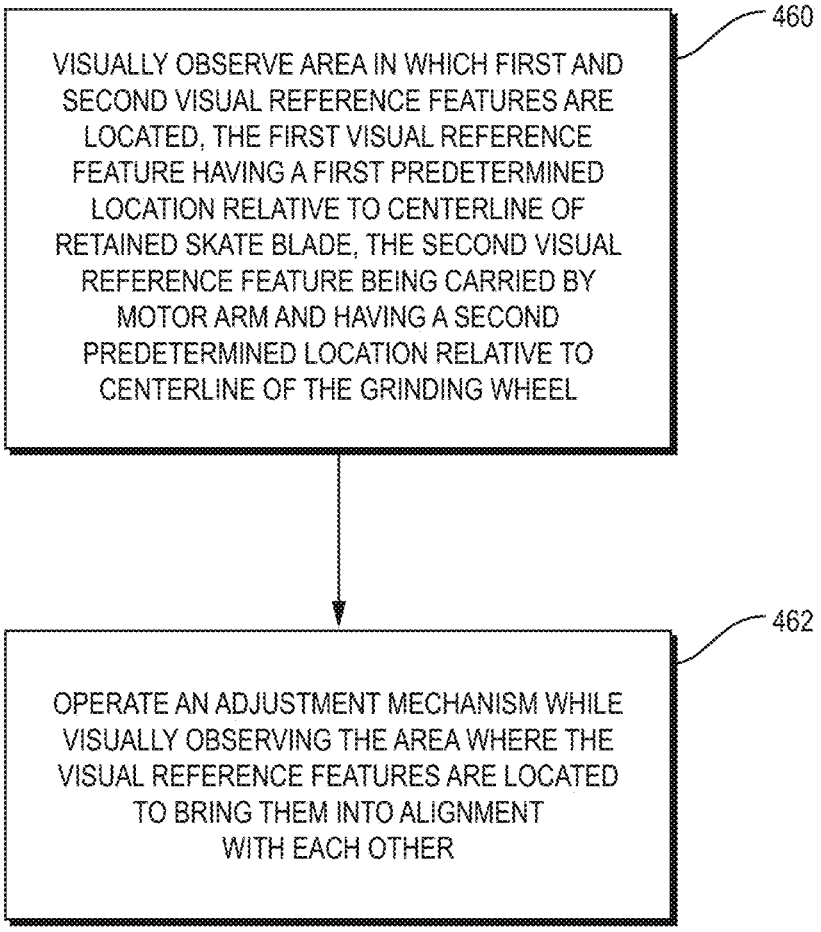
FIG. 28 is a flow diagram of an alignment process.

FIG. 28 is a simplified flow diagram for a process of aligning a grinding wheel to a retained skate blade. The process includes at 460 visually observing an area in which first and second visual reference features of the skate blade sharpening system are located, where the first visual reference feature has a first predetermined location relative to a centerline of the retained skate blade, and the second visual reference feature is carried by a motor arm that also carries the grinding wheel and that has a second predetermined location relative to a centerline of the grinding wheel. In one embodiment the first visual reference feature may be a feature like flag 448 on a separate fixture or tool such as the alignment tool 440 that is clamped in the sharpening position, so that the first visual reference feature is temporarily placed in position for the alignment operation. In alternative embodiments the first visual reference feature may be built in to the sharpening system 10, such as by incorporation into the jaws 90 for example. In one embodiment the second visual reference feature may be a notch or similar feature incorporated on the grinding wheel 36, such as described above.

The process further includes at 462 operating an adjustment mechanism while visually observing the area where the visual reference features are located to bring them into alignment with each other. This brings the grinding wheel and the retained skate blade into an aligned position in which the centerline of the grinding wheel is aligned with the centerline of the retained skate blade. In one embodiment the adjustment mechanism may be configured and used such as described above, but the adjustment mechanism may be realized in different ways in alternative embodiments.

Referring again to FIGS. 26 and 27, the visual reference features in the form of the flag 448 and notch 454 provide for detection of parallax that could affect accuracy of the adjustment. As generally known, parallax is a phenomenon by which two objects that are actually misaligned in a particular direction nonetheless appear aligned when viewed from a different direction. In the present context, parallax could potentially occur if a user is not directly above the flag 448.

Because the flag 448 has a height much greater than its thickness, if a user were viewing from a slightly incorrect angle then the flag 448 would appear thicker than when viewed from directly above. A user can adjust his/her viewing angle until the thickness is minimized. Alternatively, if light is striking the sides of the flag 448 then the illuminated sides will be slightly visible when the flag 448 is viewed off-angle. The notch 454 also provides for parallax detection, because it will only be visible as a notch when viewed from directly above. When the area of the notch 454 is viewed off-angle, the notch is visually filled by its own inside surface.

It is noted that the placement of the notch 454 toward an edge of the grinding wheel 36 has significance. Proper grinding occurs at the center of the grinding wheel 36, so if the alignment mark were placed at the center of the grinding wheel 36 then it would be affected by grinding and potentially lose its ability to function as an alignment mark. It might even be erased completely before the end of the usable lifetime of the grinding wheel 36. When formed as a notch or similar feature, it might also compromise the quality of the sharpening. By placing the alignment mark in the form of the notch 454 nearer the edge or face of the grinding wheel 36 it is not affected by the normal wearing of the abrasive over a period of use, and it does not interfere with grinding.

Alternative Grinding Wheels and Alignment Wheels

With reference now to FIGS. 67-75, a further configuration for a grinding wheel 3000 will be described. As illustrated, the grinding wheel 3000 generally comprises a grinding ring 3002 and a hub 3004. The grinding ring 3002 generally is a single metallic component while the hub 3004 comprises one or more components with one or more of the one of more components being formed of a non-metallic material. In some configurations, the entire hub 3004 is formed of non-metallic materials except for the presence of an enclosed or encased or otherwise secured communications component.

Figure 71:
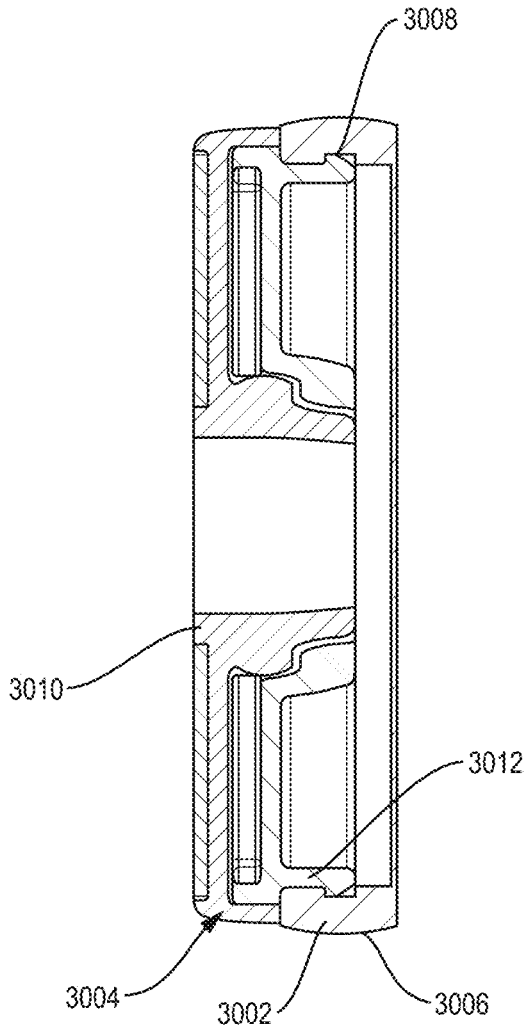
FIG. 71 is a sectioned view of the grinding wheel construction taken along the line 71-71 in FIG. 70.

With reference to FIG. 71, the grinding ring 3002 can be configured with an abrasive outer surface 3006. As described above, the abrasive outer surface is used for removing material from a skate blade during operation of the skate sharpener. In one embodiment the abrasive surface may include a diamond or cubic boron nitride (CBN) coating, deposited by electroplating for example. The grinding ring 3002 preferably is formed of steel or similar rigid, strong metal, and it may be fabricated from steel tubing or bar stock. The grinding ring 3002 has an outer surface that is formed to a desired radius. For example, the grinding ring 3002 is CNC machined to a desired radius (i.e., to match a desired radius of hollow). By forming the outer surface to the desired radius of hollow and then plating the abrasive to this formed out surface, dressing of the grinding surface can be eliminated before and/or during use. In some configurations, the ring 3002 has a diameter of 42 mm.

The grinding ring 3002 preferably comprises an exposed inner surface 3003. In other words, this inner surface 3003 is not covered by any portion of the hub 3004. In some configurations, the edge between a radially extending surface 3001 and the axially extending inner surface 3003 is chamfered. The chamfered corner assists with mounting of the grinding wheel 3002 onto the receiving portion of the skate sharpening system.

In some configurations, the inner surface 3003 has a diameter of between 25 mm and 100 mm. In some configurations, the inner surface 3003 has a diameter of 37 mm. In some configurations, the inner surface 3003 has an axial length of between 1 mm and 5 mm. In some configurations, the axial length of the inner surface 3003 is at least 2.0 mm. In some configurations, the axial length of the inner surface 3003 is 2.3 mm In other words, a distance of at least 2 mm is provided between the radial surface 3001 and any other component such that a mounting clearance is defined. Such configurations advantageously result in an axial gap being initially formed between the hub 3004 and the end surface of the arbor (see FIG. 9). This axial gap facilitates a solid face-to-face mating between the metallic grinding ring and the metallic arbor. Thus, heat transfer between the metallic grinding ring 3002 and the metallic arbor can be enhanced through the direct contact. The axial gap is initially present and through the force applied by the retention nut 508, the axial gap is eliminated as the hub 3004 yields under the force. Once the axial gap has been eliminated, the retention nut bottoms out as there is no additional rotation remaining in the nut and this gives positive feedback to the user that sufficient torque has been applied to the nut. Without a feature such as this, the user would have a much harder time deciding how much torque was sufficient to secure the grinding ring. This configuration provides the radial surface 3001 of the grinding ring 3002 for aligning the grinding ring with the arbor. Because the arbor and grinding ring are sized within a close tolerance, the mating surfaces of the grinding ring and arbor can provide the source of the connection to the motor, and not the hub 3004, which is merely used to provide a surface that abuts against a nut or other threaded fastener. As such, creating a true rotation of the ring 3002 is more likely than in situations where the hub 3004 defines the connection location.

The grinding ring 3002 comprises an inner groove 3008. The inner groove 3008 is formed on an inner surface of the grinding ring 3002. At least one face of the inner groove 3008 defines a catch surface. The catch surface, as will be described, interfaces with the hub 3004 to lock the grinding ring 3002 to the hub 3004. To simplify manufacture, the groove 3008 preferably is centered between axial ends of the grinding ring 3002.

With continued reference to FIG. 71, the hub 3004 comprises a first hub component 3010 and a second hub component 3012. The first and second hub 3010, 3012 components can be secured together in any suitable manner. In some configurations, the first hub component 3010 and the second hub component 3012 can snap-fit together.

Figure 74:
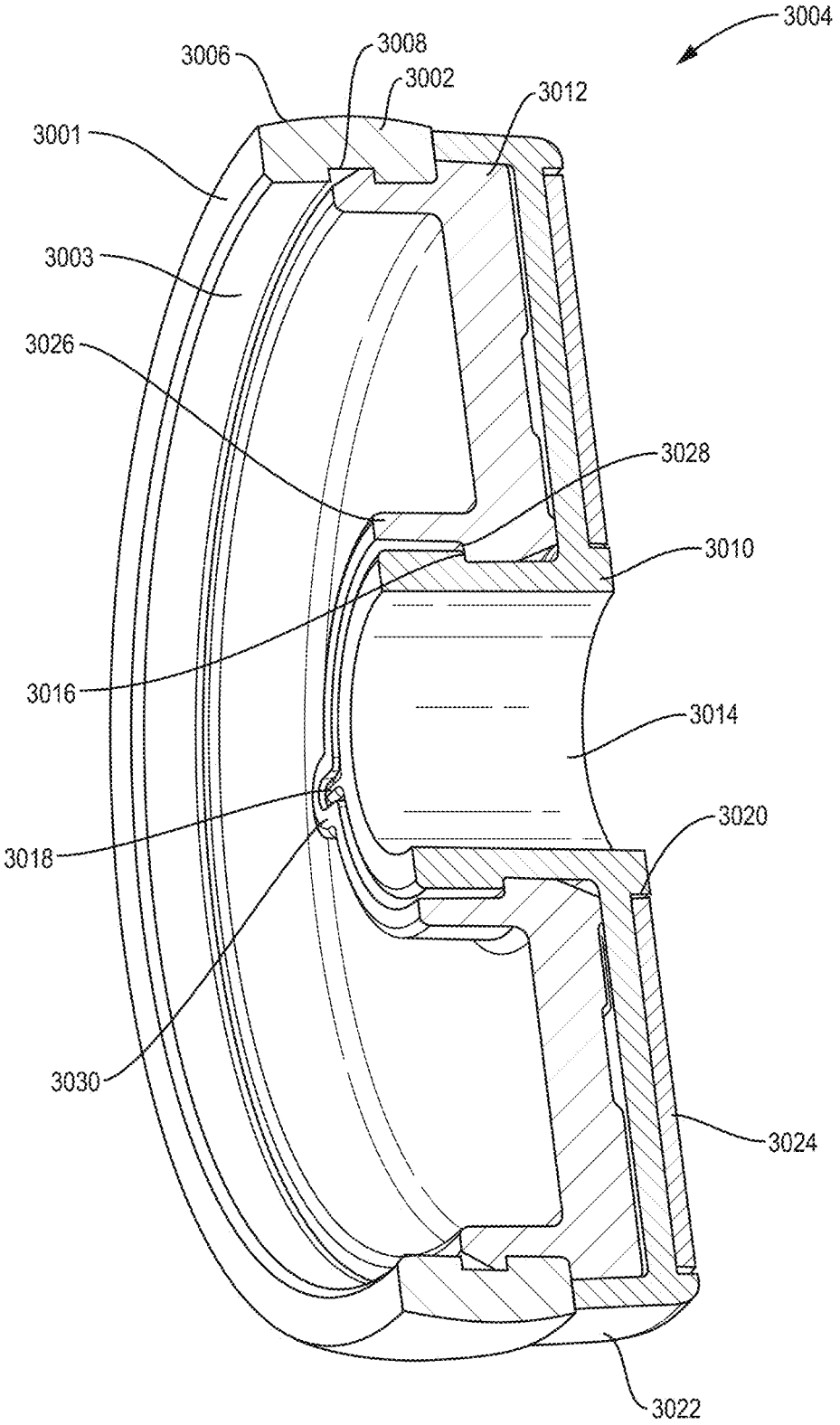
FIG. 74 is a sectioned perspective view of the grinding wheel construction of FIG. 67.
Figure 75:
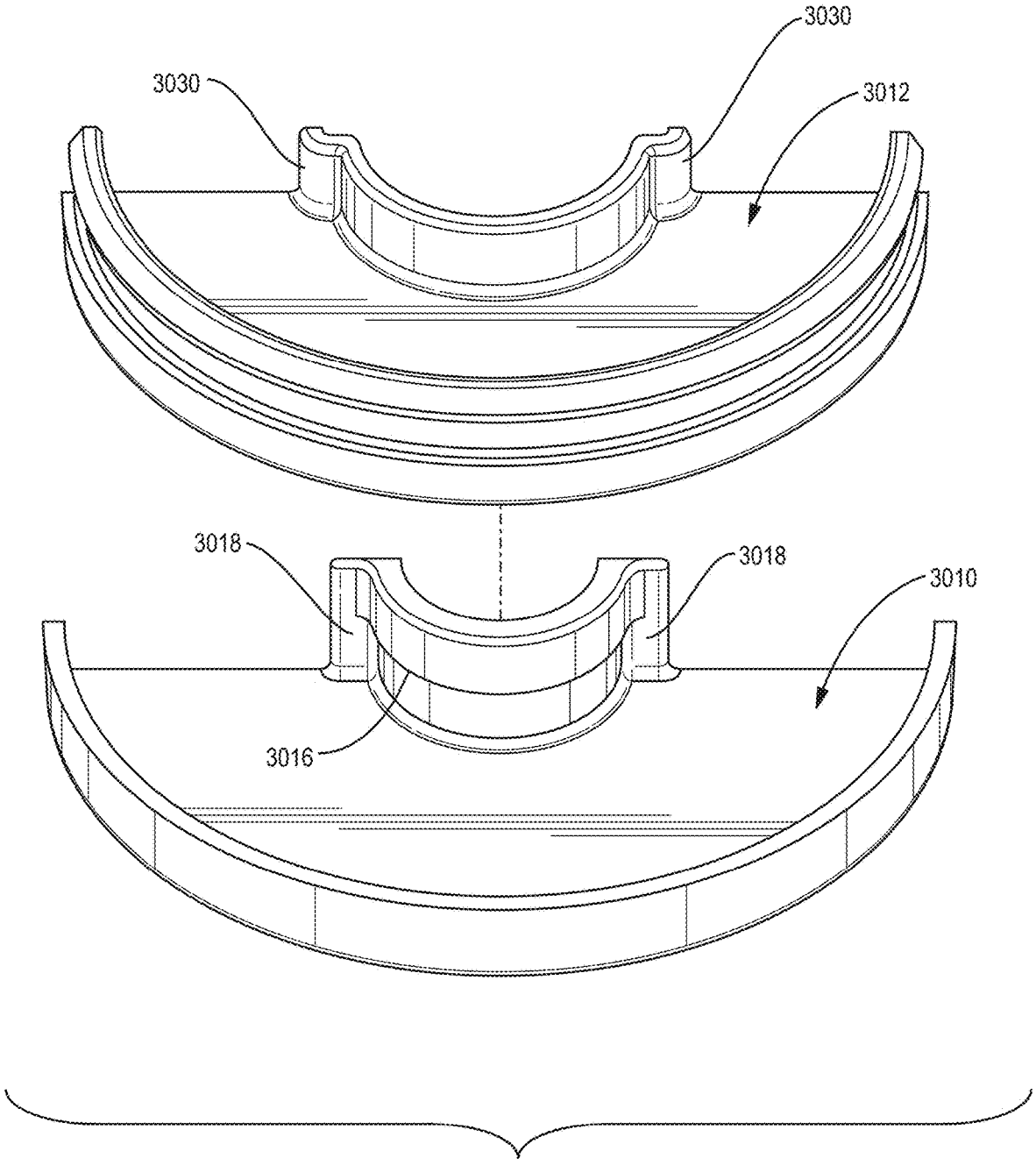
FIG. 75 is an exploded sectioned perspective view of a hub assembly of the grinding wheel of FIG. 67.

With reference to FIG. 74, the first hub component can comprise an axially extending sleeve portion 3014. An inner surface of the sleeve portion 3014 can be configured to receive an axle of the skate sharpener 1010. An outer surface of the sleeve portion 3014 can include a shoulder 3016. The shoulder 3016 can be formed by an outer recess or the like. In some configurations, the shoulder 3016 does not extend fully around the sleeve portion 3014. In the illustrate configuration, the shoulder 3016 is interrupted by at least one finger 3018, as shown in FIG. 75.

As also shown in FIG. 74, the first hub component 3010 also includes a recess 3020 defined on an opposite end to the location of the finger 3018. The recess 3020 extends radially outward to an outer shoulder 3022. The outer shoulder 3022 is slightly smaller in outer diameter than the grinding ring 3002. The recess 3020 defines a cavity that receives a label 3024 or the like. The label 3024 can be used to help visually identify one or more characteristics of the grinding wheel 3000.

With reference again to FIG. 74, the second hub component 3012 also comprises a central sleeve portion 3026. The central sleeve portion 3026 includes one or more ridge 3028 or the like, The ridge 3028 is sized and configured to interface with the shoulder 3016 of the first hub component 3010. In the illustrated configuration, the ridge 3028 extends circumferentially around an inner portion of the central sleeve portion 3026. As discussed with the first hub component 3010, the ridge 3028 is interrupted by one or more fingers 3030. In order to accommodate the finger 3018 of the first hub component 3010, the fingers 3030 of the second hub component define a gap. The gap advantageously enables the ridge 3028 to have sufficient flex to allow the second hub component 3012 to snap fit to the first hub component 3010. In this manner, once secured together, the first and second hub components 3010, 3012 are difficult to separate. In some configurations, the first and second hub components 3010, 3012 are secured together without the need for an adhesive, cohesive or welding agent.

Figure 73:
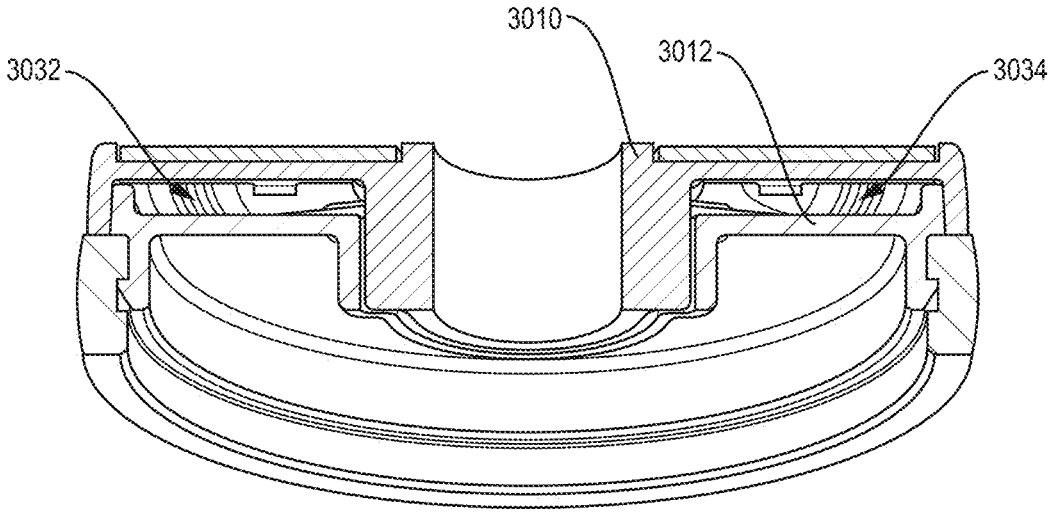
FIG. 73 is a sectioned perspective view of the grinding wheel construction of FIG. 67.

With reference to FIG. 73, a chamber 3032 can defined between the first and second hub components 3010, 3012. The chamber 3032 receives one or more communication components. In one configuration, a circular RFID tag 3034 is positioned within the chamber 3032. In some configurations, more than one RFID tag can be positioned within the chamber. In some configurations, the communication component is annular in shape. In some configurations, the communication component is more than one communication component and not annular in shape. When the two hub components 3010, 3012 are secured together, the communications components 3034 are protected from tampering. In some configurations, any attempts to gain physical access to the communications components 3034 will result in damage or mutilation of one or more of the hub components 3010, 3012. As such, the security of the communications component 3034 can be protected.

Figure 72:
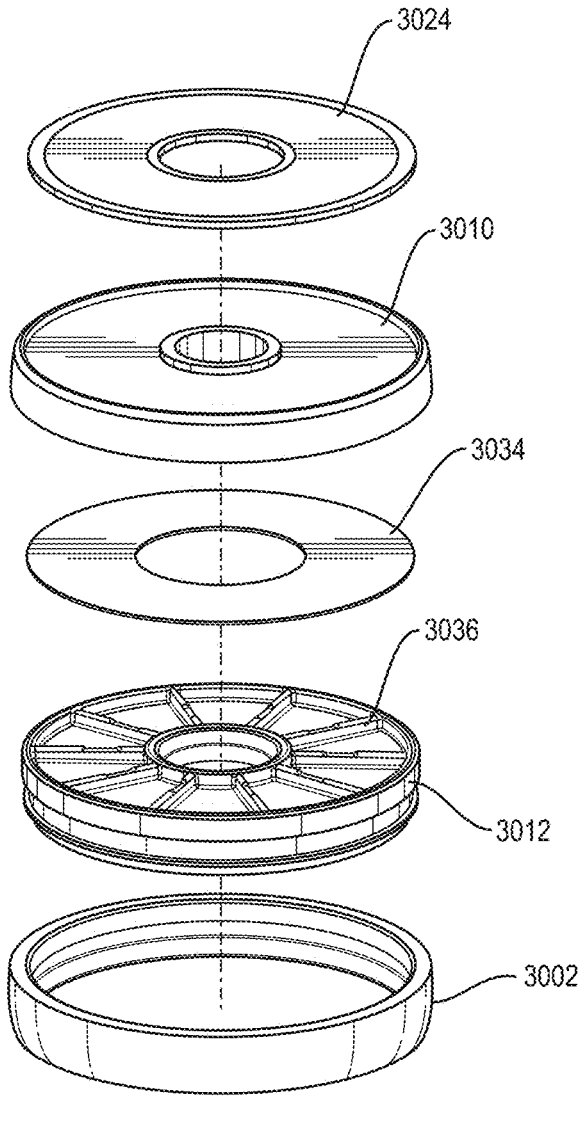
FIG. 72 is an exploded perspective view of the grinding wheel construction of FIG. 67.

With reference to FIG. 72, the second hub component 3012 includes one or more ribs 3036. In some configurations, the ribs 3036 can be formed on the first hub component 3010 or a portion of the ribs 3036 can be formed on each of the first hub component 3010 and the second hub component 3012. The ribs 3036 act as stand-offs for the communications component 3034 while securing the communications component 3034 in a desired axial location relative to the grinding ring 3002.

Because the communication component 3034 works by receiving energy from the sensor module 1222, the communications component 3034 preferably is spaced apart from the metal of the grinding ring 3002 to improve performance. In other words, as shown in the sectioned view of FIG. 73, for example, the ring 3002 is axially offset from the communications component 3034. In some configurations, the axial offset is between 0.5 mm and 20 mm. In some configurations, the axial offset is between 1 mm and 10 mm. In some configurations, the axial offset is between 2 mm and 3 mm. In some configurations, the axial offset is 2.5 mm. In some configurations, the grinding wheel can be dish-shaped but allow sufficient radial offset from the outer ring of the grinding wheel to facilitate communications. Similarly, where the grinding wheel is formed of a metallic material, holes or openings could be provided in the region of the communications component 3034 to improve communication performance.

In some configurations, when the grinding wheel 3000 is mounted to the skate sharpener 1010, the location of the communications component 3034 is axially offset between 10 mm and 40 mm from the RFID antenna component within the sensor module 1222.

In some configurations, the RFID antenna component and the communications component 3034 are axially offset between 15 mm and 25 mm. In some configurations, the axial offset is 20 mm. Such a configuration and such spacings have been found to position the communications component 3034 close enough to the RFID antenna of the sensor module 1222 to power the communications component 3034 yet distance the communications component 3034 from the grinding ring 3002 sufficiently to reduce the interference and energy absorption caused by the grinding ring 3002. Thus, in the illustrated configuration, there is an axial offset in location between an axially outermost portion of the grinding ring 3002 and the axial location of the communications component 3034. Moreover, the communications component 3034 is mounted to a non-metallic component (e.g., the hub 3004.

Figure 29:
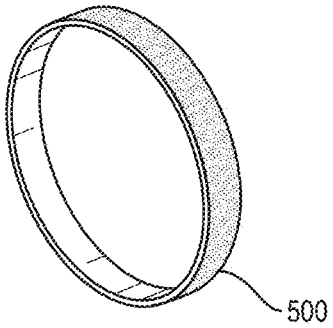
FIG. 29 is a perspective view of a grinding ring, which is useable alone or in an assembly as a portion of a grinding wheel.

FIGS. 29-34 illustrate an alternative embodiment employing a slightly different alignment scheme and alignment components. Shown in FIG. 29 is an alternative grinding wheel 500 lacking an alignment feature such as the alignment notch 454 of the grinding wheel 36 as described above. The grinding wheel 500 may in all other respects be similar or identical to the grinding wheel 36. It also may be somewhat simpler and less expensive to manufacture.

When manufacturing the grinding wheel 36, certain processing steps are used specifically to form the notch 454. Such steps are not required in manufacturing the grinding wheel 500. Moreover, the additional grinding wheel width that provides sufficient footprint to accommodate the notch 454 is less desired from a true-spin perspective. Thus, in some configurations, providing a grinding wheel that does not include the notch 454 may be desirable. However, the alignment between the grinding wheel and the skate blade still is desired. As described below, a separate alignment wheel is used for the alignment process.

Figure 30:
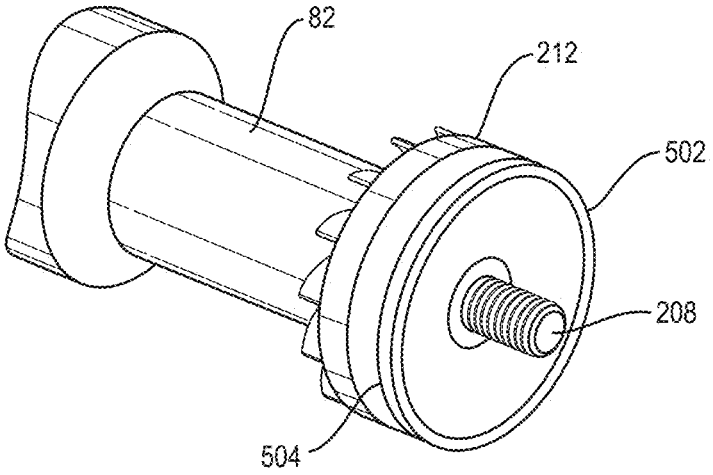
FIG. 30 is a perspective view of an arrangement having an alignment wheel mounted on a spindle.

FIG. 30 shows an alignment wheel 502 in position on the axle 208 of the spindle 82.

The alignment wheel 502 has precise similarity to the grinding wheel 500 so that it occupies the same wheel-mounting location against the arbor 212 as occupied by the wheel 36 as described above. As shown, the alignment wheel 502 includes an alignment notch 504 toward its outer face, similar to the notch 454 on grinding wheel 36. The notch 504 serves as a visual reference feature in the same manner as described above for the notch 454. In this embodiment as described more below, an alignment process results in aligning the wheel-mounting location with the skate blade through use of the alignment wheel 502. The alignment wheel 502 is then replaced with the grinding wheel 500 which is then inherently aligned with the skate blade because it occupies the aligned wheel-mounting location. When the alignment wheel 502 has been aligned and then replaced with the grinding wheel 500, the centerline of the grinding wheel 500 is precisely aligned with the centerline 432 of the jaws 90, just as described above with reference to FIGS. 25 and 27.

Figure 31:
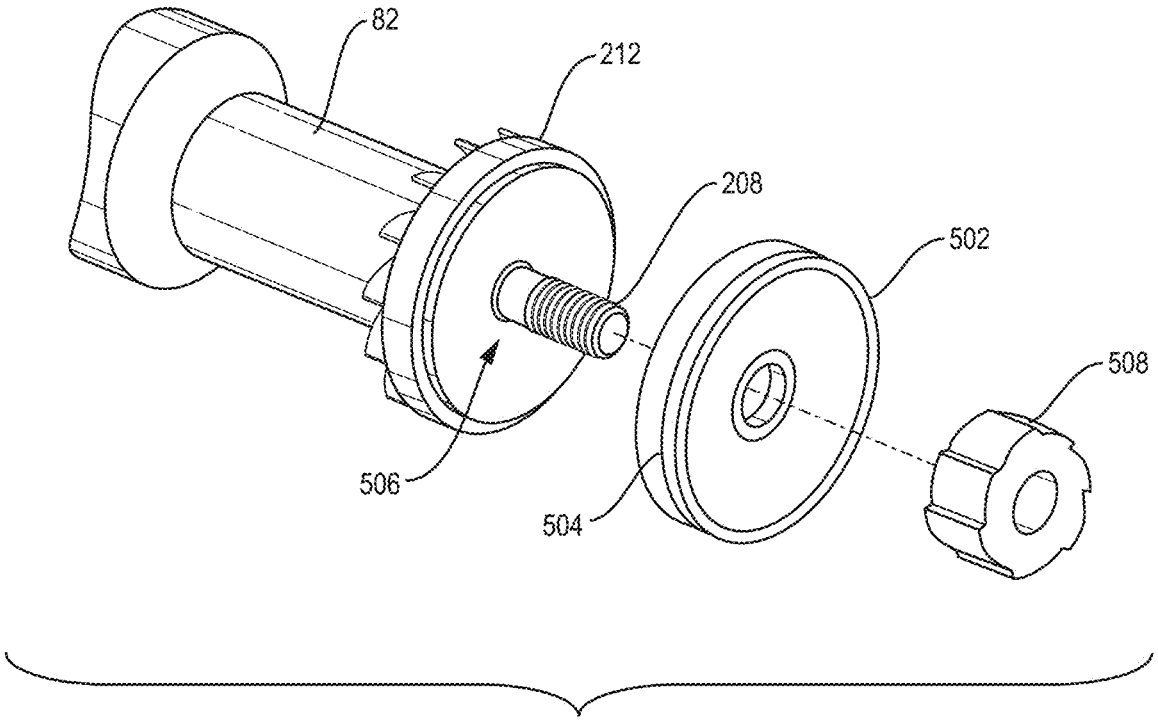
FIG. 31 is a perspective exploded view of arrangement of FIG. 30.

FIG. 31 shows additional details. The alignment wheel 502 is preferably of one-piece construction of a material such as metal or thermoplastic and mechanically preferably mimics the multi-piece grinding wheel assembly 36 (see FIG. 9). As indicated, the alignment wheel 502 is mounted against the arbor 212 at a wheel-mounting location 506 and is retained by a retention nut 508.

In some embodiments, the alignment wheel is a noncircular shape. For example, the alignment wheel can be oblong, square, octagonal, or another geometric shape. In some embodiments the alignment wheel can be asymmetric, where the alignment wheel is not symmetric about an axis.

Figure 32:
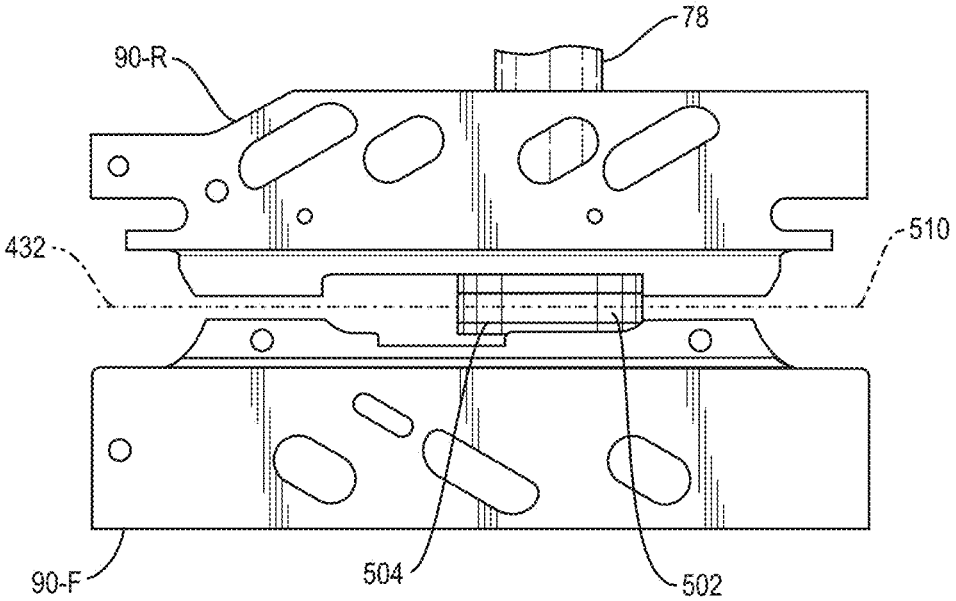
FIG. 32 is a schematic depiction of alignment between clamping jaws and an alignment wheel.

FIG. 32 is a counterpart of FIG. 25 for an embodiment using the alignment wheel 502. This view is of an aligned position in which a centerline 510 of the alignment wheel 502 is aligned with the centerline 432 of the sharpening position of the skate blade (midway between the clamping surfaces of the jaws 90). The alignment wheel 502 can be moved transversely (up and down in the view of FIG. 32) by the above-described Y-adjustment mechanism, changing the position of the alignment wheel centerline 510 with respect to the centerline 432 of the skate blade.

Figure 33:
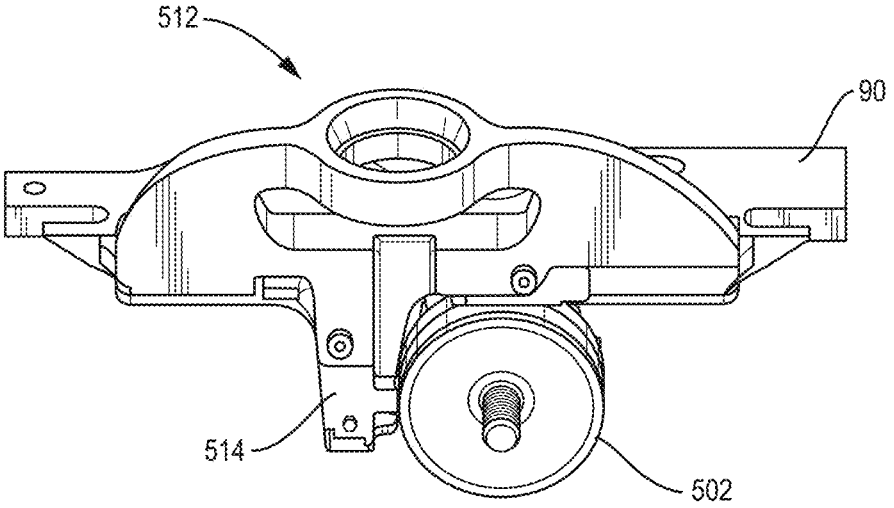
FIG. 33 is a side elevation view of an alignment tool in use with an alignment wheel.

FIG. 33 is a counterpart of FIG. 26 showing use of an alignment tool 512 similar to the alignment tool 440. In particular, the alignment tool 512 includes a flag 514 serving as a visual reference feature in the same manner as the flag 448 of alignment tool 440. The alignment tool 512 differs in appearance from the alignment tool 440, but not in its essential structure and function. The alignment tool 512 could be used in an alignment scheme using a notched grinding wheel 36 such as described above, and the alignment tool 440 could be used in an alignment scheme using a separate alignment wheel 502 as described with reference to FIGS. 29-35.

Figure 34:
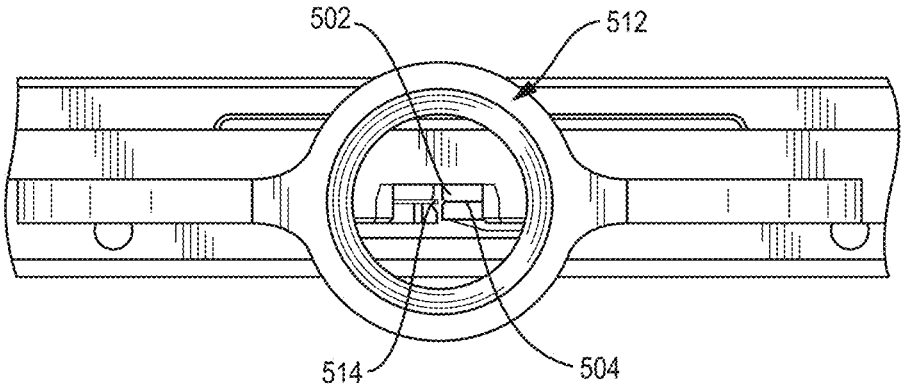
FIG. 34 is a plan view of an alignment tool in use with an alignment wheel.

FIG. 34 is a counterpart of FIG. 27 showing a similar downward view during an alignment process. An aligned position is shown in which the flag 514 is aligned with the notch 504 of the alignment wheel 502.

In some embodiments, the motor arm may be configured to incorporate the second visual reference feature. The position of the second visual reference feature on the motor arm can be positioned such that the motor arm can be moved to an aligned position without using a separate alignment component (such as an alignment wheel). In some embodiments, the second visual reference feature can be incorporated into the arbor 212. For example, the second visual reference feature can be an alignment notch positioned on the arbor 212. In some embodiments, the second visual reference feature can be positioned on another location of the motor arm.

Figure 35:
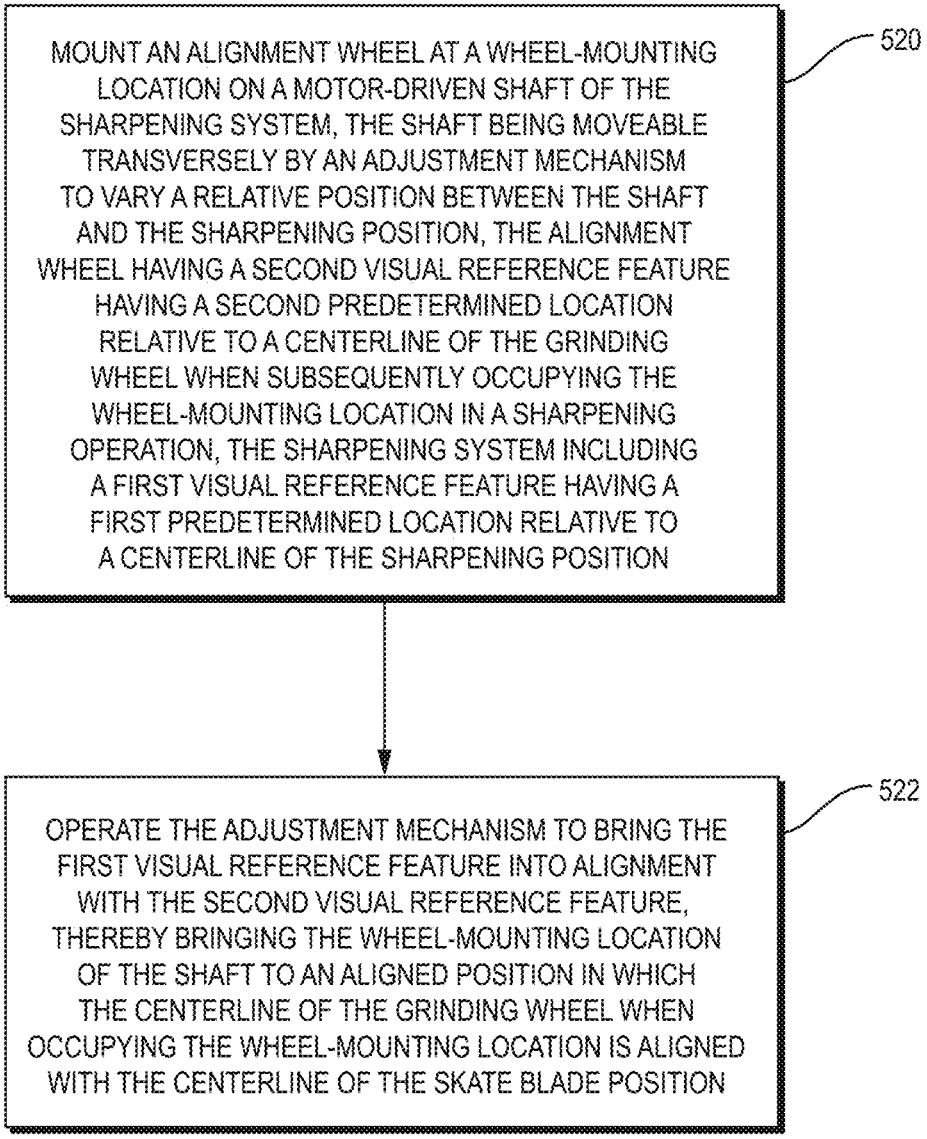
FIG. 35 is a flow diagram of an alignment process using an alignment wheel.

FIG. 35 is a counterpart of FIG. 28, illustrating a process of aligning the grinding wheel 500 to a retained skate blade. The process includes use of a first visual reference feature having a first predetermined location relative to a centerline of the sharpening position. In one embodiment a first visual reference feature can be a flag of an alignment tool (e.g., flag 514 of alignment tool 512).

The process of FIG. 35 includes, at 520, mounting an alignment wheel at a wheel-mounting location (e.g., location 506) on a motor-driven spindle of the sharpening system, the spindle being movable transversely by an adjustment mechanism to vary a relative position between the spindle and the sharpening position. The alignment wheel has a second visual reference feature (e.g., notch 504 of alignment wheel 502) having a second predetermined location relative to a centerline of the grinding wheel when subsequently occupying the wheel-mounting location in a sharpening operation.

The process further includes, at 522, operating the adjustment mechanism to bring the first visual reference feature into alignment with the second visual reference feature, thereby bringing the wheel-mounting location of the spindle to an aligned position in which the centerline of the grinding wheel when occupying the wheel-mounting location is aligned with the centerline of the skate blade position. The alignment may be achieved by visually monitoring relative positions of the visual reference features while operating the adjustment mechanism.

Although the alignment processes and apparatus as described herein contemplate a human user who looks through the magnifying lens 446 and rotates the adjustment knob 242, it will be appreciated that in alternative embodiments a more automated process may be used. For example, some manner of machine vision or other apparatus may be used to monitor relative position between the grinding wheel 36 and alignment tool or between the alignment wheel 502 and the alignment tool, and the adjustment mechanism may be driven by an adjustment motor provided with an electrical adjustment signal. In an embodiment employing automation, a controller can then perform the process of FIG. 28 or FIG. 35 based on position information from the position-monitoring apparatus and by generating the electrical adjustment signal to change the relative positions of the respective components accordingly until an aligned position is detected. Alternatively, in a less automated system, the offset may be displayed in numbers or graphics to a human user who controls the adjustment.

Dust Capture and Control

During any grinding operation, the skate sharpener 1010 will generate dust or debris associated with the metal being removed from the skate blade being sharpened. Desirably, the skate sharpener 1010 can be configured for use in a household environment. For at least this reason, dust containment is desired. More particularly, because the skate sharpener 1010 can have one or more light transmissive or transparent components that allow users or observers to see inside of the skate sharpener, dust containment and management is a consideration.

With reference now to FIGS. 76-79, an example of a dust containment and removal configuration for the skate sharpener 1010 will be described. The configuration provides a flow of air through the machine while filtering the exhaust and providing one or more components designed to contain and/or retain the dust within the machine until such time as cleaning is desired.

Figure 76:
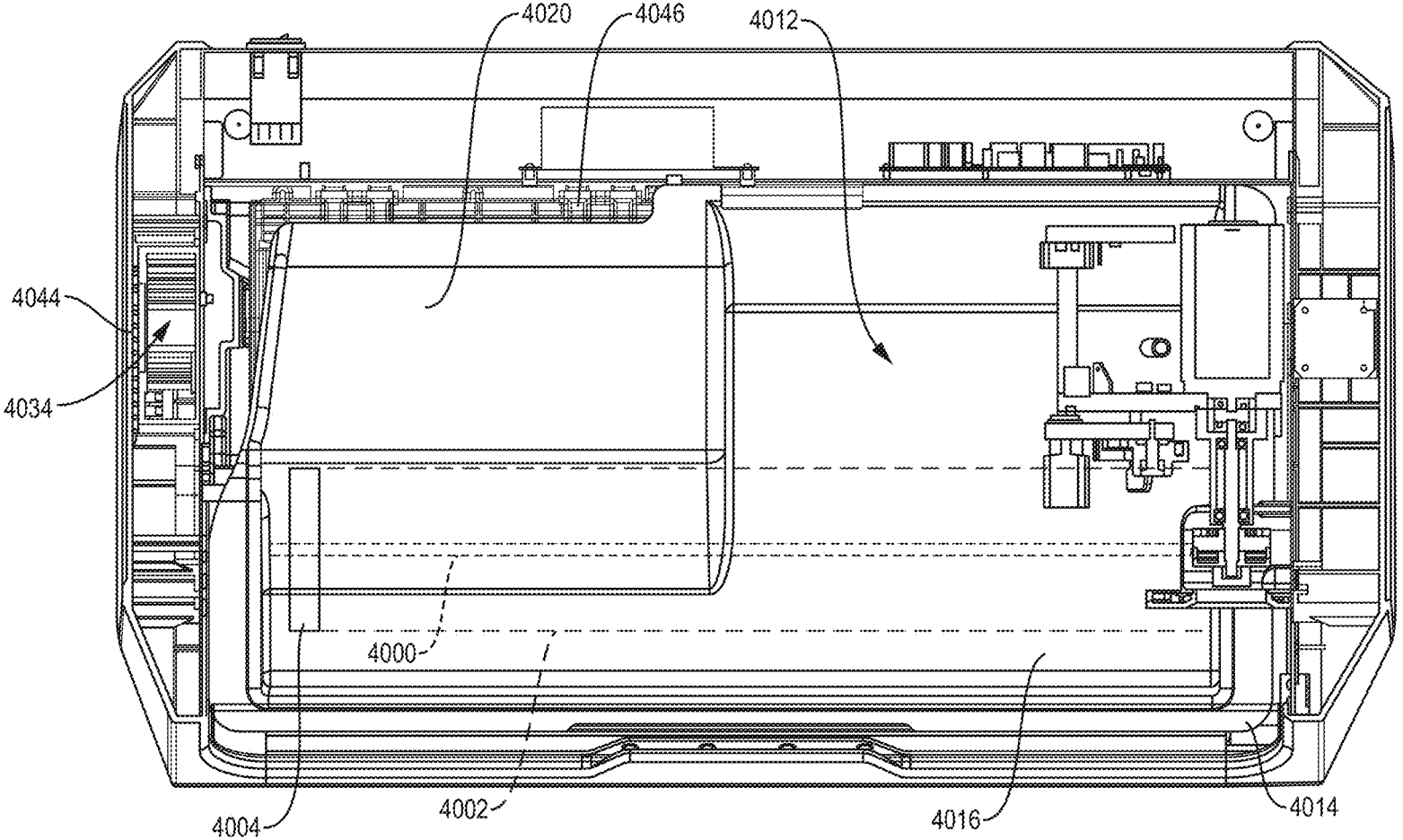
FIG. 76 is a sectioned top view of the skate sharpening system of FIG. 36 taken along the line 76-76 in FIG. 37.

With reference to FIG. 76, a cutting path 4000 of the grinding wheel is shown with dashed lines. During translation of the grinding wheel along this path 4000, metal shavings or grindings will be produced. As such swarf of the metal shavings or grindings will emanate from the grinding wheel. A swarf zone 4002 is illustrated in FIG. 76 in chain line (i.e., dash-dot-dash). The swarf zone 4002 is a region in which most of the shavings or grindings will naturally fall.

In some configurations, one or more magnetic members 4004 can be positioned within the inner compartment of the skate sharpener 1010. In some configurations, the one or more magnetic members 4004 can be positioned on a lower portion of the inner compartment. In the illustrated configuration, the one or more magnetic members 4004 are positioned on or adjacent to a floor of the inner compartment of the skate sharpener 1010. In some configurations, the one or more magnetic members 4004 is positioned within the swarf zone. In the illustrated configuration, the one or more magnetic members 4004 are positioned on or adjacent to the floor of the inner compartment within the swarf zone 4002. In some configurations, the one or more magnetic members 4004 are positioned at least partially within, and/or at least a portion of the one or more magnetic members 4004 is positioned to within, a region positioned vertically below the cutting tool path 4000. These locations can position the one or more magnetic member 4004 in a location that will reduce the movement of the shavings or grindings and, therefore, provide a cleaner appearance to the skate sharpener. In some configurations, the one or more magnetic member 4004 is a cap that is positioned at or near the swarf that sprays out from the grinding wheel as the grinding wheel sharpens the skate blade. In some configurations, the cap captures between about 65% and 80% of the metal dust generated in a sharpening operation. This capture of the dust helps maintain a tidier appearance and improves operation and life of a dust capture and/or filtration system 4010.

Figure 77:
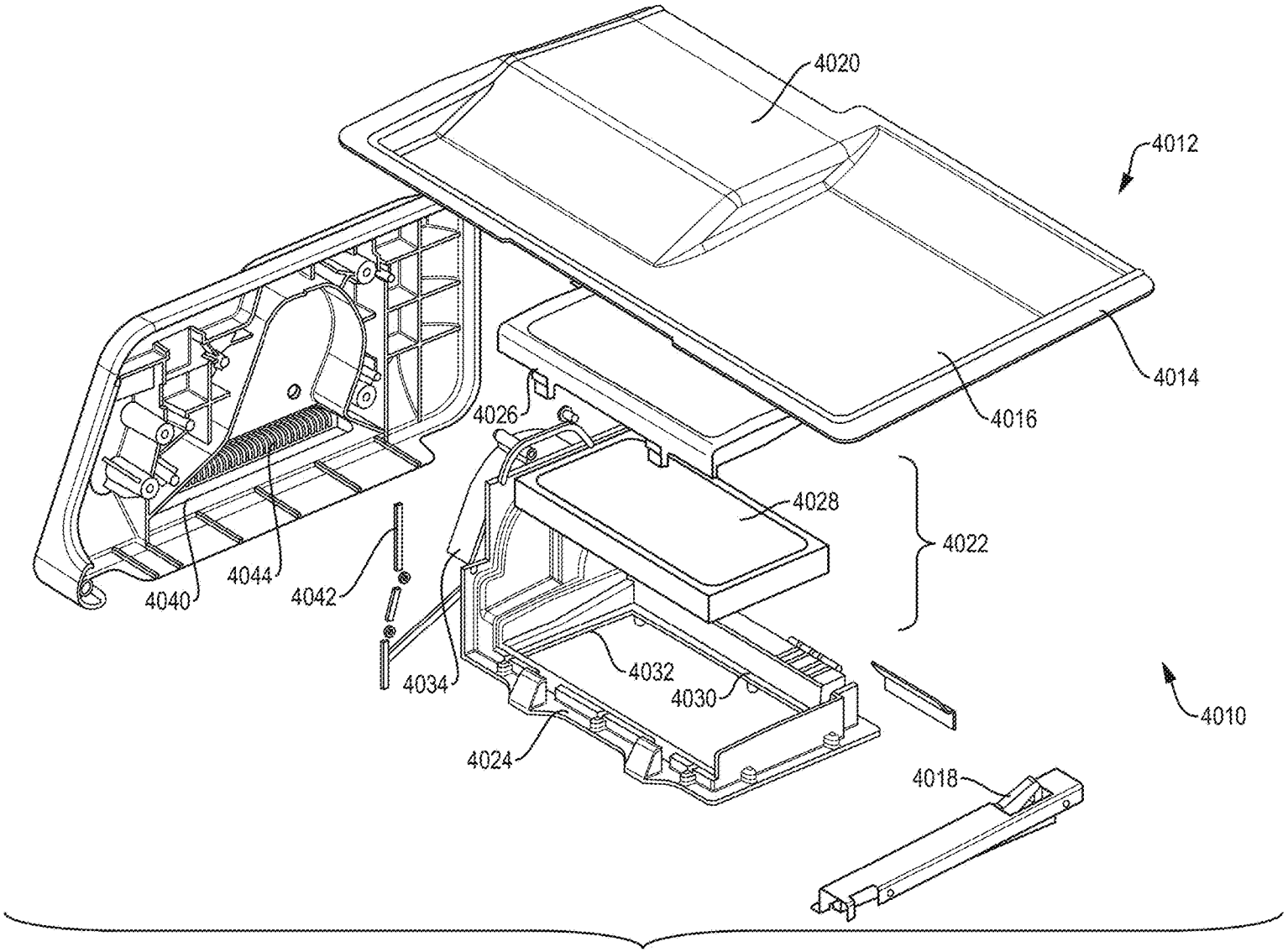
FIG. 77 is an exploded perspective view of certain components of an air filtration and dust capture system of the skate sharpening system of FIG. 76.
Figure 78:
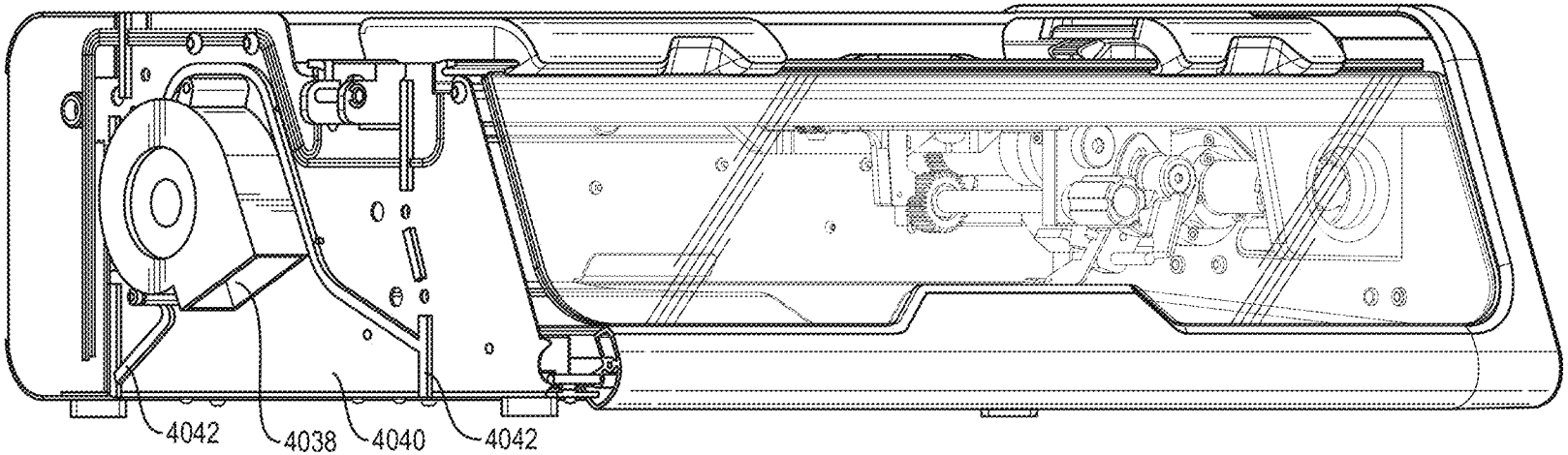
FIG. 78 is front left perspective view with the left end cap removed to illustrate a blower configuration.
Figure 79:
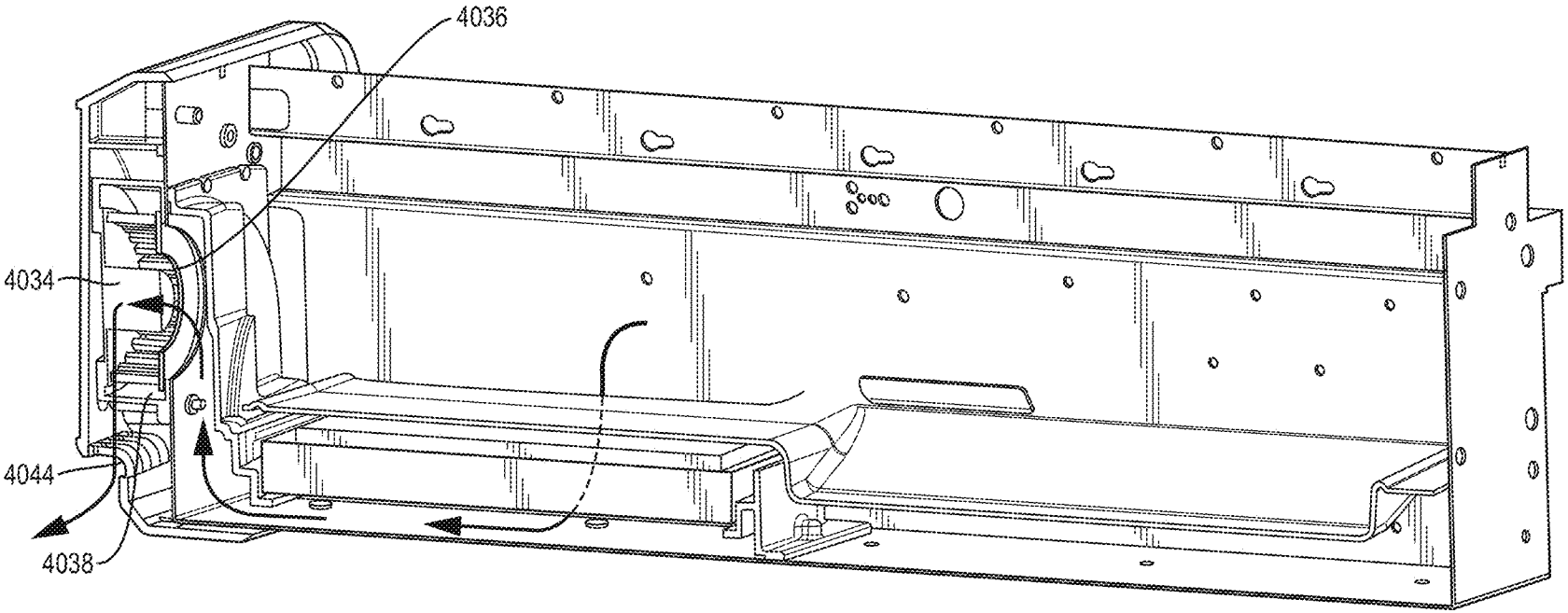
FIG. 79 is a sectioned view of a portion of the skate sharpening system of FIG. 36.

With reference now to FIG. 77, components of the dust capture and/or filtration system 4010 that forms a portion of the skate sharpener 1010 will be described. As illustrated, the skate sharpener 1010 can be provided with a dust pan 4012. The dust pan 4012 is sized and configured to cover much if not all of the bottom or floor of the compartment defined within the skate sharpener 1010. The dust pan 4012 includes an outer lip 4014 and a recessed main region 4016. The outer lip 4014 can be a single lip that circumscribes the main region 4016 or can be a plurality of lips that can be used to support the dust pan 4012 in position within the sharpener.

As will be described, in some configurations, the skate sharpener 1010 can be configured to not operate without the dust pan 4012 in positon within the skate sharpener. For this reason, one or more switches 4018 can be provided. The lip 4014 can bear against the switch 4018 such that the presence or absence of the dust pan 4012 can be detected. Other configurations also can be used. In addition, the magnetic member 4004 can be positioned on top of, underneath or within the dust pan 4012.

The illustrated dust pan 4012 includes an upwardly embossed portion 4020. The upwardly embossed portion 4020 overlies an air filter assembly 4022. As illustrated, the air filter assembly 4022 comprises a base 4024 and a capture ring 4026 that secure a filtration element 4028 in position. The filtration element 4028 can be any desirable medium so long as the filtration element 4028 is able to trap and retain dust generated during operation of the skate sharpener 1010. In some configurations, the filtration element 4028 is a HEPA filter element.

As illustrated, the base 4024 includes one or more internal ribs or other structural features 4030 that hold the filtration element 4028 above a floor of the air filter assembly. Thus, the filtration element is positioned above an air flow exit from the illustrated air filter assembly 4022. Of course, other assemblies can be used to filter airflow through an air filter assembly.

The capture ring 4026 overlies the filtration element 4028 and secures the filtration element 4028 in position. In some configurations, the capture ring 4028 is pivotable about a rear portion and includes catches or the like to allow the capture ring 4028 to squeeze on the outer periphery of the filtration element 4028. In some configurations, a ring-like seal or the like can be positioned between the base 4024 and the filtration element 4028 such that air flow must pass through the filtration element 4028 rather than bypassing the filtration element by passing between the base 4024 and the filter element 4028. In some configurations, a sealing relationship or assembly could be established between the capture ring and the filter. Other configurations also are possible.

An exit 4032 is formed in one end of the air filter assembly 4022. The exit 4032 leads upwardly into a blower 4034. The blower 4034 can have any suitable configuration. In the illustrated configuration, the airflow enters that a central opening 4036 (see FIG. 79) and exits through a tangentially oriented outlet 4038 (see FIG. 78). Airflow exiting the outlet 4038 enters into an exhaust cavity 4040. The exhaust cavity 4040 can be defined by an outer end cap 4042 of the skate sharpener 1010. The exhaust cavity 4040 also can be defined by one or more gaskets or seals 4042 to help guide the airflow to an exit 4044 from the skate sharpener 1010.

Advantageously, the flow generated by the blower 4034 also can draw airflow in though the opposite end of the skate sharpener 1010 to further aid in cooling of the stepper motor 1260, where present. Most of the flow into the air filter assembly 4022 occurs either around the edges of the outer lip 4014 or through a small carveout 4046 (see FIG. 76) provided to an outer perimeter of the dust pan 4012. The airflow through these two portions is adequate to provide both sufficient cooling flow as well as sufficient airflow through the filter.

Skate Sharpener Operation Control

As discussed above, operation of the skate sharpener can be interrupted or otherwise controlled based upon various sensed conditions. For example, when the switches of the slot covers indicate to the controller that the slot covers are not in position over the slot and adjacent to the skate blade or skate blade holder, the controller may interrupt power to one or more of the motors that drive the grinding wheel.

Similarly, as discussed above, the switch 4018 can be used to detect the presence or absence of the dust pan 4012. When the dust pan is not present, the controller again may interrupt power to one or more of the motors that drive the grinding wheel. While not shown, a switch can be provided that indicates the presence or absence of the filter element. Again, operation of one or more of the motors that drive the grinding wheel can be interrupted if the filter element is not detected as being present.

Figure 80:
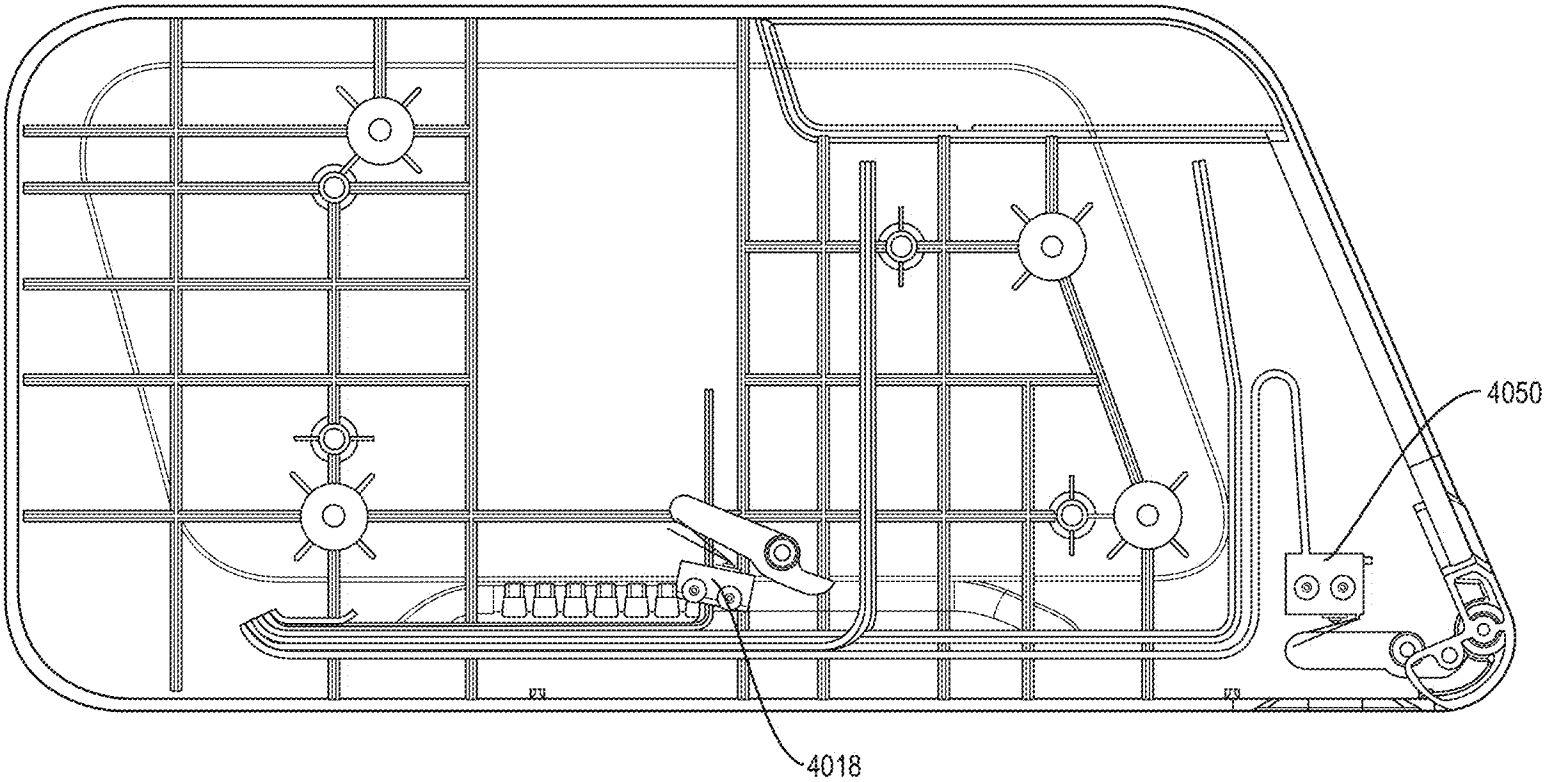
FIG. 80 is a view of an inside of the right end wall and illustrating the location and construction of two switch assemblies, which switch assemblies are shown separate of a supporting frame.

Further, as shown in FIG. 80, a front door switch 4050 can be provided to the skate sharpener 1010. The front door switch can be used to detect whether the front door is open or closed. When the front door switch indicates that the front door is opened, the controller again may interrupt power to one or more of the motors that drive the grinding wheel. In some configurations, the front door may be latched shut such that it cannot open during operation of the sharpener.

In some configurations, the controller can be configured to detect the absence or presence of a grinding wheel prior to initiation of a grinding operation. In some embodiments, the controller may determine whether the grinding wheel is present by detecting an identification tag 204 of the grinding wheel. When the grinding wheel is not present, the controller may interrupt power of one or more of the motors that drive the grinding wheel, or otherwise prevent initiation of a grinding operation.

In some configurations, any or all of these operations can be performed by something other than the controller. For example, the switches can, themselves, simply interrupt the power. In use, if any of the slot covers or door are not in the operating position, the skate sharpener will stop grinding or thwart the initiation of a grinding operation. Thus, the skate sharpener can provide improved operating characteristics that result in the user obtaining the full benefit of each of the designed in features.

A soft start routine for operational control of the skate sharpener can be described with additional reference to FIGS. 4, 7, 8, and 83-92. During the grinding operation, when the grinding wheel 36 makes first contact with the right edge of the skate blade 142, the grinding power goes from approximately zero to an elevated state in a very short period of time. The moment (e.g., torque) created at the interface between the skate blade 142 and grinding wheel 36 can push the control arm 78 upward (for example, further driving the grinding wheel into the skate) and can increase the contact force at this interface. When downward movement of the grinding wheel 36 occurs as it traverses along the skate blade 142, the grinding wheel 36 may bounce on the edge of the skate blade 142. The degree to which a bounce may occur can be affected by a number of factors, such as, for example, the position of contact of the grinding wheel 36 on the skate blade 142, the steepness of the edge of the skate blade 142, the coarseness of the grinding wheel 36, the age of the grinding wheel (for example, newer grinding wheels may have more aggressive abrasive than used grinding wheels), and other factors. For example, a higher wheel position, steeper blade, and/or newer wheel may each contribute to increased bounce during contact. In some circumstances, bouncing of the grinding wheel 36 may cause damage to components of the skate sharpener. The bouncing behavior of the grinding wheel can result in non-uniform material removal and surface finish of the skate.

In some embodiments, a soft start routine can be implemented to help reduce bouncing when the grinding wheel 36 first contacts the skate blade 142. Before the grinding wheel 36 contacts the skate blade 142, the grinding wheel 36 travels a distance between the home position and the contact position of the skate blade 142. Without a soft start routine enabled, the grinding wheel 36 may rotate at full speed, for example between 4000 rpm and 12000 rpm, and spin at roughly this rate for the complete grinding operation. In embodiments that implement a soft start routine, the grinding motor 80 may initially operate at a lower speed, such as 500 rpm to 3500 rpm until contact is made with the skate blade 142.

The soft start routine can help to reduce bouncing when a grinding wheel first contacts the skate blade. The soft start routine can help to reduce the opposing forces experienced between the grinding wheel 36 and the skate blade 142 at the point of first contact. By reducing grinding wheel RPM at the point of contact, the grinding wheel 36 can experience reduced forces which help to reduce the downward movement of the motor arm 78 and reduce bouncing behavior. After contact is established between grinding wheel 36 and skate blade 142, the soft start routine can be configured to ramp up the speed of the grinding motor 80 to full speed, which can result in a smooth translation of the grinding wheel 36 during operation without bouncing. The soft start routine can be configured to help eliminate dangerous conditions, such as, the grinding ring 36 hitting the jaws holding the skate blade or the grinding ring 36 hitting a steep skate blade 142, which could break or damage one or more components of the sharpener (such as, the jaws) or damage the skate blade 142. In some embodiments, the soft start routine can smooth the power consumption across the heel which can result in more even material removal rate on all sections of the skate.

Prior to contact with the skate, the control system can monitor the current drawn by the grinding motor and can establish a baseline current of the system. The baseline current represents the amount of current, and thus power, used by the grinding motor 80 prior to the grinding wheel 36 contacting the skate blade 142. The baseline current can vary each time the skate sharpener is operated, during grinding operations, and between different systems. Some factors that may contribute to variations in a baseline current can include, but is not limited to, slight differences between motors and in-part tolerances (such as, bearings of the grinding spindle), temperatures of the motor and spindle, wear of mechanical and electrical components, and/or other factors may influence variations in current. In some embodiments, the baseline current can be established over a period of between 0.5 seconds to 3 seconds. In some embodiments, the baseline current may be determined in less than one second, under two seconds, under 3 seconds, or another time period. In some embodiments, baseline current determination may be delayed during initial startup (such as, a cold start) of the motor for a defined period of time in order for the system to arrive a steady state. The delay can help to filter out transient power fluctuations that may be experienced during start-up and allow time for the skate sharpener to attain a steady state of operation.

When the grinding wheel makes contact with the skate, the grinding motor 80 may naturally slow down due to the load applied to the grinding wheel 36 via friction and resistance on the motor's output spindle 82. When the grinding motor 80 slows down, the back EMF generated by the grinding motor 80 is reduced, which results in an increase in the current flowing to the grinding motor 80. The control unit 32 of the skate sharpener can monitor the current and can detect the increase in current. The control unit 32 can implement a threshold over the baseline current to determine whether the grinding wheel is in contact with the skate blade 142. The threshold can be a percentage of the baseline (such as, for example, a 10% increase of the baseline current), a static value (such as, for example, an increase of 200 mA over the baseline current), a rate of increase in the current (such as an increase of 200 mA in 0.1 seconds), and/or other threshold configured to detect contact between the grinding wheel and the skate blade. The current value data, as measured by the control unit, may be filtered or smoothed in order to reduce electromagnetic noise and/or mechanical vibration in order to generally improve the ability to detect contact with the skate.

After contact between the skate and the grinding wheel has been detected, the control unit 32 can ramp the speed of the grinding motor 80 to a higher speed, which may be full speed in a relatively short period of time. For example, in one embodiment, the speed of the grinding wheel 36 may be increased from 1000 rpm to 8000 rpm over a period of 0.55 seconds. The rotational speed of the grinding wheel 36 may be controlled using various control algorithms, such as Pulse Width Modulation (PWM) or other algorithms known in the art for controlling rotational speed of an electric motor. The ramp from the intermediate speed to full speed can use a linear, exponential, or other ramp algorithm configured to help reduce bounce while increasing speed and maintaining a smooth transition. The soft start routine can be implemented using open loop or closed loop control of ramp speed. The implementation of a soft start routine is not limited to the grinding motors described herein, and can be implemented with various types of electric motors that can be configured to modulate the speed of the electric motor.

In some embodiments, the bounce experienced by the system can be greater in one direction, for example moving from right to left or visa-versa. When the grinding wheel traverses over the left side (moving right to left or left to right) of the skate, the bounce can be significantly less because interface forces are decreased at the left side of the skate due to such factors as the direction of rotation, location of the pivot point, and the side of the grinding ring where frictional forces are generated. When the grinding wheel returns to its home position off the right edge of the skate, the direction of rotation of the grinding wheel causes an increase in the force driving the grinding wheel into the skate.

In some embodiments, it can be beneficial for the soft start routine to implement a lower grinding speed on the right edge (heel) of the skate. This lower grinding speed can result in a decrease in material removal rate on the right to left pass which can help neutralize the higher removal rate of material from the heel by the grinding wheel during the left to right pass. The result can be a more uniform material removal rate along the length of the skate. It should also be appreciated that the soft start routine can be used on the initial approach and contact with the skate blade on either end of the skate (e.g., right or left, heel or toe).

After the grinding wheel returns to the home position, the soft start routine can be reinitiated to allow the grinding motor to spin down to a lower intermediate speed, in accordance with the operational parameters of the grinding operation, and repeat the soft start routine on a subsequent pass of the skate blade 142. The baseline current can be reestablished for each cycle in order to compensate for possible changes in the baseline current. For example, the current to the motor can change as the motor and spindle heat up from use.

In some embodiments, the control unit 32 can detect contact between the grinding wheel 36 and the skate blade 142 using various alternative methods and systems. In some embodiments, an electrical proximity or contact sensor can detect contact between the skate blade 142 and grinding wheel 36. In some embodiments, a speed sensor (such as, for example, hall effect sensors, optical switches, encoders, and the like) can measure the grinding wheel 360 and/or motor speed to detect when the speed of the grinding wheel and/or motor reduces. In some embodiments, a tilt-sensor or accelerometer mounted on the control arm 78 can detect when the control arm 78 starts to move downward and/or detect vibration levels in the control arm 78. In some embodiments, back EMF generated by the motor can be measured by sampling motor voltage generation when spinning to determine when the back EMF decreases by a threshold amount. In some embodiments, a torque sensor (e.g., piezo or strain gauge) on the motor output or grinding motor spindle shaft 82. The control unit 32 may implement one or more of the above contact detection systems in place of, or in addition to, the current baseline detection routine described above.

In some embodiments, the control unit 32 can record the position of the speed ramp up and can apply a similar ramp down when the grinding wheel is returning to its home position off the trailing edge of the skate blade 142. The ramp down can help provide a more uniform grinding power and material removal rate. In some embodiments, a stepper motor can facilitate implementation of the ramp down by correlating the current sensing of the contact detection to a specific location in the grinding wheel travel. In some embodiments, an encoder can be used to detect grinding wheel position or an accelerometer to detect motor arm angle.

In some embodiments, the soft start routine can also be used in an algorithm to change the profile or "rocker" of a skate blade. Changing the profile of a skate can require inconsistent material removal along the skate edge to affect the lengthwise shape of the skate and thus the position of the skate over the skate edge. The soft start can correlate motor current information (or other motor power measurements) with location along the length of the skate. The information gathered by the soft start routine can be used to selectively remove more or less skate material from a given segment of the blade.

In some embodiments, the soft start routine can be used to increase translation speed of the grinding wheel as compared to systems that do not use a soft start routine. For example, after the grinding wheel smoothly contacts the skate, the rotational speed of the grinding wheel 36 and the translation speed may be ramped up to speeds above what would be capable on a system using a uniform grinding speed during the grinding operation.

In some embodiments, the soft start routine can adjust the speed to account for the safe operation of grinding wheels having various grit levels. Without a soft start routine, a sharpening system may need to select a slower grinding ring speed based on the most aggressive grinding wheel that can be used with the system. The soft start routine can compensate for grinding rings of various grits by ramping up to full speed after smooth contact with the skate and without producing a potentially destructive bounce.

In some embodiments, the soft start routine can be disabled. For example, users of the sharpening system may use a skate type with the sharpening system that is not conducive to the Soft Start routine. In such situations, the user may disable the soft start routine in favor of sharpening at a constant grinding speed.

Figure 83:
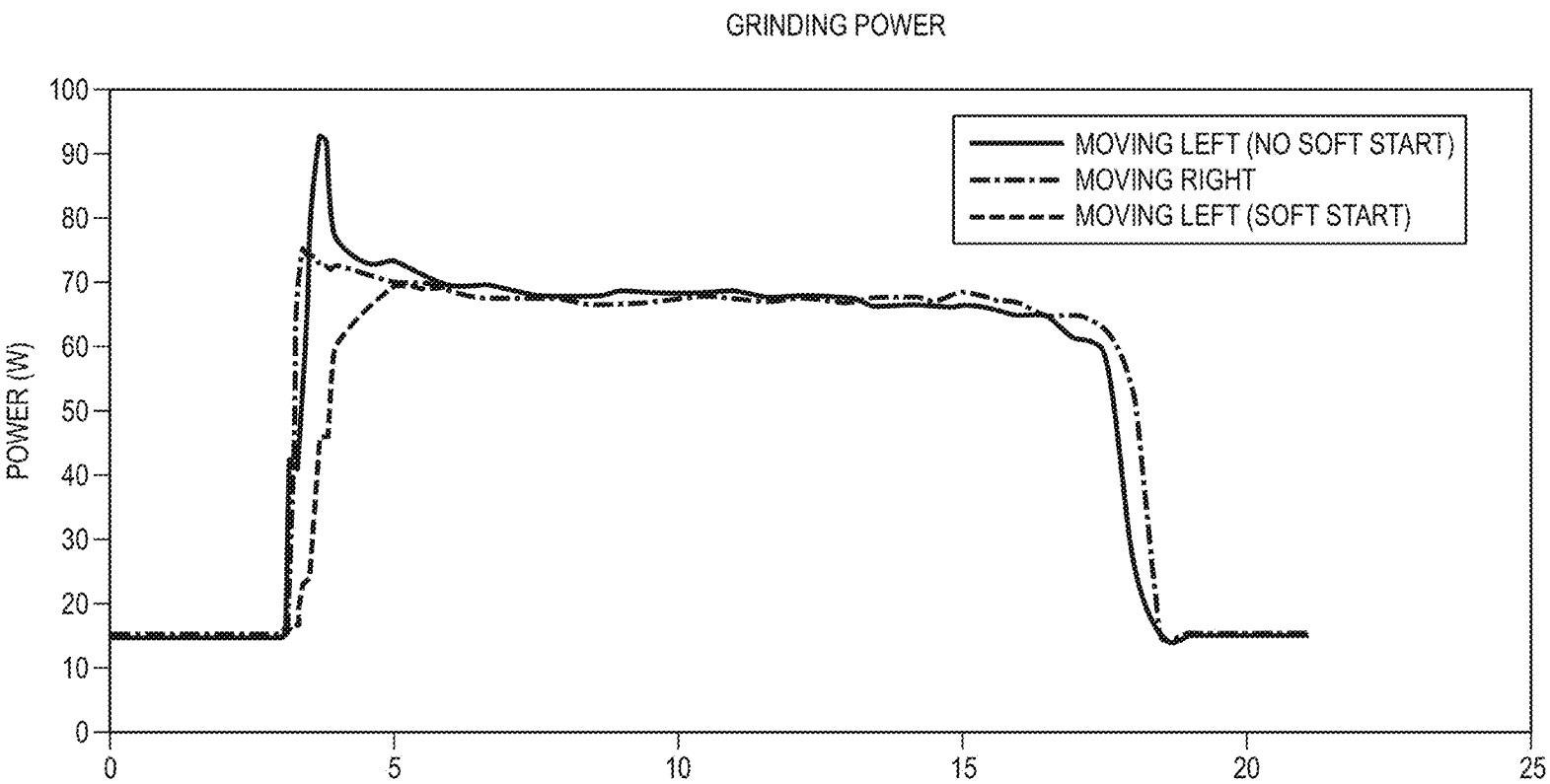
FIG. 83 is an embodiment of a chart illustrating an example of power consumed by a grinding motor during a grinding operation.
Figure 84:
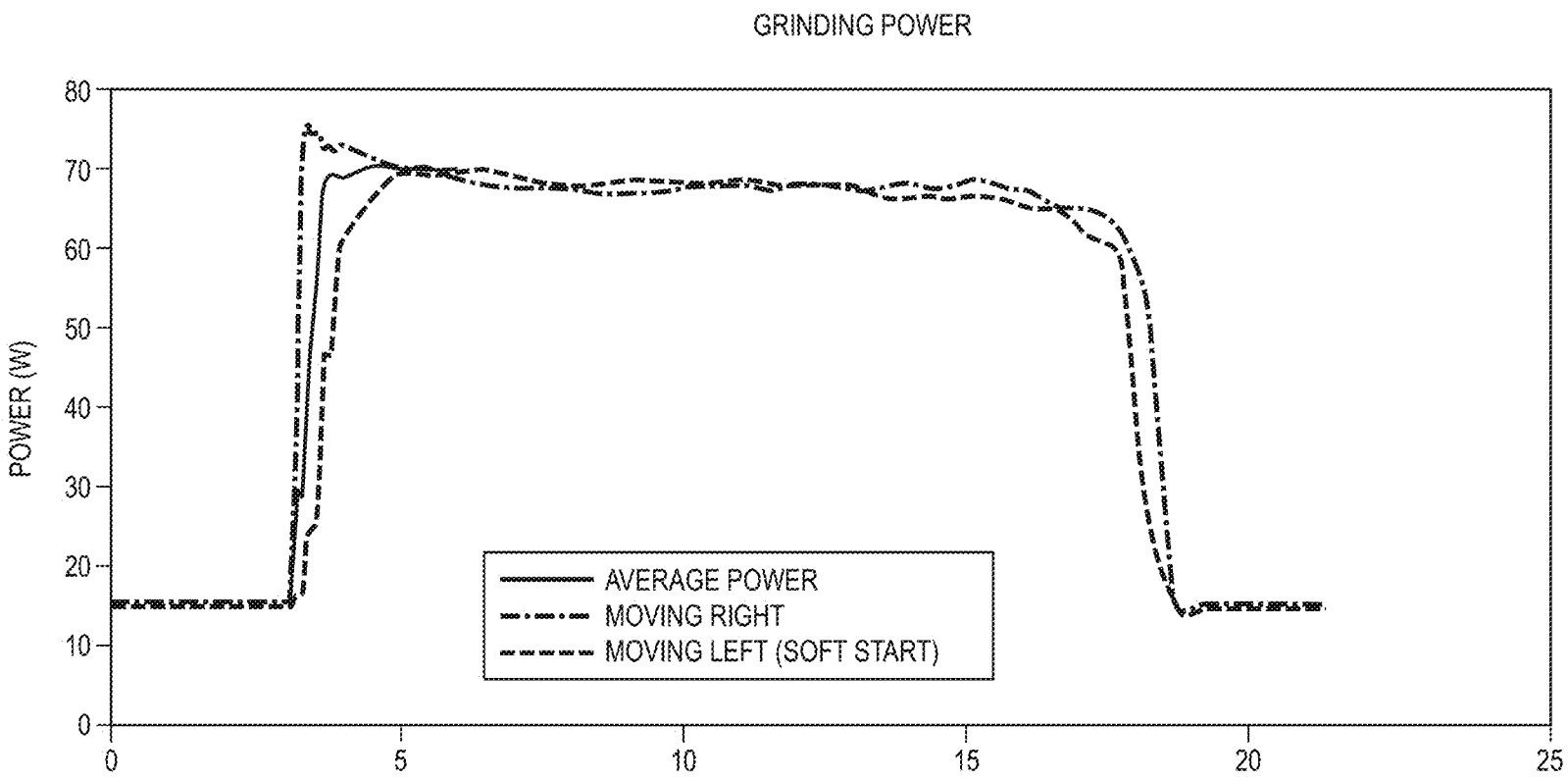
FIG. 84 is an embodiment of a chart illustrating an example of power consumed by a grinding motor during a grinding operation.

FIGS. 83 and 84 illustrate charts showing an example of power consumed by a grinding motor during a grinding operation. The solid black line illustrates a pass of the grinding ring from the starting position on the right side of the machine, moving from right to left, from heel to toe ("moving left") without implementation of a soft start routine. The significant peak in the power consumed is visible at the initiation of the moving left pass. On the return pass, moving from left to right, from toe to heel, ("moving right"), illustrated by the dash-dot line, there is another characteristic peak visible on the heel of the skate. The moving left pass utilizing the soft start routine is illustrated by the dashed line. The charts illustrates an example embodiment of how the soft start routine can change the power consumed during the grinding operation. FIG. 84 additionally illustrates embodiments of the soft start "moving left" power consumption (dashed line), the "moving right" power consumption (dash-dot line), and an average power (solid line) consumed on the heel of the skate in both the "moving left" and the "moving right" passes. In this embodiment, the average power consumption seen at the heel is approximately equal to the power consumption seen across the skate blade.

Figure 85:
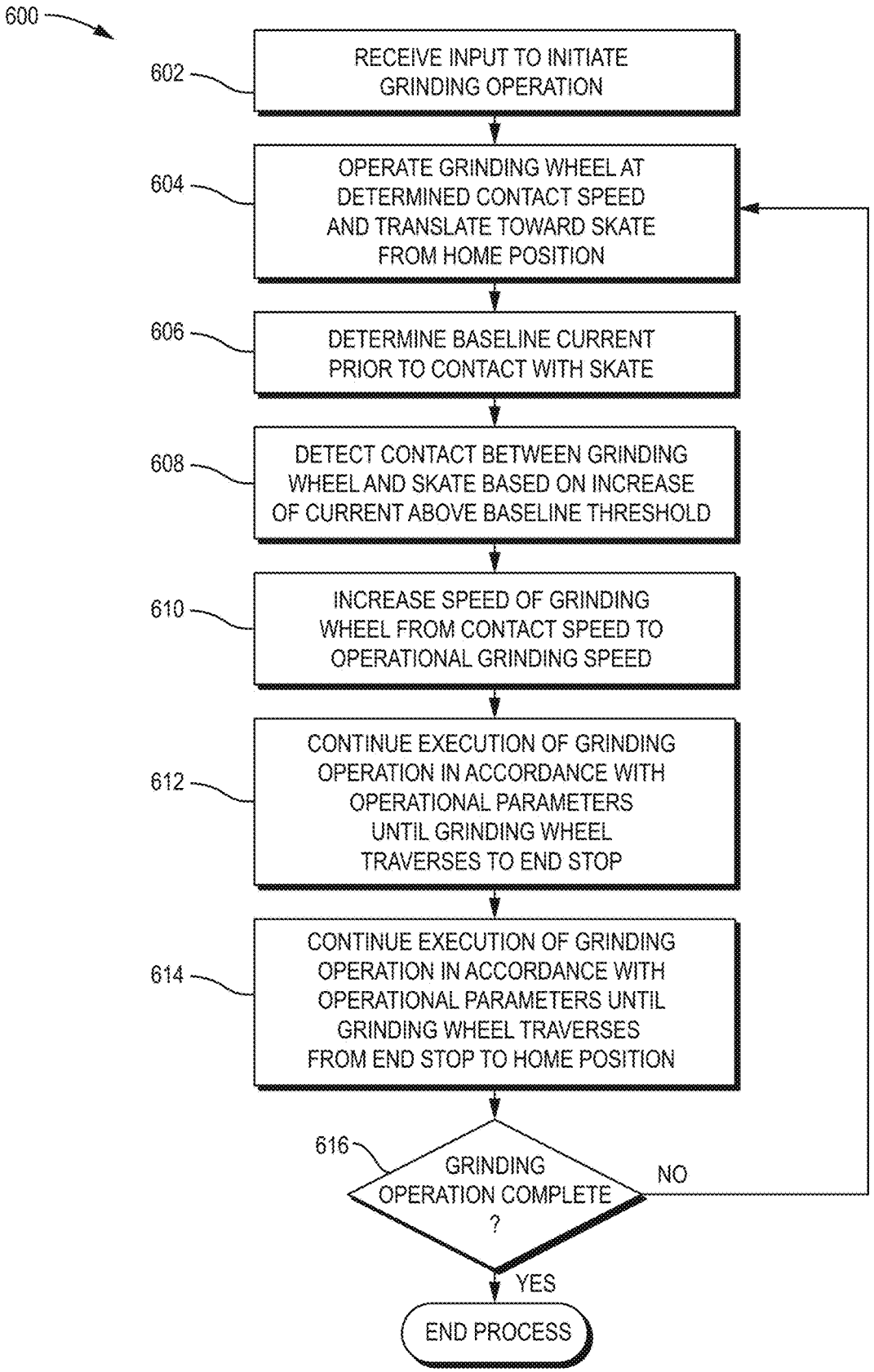
FIG. 85 illustrates an embodiment of a flowchart for execution of a soft start routine.

FIG. 85 illustrates an embodiment of a flowchart for execution of a soft start routine 600. The routine 600 can be implemented by any system that can dynamically control the speed of the grinding wheel within a skate sharpener. The routine 600, in whole or in part, can be implemented by the control unit 32, controllers 132, and/or other hardware or software based control systems. Although any number of systems, in whole or in part, can implement the routine 600, to simplify discussion, the routine 600 will be described with respect to the control unit 32. Further, although embodiments of the routine 600 may be performed with respect to variations of the sharpening system, to simplify discussion, the routine 600 will be described with respect to the skate sharpener 10.

At block 602, the control unit 32 receives input to initiate a grinding operation. The input may be received from an operator manually providing the input by pressing an input key, such as a start button. In some embodiments, the input may be a signal received from a remote source configured to initiate the operation of the skate sharpener.

At block 604, the control unit 32 begins operating the grinding motor 80 at a determined contact speed and begins translating the grinding wheel 36 toward the skate blade 142 from the home position for execution of the grinding operation. The grinding motor 80 may initially operate at a contact speed, such as 500 rpm, 1000 rpm, 1500 rpm, 2000 rpm, 2500 rpm, 3000 rpm, 3500 rpm and/or number between the ranges. The contact speed can be a lower speed than the operational grinding speed of the grinding operation. The grinding motor 80 can operate at the contact speed as the grinding wheel 36 travels a distance between the home position toward the contact position of the skate blade 142.

At block 606, the control unit determines the baseline current of the grinding motor 80 prior to contact with the skate blade 142. The control unit 32 can monitor the current supplied to the grinding motor 80 and can determine a baseline current of the grinding motor 80. The baseline current represents the amount of current used by the grinding motor 80 prior to the grinding wheel 36 contacting the skate blade 142. The baseline current can vary between skate sharpeners, between passes during the grinding operation, and between uses of the same skate sharpener. In some embodiments, the baseline current can be determined each time the grinding wheel executes a pass of grinding operation from the home position. In some embodiments, the baseline current can be established in less than 0.5, less than 1 second, less than 2 seconds, less than 3 seconds, and/or within any combination of ranges of the above listed time periods. In some embodiments, such as during initial startup, the determination of the baseline current may be delayed for a defined period of time in order for the skate sharpener to reach steady state operation. Delaying the determination can help to filter out transient power fluctuations that may be experienced during start-up and prior to attaining a steady state of operation.

At block 608, the control unit can detect contact between the grinding wheel 36 and the skate blade 142 based on an increase in current to the grinding motor 80 over the baseline current by a threshold amount. When the grinding wheel 36 makes contact with the skate, the grinding motor 80 may slow down due to the load applied to the grinding wheel 36 via friction and resistance on the motor's output spindle 82. When the motor 80 slows down, the back EMF generated by the motor 80 is reduced, which results in an increase in the current flowing to the motor. The control unit 32 can monitor the current and detect when the current increases over a defined threshold. The threshold can be a percentage of the baseline (such as, for example, a 10% increase of the baseline current) or a static value (such as, for example, an increase of 200 mA over the baseline current).

At block 610, the control unit can increase the speed of the grinding motor to an operational grinding speed. The operational grinding speed can be greater than 5000 rpm, 6000 rpm, 7000 rpm, 8000 rpm, and/or any other speed greater than the contact speed, as defined by the operational parameters of the grinding operation. The rotational speed of the grinding wheel 36 may be controlled using various control algorithms, such as Pulse Width Modulation (PWM) or other algorithms known in the art for controlling rotational speed of the grinding motor. The ramp from the intermediate speed to full speed can use a linear, exponential, or other ramping algorithm to increase speed while reducing bouncing of the grinding wheel on the skate. The increase in operational speed can be implemented in a relatively short amount of time. For example, in one embodiment, the speed of the grinding wheel may be increased from 1000 rpm to 8000 rpm over a period of 0.55 seconds. Operation of the grinding motor can be implemented using open loop or closed loop control systems.

At block 612, the control unit continues execution of the grinding operation in accordance with operational parameters until the grinding wheel traverses to the end stop of the skate sharpener. In some embodiments, the grinding operation applies a constant grinding force along the entire length of the skate. In some embodiments, the grinding operation may apply a varied grinding force along the length of the skate. For example, a grinding operation may be configured to alter the profile of the skate. In such an instance, non-uniform amounts of material are removed along the length of the skate.

At block 614, the control unit continues execution of the grinding operation in accordance with operational parameters until the grinding wheel traverses from the end stop to the home stop of the skate sharpener. In some embodiments, the bounce of the grinding wheel relative to the skate blade experienced by the system can be greater in one direction, for example moving from the home location to the end of the pass or visa-versa. In some embodiments, when the grinding wheel 36 traverses from the end location to the home location, the bounce can be significantly less because interface forces can be decreased on the end stop side of the skate due to factors, such as the direction of rotation of the grinding wheel 36, location of the pivot point, and the side of the grinding wheel 36 where frictional forces are generated. The rotational speed of the grinding wheel 36 can be the same in both directions. In some embodiments, the rotational speed will be different for each direction in accordance with the operational parameters of the grinding routine. In some embodiments, the control unit 32 can apply a ramp down when the grinding wheel is returning to its home position off the trailing edge of the skate. The ramp down can help provide a more uniform grinding power and material removal rate.

At block 616, after the grinding wheel returns to the home stop, the control unit determines whether the grinding routine is complete. If the grinding routine is complete the process ends. If the grinding routine is not complete the process returns to block 604 to complete another pass. If another pass is going to be initiated, the soft start routine can be reinitiated to allow the grinding motor to spin down to a lower intermediate speed, in accordance with the operational parameters of the grinding operation, and repeat the soft start routine on the subsequent pass. The baseline current can be reestablished for each cycle in order to compensate for possible changes in the baseline current.

In some embodiments, the skate sharpener can determine whether the skate blade is in contact with the grinding wheel during the skate sharpening process. In most skate sharpening systems, the sharpening of a single blade requires multiple cycles of the grinding wheel across the surface as this allows for the best balance of material removal and surface finish. It is generally desirable to make the cycle time as short as possible so as to make the sharpening procedure as quick as possible. This is particularly important in commercial operations where the cycle time represents throughput of the machine and potentially increased revenue.

The sharpener can detect when the grinding ring leaves the skate blade after making a pass across the skate. Because the skate sharpener can detect that the grinding ring has left the skate blade, the skate sharpener can reverse the translation direction sooner than it would have otherwise been able to if the system were waiting for the sensor at the end stop of the skate sharpener. This early reversal can save the user a significant amount of time on each pass of a sharpening cycle.

Figure 86:
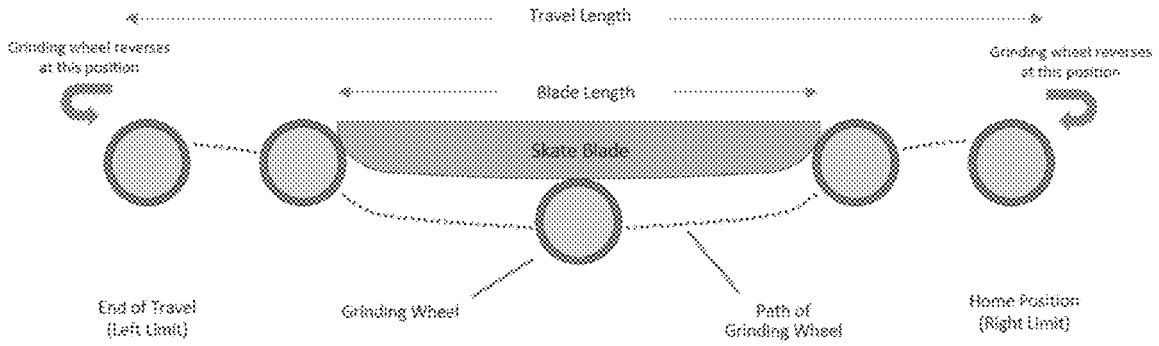
FIG. 86 illustrates a typical grinding wheel path along a skate blade within a skate sharpener.

FIG. 86 illustrates a typical grinding wheel path along a skate blade within a skate sharpener. The skate sharpener has a travel length that is configured to accommodate blades of various sizes. The travel length refers to the length that the grinding wheel travels between hitting stops at either end of the skate sharpener. When an individual skate blade is sharpened, the blade length of the skate blade is only a portion of the total travel length of the grinding wheel. The difference between the travel length and the blade length results in excess travel time between the end of the skate blade and a grinding wheel stop position, which increases the time of each sharpening cycle of the skate blade.

Figure 87:
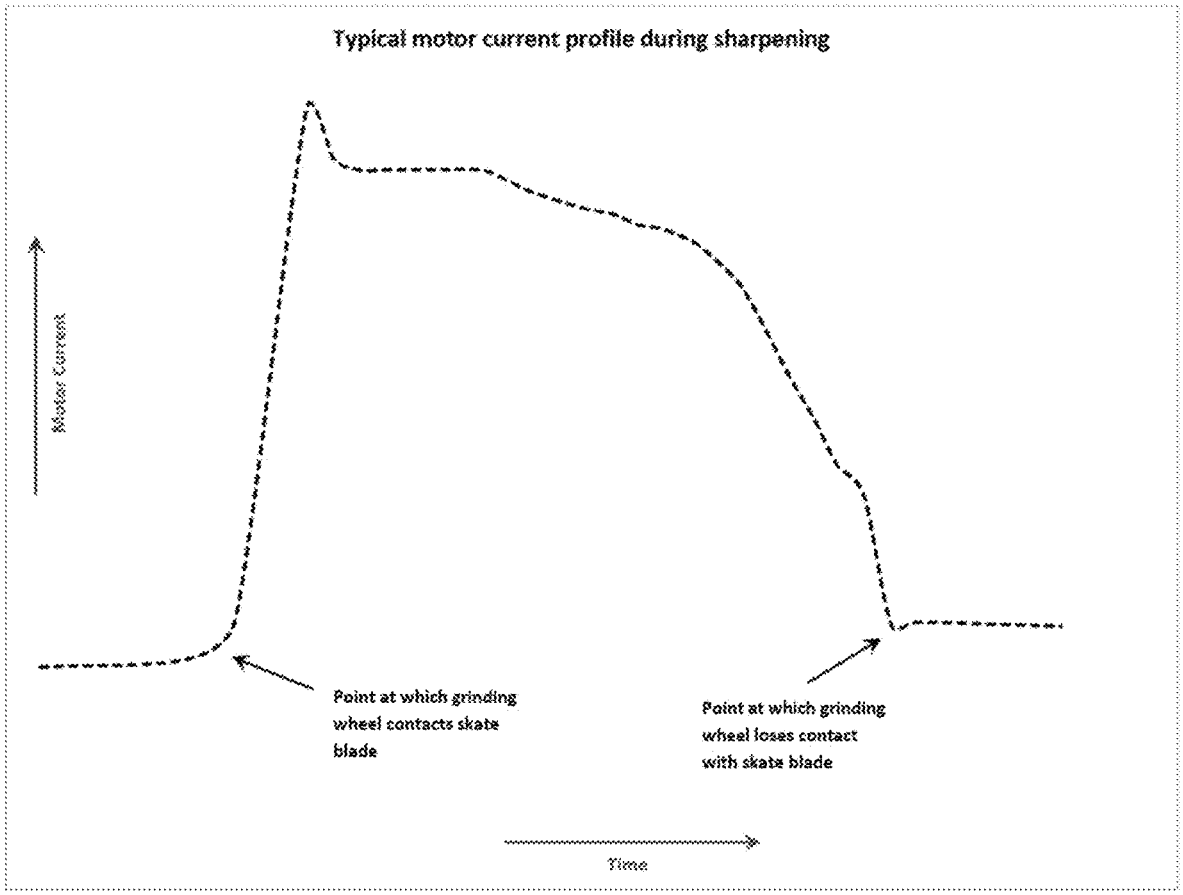
FIG. 87 illustrates an embodiment of a typical motor current profile during a sharpening cycle.

FIG. 87 illustrates a typical motor current profile during a sharpening cycle from the home position to an End of Travel stop position or visa-versa. In order to significantly reduce the cycle time of a sharpening system, a method of sensing the contact and then loss of contact between grinding wheel and skate blade may be employed to determine when to reverse the translation of the grinding wheel. This may be accomplished by sensing the current of the grinding motor and looking for a change (e.g., a reduction) in the current which signals that the grinding wheel is no longer in contact with the skate blade. The system can determine the point at which the grinding wheel contacts the skate blade and the point at which the grinding wheel loses contact with the skate blade.

Figure 88:
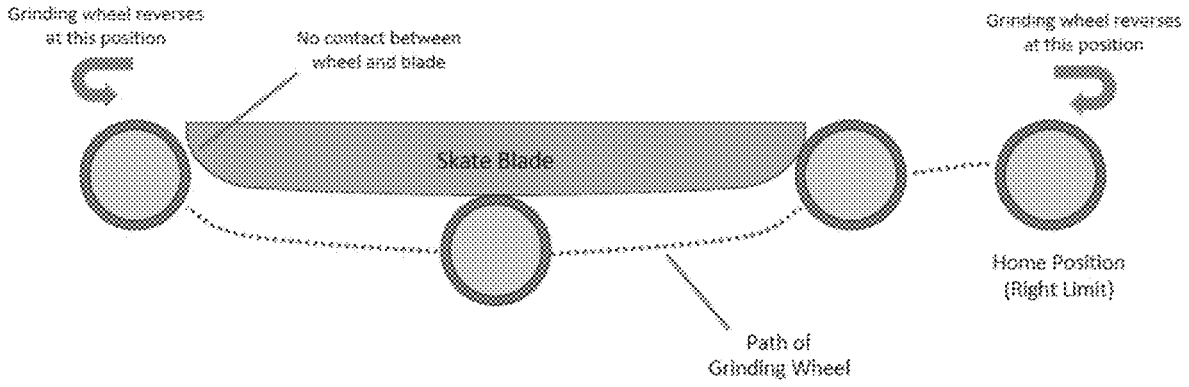
FIG. 88 illustrates a travel path of a grinding wheel that is using skate sensing to determine when to reverse the translation of the grinding wheel.

FIG. 88 illustrates a travel path of a grinding wheel that is using a skate sensing process to determine when to reverse the translation of the grinding wheel. When the grinding wheel is in contact with the skate blade, the friction at this interface between the stationary part (skate blade) and moving part (grinding wheel) creates a load on the motor. When this contact is removed, the motor has a reduced load, and therefore will draw less current from its power supply. Such as illustrated in the embodiment of the motor current profile in FIG. 87.

Figure 89:
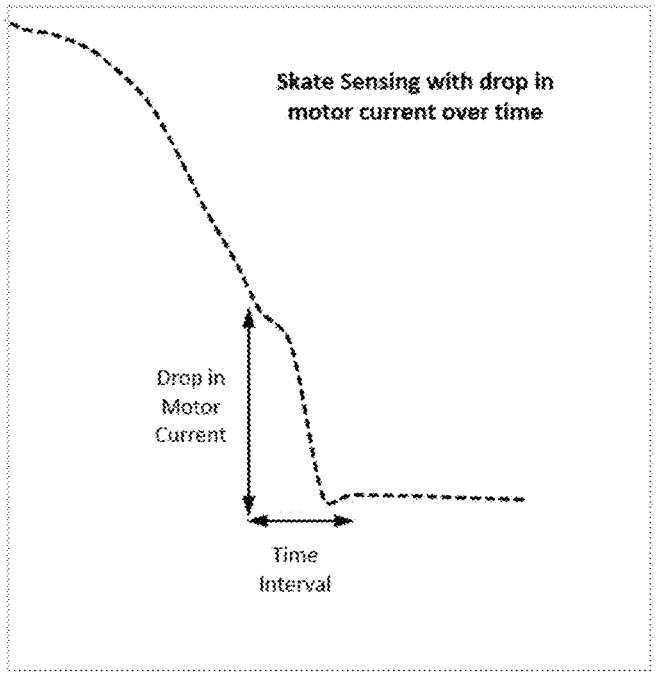
FIG. 89 provides an illustrative embodiment of a drop in motor current below a defined threshold.

In some embodiments, the control system can be configured to detect a drop in motor current over a defined period of time to indicate that the grinding wheel is no longer in contact with the blade. For example, the drop in motor current can be greater than or equal to about 0.1 amps and less than or equal to about 2.0. In some embodiments, the drop in amps can be at least about 0.8, between 0.1 and 0.8, between 0.1 and 1.2, 0.8 and 2.0, or any range of the foregoing ranges. The defined period of time can be in a period of time of about 0.1 seconds, 0.5 seconds, 1 second, 2 seconds, 3 seconds, 5 seconds, another defined time period, or a range of time periods. FIG. 89 provides an illustrative embodiment of a drop in motor current over a defined time period. In some embodiments, the control system may be configured to determine a magnitude of the drop in motor current without determining whether the drop occurred during a defined period of time.

Figure 90:
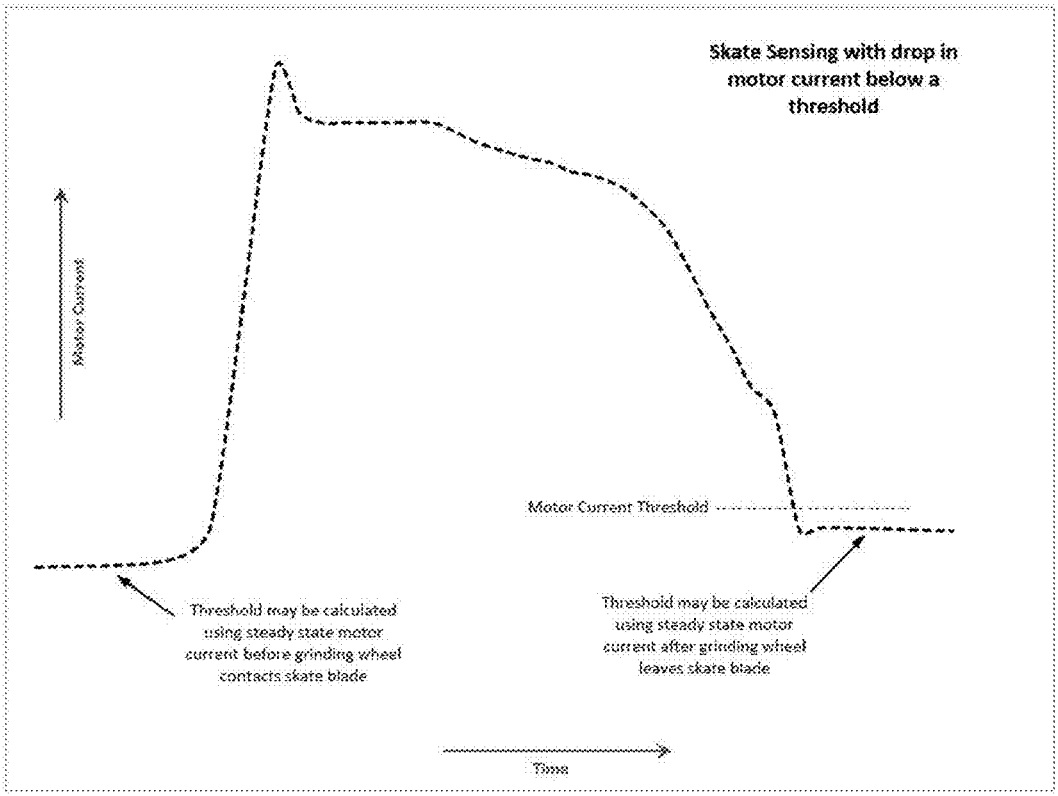
FIG. 90 provides an illustrative embodiment of a drop in motor current below a defined threshold.

In some embodiments, the control system may be configured to determine whether the motor current drops below a previously determined threshold, such as illustrated in FIG. 90. The threshold may be calculated relative to the current level while the grinding ring was in contact with the skate and/or relative to when the grinding wheel was not touching the skate. For example, the threshold may be calculated based, at least in part, on the current level when the grinding ring started out initially from the Home Position or after the grinding ring leaves the skate after a pass.

Figure 91:
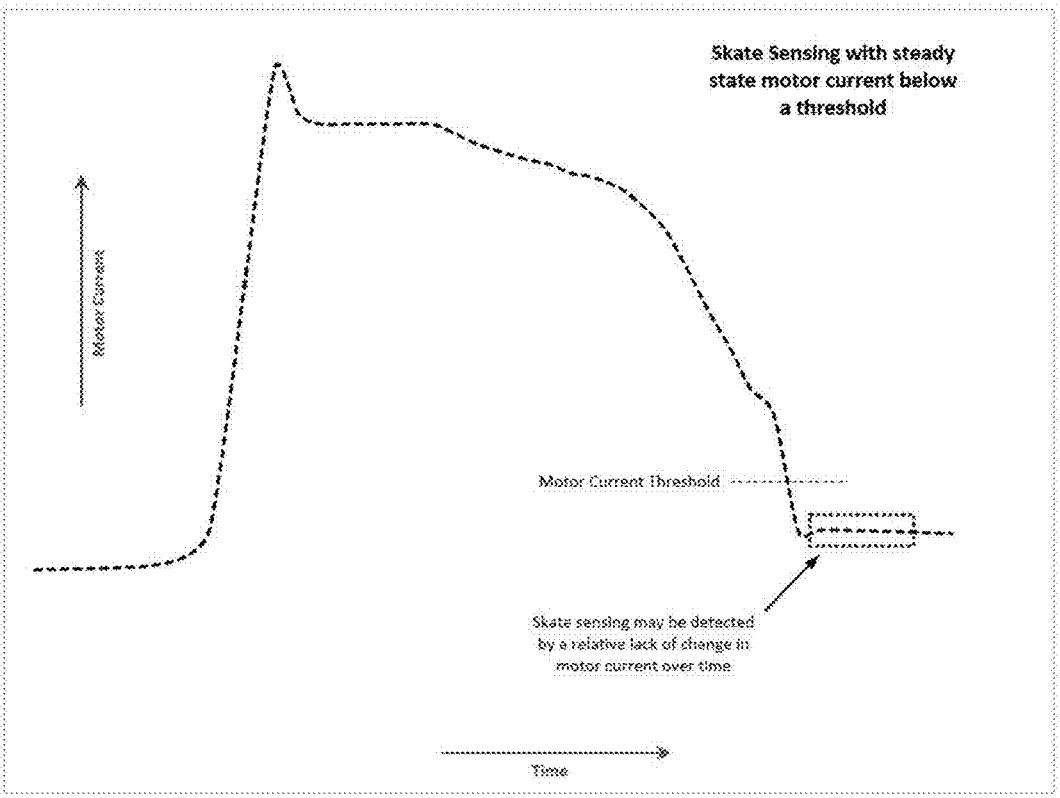
FIG. 91 provides an illustrative embodiment of the stabilization of the motor current below a defined threshold.

A threshold may be used with or without a time requirement. For example, as illustrated in FIG. 91, the control system can determine that the grinding wheel is not touching the skate blade when the current drops below a threshold and remains below the threshold for a defined period of time. In some embodiments, the control system may determine whether the motor current has stabilized below a current threshold to indicate that the grinding wheel is not contacting the skate blade. In any of the embodiments described, the current value data, as measured by the control unit, may be filtered or smoothed in order to reduce electromagnetic noise and/or mechanical vibration in order to generally improve the ability to detect the end of the skate.

When the control system determines that the grinding wheel is no longer in contact with the skate blade, the translation direction may then be reversed, eliminating the wasted travel time for the grinding wheel to reach the end of travel limit switch and return to the skate again. It can be appreciated that the smaller the skate blade, the more time is saved by not traversing to the end stop of the skate sharpener. The detection of the end of the skate blade can be used at either end of the skate.

In some embodiments, the skate detection routine can be disabled. For example, users of the sharpening system may use a skate type with the sharpening system that is not conducive to the skate detection routine. In such situations, the user may disable the skate detection routine in favor of sharpening all the way to the sensor at the end stop of the skate sharpener.

In some embodiments, in the event the grinding motor and the control unit do not detect contact with the skate after a predetermined amount of time, either on the pass from left to right or right to left, the system can halt the grinding motor and/or return the grinding ring to the home position. The benefit of stopping the grinding wheel in this scenario could be to prevent travel of the grinding ring when a skate is not inserted and/or ensure that the grinding ring will not make contact with parts of the machine that could be in the way of the grinding wheel if a skate is not inserted. An example of a feature on the system to avoid would be the skate clamp jaws without a skate loaded.

Figure 92:
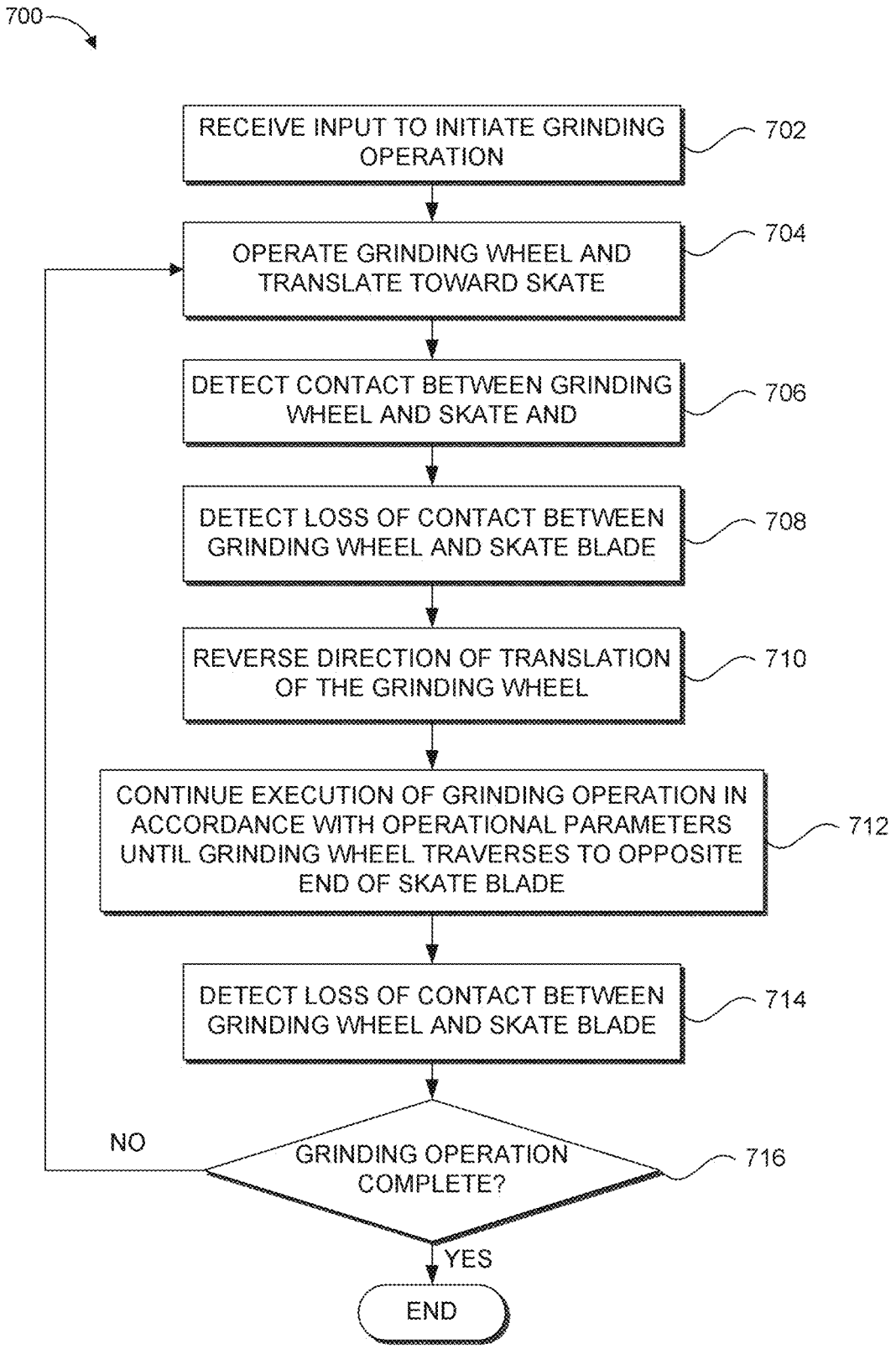
FIG. 92 illustrates an embodiment of a flowchart for execution of a skate sensing routine.

FIG. 92 illustrates an embodiment of a flowchart for execution of a skate sensing routine 700. The routine 700 can be implemented by any system that can dynamically control the operation of the grinding wheel within a skate sharpener. The routine 700, in whole or in part, can be implemented by the control unit 32, controllers 132, and/or other hardware or software based control systems. Although any number of systems, in whole or in part, can implement the routine 700, to simplify discussion, the routine 700 will be described with respect to the control unit 32. Further, although embodiments of the routine 700 may be performed with respect to variations of the sharpening system, to simplify discussion, the routine 700 will be described with respect to the skate sharpener 10.

At block 702, the control unit 32 receives input to initiate a grinding operation. The input may be received from an operator manually providing the input by pressing an input key, such as a start button. In some embodiments, the input may be a signal received from a remote source configured to initiate the operation of the skate sharpener.

At block 704, the control unit 32 begins operating the grinding motor 80 at a determined contact speed and begins translating the grinding wheel 36 toward the skate blade 142 from the home position for execution of the grinding operation. The grinding motor 80 may initially operate at a contact speed, such as 500 rpm, 1000 rpm, 1500 rpm, 2000 rpm, 2500 rpm, 3000 rpm, 3500 rpm and/or number between the ranges. The contact speed can be a lower speed than the operational grinding speed of the grinding operation. The grinding motor 80 can operate at the contact speed as the grinding wheel 36 travels a distance between the home position toward the contact position of the skate blade 142.

At block 706, the control unit can detect contact between the grinding wheel 36 and the skate blade 142 based on an increase in current to the grinding motor 80 over the baseline current by a threshold amount. When the grinding wheel 36 makes contact with the skate, the grinding motor 80 may slow down due to the load applied to the grinding wheel 36 via friction and resistance on the motor's output spindle 82. When the motor 80 slows down, the back EMF generated by the motor 80 is reduced, which results in an increase in the current flowing to the motor. The control unit 32 can monitor the current and detect when the current increases over a defined threshold. The threshold can be a percentage of the baseline (such as, for example, a 10% increase of the baseline current) or a static value (such as, for example, an increase of 200 mA over the baseline current).

In some embodiments, the control unit can determine a baseline current of the grinding motor 80 prior to contact with the skate blade 142. The control unit 32 can monitor the current supplied to the grinding motor 80 and can determine a baseline current of the grinding motor 80. The baseline current can represent the amount of current used by the grinding motor 80 prior to the grinding wheel 36 contacting the skate blade 142. The baseline current can vary between skate sharpeners, between passes during the grinding operation, and between uses of the same skate sharpener. In some embodiments, the baseline current can be determined each time the grinding wheel executes a pass of grinding operation from the home position. In some embodiments, the baseline current can be established in less than 0.5, less than 1 second, less than 2 seconds, less than 3 seconds, and/or within any combination of ranges of the above listed time periods. In some embodiments, such as during initial startup, the determination of the baseline current may be delayed for a defined period of time in order for the skate sharpener to reach steady state operation. Delaying the determination can help to filter out transient power fluctuations that may be experienced during start-up and prior to attaining a steady state of operation.

After detection of the skate blade, the control unit can continue with the grinding operation along the length of the skate blade. In some embodiments, the control unit can increase the speed of the grinding motor to an operational grinding speed. The operational grinding speed can be greater than 5000 rpm, 6000 rpm, 7000 rpm, 8000 rpm, and/or any other speed greater than the contact speed, as defined by the operational parameters of the grinding operation. The rotational speed of the grinding wheel 36 may be controlled using various control algorithms, such as Pulse Width Modulation (PWM) or other algorithms known in the art for controlling rotational speed of the grinding motor. The ramp from the intermediate speed to full speed can use a linear, exponential, or other ramping algorithm to increase speed while reducing bouncing of the grinding wheel on the skate. The increase in operational speed can be implemented in a relatively short amount of time. For example, in one embodiment, the speed of the grinding wheel may be increased from 1000 rpm to 8000 rpm over a period of 0.55 seconds. Operation of the grinding motor can be implemented using open loop or closed loop control systems.

At block 708, the control unit can detect loss of contact between the grinding wheel 36 and the skate blade 142 based on a decrease in current to the grinding motor 80. In some embodiments, the control unit can determine loss of contact when there is a drop in motor current over a defined period of time. In some embodiments, the control unit can determine when the motor current drops below a threshold amount. The control unit 32 can monitor the current and detect when the current decreases below the defined threshold. The threshold may be calculated relative to the current level while the grinding ring was in contact with the skate and/or relative to when the grinding wheel was not touching the skate. In some embodiments, the control system may determine whether the motor current has stabilized below a current threshold to indicate that the grinding wheel is not contacting the skate blade.

At block 710, the control unit reverses direction of translation of the grinding wheel to move in the opposite direction. In some embodiments, the reversal of direction of the grinding wheel after detection may be delayed by a defined period of time to help ensure that the grinding wheel has completely lost contact with the skate blade.

At block 712, the control unit continues execution of the grinding operation in accordance with operational parameters until the grinding wheel traverses toward the home stop of the skate sharpener. In some embodiments, the bounce of the grinding wheel relative to the skate blade experienced by the system can be greater in one direction, for example moving from the home location to the end of the pass or visa-versa. In some embodiments, when the grinding wheel 36 traverses from the end location to the home location, the bounce can be significantly less because interface forces can be decreased on the end stop side of the skate due to factors, such as the direction of rotation of the grinding wheel 36, location of the pivot point, and the side of the grinding wheel 36 where frictional forces are generated. The rotational speed of the grinding wheel 36 can be the same in both directions. In some embodiments, the rotational speed will be different for each direction in accordance with the operational parameters of the grinding routine. In some embodiments, the control unit 32 can apply a ramp down when the grinding wheel is returning to its home position off the trailing edge of the skate. The ramp down can help provide a more uniform grinding power and material removal rate.

At block 714, the control unit can detect loss of contact between the grinding wheel 36 and the skate blade 142 prior to returning to the home position in the same manner as described with respect to block 708. At block 716, the control unit can determine whether the grinding operation is complete. If the grinding routine is complete, the control unit translates the grinding wheel back to the home stop and the process ends. If the grinding routine is not complete the process returns to block 704 to complete another pass. In some configurations, the door 30, 1030 can include a window 31, 1031 or the like. The window 31, 1031 can be a majority of the door 30, 1030 or can be a small portion of the door 30, 1030. The window 31, 1031 provides light transmissivity between the inside and the outside of the skate sharpener 10, 1010. In some configurations, the window 31, 1031 is transparent. In some configurations, the window 31, 1031 is translucent. In some configurations, the window 31, 1031 is other than opaque.

Because of the ability for light to be transmitted from inside of the skate sharpener to outside of the skate sharpener, it is possible to provide a general indication of one or more states of operation of the sharpening system to the user through the window. For example, in some configurations, one or more light sources can be provided within the sharpening system. In one configuration, a multi-colored light strip can be provided just inside of the door. The light strip can be used to indicate various operating conditions of the sharpening system. For example, red can be used to indicate an error or a need for attention (e.g., slot covers not engaged with skate blade or blade holder), orange can be used to indicate a need for input into a user interface, white can be used to indicate that the door is open and green can be used to indicate that a skate sharpening process has been completed. Other indications can be used and other conditions also can be indicated. In some configurations, a flashing pattern can be used instead of discrete colors.

While various embodiments of the invention have been particularly shown and described, it will be understood by those skilled in the art that various changes in form and details may be made therein without departing from the spirit and scope of the invention as defined by the appended claims.

What is claimed is:

1. A skate blade sharpening system comprising:

a grinding motor configured to rotate a grinding component mounted at a mounting location, the grinding component having an outer surface dimensioned and configured to grind a bottom edge of a skate blade during a grinding operation, and the grinding component including an identification tag having interface circuitry and memory including a usage location configured to store a usage tracking value;

a transceiver configured to communicate with the interface circuitry of the identification tag, and to read from and write to the usage location; and a controller configured to:

control operation of the grinding motor and perform grinding operations, wherein the grinding component is configured to be translated longitudinally relative to the bottom edge of the skate blade during grinding operations;

read, using the transceiver, a current usage tracking value from the usage location;

control sharpening operations based, at least in part, on the current usage tracking value; and write, using the transceiver, an update to the current usage tracking value based, at least in part, on usage of the grinding component during grinding operations.

2. The skate blade sharpening system of claim 1, wherein the controller is further configured to selectively enable or disable grinding operations based, at least in part, on the current usage tracking value.

3. The skate blade sharpening system of claim 2, wherein the controller is configured to initiate the grinding operation based on input received from a remote system.

4. The skate blade sharpening system of claim 1, wherein the usage tracking value indicates usage of the grinding component, and wherein the controller is configured to update, via the transceiver, the usage tracking value based, at least in part, on usage of the grinding component during grinding operations.

5. The skate blade sharpening system of claim 4, wherein the usage tracking value indicates usage of the grinding component based on usage parameters.

6. The skate blade sharpening system of claim 4, wherein the controller is configured to update the usage tracking value prior to the grinding operation.

7. The skate blade sharpening system of claim 4, wherein the controller is configured to update the usage tracking value after the grinding operation is complete.

8. The skate blade sharpening system of claim 4, wherein the identification tag is located on the grinding component such that the identification tag rotates with the grinding component during the grinding operation, and wherein the transceiver is configured to engage in wireless communication with the transceiver during the grinding operation as the grinding component rotates.

9. The skate blade sharpening system of claim 4, wherein the transceiver is configured to engage in wireless communication with the transceiver when the grinding component is stationary.

10. The skate blade sharpening system of claim 4, wherein the usage tracking value indicates usage of the grinding component as a number of passes performed by the grinding component during grinding operations.

11. The skate blade sharpening system of claim 10, wherein the controller is configured to update the usage tracking value after a defined number of passes during the grinding operation.

12. The skate blade sharpening system of claim 1, wherein the transceiver is a radio frequency identification (RFID) transceiver, and wherein the transceiver is configured to communicate with the identification tag using RFID communication protocols.

13. The skate blade sharpening system of claim 1, further comprising a lighting component configured to illuminate an interior of a housing of the skate blade sharpening system.

14. The skate blade sharpening system of claim 13, wherein the lighting component is configured to output different visual indications for different operational states of the skate blade sharpening system.

15. The skate blade sharpening system of claim 14, wherein the visual indications include light of different colors, and wherein each operational state of the skate blade sharpening system is associated with a different color.

16. The skate blade sharpening system of claim 15, further comprising a door configured to provide access to the interior of the housing and a door switch configured to determine whether the door is in an open position or a closed position, wherein the controller is further configured to prevent operation of the skate blade sharpening system when the door is in the open position.

17. The skate blade sharpening system of claim 16, wherein the door includes a latch, and wherein the controller is further configured to lock the door in the closed position during the grinding operation of the skate blade sharpening system.

18. The skate blade sharpening system of claim 16, wherein the door includes a transparent panel, wherein the interior of the housing of the skate blade sharpening system is visible through the transparent panel, and wherein the visual indications output by the lighting component are visible through the transparent panel.

19. A method of operating a skate blade sharpening system, the method comprising:

receiving an input to perform at least one grinding operation with a grinding component using the skate blade sharpening system, the grinding component including an identification tag having interface circuitry and memory including a usage location configured to store a usage tracking value;

communicating, using a transceiver of the skate blade sharpening system, with the interface circuitry of the identification tag to read a current usage tracking value from the usage location;

determining whether to perform the at least one grinding operation based at least in part, on the current usage tracking value;

in response to a determination to initiate the at least one grinding operation, performing the at least one grinding operation with the grinding component, wherein the grinding component is configured to be translated longitudinally relative to a bottom edge of a skate blade during grinding operations, the grinding component having an outer surface dimensioned and configured to grind the bottom edge of the skate blade; and communicating, using the transceiver, with the interface circuitry of the identification tag to write an update to the usage tracking value based, at least in part, on the at least one grinding operation.

20. The method of claim 19, further comprising disabling the at least one grinding operation based, at least in part, on the current usage tracking value.

21. The method of claim 19, wherein the determination to initiate the at least one grinding operation is based, at least in part on, input received from a remote system.

22. The method of claim 19, wherein the update to the usage tracking value is performed prior to the at least one grinding operation.

23. The method of claim 19, wherein the update to the usage tracking value is performed after the at least one grinding operation is complete.

24. The method of claim 19, wherein the update to the usage tracking value is performed after a defined number of passes during the at least one grinding operation.

25. The method of claim 19, wherein communication between the transceiver and the interface circuitry occurs when the grinding component is rotating or stationary.

26. The method of claim 19, further comprising outputting different visual indications for different operational states of the skate blade sharpening system using a lighting component configured to illuminate an interior of a housing of the skate blade sharpening system.

27. The method of claim 19, further comprising preventing the at least one grinding operation from being performed when a door to an interior of the skate blade sharpening system is in an open position.

28. The method of claim 27, further comprising locking the door in a closed position during the at least one grinding operation.

* * * * *